US008696524B2

(12) United States Patent
Piaget et al.

(10) Patent No.: US 8,696,524 B2
(45) **Date of Patent: *Apr. 15, 2014**

(54) DUAL DECK EXERCISE DEVICE

(75) Inventors: Gary Piaget, Deer Harbor, WA (US); Brent Christopher, Portland, OR (US); Brian R. Cook, Shelton, WA (US); Douglas A. Crawford, Lafayette, CO (US); Edward L. Flick, Portland, OR (US); Eric D. Golesh, Arvada, CO (US); Ben Monette, Vancouver, WA (US); Randal Potter, Camas, WA (US); Todd Singh, West Linn, OR (US); Matt Rauwerdink, Portland, OR (US); Patrick A. Warner, Boulder, CO (US); Bradley J. Smith, Tyler, TX (US)

(73) Assignee: Nautilus, Inc., Vancouver, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/619,902

(22) Filed: Sep. 14, 2012

(65) Prior Publication Data

US 2013/0190139 A1 Jul. 25, 2013

Related U.S. Application Data

(63) Continuation of application No. 13/216,042, filed on Aug. 23, 2011, now Pat. No. 8,550,962, which is a continuation of application No. 12/624,694, filed on Nov. 24, 2009, now Pat. No. 8,002,674, which is a continuation of application No. 10/789,182, filed on Feb. 26, 2004, now Pat. No. 7,621,850.

(60) Provisional application No. 60/450,789, filed on Feb. 28, 2003, provisional application No. 60/450,890, filed on Feb. 28, 2003, provisional application No. 60/451,104, filed on Feb. 28, 2003.

(51) Int. Cl.
*A63B 22/02* (2006.01)

(52) U.S. Cl.
USPC ..... 482/54

(58) Field of Classification Search
USPC ..... 482/51–54, 148
See application file for complete search history.

(56) References Cited

U.S. PATENT DOCUMENTS 347,101 A 8/1886 Ferry
964,898 A 7/1910 Budingen (Continued)

FOREIGN PATENT DOCUMENTS

AU 233194 8/1959
CN 2510102 Y 9/2002

(Continued)

OTHER PUBLICATIONS

Author Unknown, "Catalog", Diamond House International, Inc., Date Unknown.

(Continued)

*Primary Examiner* — Stephen Crow
(74) *Attorney, Agent, or Firm* — Dorsey & Whitney LLP

(57) ABSTRACT

An exercise device employing side-by-side pivotally supported moving surfaces. In one particular example, an exercise device employs a first belt deployed about a front roller and a rear roller and an adjacent second belt deployed about a front roller and a rear roller. The rear of the belts in the area of the rear rollers are pivotally secured and the front of the belts in the area of the front roller are adapted to reciprocate in an up and down motion during use. In some implementations, the moving surfaces include an interconnection structure such that a generally downward movement of one surface is coordinated with a generally upward movement of the other surface. In other implementations, the moving surfaces are operably associated with one or more resistance elements that effect the amount of force required to pivot or actuate the moving surfaces.

19 Claims, 126 Drawing Sheets

(56) References Cited

U.S. PATENT DOCUMENTS 1,082,940 A 12/1913 Flora
2,017,128 A 10/1935 O'Neill, Jr.
2,037,492 A 4/1936 Arnold
2,117,957 A 5/1938 Heller
2,434,760 A 1/1948 Eggleston
2,512,904 A 6/1950 Strelecky
2,538,980 A 1/1951 Payne, Jr.
3,408,067 A 10/1968 Armstrong
3,437,180 A 4/1969 Natschke et al.
3,464,601 A 9/1969 Christensen
3,512,619 A 5/1970 Rauglas
3,580,340 A 5/1971 Brown
3,637,206 A 1/1972 Chickering, III
3,642,279 A 2/1972 Cutter
3,650,529 A 3/1972 Salm et al.
3,659,845 A 5/1972 Quinton
3,711,090 A 1/1973 Fiedler
3,747,924 A 7/1973 Champoux
3,792,860 A 2/1974 Selnes
3,814,420 A 6/1974 Encke
3,826,491 A 7/1974 Elder
3,963,101 A 6/1976 Stadelmann et al.
3,966,182 A 6/1976 Stadelmann et al.
4,061,460 A 12/1977 George
4,066,257 A 1/1978 Moller
4,126,326 A 11/1978 Phillips
4,204,673 A 5/1980 Speer, Sr.
4,274,625 A 6/1981 Gaetano
4,334,676 A 6/1982 Schonenberger
4,342,452 A 8/1982 Summa
4,344,616 A 8/1982 Ogden
4,374,587 A 2/1983 Ogden
4,406,451 A 9/1983 Gaetano
4,423,864 A 1/1984 Wiik
4,426,077 A 1/1984 Becker
4,429,871 A 2/1984 Flechner
4,533,136 A 8/1985 Smith et al.
4,555,108 A 11/1985 Monteiro
4,563,001 A 1/1986 Terauds
4,592,544 A 6/1986 Smith et al.
4,659,074 A 4/1987 Taitel et al.
4,659,077 A 4/1987 Stropkay
4,673,177 A 6/1987 Szymski
4,733,858 A 3/1988 Lan
4,743,011 A 5/1988 Coffey
4,747,612 A 5/1988 Kuhn
4,796,881 A 1/1989 Watterson
4,830,362 A 5/1989 Bull
4,838,543 A 6/1989 Armstrong et al.
4,842,268 A 6/1989 Jenkins
4,938,474 A 7/1990 Sweeney et al.
5,039,088 A 8/1991 Shifferaw
5,048,821 A 9/1991 Kuo-Liang
5,054,770 A 10/1991 Bull
5,062,627 A 11/1991 Bingham
5,071,115 A 12/1991 Welch
5,092,581 A 3/1992 Koz
5,110,117 A 5/1992 Fisher et al.
5,114,390 A * 5/1992 Tribelhorn, Jr. ..... 482/54
5,129,872 A 7/1992 Dalton et al.
5,129,873 A 7/1992 Henderson et al.
5,135,447 A 8/1992 Robards, Jr. et al.
5,139,255 A 8/1992 Sollami
5,149,084 A 9/1992 Dalebout et al.
5,162,029 A 11/1992 Gerard
5,163,888 A 11/1992 Stearns
5,180,353 A 1/1993 Snyderman
5,188,577 A 2/1993 Young et al.
5,199,934 A 4/1993 Lin
5,207,621 A 5/1993 Koch et al.
5,226,866 A 7/1993 Engel et al.
5,238,462 A 8/1993 Cinke et al.
5,263,910 A 11/1993 Yang
5,267,923 A 12/1993 Piaget et al.
5,282,776 A 2/1994 Dalebout
5,299,993 A 4/1994 Habing
5,318,488 A 6/1994 Babcock
5,318,490 A 6/1994 Henderson et al.
5,320,588 A 6/1994 Wanzer et al.
5,336,142 A 8/1994 Dalebout et al.
5,336,146 A 8/1994 Piaget et al.
5,338,271 A 8/1994 Wang
5,338,273 A 8/1994 Metcalf et al.
5,370,592 A 12/1994 Wu
5,372,559 A 12/1994 Dalebout et al.
5,372,560 A 12/1994 Chang
5,385,520 A 1/1995 Lepine et al.
5,411,279 A 5/1995 Magid
5,431,612 A 7/1995 Holden
D360,915 S 8/1995 Bostic et al.
5,441,467 A 8/1995 Stevens
5,460,586 A 10/1995 Wilkinson et al.
5,490,818 A 2/1996 Haber et al.
5,492,517 A 2/1996 Bostic et al.
5,512,025 A 4/1996 Dalebout et al.
5,518,470 A 5/1996 Piaget et al.
5,529,555 A 6/1996 Rodgers, Jr.
5,538,489 A 7/1996 Magid
5,575,740 A 11/1996 Piaget et al.
5,595,556 A 1/1997 Dalebout et al.
5,607,376 A 3/1997 Magid
5,622,527 A 4/1997 Watterson et al.
5,626,539 A 5/1997 Piaget et al.
5,643,144 A 7/1997 Trulaske
5,645,512 A 7/1997 Yu
5,662,557 A 9/1997 Watterson et al.
5,665,033 A 9/1997 Palmer
5,669,856 A 9/1997 Liu
5,676,624 A 10/1997 Watterson et al.
5,679,101 A 10/1997 Magid
5,690,582 A 11/1997 Ulrich et al.
5,709,632 A 1/1998 Socwell
5,733,228 A 3/1998 Stevens
5,749,807 A 5/1998 Webb
5,762,587 A 6/1998 Dalebout et al.
5,769,760 A 6/1998 Lin et al.
5,779,598 A 7/1998 Lee
5,792,029 A 8/1998 Gordon
5,803,871 A 9/1998 Stearns et al.
5,803,874 A 9/1998 Wilkinson
5,803,880 A 9/1998 Allen
5,816,372 A 10/1998 Carlson et al.
5,833,584 A 11/1998 Piaget et al.
5,857,941 A 1/1999 Maresh et al.
5,871,421 A 2/1999 Trulaske et al.
5,879,271 A 3/1999 Stearns et al.
5,882,281 A 3/1999 Stearns et al.
5,897,459 A 4/1999 Habing et al.
5,897,460 A 4/1999 McBride et al.
5,897,461 A 4/1999 Socwell
5,913,384 A 6/1999 Williams
5,919,115 A 7/1999 Horowitz et al.
5,951,449 A 9/1999 Oppriecht
5,967,944 A 10/1999 Vittone et al.
5,993,358 A 11/1999 Gureghian et al.
5,993,359 A 11/1999 Eschenbach
6,007,462 A 12/1999 Chen
6,024,676 A 2/2000 Eschenbach
6,030,320 A 2/2000 Stearns et al.
6,033,344 A 3/2000 Trulaske et al.
6,042,512 A 3/2000 Eschenbach
6,042,513 A 3/2000 Koteles et al.
6,042,519 A 3/2000 Shea
6,045,490 A 4/2000 Shafer et al.
6,090,014 A 7/2000 Eschenbach
6,113,518 A 9/2000 Maresh et al.
6,152,859 A 11/2000 Stearns
6,155,958 A 12/2000 Goldberg
6,168,552 B1 1/2001 Eschenbach
6,179,754 B1 1/2001 Wang et al.
6,210,305 B1 4/2001 Eschenbach
6,217,485 B1 4/2001 Maresh
6,217,487 B1 4/2001 Reinert
6,258,012 B1 7/2001 Yoshimura

(56) References Cited

U.S. PATENT DOCUMENTS

| | | | |
|---|---|---|---|
| 6,261,209 | B1 | 7/2001 | Coody |
| 6,264,042 | B1 | 7/2001 | Cossey, Jr. et al. |
| 6,283,896 | B1 | 9/2001 | Grunfeld et al. |
| 6,409,633 | B1 | 6/2002 | Abelbeck |
| 6,422,976 | B1 | 7/2002 | Eschenbach |
| 6,422,977 | B1 | 7/2002 | Eschenbach |
| 6,440,042 | B2 | 8/2002 | Eschenbach |
| 6,454,679 | B1 | 9/2002 | Radow |
| 6,461,279 | B1 | 10/2002 | Kuo |
| 6,554,749 | B2 | 4/2003 | Iund et al. |
| 6,645,124 | B1 | 11/2003 | Clem |
| 6,648,801 | B2 | 11/2003 | Stearns et al. |
| 6,648,802 | B2 | 11/2003 | Ware |
| 6,761,667 | B1 | 7/2004 | Cutler et al. |
| 6,783,481 | B2 | 8/2004 | Stearns et al. |
| 6,811,517 | B1 | 11/2004 | Eschenbach |
| 6,811,519 | B2 | 11/2004 | Kuo |
| 6,824,502 | B1 | 11/2004 | Huang |
| 6,835,166 | B1 | 12/2004 | Stearns et al. |
| 6,837,829 | B2 | 1/2005 | Eschenbach |
| 6,846,273 | B1 | 1/2005 | Stearns et al. |
| 6,849,034 | B2 | 2/2005 | Eschenbach |
| 6,872,168 | B2 | 3/2005 | Wang et al. |
| 6,893,383 | B1 | 5/2005 | Chang et al. |
| 6,902,513 | B1 | 6/2005 | McClure |
| 6,923,745 | B2 | 8/2005 | Stearns |
| 6,923,746 | B1 | 8/2005 | Skowronski et al. |
| 6,974,404 | B1 | 12/2005 | Watterson et al. |
| D521,577 | S | 5/2006 | Wu |
| D527,060 | S | 8/2006 | Flick et al. |
| 7,097,593 | B2 | 8/2006 | Chang |
| D534,973 | S | 1/2007 | Flick et al. |
| 7,163,493 | B1 | 1/2007 | Kuo |
| 7,166,062 | B1 | 1/2007 | Watterson et al. |
| 7,169,088 | B2 | 1/2007 | Rodgers |
| 7,179,204 | B2 | 2/2007 | Anderson et al. |
| 7,201,704 | B2 | 4/2007 | Stearns |
| D546,909 | S | 7/2007 | Flick |
| 7,270,625 | B2 | 9/2007 | Miller |
| 7,306,546 | B2 | 12/2007 | Lo |
| 7,377,882 | B2 | 5/2008 | Watterson et al. |
| 7,494,454 | B2 | 2/2009 | Sheets |
| 7,517,303 | B2 | 4/2009 | Crawford et al. |
| 7,553,260 | B2 | 6/2009 | Piaget et al. |
| 7,618,346 | B2 | 11/2009 | Crawford et al. |
| 7,621,850 | B2 | 11/2009 | Piaget et al. |
| 7,645,214 | B2 | 1/2010 | Lull |
| 7,704,191 | B2 | 4/2010 | Smith et al. |
| 7,731,636 | B2 | 6/2010 | Lull et al. |
| 7,731,637 | B2 | 6/2010 | D'Eredita |
| D624,975 | S | 10/2010 | Flick et al. |
| 7,811,209 | B2 | 10/2010 | Crawford et al. |
| 7,815,549 | B2 | 10/2010 | Crawford et al. |
| 7,819,779 | B2 | 10/2010 | Chang |
| 7,862,484 | B1 | 1/2011 | Coffey |
| 7,967,730 | B2 | 6/2011 | Crawford et al. |
| 8,002,674 | B2 | 8/2011 | Piaget et al. |
| RE42,698 | E | 9/2011 | Kuo et al. |
| 8,113,994 | B2 * | 2/2012 | Piaget et al. ..... 482/52 |
| 8,147,385 | B2 | 4/2012 | Crawford et al. |
| 8,272,996 | B2 | 9/2012 | Weier |
| 8,439,807 | B2 | 5/2013 | Piaget |
| 2001/0016542 | A1 | 8/2001 | Yoshimura |
| 2003/0064862 | A1 | 4/2003 | Hald et al. |
| 2004/0192514 | A1 | 9/2004 | Piaget et al. |
| 2004/0214693 | A1 | 10/2004 | Piaget et al. |
| 2005/0202939 | A1 | 9/2005 | Lull et al. |
| 2005/0209059 | A1 | 9/2005 | Crawford et al. |
| 2005/0209060 | A1 | 9/2005 | Lull |
| 2005/0209061 | A1 | 9/2005 | Crawford et al. |
| 2005/0233864 | A1 | 10/2005 | Smith et al. |
| 2006/0223680 | A1 | 10/2006 | Chang |
| 2008/0070758 | A1 | 3/2008 | Lull et al. |
| 2009/0029831 | A1 | 1/2009 | Weier |
| 2009/0176626 | A1 | 7/2009 | Crawford et al. |
| 2009/0264260 | A1 | 10/2009 | Piaget et al. |
| 2010/0062904 | A1 | 3/2010 | Crawford et al. |
| 2010/0093500 | A1 | 4/2010 | Elbaz et al. |
| 2010/0248906 | A1 | 9/2010 | D'Eredita |
| 2011/0034303 | A1 | 2/2011 | Crawford et al. |
| 2011/0218079 | A1 | 9/2011 | Ohrt et al. |
| 2011/0256988 | A1 | 10/2011 | Weier |
| 2011/0312472 | A1 | 12/2011 | Piaget et al. |
| 2012/0142501 | A1 | 6/2012 | Piaget et al. |
| 2012/0190509 | A1 | 7/2012 | Crawford et al. |
| 2013/0023383 | A1 | 1/2013 | Weier |
| 2013/0190138 | A1 | 7/2013 | Piaget et al. |

FOREIGN PATENT DOCUMENTS

| | | | |
|---|---|---|---|
| CN | 2516185 | | 10/2002 |
| CN | 2675190 | Y | 2/2005 |
| DE | 20005640 | | 6/2000 |
| EP | 0176277 | | 4/1986 |
| EP | 1316332 | | 6/2003 |
| FR | 2806921 | A3 | 10/2001 |
| GB | 2184361 | | 6/1987 |
| SU | 1265113 | A1 | 10/1986 |
| TW | 097088 | | 3/1988 |
| TW | 184377 | | 5/1992 |
| TW | 367860 | | 8/1999 |
| TW | 375944 | | 12/1999 |
| TW | 381497 | | 2/2000 |
| TW | 472593 | | 1/2002 |
| TW | 515306 | | 12/2002 |
| TW | 542735 | B | 7/2003 |
| TW | 547102 | | 8/2003 |
| TW | 569789 | U | 1/2004 |
| WO | 95/16502 | | 6/1995 |
| WO | 99/21620 | | 5/1999 |
| WO | 01/58534 | | 8/2001 |
| WO | 2004/108225 | | 12/2004 |

OTHER PUBLICATIONS

Author Unknown, "Nautilus Home Health & Fitness Catalog", Nautilus, Inc., 2004, 1-56.

U.S. Appl. No. 13/619,799, filed Sep. 14, 2012, Piaget et al.

* cited by examiner

DUAL DECK EXERCISE DEVICE

CROSS-REFERENCE TO RELATED APPLICATIONS

The present application is a continuation of U.S. patent application Ser. No. 13/216,042 entitled "Dual Deck Exercise Device", filed on Aug. 23, 2011, which is a continuation of U.S. patent application Ser. No. 12/624,694 (U.S. Pat. No. 8,002,674, issued Aug. 23, 2011), entitled "Dual Deck Exercise Device" filed on Nov. 24, 2009, which is a continuation of U.S. patent application Ser. No. 10/789,182 (U.S. Pat. No. 7,621,850, issued Nov. 24, 2009) entitled "Dual Deck Exercise Device" filed on Feb. 26, 2004, which is a non-provisional application claiming priority under 35 U.S.C. §119(e) to U.S. Provisional Patent Application No. 60/450,789 entitled "Dual Deck Exercise Device" filed on Feb. 28, 2003, U.S. Provisional Patent Application No. 60/451,104 entitled "Exercise Device With Treadles" filed on Feb. 28, 2003, and U.S. Provisional Patent Application No. 60/450,890 entitled "System and Method for Controlling an Exercise Apparatus" and filed on Feb. 28, 2003, which are hereby incorporated by reference in their entireties, as if fully described herein.

The present application is related to and incorporates by reference in its entirety, as if fully described herein, the subject matter disclosed in the following U.S. applications and patents:

U.S. patent application Ser. No. 10/789,294, entitled "Exercise Device with Treadles" filed on Feb. 26, 2004, now U.S. Pat. No. 7,553,260; which is a non-provisional application claiming priority under 35 U.S.C. §119(e) to: U.S. Provisional Patent Application No. 60/450,789 entitled "Dual Deck Exercise Device" filed on Feb. 28, 2003, U.S. Provisional Patent Application No. 60/451,104 entitled "Exercise Device With Treadles" filed on Feb. 28, 2003, and U.S. Provisional Patent Application No. 60/450,890 entitled "System and Method For Controlling an Exercise Apparatus" and filed on Feb. 28, 2003;

U.S. patent application Ser. No. 10/789,579 entitled "System and Method For Controlling an Exercise Apparatus" filed on Feb. 26, 2004, now U.S. Pat. No. 7,618,346, which is a non-provisional application claiming priority under 35 U.S.C. §119(e) to: U.S. Provisional Patent Application No. 60/450,890 entitled "System and Method For Controlling an Exercise Apparatus" filed on Feb. 28, 2003; U.S. Provisional Patent Application No. 60/450,789 entitled "Dual Deck Exercise Device" filed on Feb. 28, 2003; and U.S. Provisional Patent Application No. 60/451,104 entitled "Exercise Device With Treadles" filed on Feb. 28, 2003;

U.S. Provisional Patent Application No. 60/548,265 entitled "Exercise Device With Treadles" filed on Feb. 26, 2004;

U.S. Provisional Patent Application No. 60/548,786, entitled "Control System and Method For an Exercise Apparatus" filed on 26 Feb. 2004;

U.S. Provisional Patent Application No. 60/548,811 entitled "Dual Treadmill Exercise Device Having a Single Rear Roller" filed on Feb. 26, 2004;

U.S. Provisional Application No. 60/548,787 entitled "Hydraulic Resistance, Arm Exercise, and Non-Motorized Dual Deck Treadmills" filed on Feb. 26, 2004; and U.S. Design application No. 29/176,966 entitled "Exercise Device with Treadles" and filed on Feb. 28, 2003, now U.S. design Pat. No. D534,973.

FIELD OF THE INVENTION

The present invention generally involves the field of exercise devices, and more particularly involves an exercise device including a pair of treadles with moving surfaces provided thereon.

BACKGROUND OF THE INVENTION

The health benefits of regular exercise are well known. Many different types of exercise equipment have been developed over time, with various success, to facilitate exercise. Examples of successful classes of exercise equipment include the treadmill and the stair climbing machine. A conventional treadmill typically includes a continuous belt providing a moving surface that a user may walk, jog, or run on. A conventional stair climbing machine typically includes a pair of links adapted to pivot up and down providing a pair of surfaces or pedals that a user may stand on and press up and down to simulate walking up a flight of stairs.

Various embodiments and aspects of the present invention involve an exercise machine that provides side-by-side moving surfaces that are pivotally supported at one end and adapted to pivot up and down at an opposite end. With a device conforming to the present invention, two pivotable moving surfaces are provided in a manner that provides some or all of the exercise benefits of using a treadmill with some or all of the exercise benefits of using a stair climbing machine. Moreover, an exercise machine conforming to aspects of the present invention provides additional health benefits that are not recognized by a treadmill or a stair climbing machine alone. These and numerous other embodiments and aspects of the present invention are discussed in greater detail below.

SUMMARY OF THE INVENTION

According to one embodiment of the invention a first treadle is operably mounted to a frame to pivot with respect to the frame. A first resistance element is mounted between the frame and the first treadle in a mounting position that can be selectively adjusted within a range of mounting positions. The first resistance treadle has a position that is adjusted by the adjustment of the mounting position of the first resistance element. A similar resistance element may be operably mounted between a second treadle and the frame in order to adjust a position of the second treadle with respect to the frame. The resistance elements may be mounted on a continuous adjustment structure such as a lead screw to permit continuous adjustment of the resistance elements within their ranges of mounting positions. The lead screw may be operably connected to a motor to rotate the lead screw. As an alternative to the continuous adjustment structure, a discrete adjustment structure such as a pop pin may be used. The attachment point for the resistance element to the treadles may be variable in order to adjust the position of the treadles.

According to one embodiment of the invention first and second treadles are pivotally mounted to a frame. Each treadle is provided with a continuous tread. Each tread is provided with its own motor producing a driving force for the respective tread. Optionally, each treadle may be provided with a driving roller for transferring the driving force from the corresponding motor to that treadle's continuous tread. Each motor may be controlled separately to drive the two continuous treads at different speeds. Alternatively, the motors may be synchronized through a common control to assure that the two continuous treads are driven at substantially the same speed as each other.

According to one embodiment of the invention a treadle assembly includes a frame, an upper deck spaced apart from and generally above the frame, a tread that is slidable across a top surface of the upper deck, and a suspension that operably contacts the frame and the upper deck to hold the upper deck in position adjacent to and generally below the tread, the suspension also cushions the upper deck upon deflection of the upper deck towards said frame. The suspension may comprise at least one resilient member interposed between said frame and said upper deck, or may include a plurality of resilient bumpers interposed between the frame and the upper deck. At least one rigid bumper may also be provided as part of the suspension. Alternatively, the suspension may comprise a plurality of resilient bumpers and a plurality of hard bumpers, wherein the resilient bumpers contact a lower surface of the upper deck upon initial deflection of the upper deck towards said frame and wherein the hard bumpers are spaced apart from the lower surface of said upper deck upon initial deflection of the upper deck towards the frame.

According to another embodiment of the present invention a treadle assembly includes a frame, an upper deck spaced apart from and generally above the frame, a tread that is slidable across a top surface of the upper deck, and a suspension that operably contacts the frame and the upper deck to hold the upper deck in position adjacent to and generally below the tread, the suspension also cushions the upper deck upon deflection of the upper deck towards said frame. The upper deck is cantilevered with respect to the frame, and the suspension system includes at least one resilient member interposed between the frame and the upper deck.

According to one embodiment of the present invention a pair of treadles are pivotally attached to a frame at a restrained end of the treadles. Each of the treadles has a tread portion formed by a top span of a continuous belt. Resistance devices associated with each treadle oppose pivotal movement of the treadles in at least one direction. The treadles slope downwardly from the higher restrained ends towards lower free ends. The frame may include an upright. The resistance devices and the treadles may be attached to the upright. At least one of the resistance devices may resist pivoting of the corresponding treadle in both directions. An interconnect may be operably associated with each treadle to cause one treadle to rise while the other treadle lowers. The resistance devices would not need to include return spring action if an interconnect is used.

According to one embodiment of the present invention a dual deck exercise machine includes a pair of treadles pivotally mounted on a frame. A dependency structure is operably associated with both treadles and mounted to the frame such that when either treadle is pushed down, the other treadle is pushed up. A resistance mechanism is operably associated with the dependency structure to provide resistance to movement of the treadles. The dependency structure may be a rocking arm. The resistance structure may be a rotational brake, an electro-magnetic brake, or a hydraulic mechanism.

According to one embodiment of the present invention an exercise machine includes a treadle pivotally mounted to a frame for pivotal movement in a generally vertical plane. A first resistance element, such as a shock, is operably attached at a top end to the frame at first location within a range of attachment locations on the frame. Adjustment of the attachment point of the resistance element to the frame changes a height of the treadle. A lead screw mechanism may be used to attach the resistance mechanism to the frame. A pin may be used to engage the top end of the resistance element and an aperture in the frame to attach the top of the resistance element to the frame. The pin may be a spring-loaded pop pin. The exercise device may include a second treadle and second resistance element similar to the first treadle and first resistance element. A dependency device may be attached between the first and second treadles to cause one treadle to move up when the other treadles is moved down. The adjustment of the two treadles can be independent from each other so that the treadles may be set at different heights.

According to one embodiment of the present invention a dual deck exercise machine includes a pair of treadles connected to a frame by a pair of scissor trusses. Each of the scissor trusses is movable between a lower position and an upper position. A biasing member is attached to each truss to resiliently bias the scissor trusses towards the upper position. A dampener may be associated with each of the trusses. A dependency device may be operably associated with each of the treadles to cause one treadle to raise as the other treadle is lowered. The treadles may remain parallel to a support surface as the treadles move downwardly. The biasing members can be placed in tension or in compression as the treadles move from the upper position towards the lower position.

According to one embodiment of the present invention a dampening device for use on an exercise machine having treadles includes a reservoir containing hydraulic fluid. The reservoir is divided into two chambers by a valve. A plunger is provided in each chamber, and each plunger is associated with a treadle. As one plunger is pushed into its respective chamber by the respective treadle it pushes hydraulic fluid through the valve into the other chamber to push the other plunger and its treadle outward. The valve may be adjustable to produce a varying dampening effect. The plungers may be provided in cylinders that are sealed by a shared cap. The cylinders may be mounted side-by-side and contained within a housing. A passage may be provided in the shared cap to allow for flow of hydraulic fluid between the two chambers. The plungers may be associated with the treadles through a dependency device. A biasing mechanism, such as a spring may be associated with each plunger to urge the corresponding treadles upwards.

According to one embodiment of the present invention an exercise device includes a treadle pivotally mounted to a frame for pivotal movement of the treadle in a generally vertical plane. A dampener attached between the frame and the treadle resists movement of the treadle. A spring attached between the frame and the treadle urges the treadle upward. A similar second treadle may be pivotally mounted to the frame and provided with a dampener and spring. The springs may be elastomeric. The springs may be stretched by a downward movement of the treadles, or the springs may be compressed by a downward movement of the treadles. The dampeners may have adjustable resistance.

According to one embodiment of the present invention a dual deck exercise machine includes a pair of treadles mounted on a frame. Each of the treadles has front and rear rollers, and a tread extending around the rollers. Each of the treadles is associated with a corresponding drive roller mechanism. The drive roller mechanisms may be placed in frictional engagement with the treads. The drive roller mechanisms may also be placed in frictional engagement with one of the rollers on each treadle. The drive roller mechanism may be a common drive roller. The common drive roller may be placed in frictional engagement or positive engagement with one of the rollers from each treadle. A control mechanism may be provided to control the speed of the drive roller mechanism, in order to control the speed at which the treads move.

According to one embodiment of the invention an exercise device is provided with a treadle assembly pivotally attached to a frame. The treadle assembly will pivot to a storage position substantially parallel to the upright. Side rails may be pivotally attached to the upright, and may pivot into a storage position. A latching mechanism may be provided to retain the treadle assembly in the storage position. The exercise machine is preferably free standing when in the storage position, with the treadle assembly rotated to an over-center orientation.

According to one embodiment of the invention an exercise device is provided with a treadle assembly pivotally attached to a frame. An upright is also pivotally attached to the frame. A side rail is attached to the upright. The side rail will pivot about a side rail pivot into a storage position, and the upright will pivot about an upright pivot into a storage position. A lateral support may be operably attached to the frame to provide lateral support to the exercise device in the storage position. The exercise machine may be free standing on a front end of the frame and a bottom portion of the upright when adjusted into the storage position.

According to one embodiment of the invention an exercise device has a rear base frame with a treadle assembly attached thereto. A front base frame is pivotally attached to a front portion of the rear base frame at a base frame pivot. An upright is attached to the front base frame. The rear base frame is pivotal about the base frame pivot between an operational position wherein the front base frame is generally transverse to the upright and a storage position wherein the front base frame is generally parallel with the upright. The treadle assembly may be attached to a rear portion of the rear base frame. The exercise device is free standing on the front base frame with the rear base frame and the upright in a generally vertical orientation when the rear base frame is in the storage position. The rear base frame may be rotated to an over-center orientation in the storage position.

According to one embodiment of the present invention an exercise device has a main frame and a housing fixedly attached to the main frame. At least one treadle is attached to the main frame, and the height of the housing is at least equal to the height of the treadle during operation of the treadle. A resistive element may be operationally attached between the treadle and the housing. The housing may be of a single piece construction. A return element may be operationally attached between the treadle and the housing.

According to one embodiment of the invention a pair of movable belt treadle assemblies are pivotally mounted to a frame. First and second dampening devices are coupled between the frame and the respective treadle assemblies, and first and second biasing devices are coupled between the frame and the respective treadle assemblies. The treadle assemblies may comprise drive rollers that are attached to a motor through a drive shaft and a torque transfer mechanism. The frame may include an upright member to which the treadle assemblies are pivotally mounted. A treadle may be mounded to the upright at a fixed, or variable, pivot point. The dampening devices and biasing devices may be incorporated into first and second unitary devices coupled between the upright and treadle assemblies.

According to another embodiment of the present invention, first and second movable belt treadle assemblies are pivotally mounted to a frame. First and second dampening devices are coupled between the frame and their respective treadle assemblies. First and second biasing devices are coupled between the frame and their respective treadle assemblies. First and second movable belt treadle assemblies include belts having upper surfaces for engagement by a user's feet, and a drive mechanism for driving the upper surfaces of the belts in a direction away from where the first and second movable treadle assemblies are pivotally mounted to the frame.

According to another embodiment of the present invention an exercise device includes a pair of treadle assemblies operably connected to a frame for complementary movement in a generally vertical plane as a user steps on a tread portion of each treadle assembly. Each tread portion is formed by a separate movable belt. The exercise device may include a driver mechanism for moving the movable belts with respect to the treadle assemblies. Optionally, the driver mechanism can drive the belts simultaneously with the treadle assemblies moving in complementary fashion with respect to each other. The treadle assemblies may be locked in a fixed orientation relative to the frame so that the exercise device can function as a treadmill. The movable belts can be locked in a fixed position relative to the treadle assemblies such that the exercise device can function as a stepper.

According to one embodiment of the present invention a pair of movable belt treadle assemblies are pivotally mounted to a frame. A rocker arm having a first end and a second end is also pivotally mounted to the frame. A first tie rod is coupled to the first end of the rocker arm and the first treadle assembly. A second tie rod is coupled between the second end of the rocker arm and the second treadle assembly. Universal joints may be used to couple the tie rods to the rocker arms and the treadle assemblies. The tie rods may be coupled to the treadle assemblies at side frame members provided on the first and second treadle assemblies.

According to another embodiment of the present invention first and second treadle assemblies are pivotally mounted to a frame. A rocker arm having a first end and a second end is also pivotally mounted to the frame. A first tie rod couples the first end of the rocker arm to the first treadle assembly, and a first biasing device is coupled between the first end of the rocker arm and the frame. A second tie rod couples the second end of the rocker arm to the second treadle assembly, and a second biasing device is coupled between the second end of the rocker arm and the frame.

According to one embodiment of the present invention an exercise device includes a pair of treadle assemblies pivotally mounted to a frame. A pair of biasing devices are operably provided between the frame and their respective treadle assemblies for acting against the treadle assemblies with a push-up biasing force. The biasing devices may have fixed biasing characteristics, or variable biasing characteristics. The biasing devices may be coupled directly to a base frame member of the frame. The biasing devices may be helical springs. The helical springs may bear against the base frame member at one end and against a flange provided on their respective treadle assemblies at the other end.

According to one embodiment of the present invention a pair of treadle assemblies are pivotally mounted to a frame. A brake based dampening assembly is provided that has a first belt and coupled to the first treadle assembly and a second belt coupled to the second treadle assembly. The brake based dampening assembly dampens downward rotation of the treadle assemblies. The brake based dampening assembly may include a single continuous dampening belt, a brake, a differential freewheel coupled to the brake, and a pulley system for guiding the continuous dampening belt. Alternatively, the brake based dampening assembly may include a first dampening belt associated with the first treadle assembly, and a second dampening belt associated with the second treadle assembly. The brake based dampening assembly may include first and second dampening belts and first and second brakes. An interconnect device may be included as part of the exercise apparatus such that when either of the treadle assemblies is pushed down the other treadle assembly is correspondingly pushed up.

According to another embodiment of the present invention a pair of treadle assemblies is pivotally mounted to a frame. A single continuous dampening belt is provided with a first end attached to the first treadle assembly and the second end attached to the second treadle assembly. A flywheel is mounted to the frame. A differential freewheel is coupled to the flywheel. A pulley system guides the continuous dampening belt between the first and second ends of the continuous dampening belt and includes pulleys attached to the differential freewheel such that movement of the treadle assemblies resistably turns the flywheel. The differential freewheel may be eliminated if a differential flywheel is used.

According to one embodiment of the present invention first and second treadle assemblies are pivotally mounted to a frame. A first biasing mechanism has a rigid support member disposed on the first treadle assembly and a resilient member coupled to the frame. A second biasing mechanism has a support member disposed on the second treadle assembly and a resilient member coupled to the frame. A flat spring may be coupled to the frame in order to form the first and second biasing mechanisms. A leaf spring may be coupled to the frame in a concave aspect relative to the treadle assemblies to form the biasing mechanisms. A leaf spring may be coupled to the frame to present a convex aspect relative to the treadle assemblies to form the biasing mechanisms. A multiple section torsion spring may be coupled to the frame itself at several locations. The torsion spring sections of the torsion spring form the biasing mechanisms. A flat spring having a first prong and a second prong disposed towards the front of the first and second treadle assemblies can form the biasing mechanisms.

According to one embodiment of the present invention first and second treadle assemblies are pivotally mounted to a frame. A first cushioning mechanism having a rigid member and a resilient member is disposed between the frame and the first treadle assembly. A second cushioning mechanism having a rigid member and a resilient member is disposed between the frame and the second treadle assembly. The rigid members may comprise rigid protrusions from the treadle assemblies, and the resilient members may include a soft rubber bumper coupled to the frame.

According to one embodiment of the present invention a first treadle assembly is provided that has a first belt, a first drive roller and first and second rollers. The first drive roller and a first and second rollers are disposed in a generally inverted triangular arrangement with the first drive roller being at the apex of the triangular arrangement. A first belt is disposed around the first drive roller and a first and second rollers, and the first treadle assembly is pivotally mounted to the frame in proximity to the first drive roller. A second treadle assembly similar to the first treadle assembly is also pivotally mounted to the frame proximate to the second drive roller. A motor coupled to the frame may be coupled to a drive shaft through a torque transfer mechanism. The drive shaft may be affixed to the first and second drive rollers to provide a pivot for the first and second treadle assemblies. Dampening devices and biasing devices may be coupled between the frame and the treadle assemblies. A reciprocating linkage may be coupled between the treadle assemblies.

A pair of treadle assemblies are pivotally coupled to a frame. Each of the treadle assemblies has at least a front roller and a rear roller. Movable belts are disposed around the front and rear rollers of each treadle assembly. Each treadle assembly has a step area defined on the movable belt between the front roller and the rear roller. A deck is absent from the step areas. Biasing devices may be coupled between the frame and the treadle assemblies. A motor may be provided to move the movable belts around the front and rear rollers. The movable belts may have reinforced edges.

According to another embodiment of the present invention a pair of treadle assemblies are pivotally coupled to a frame. Each of the treadle assemblies has a front roller and a rear roller with a movable belt disposed around the front and rear rollers. Each treadle assembly includes a deck that has a first user selectable position in proximity to a step area defined between the front roller and the rear roller, and a second user selectable position removed from the step area. Biasing devices may be coupled between the frame and the treadle assemblies. The movable belts may include reinforced edges. The movable belts may be placed in tension between the reinforced edges.

The present invention provides for a protective guard for an exercise apparatus having a first treadle assembly and a second treadle assembly pivotally connected with a base frame. The protective guard helps prevent undesired access to the internal framework of the treadle assemblies and the base frame.

In one aspect of the present invention, a protective guard for an exercise apparatus having a first treadle assembly and a second treadle assembly includes a base shroud having at least one treadle aperture, a first treadle shroud connected with the first treadle assembly; and a second treadle shroud connected with the second treadle assembly. The first treadle shroud and the second treadle shroud enclose areas between the first treadle assembly, the second treadle assembly, and the base shroud.

In another form, a protective guard for an exercise apparatus having a first treadle assembly and a second treadle assembly includes a base shroud defined by a right side portion, a left side portion, and a rear side portion. The protective guard also includes a first treadle shroud connected with the first treadle assembly, and a second treadle shroud connected with the second treadle assembly.

In yet another form, the protective guard further includes a center shield between the first treadle assembly and the second treadle assembly. The center shield can be pivotally supported on the exercise apparatus by a center drive bracket and a spring.

The features, utilities, and advantages of various embodiments of the invention will be apparent from the following more particular description of embodiments of the invention as illustrated in the accompanying drawings and defined in the appended claims.

Generally, the invention comprises an exercise machine having dual decks angularly reciprocating about a common axis. The exercise machine may employ two treadles, each capable of independent reciprocating motion. The treadles generally reciprocate about a common axis, either at the front or rear of the treadles.

One embodiment of the exercise machine may include a locking mechanism. The locking mechanism may lock out or otherwise impede treadle motion. One embodiment of the locking mechanism takes the form of a pedal, pivot mechanism, and locking tab. As the pedal is depressed, a bar pivots about the pivot mechanism, moving the locking tab into engagement with a channel formed on the underside of the treadle, or optionally simply with the underside of the treadle itself. The locking tabs prevent further downward treadle motion.

In another embodiment of the locking mechanism, a cam may be attached to the pedal and bar. Downward pedal motion forces the bar along a pivot, driving the cam rotationally upward until it engages the underside of the treadle. This results in locking out the treadle motion.

In yet another embodiment of a locking mechanism, the pedal may be omitted and a key attached to one end of the bar. The bar may be moved laterally, pushing the key into a slot or receptacle formed on or depending from the underside of the treadle. Mating of the key and the slot results in restriction of treadle motion.

In some embodiments of the dual-deck exercise device, one or more handle bars (or other portion of an upper body structure) may be connected to one or more treadles. The interconnects may take the form of a fixed-length bar or a piston. Where a fixed-length bar is used, the handle bar may include a bar slot along which the top of the bar slides when the treadle and/or handle bar is moved. Further, a spring or hinge joint may be located at or near a bend in the handle bar to permit the handle bar to move laterally independent of treadle motion.

In yet other embodiments, the motion of one or more handle bars may partially or fully actuate a corresponding treadle belt motion. For example, the handle bar may be connected to the treadle, or treadle roller, by a one-way bearing or a ratchet and pawl assembly. As the handle bar is moved in a first direction, the bearing or ratchet may force the treadle roller to rotate and the treadle belt to move correspondingly. As the handle bar moves in a second direction, the bearing or ratchet may disengage, permitting free treadle belt movement independent of the handle bar. In this manner, the treadle belt is driven in a single direction by handle bar motion. It should be noted the handle bar motion drives only the treadle roller and belt passing therearound, rather than moving the treadle assembly angularly about a pivot point.

Alternately, a bottom end of each handle bar may be received in a slot located along the side of each treadle. In such an embodiment, the handle bars may pivot about a pivot point located between the handle bar top and bottom. Thus, as the handle bars are moved back and forth, the treadles may be driven up and down by the handle bar bottoms moving along the aforementioned slots. The combination of slot and pivot effectively translates the handle bar's lateral motion into vertical motion for the treadle. An interconnect may operatively connect the two treadle axles, moving the treadles in opposite or the same directions.

Some embodiments of the dual-deck exercise device may incorporate resistive elements into the handle bar structure to provide or enhance an upper-body workout. For example, a piston or spring may be connected to both a portion of the handle bar and an upright or other upper body structure element. As the handle bar portion is driven towards the upper body structure or upright, the piston or spring naturally resists the handle bar motion, forcing a user of the exercise device to exert more force to move the handle bar. This, in turn, enhances the user's upper body workout.

Yet other embodiments of the dual-deck exercise device may include a height adjustment mechanism capable of changing the rear height of the treadles. The treadles may be moved up or down by, for example, turning a threaded screw received in a threaded adjustor attached to a treadle. As the screw turns, the adjustor raises or lowers the attached treadle. Such raising and lowering generally also affects the maximum operating angle achieved between the front and rear of each treadle during operation. As the treadle rear is raised, the maximum operating angle decreases, because the height of the treadle rear is raised closer to the maximum operating height of the treadle front. In some cases, the treadle rear may be raised sufficiently high that the angle between rear and front of the treadle may form a decline, rather than incline.

The dual-deck exercise device may also permit throw adjustment. Generally, "throw" is defined the angle between the lowest and highest points of the treadle's vertical motion, as measured from the main frame or exercise device base. Accordingly, this angle may be changed as desired by a user. A throw bar is rotatably attached to a pivot support about a pivot point, and extends in both directions beyond the pivot point, running perpendicular to (and beneath) the longitudinal axis of the treadles. One throw adjust per treadle seats along the throw bar. The top of each throw adjust abuts the treadle base.

The throw adjust may be moved along the longitudinal axis of the throw bar Generally, the farther away from the pivot point the throw adjust is seated, the greater the vertical distance (translated to angle) traveled by the treadle during operation. Accordingly, adjusting the seating of the throw adjust on the throw bar may vary the treadle's angle of operation.

Finally, some embodiments of the dual-deck exercise device may be modular. Modular embodiments may be shipped and/or stored in more compact spaces. For example, the motor, treadles, and drive belt may all be shipped separate from the exercise device frame, and assembled by a user prior to operation. The motor may drive one or more treadles by a drive belt connected to both the motor and a treadle axis or roller. As the motor operates, it turns the drive belt, which in turn rotates the roller and forces a treadle belt overlying the roller to move.

Alternately, the motor may underlie a treadle and be directly connected to the treadle belt by a wheel or other direct-drive device. As the motor operates, the wheel spins beneath the treadle belt, frictionally driving the belt.

Generally speaking, the present invention, in one embodiment, is an exercise machine including a base frame, a first treadle operably coupled to the base frame, and a second treadle operably coupled to the base frame. The first treadle includes a first treadle frame and a first tread surface displaceable relative to the first treadle frame. At least a portion of the first treadle frame is displaceable relative to the base frame. Similarly, the second treadle includes a second treadle frame and a second tread surface displaceable relative to the second treadle frame. At least a portion of the second treadle frame is displaceable relative to the base frame.

In one embodiment, each tread surface is a set of rollers and each roller is rotationally mounted on an axis supported by the roller's respective treadle frame. The outer circumference of each roller is rotationally displaceable relative to the roller's respective treadle frame and is adapted for direct contact with a user's foot or shoe.

In one embodiment, each tread surface is a tread belt. Each tread belt may be a continuous tread belt (i.e., a tread belt that travels in a continuous circuit about its respective treadle frame as the tread belt displaces) or, each tread belt may be a non-continuous tread belt (i.e., a tread belt that does not travel in a continuous circuit about its respective treadle frame as the tread belt displaces). Where the tread belt is a non-continuous tread belt, the tread belt may have a first end coupled to a first roller and a second end coupled to a second roller. Furthermore, each non-continuous tread belt may be biased so its longitudinal center returns to a starting position after a user's foot or shoe is no longer displacing the belt.

In one embodiment, the base frame includes a first frame member and a second frame member and the treadles are pivotally displaceable about an axis that extends between the first and second frame members. In one embodiment, the first and second treadles each further include a roller and the axes of the rollers are coaxial with the axis that extends between the first and second frame members. These rollers may be the rear most roller of each treadle, or they may be the forward most roller of each treadle. Also, these rollers may be drive rollers for driving the tread surface of each treadle, or they may be non-powered idler rollers.

In one embodiment, the base frame again includes a first frame member and a second frame member and the treadles are pivotally displaceable about an axis that extends between the first and second frame members. Each treadle further includes a front end roller and a rear end roller, and the axis that extends between first and second frame members intersects the treadle frames at a location forward of the rear end roller and rearward of the front end roller.

In one embodiment, the first and second frame members each include a slot and the axis, which extends between the first and second frame members and about which the treadles may pivotably displace relative to the base frame, is a rod displaceable along the slots. The slots may be arcuate, and the slope of the treadles changes as the rod displaces along the slots. One or both ends of the rod may include a nut or knob for securing the rod in place along the respective slot.

In one embodiment, the base frame further includes guide flanges that extend from the base frame and are offset along the base frame from the axis, which extends between the first and second frame members and about which the treadles may pivotably displace relative to the base frame. Each guide flange includes a slot and first and second positioning elements displaceable within the slot. Each first positioning element is adapted to come into contact with its respective treadle frame to arrest the movement of the treadle in a first direction along the slot. Each second positioning element is adapted to come into contact with its respective treadle frame to arrest the movement of the treadle in a second direction along the slot. The slot may be arcuate.

In one embodiment, each treadle further includes a front roller pivotable about a first axis and a rear roller pivotable about a second axis. Furthermore, the axis, which extends between the first and second frame members and about which the treadles are pivotably displaceable relative to the base frame, is perpendicularly offset from a line that runs between the axes of the pivotable rollers. The tread surface is a tread belt that displaces about the pivotable rollers.

In a variation of the immediately preceding embodiment, each treadle includes a third roller that is coaxial with, and pivotable about, the axis that extends between the first and second frame members and about which the treadles are pivotably displaceable relative to the base frame. Accordingly, the tread belt is displaceable about the three rollers. In yet another variation, each treadle includes a fourth roller pivotable about a third axis that is perpendicularly offset from the line that runs between the axes of the front and rear rollers. Accordingly, the tread belt is displaceable about the four rollers.

In one embodiment, each treadle further includes a first, a second and a third roller. Each first roller is pivotable about a first axis at the front of the respective treadle frame. Each second roller is pivotable about a second axis at the rear of the respective treadle frame. Each third roller is pivotable about a third axis perpendicularly offset from the respective treadle frame and fixedly positioned relative to the base frame. Each tread surface is a tread belt that is displaceable about the respective three rollers. Each treadle frame is adapted to displace generally simultaneously rearwardly and downwardly when depressed. Additionally, in one variation of this embodiment, each treadle includes a fourth roller pivotable about a fourth axis perpendicularly offset from the respective treadle frame and fixedly positioned relative to the base frame. Each tread belt is displaceable about the respective four rollers and each treadle frame is adapted to displace generally simultaneously rearwardly and downwardly when depressed.

In one embodiment, the exercise machine further includes pivot links to couple each treadle to the base frame. Each pivot link has a first end pivotally coupled to a treadle about a first axis and a second end pivotally coupled to a portion or extension of the base frame about a second axis. For each pivot link, an acute angle exists between the top edge of a pivot link and the adjacent bottom edge of a treadle frame when the treadle has not been depressed. As a treadle is depressed, the angle becomes increasingly acute, and the treadle frame generally simultaneously moves rearward and downward.

In one embodiment, the exercise machine further includes pivot links to couple each treadle to the base frame. Each pivot link has a first end pivotally coupled to a treadle about a first axis and a second end pivotally coupled to a portion or extension of the base frame about a second axis. A pivot link may further include a torsion spring acting about the second axis and coupled to the pivot link and the portion or extension of the base frame. When a treadle has not been depressed, an obtuse angle exists between the top edge of the pivot link and the adjacent top edge of the respective treadle frame.

In one embodiment, the exercise machine further includes four bar linkages to couple each treadle to the base frame. Each four bar linkage has a first corner pivotally coupled to a treadle about a first axis and a second corner pivotally coupled to a portion or extension of the base frame about a second axis. Each four bar linkage includes upper and lower horizontal members, front and rear vertical members, and a spring. A front end of the upper horizontal member is pivotally connected to a top end of the front vertical member about the first axis. A rear end of the lower horizontal member is pivotally connected to a bottom end of the rear vertical member about the second axis. The spring may be between the upper and lower horizontal members and biases the horizontal members apart. When depressed, a treadle frame equipped with the four bar linkage generally simultaneously moves forward and downward.

In one embodiment, each treadle further includes a first swing arm and a second swing arm, and the base frame includes an axle and first and second pulleys and cables. Each first swing arm has a lower end pivotably coupled to the respective treadle and an upper end pivotably coupled to the base frame. Each second swing arm has a lower end pivotably coupled to the respective treadle and an upper end pivotably coupled to the base frame. The first pulley is coaxially mounted on the axle and connected by the first cable to the first treadle. The second pulley is coaxially mounted on the axle and connected by the second cable to the second treadle. Displacement of the first treadle causes a generally equal, but opposite displacement of the second treadle.

In one embodiment, the exercise machine further includes a rocker arm and a spring, and each treadle further includes a first swing arm and a second swing arm. Each first swing arm has a lower end pivotably coupled to the respective treadle and an upper end pivotably coupled to the base frame. Each second swing arm has a lower end pivotably coupled to the respective treadle and an upper end pivotably coupled to the base frame. The rocker arm is pivotably coupled to the base frame and has a first end operably coupled to the first treadle and a second end operably coupled to the second treadle. The spring biases the treadles back into a non-displaced position after being displaced by a user's foot or shoe. The spring may interact between the base frame and at least one of the swing arms. Displacement of the first treadle causes a generally equal, but opposite displacement of the second treadle.

In one embodiment, the base frame includes first and second vertical posts and a cable routed around a set of sheaves, and each treadle further includes first and second sleeves. The first sleeve is pivotably coupled to the first treadle and slidably displaceable along the first post. The second sleeve is pivotably coupled to the second treadle and slidably displaceable along the second post. The cable interconnects the first and second sleeves such that displacement of the first treadle causes a generally equal, but opposite displacement of the second treadle.

In one embodiment, the exercise machine further includes a control mechanism and a rocker arm pivotally coupled to the base frame. The rocker arm includes a first end operably coupled to the first treadle and a second end operably coupled to the second treadle. Displacement of the ends of the rocker arm may be in a generally vertical plane. Displacement of the first treadle causes a generally equal, but opposite displacement of the second treadle.

The control mechanism is for limiting the displacement of the ends of the rocker arm. In one embodiment, the control mechanism includes a rod and first and second cam elements. The rod is rotationally coupled to the base frame. The first cam element is coaxially mounted on the rod and has an outer circumferential surface that is generally parallel to the axis of the first cam element and adapted to contact the first end of the rocker arm. Similarly, the second cam element is coaxially mounted on the rod and has an outer circumferential surface that is generally parallel to the axis of the second cam element and adapted to contact the second end of the rocker arm. The distance between the axis of the each cam element and its outer circumferential surface gradually increases when traveling along the outer circumferential surface from a point where said distance is least to a point where said distance is greatest.

In one embodiment, the exercise machine includes a low friction surface located between the first and second treadles. More specifically, in one embodiment, the first treadle may include a first edge, the second treadle may include a second edge adjacent to the first edge, and the low friction surface may be at least a portion of one of the edges.

The low friction surface may be a rollable or rolling type surface (i.e., a low friction surface formed from a set of rollers), a slidable type surface, or a combination of rolling type and sliding type surfaces. The slidable type surface may be TEFLON™ or nylon, or another low friction type polymer. Also, the slidable type surface may be lubricated.

In embodiment, the exercise machine further includes a third treadle, a portion of which is a low friction surface. The low friction surface may be a rolling type or slidable type surface of the types already described. The third treadle may be biased in an upward position. Furthermore, the third treadle may alternatingly track the first and second treadles between a highest treadle displacement point and a point midway between the highest treadle displacement point and a lowest treadle displacement point.

BRIEF DESCRIPTION OF THE DRAWINGS

The detailed description will refer to the following drawings, wherein like numerals refer to like elements, and wherein.

Figure 79C:
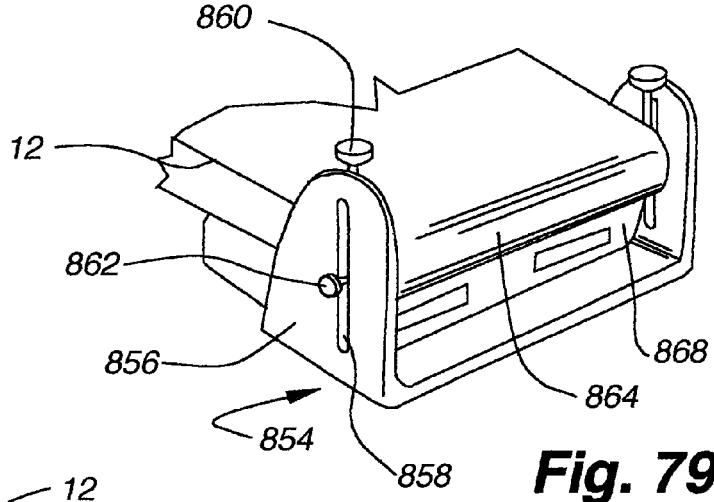
FIG. 79C displays a back view of a treadle attached to a height adjustment mechanism.
Figure 79A:
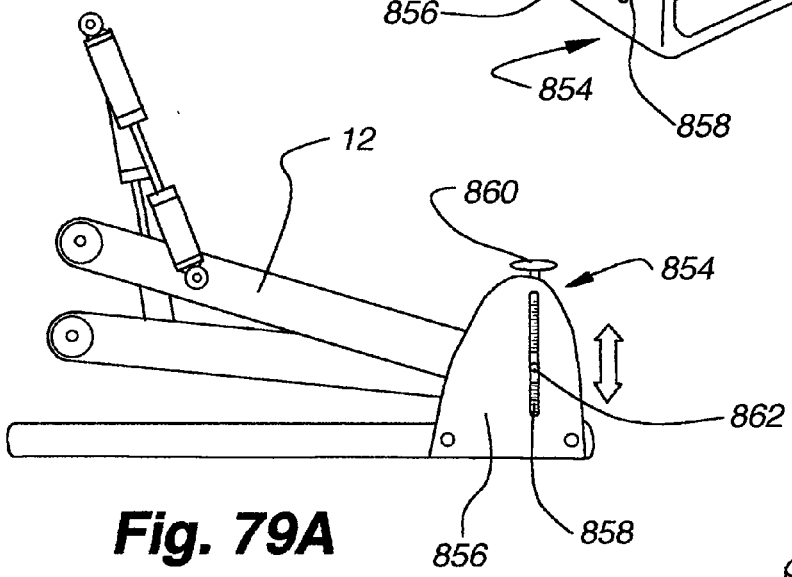
FIG. 79A depicts a side view of a pair of treadles operably connected to a height adjustment mechanism for a treadle.
Figure 79B:
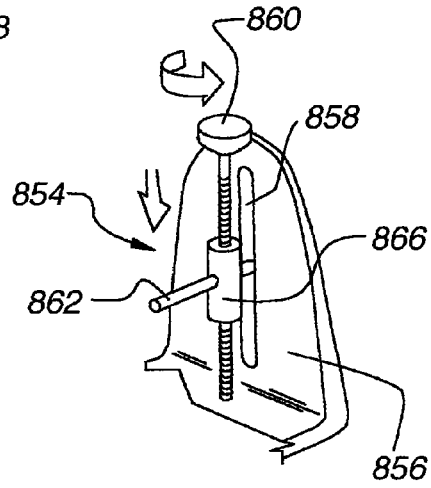
FIG. 79B depicts an isometric view of the height adjustment mechanism of FIG. 79A.
Figure 80A:
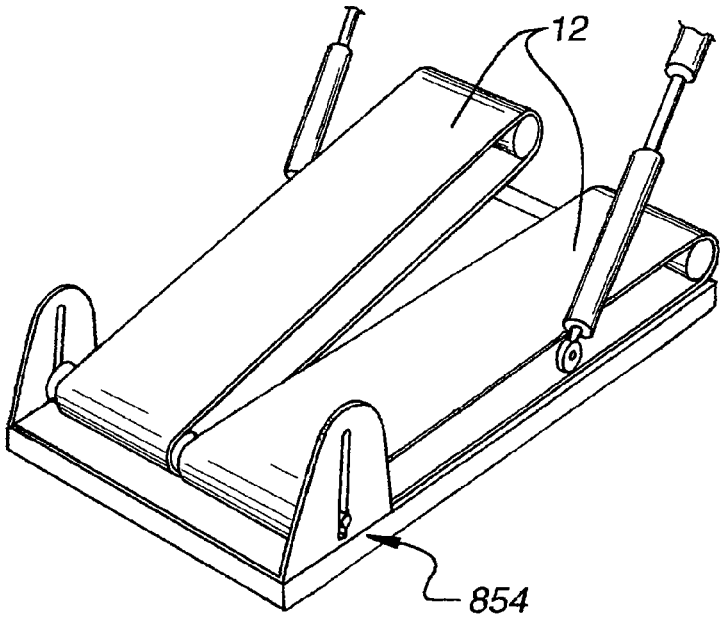
FIG. 80A depicts treadles of the exercise machine operating in an unlocked mode, with the treadle rear in a lowest position afforded by the adjustment mechanism of FIGS. 79A-79C.
Figure 80B:
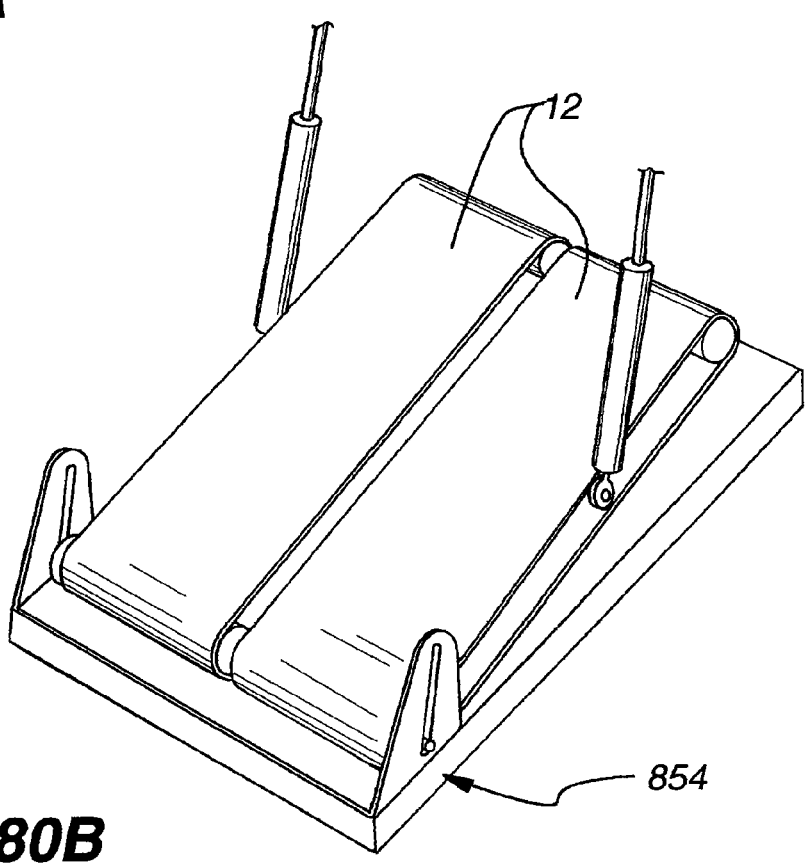

FIG. 80B displays treadles locked in high position, with the treadle rear in a highest position afforded by an adjustment mechanism of FIGS. 79A-79C.

Figure 81:
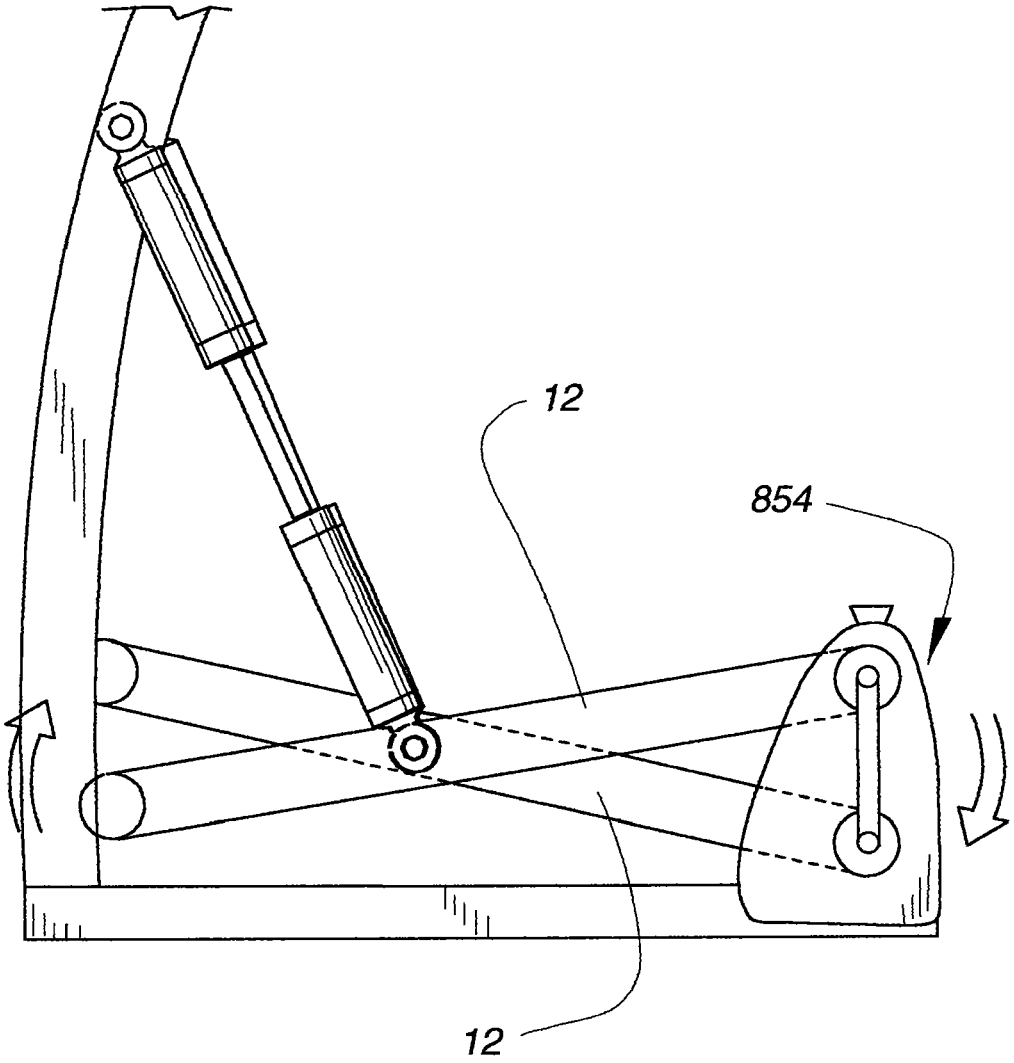

FIG. 81 depicts treadles in both the high position and low position of FIGS. 80A and 80B.

Figure 82:
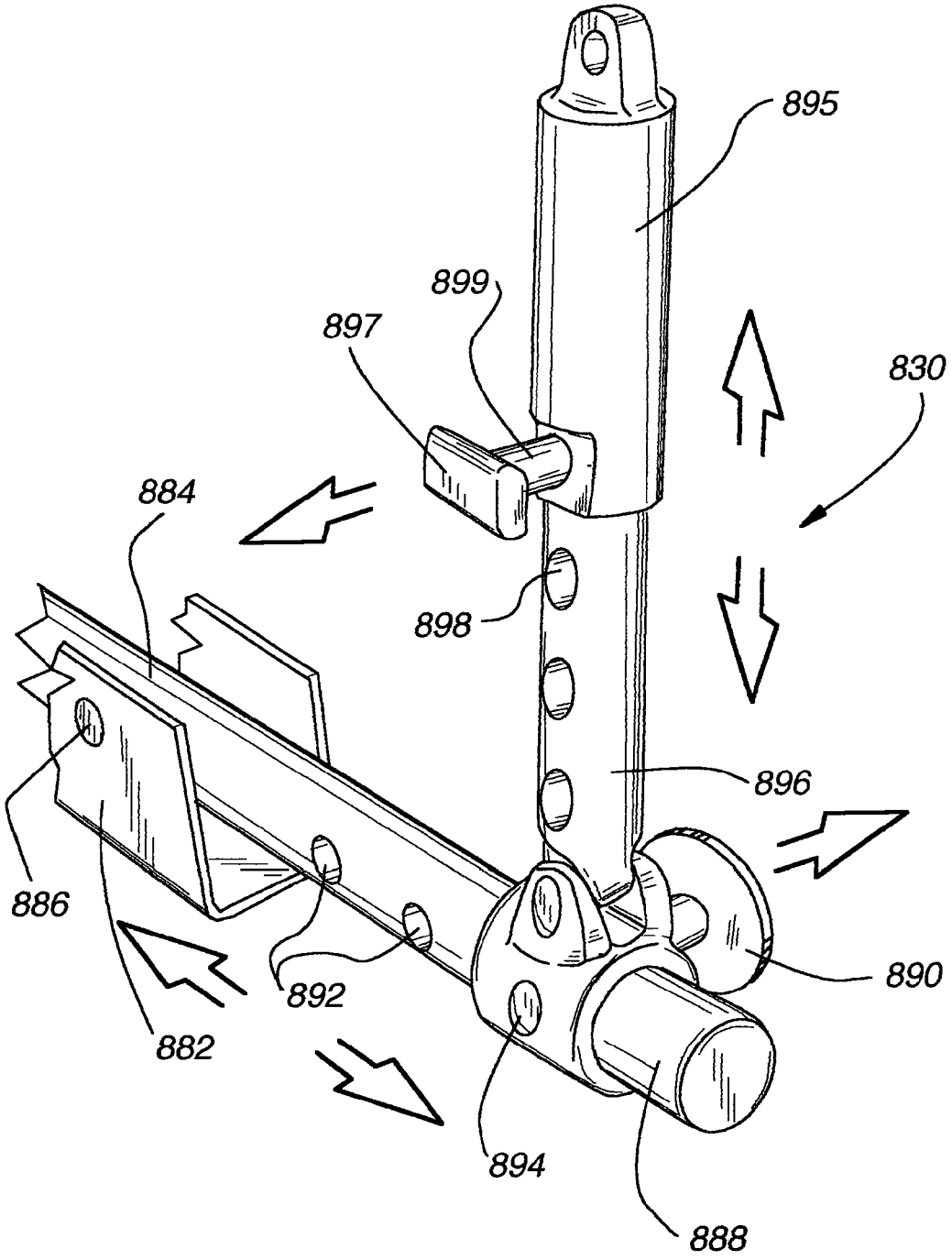

FIG. 82 depicts a treadle throw adjustment mechanism.

Figure 83A:
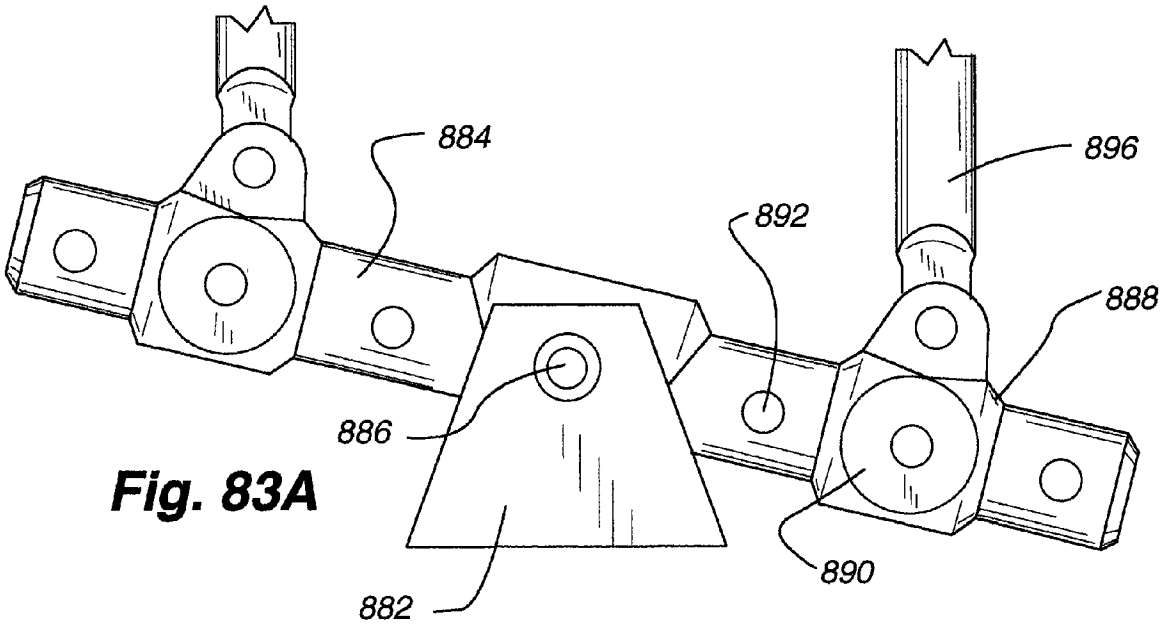

FIG. 83A depicts two directions of extension for a throw bar used in the throw adjustment mechanism of FIG. 82.

Figure 83B:
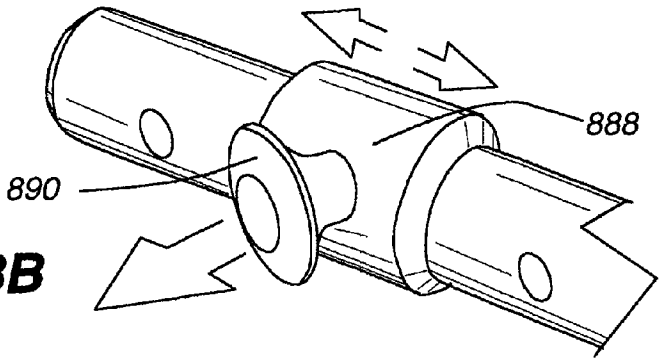

FIG. 83B depicts an isometric view of a throw adjust and throw pull used in the throw adjustment mechanism of FIG. 82.

Figure 83E:
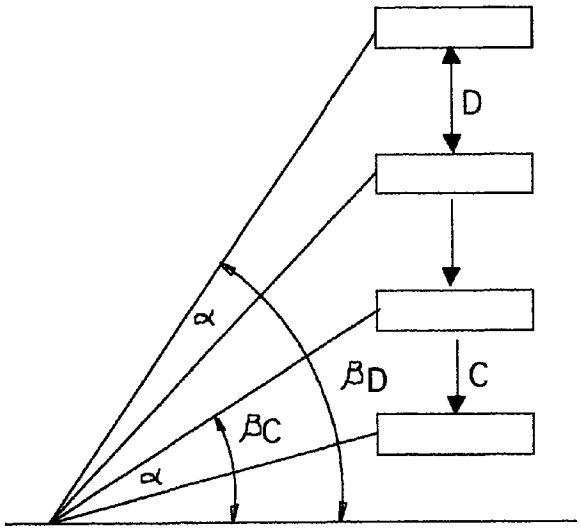
Figure 83F:
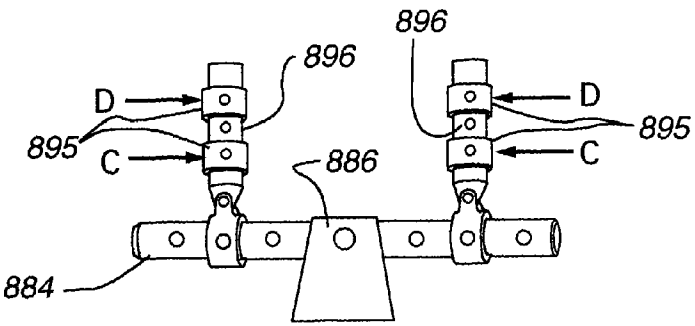
Figure 83C:
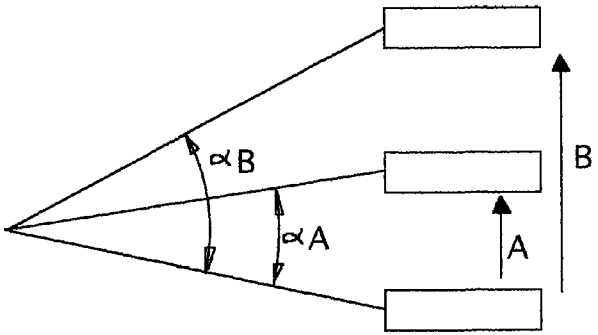

FIG. 83C depicts the relationship between the position of a throw adjust along the throw bar of FIG. 83A, the angle of treadle incline, and angle of treadle operation.

Figure 83D:
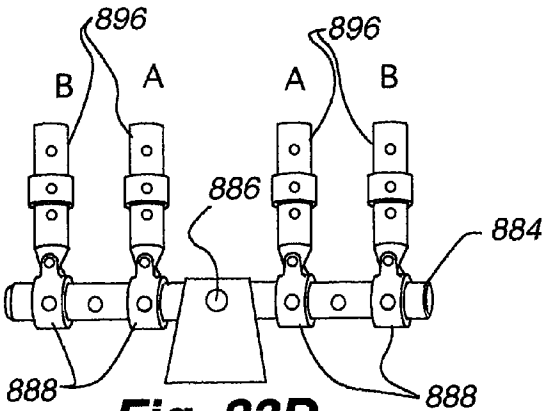

FIG. 83D depicts the various settings of the throw adjust seating along a throw bar, in accordance with FIG. 83C.

FIG. 83E depicts the relationship between the position of an angle adjust along the angle bar depicted in FIG. 83A and the starting and stopping angles for a treadle's range of motion.

FIG. 83F depicts the various settings of an angle adjust along the angle bar, in accordance with FIG. 83E.

Figure 84A:
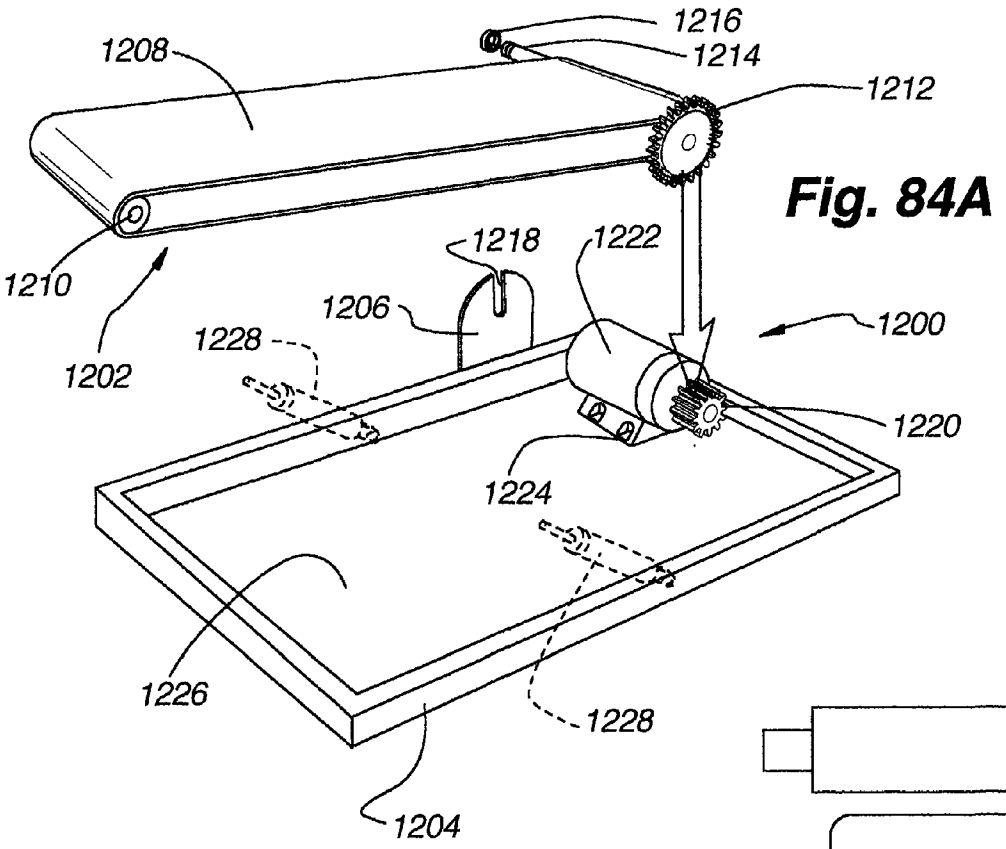

FIG. 84A depicts an embodiment of a modular treadle and frame configuration.

Figure 84B:
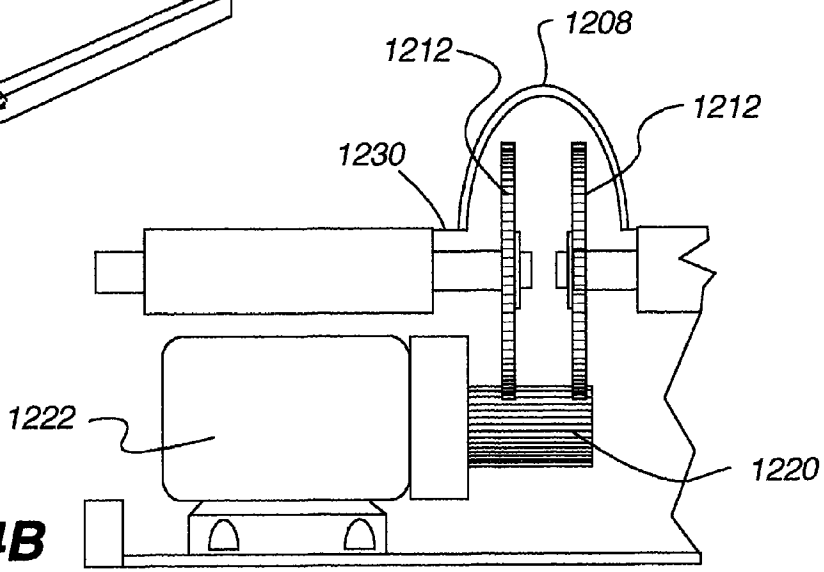

FIG. 84B depicts the drive gear and motor assembly of the modular configuration shown in FIG. 84A, with two treadle assemblies mounted thereto.

Figure 85:
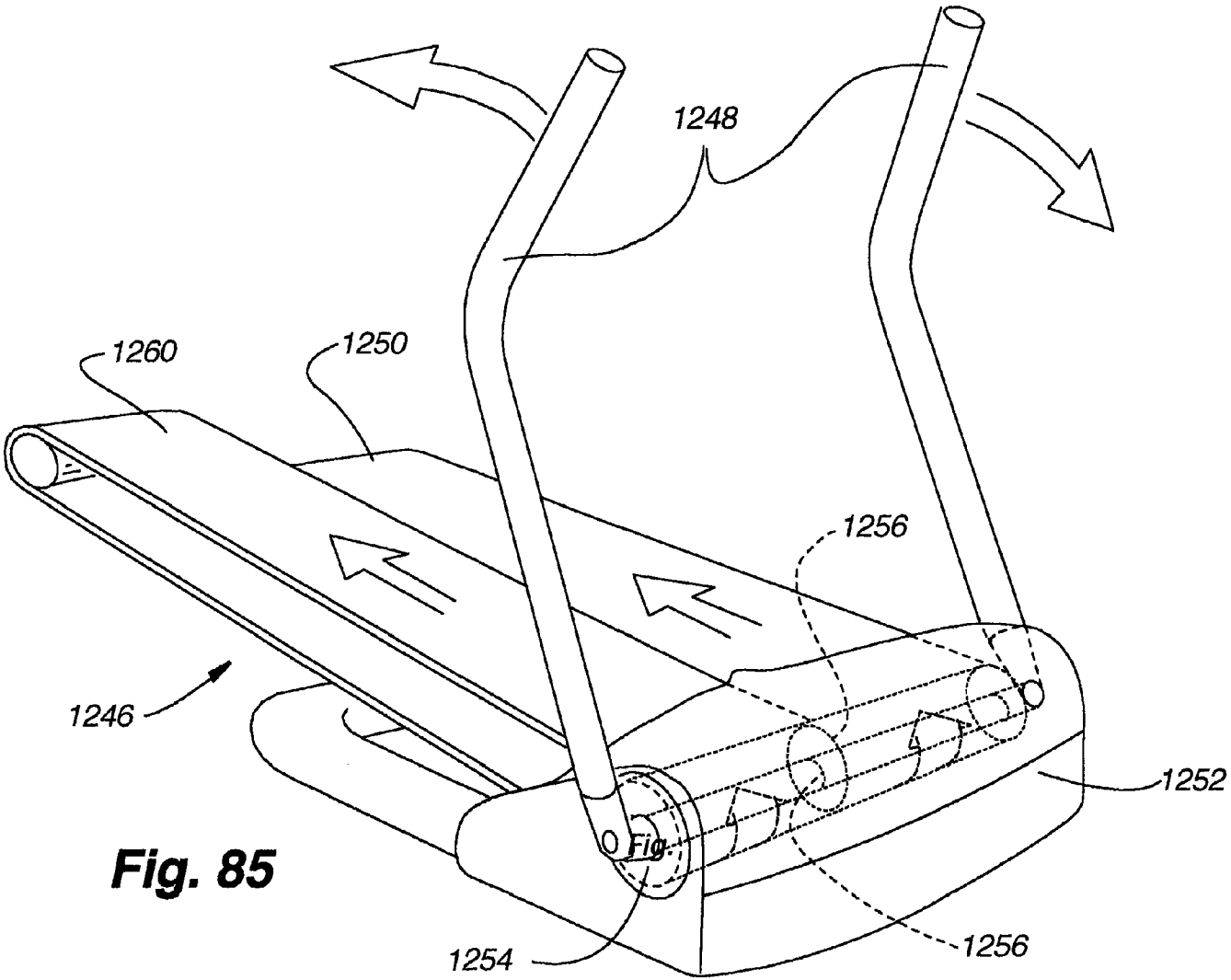

FIG. 85 depicts an embodiment of a dual-deck exercise device wherein handle motion actuates treadle motion.

Figure 86:
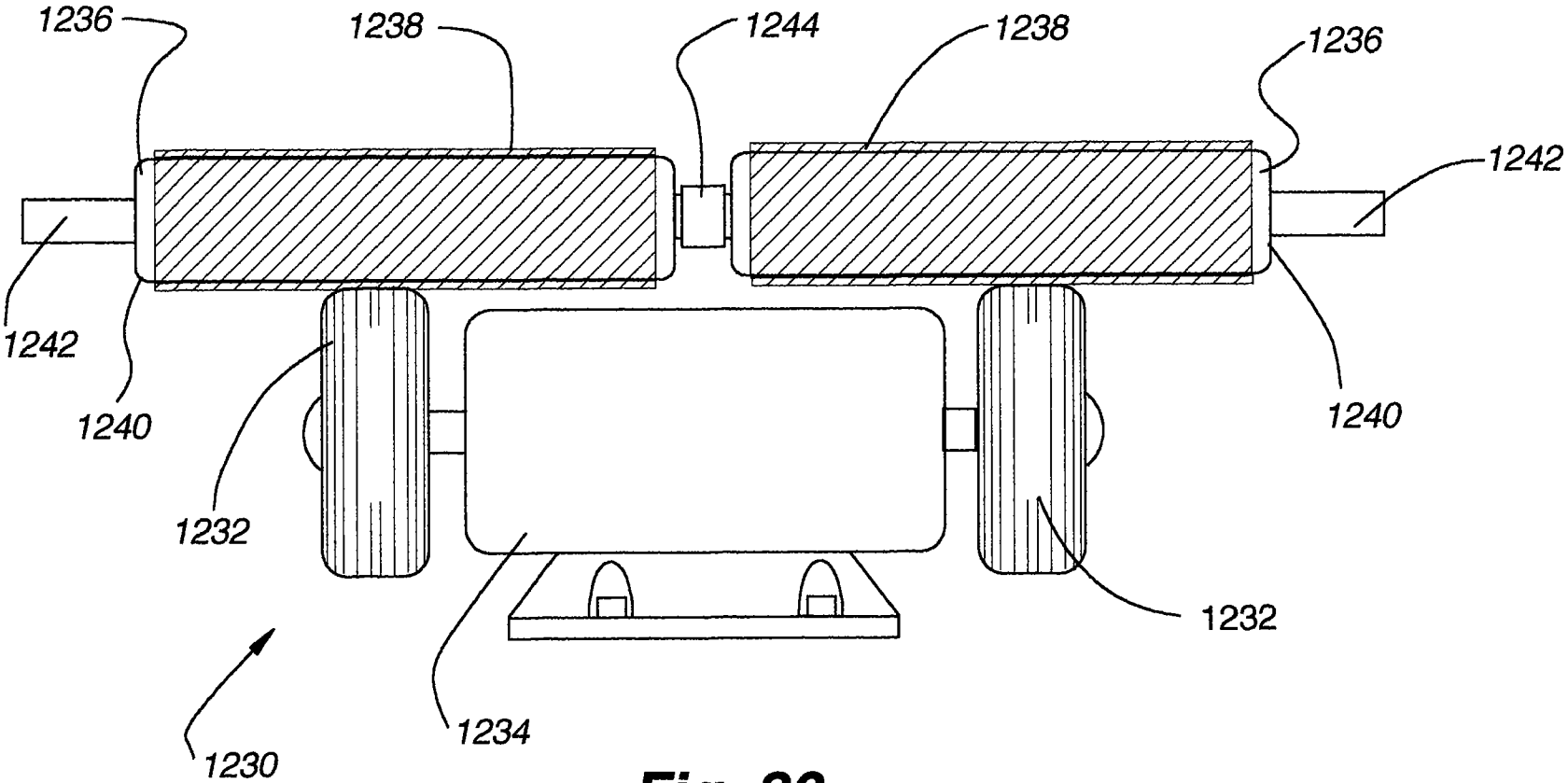

FIG. 86 depicts an alternate embodiment of the drive gear and motor assembly shown in FIG. 84.

Figure 87:
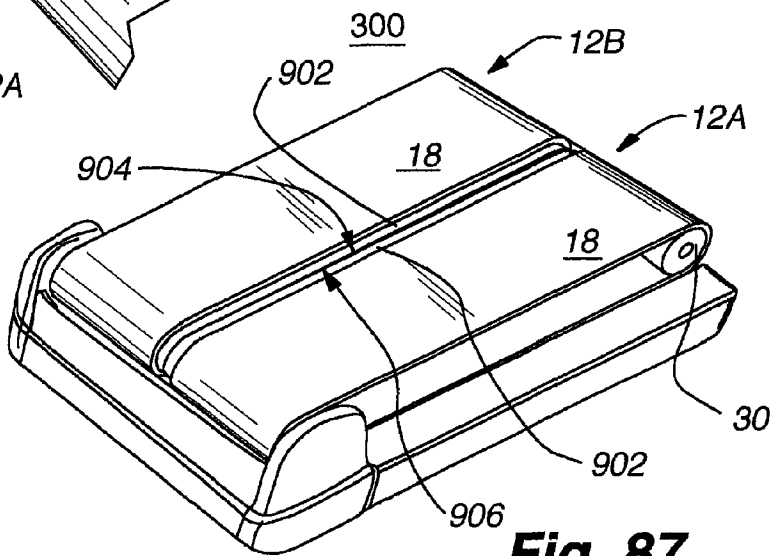

FIG. 87 is an isometric view of the treadle and base frame portion of the exercise machine illustrating a low friction interface, according to one embodiment of the invention.

Figure 88:
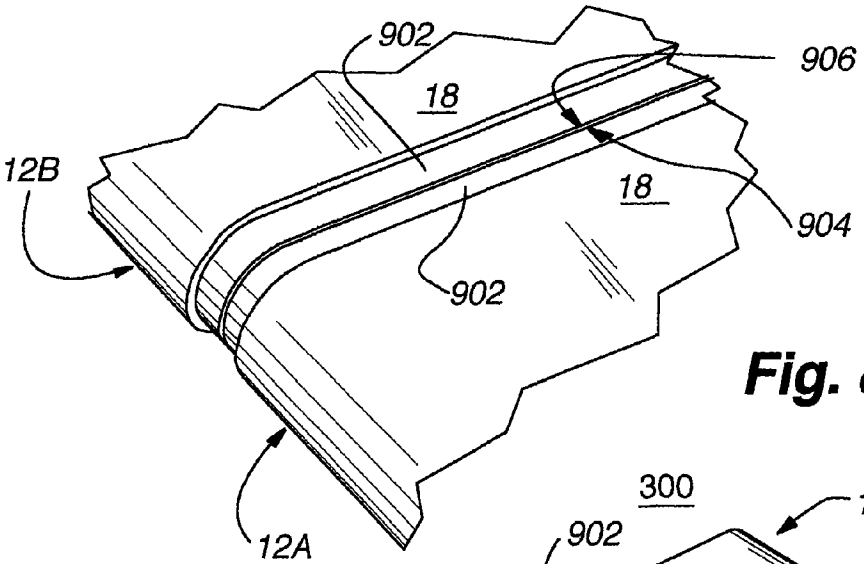

FIG. 88 is an enlarged isometric view of the low friction interface illustrated in FIG. 87, wherein the low friction interface is formed by a slick, slidable surface, according to one embodiment of the invention.

Figure 89:
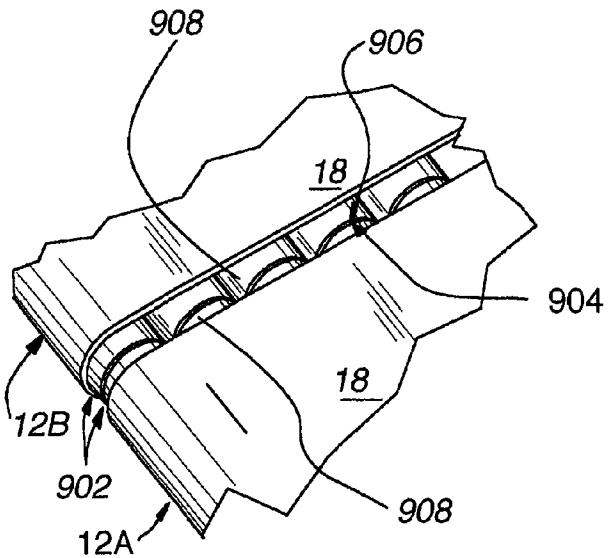

FIG. 89 is an enlarged isometric view of the low friction interface illustrated in FIG. 87, wherein the low friction interface is formed by a set of rollers, according to one embodiment of the invention.

Figure 90:
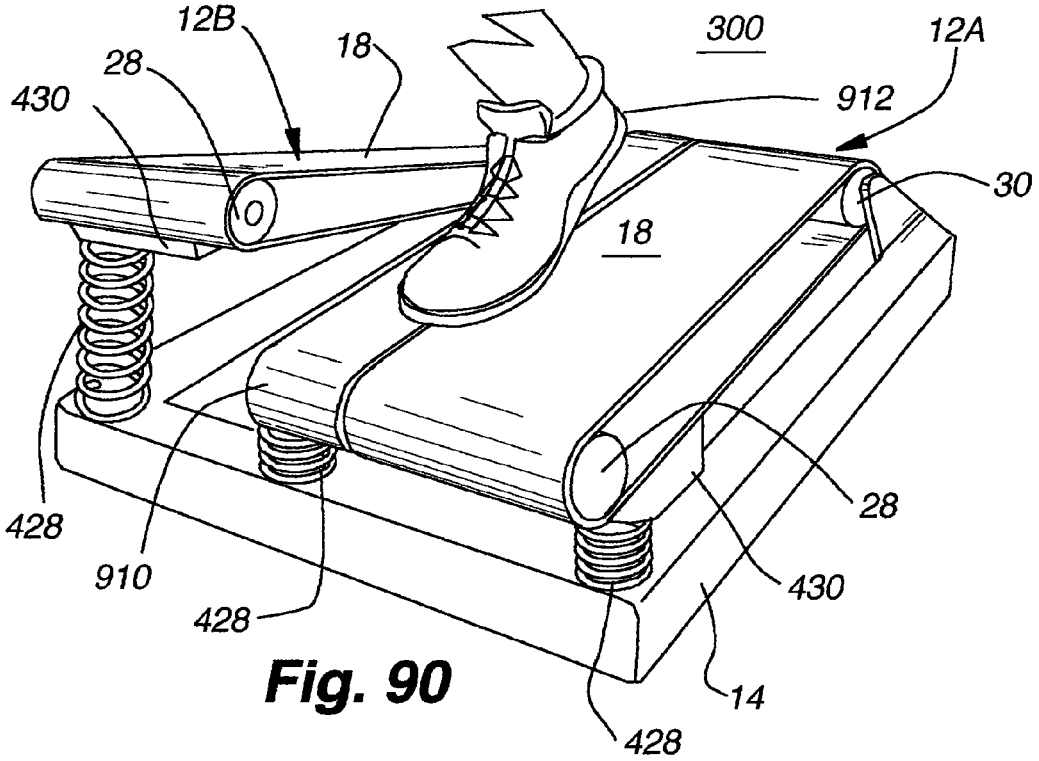

FIG. 90 is an isometric view of the treadle and base frame portion of the exercise machine, according to one embodiment of the invention, wherein the machine is equipped with a third or middle treadle having a low friction surface.

Figure 91:
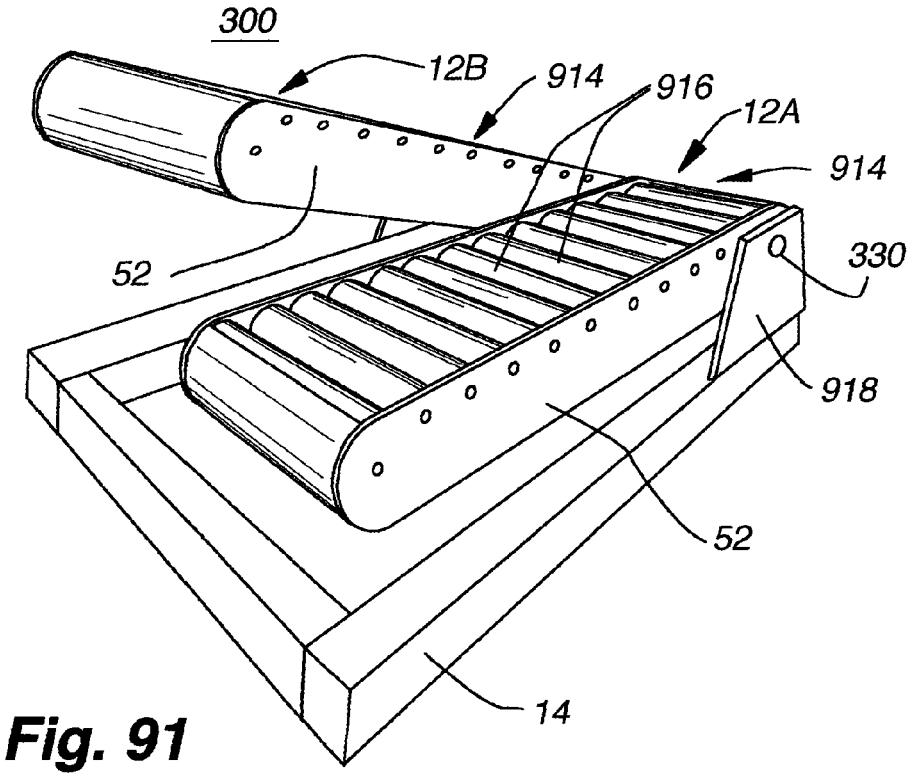

FIG. 91 is an isometric view of the treadle and base frame portion of the exercise machine, according to one embodiment of the invention, wherein the tread surface of each treadle includes a set of rollers.

Figure 92:
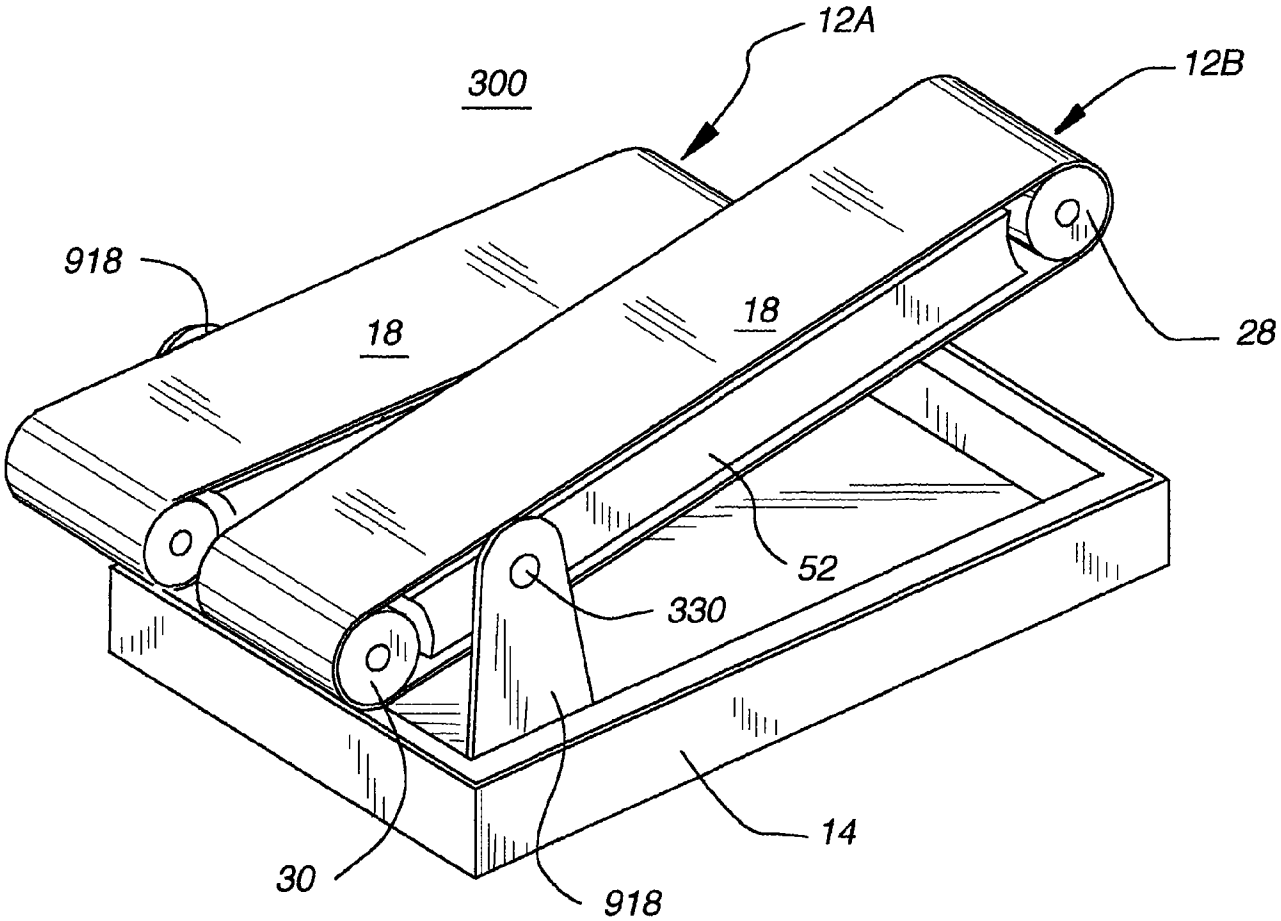

FIG. 92 is an isometric view of the treadle and base frame portion of the exercise machine, according to one embodiment of the invention, wherein the base frame is coupled with the treadle frame at a point or location between the longitudinal ends of each treadle.

Figure 93:
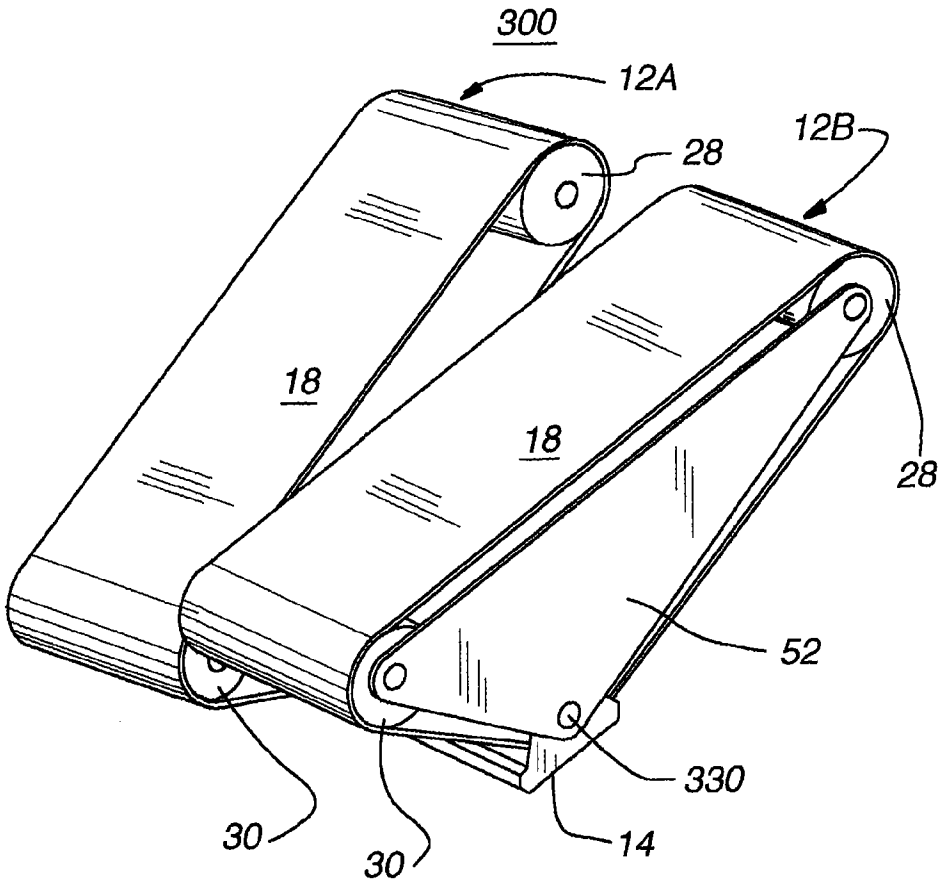

FIG. 93 an isometric view of the treadle and base frame portion of the exercise machine, according to one embodiment of the invention, wherein a set of triangular frame members are provided to pivotally couple the treadles to the base frame at a location between the ends of the treadle.

Figure 94:
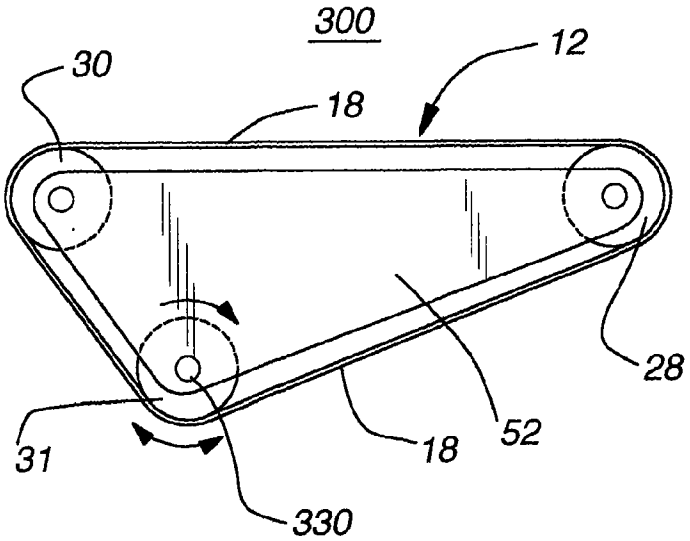

FIG. 94 is a right side elevation of the treadle and base frame portion of the exercise machine illustrated in FIG. 93.

Figures 95, 96:
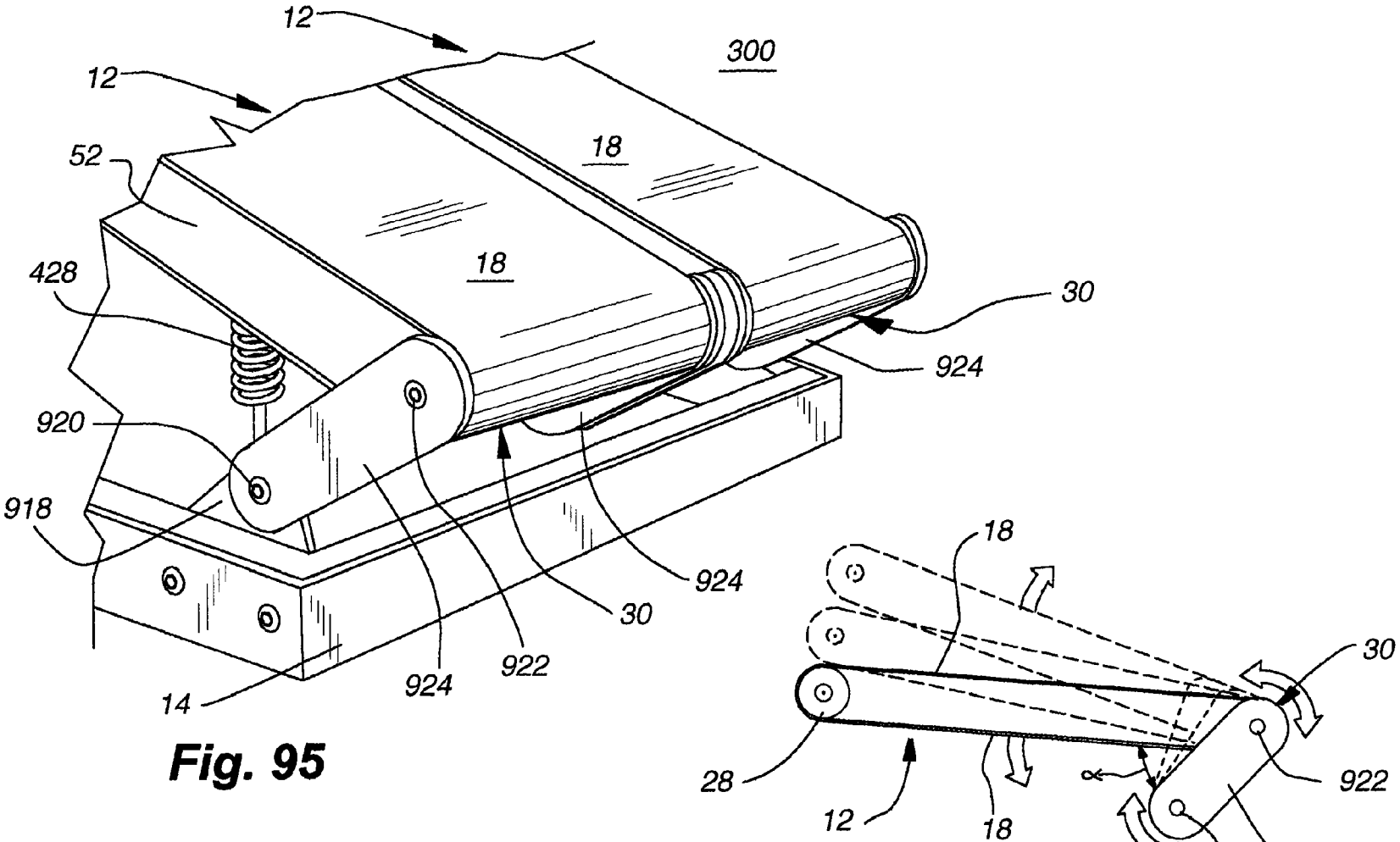

FIG. 95 is an isometric view of the treadle and base frame portion of the exercise machine, according to one embodiment of the invention, wherein an articulated linkage arrangement is utilized to pivotally couple the treadles to the base frame.

FIG. 96 is a left side view of the treadle and linkage arrangement illustrated in FIG. 95.

Figure 97:
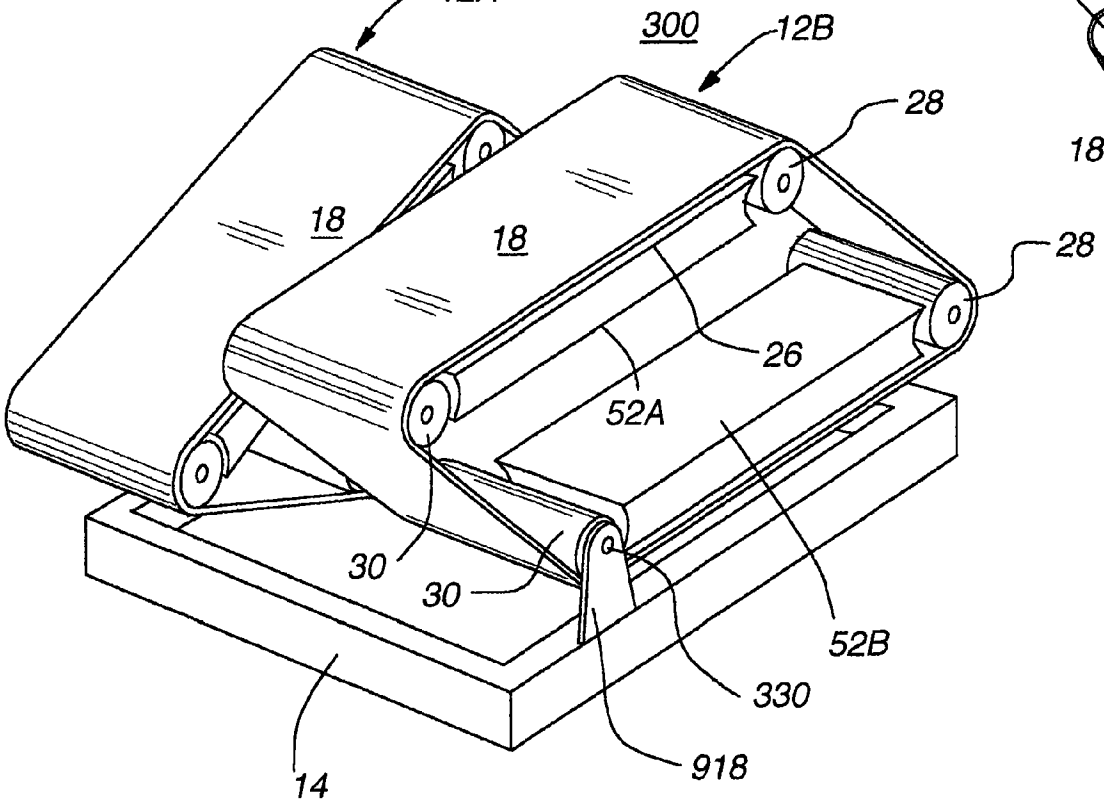

FIG. 97 is an isometric view of the treadle and base frame portion of the exercise machine, according to one embodiment of the invention, wherein the treadles have an upper treadle frame with two rollers, a lower treadle frame with two rollers, and a continuous tread belt encircling the frames and rollers to form a trapezoidal configuration when viewed from the side of the treadle.

Figure 98A:
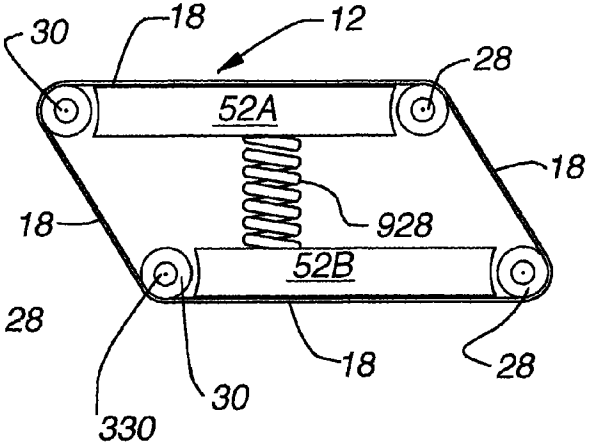

FIG. 98A is a right side view of the treadle illustrated in FIG. 97 and indicates the trapezoidal configuration formed by the frame, four rollers and continuous tread belt.

Figure 98B:
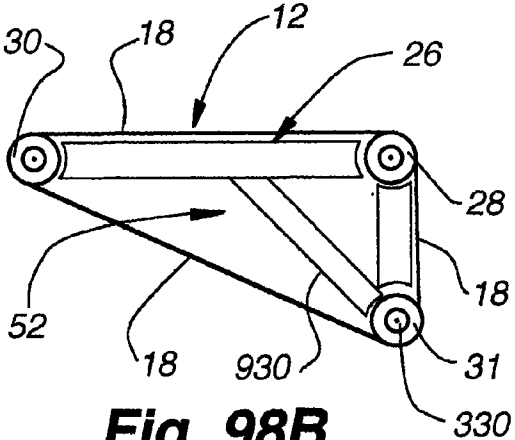

FIG. 98B is a right side view of an alternative embodiment of the embodiment of the invention illustrated in FIG. 97, namely a treadle with a frame, three rollers, and a continuous tread belt forming a triangular configuration.

Figure 99A:
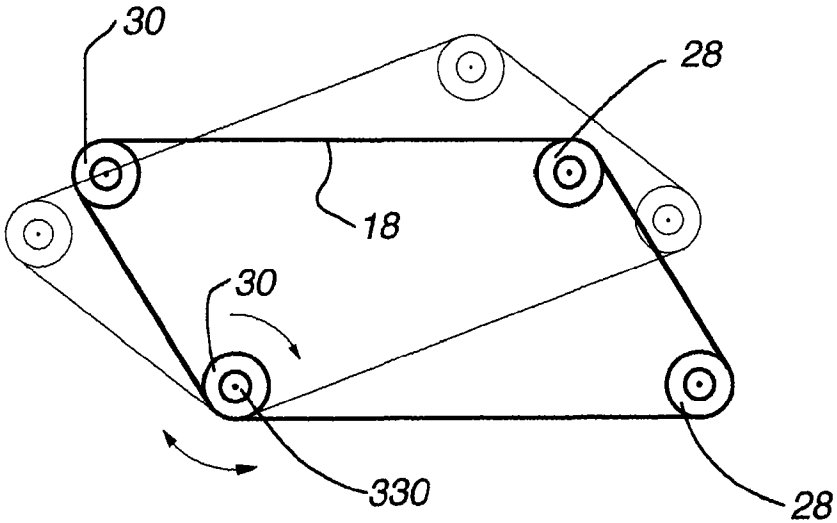

FIG. 99A is a right side view of the treadle illustrated in FIG. 97 and indicates the trapezoidal treadle displacing about a pivot point.

Figure 99B:
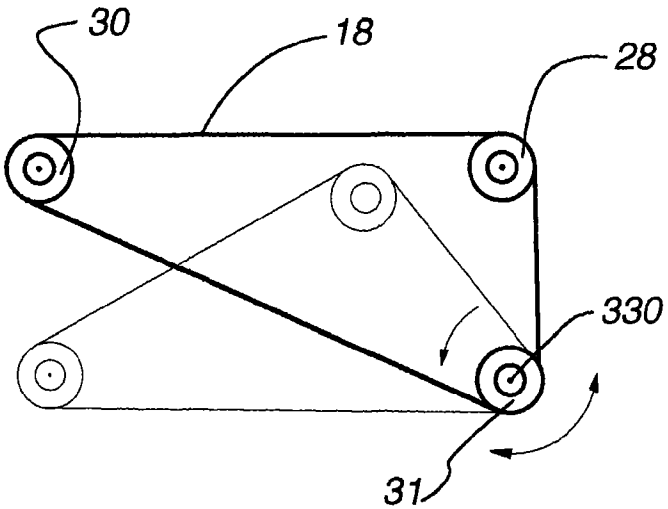

FIG. 99B is the same view of the treadle illustrated in FIG. 98B and indicates the triangular treadle displacing about a pivot point.

Figure 100:
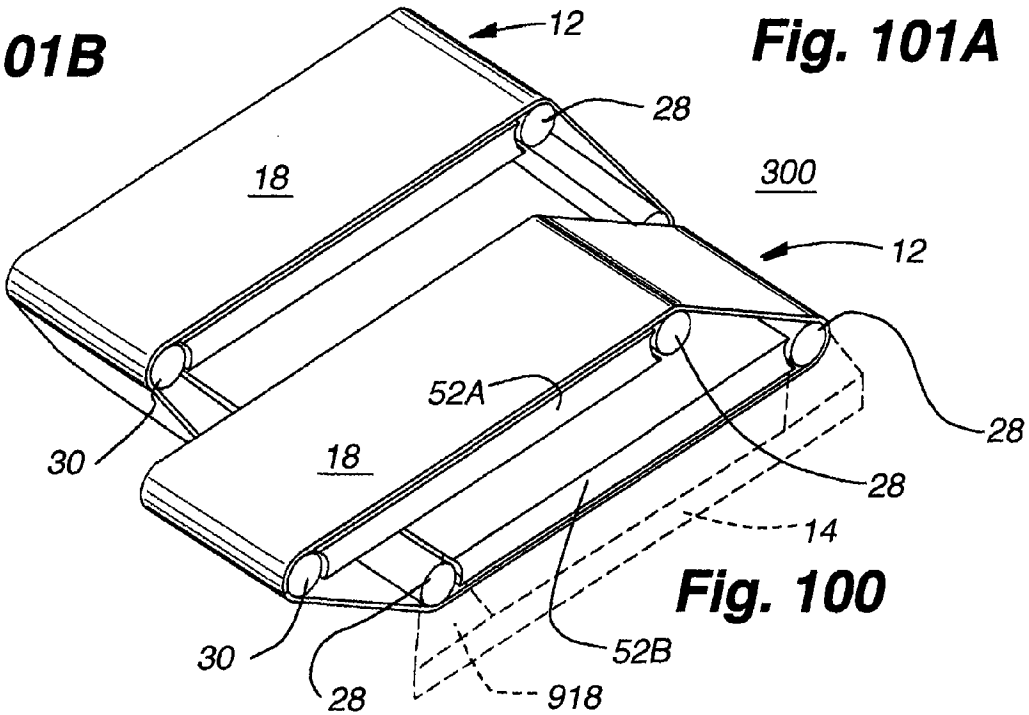

FIG. 100 is an isometric view of the treadle and base frame portion of the exercise machine, according to one embodiment of the invention, wherein the treadles have a trapezoidal configuration when viewed from the side, the lower rear roller and the front rear rollers are fixed relative to the base frame, and the treadle may collapse such that the upper treadle frame may move downward and rearward while remaining generally parallel to the lower treadle frame.

Figure 101A:
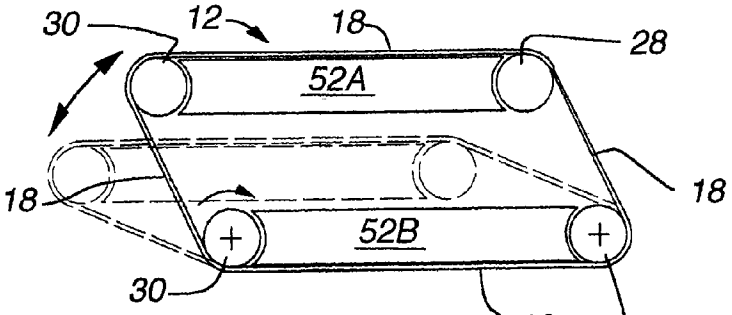

FIG. 101A is a right side view of the treadle illustrated in FIG. 93 and indicates the treadle collapsing.

Figure 101B:
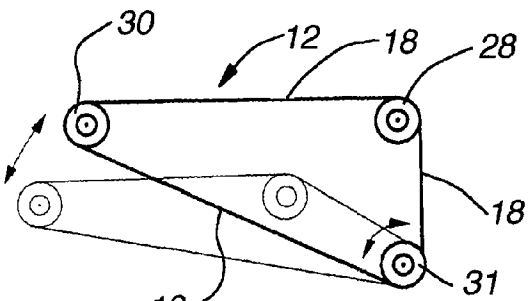

FIG. 101B is a right side view of the treadle illustrated in FIG. 91B and indicates the treadle collapsing.

Figure 102:
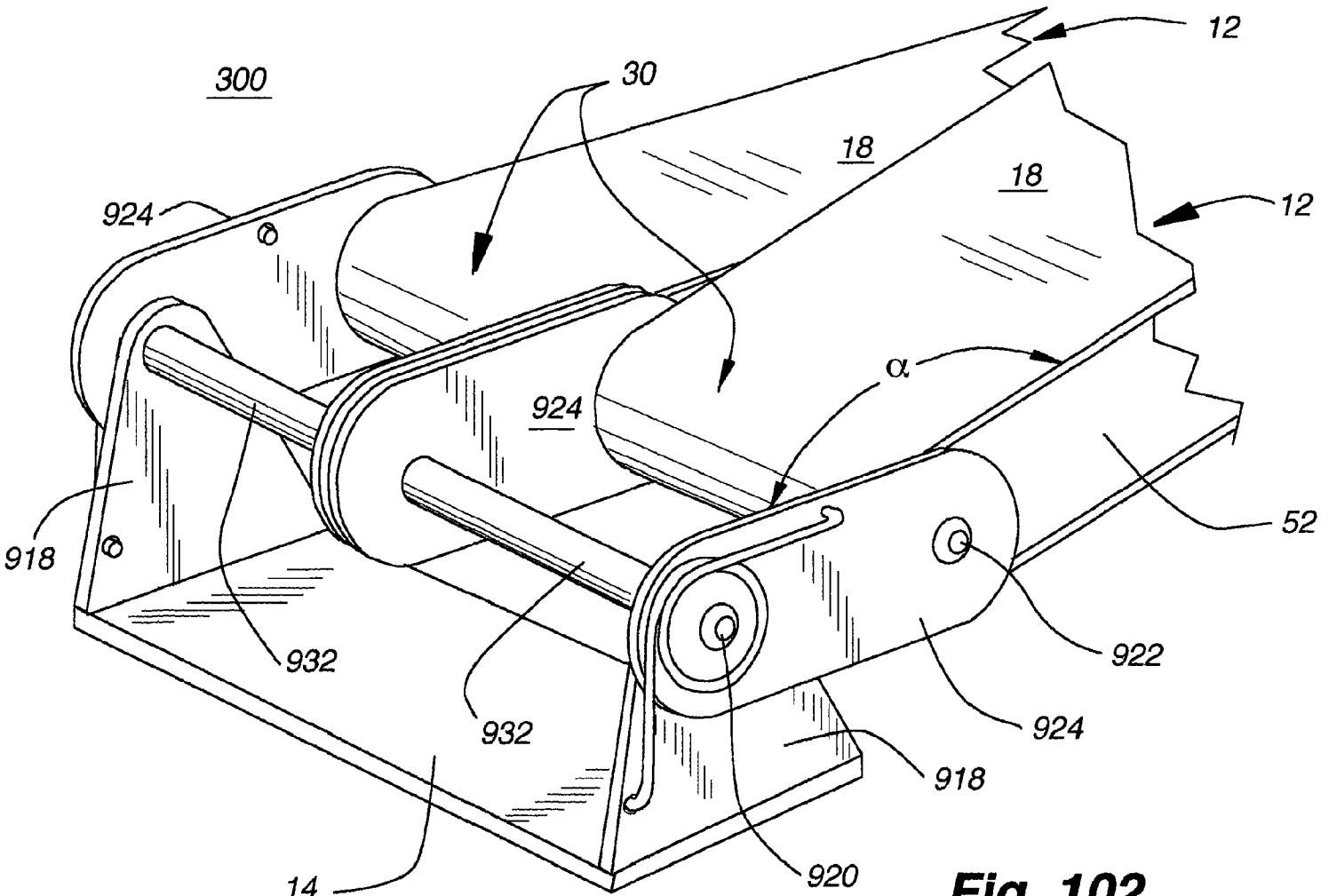

FIG. 102 is an isometric view of the treadle and base frame portion of the exercise machine, according to one embodiment of the invention, wherein the treadles are coupled to the base frame via pivot link members.

Figure 103:
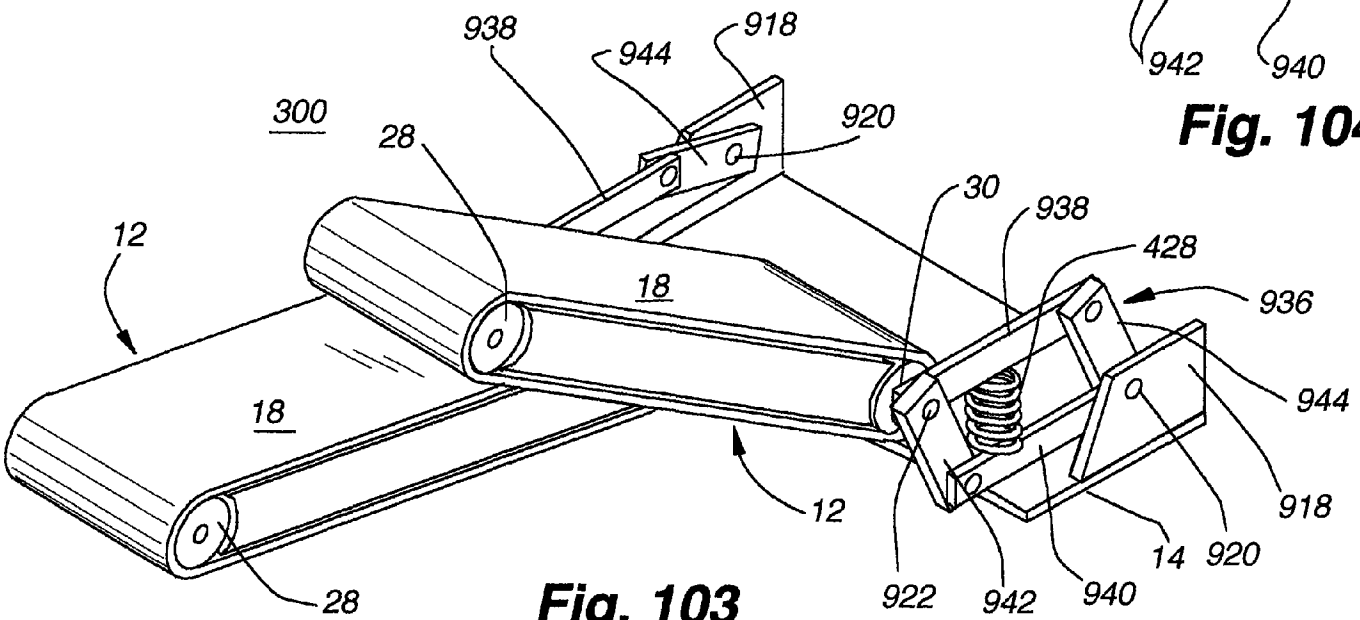

FIG. 103 is an isometric view of the treadle and base frame portion of the exercise machine, according to one embodiment of the invention, wherein the treadles are coupled to the base frame of the exercise machine via four bar linkages.

Figure 104:
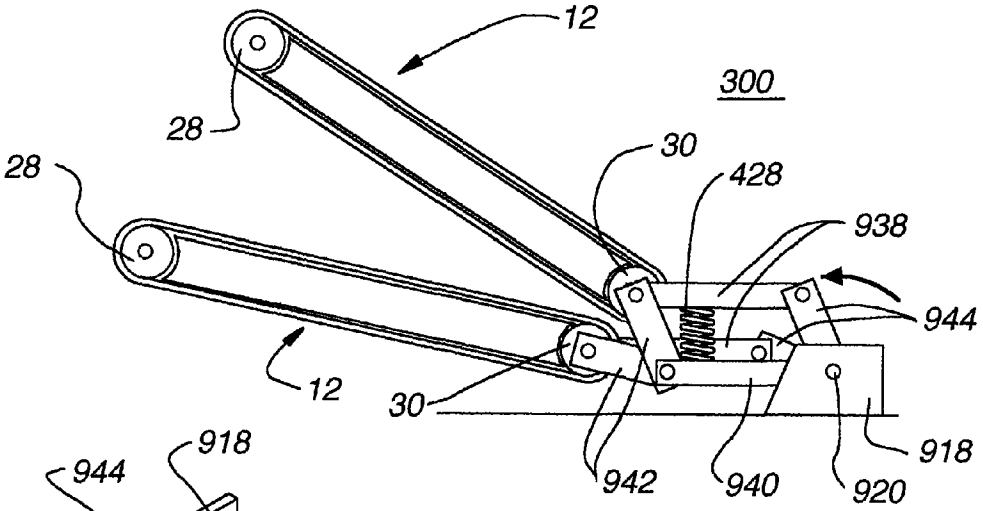

FIG. 104 is a left side elevation of the treadle and base frame portion of the exercise machine illustrated in FIG. 103.

Figure 105:
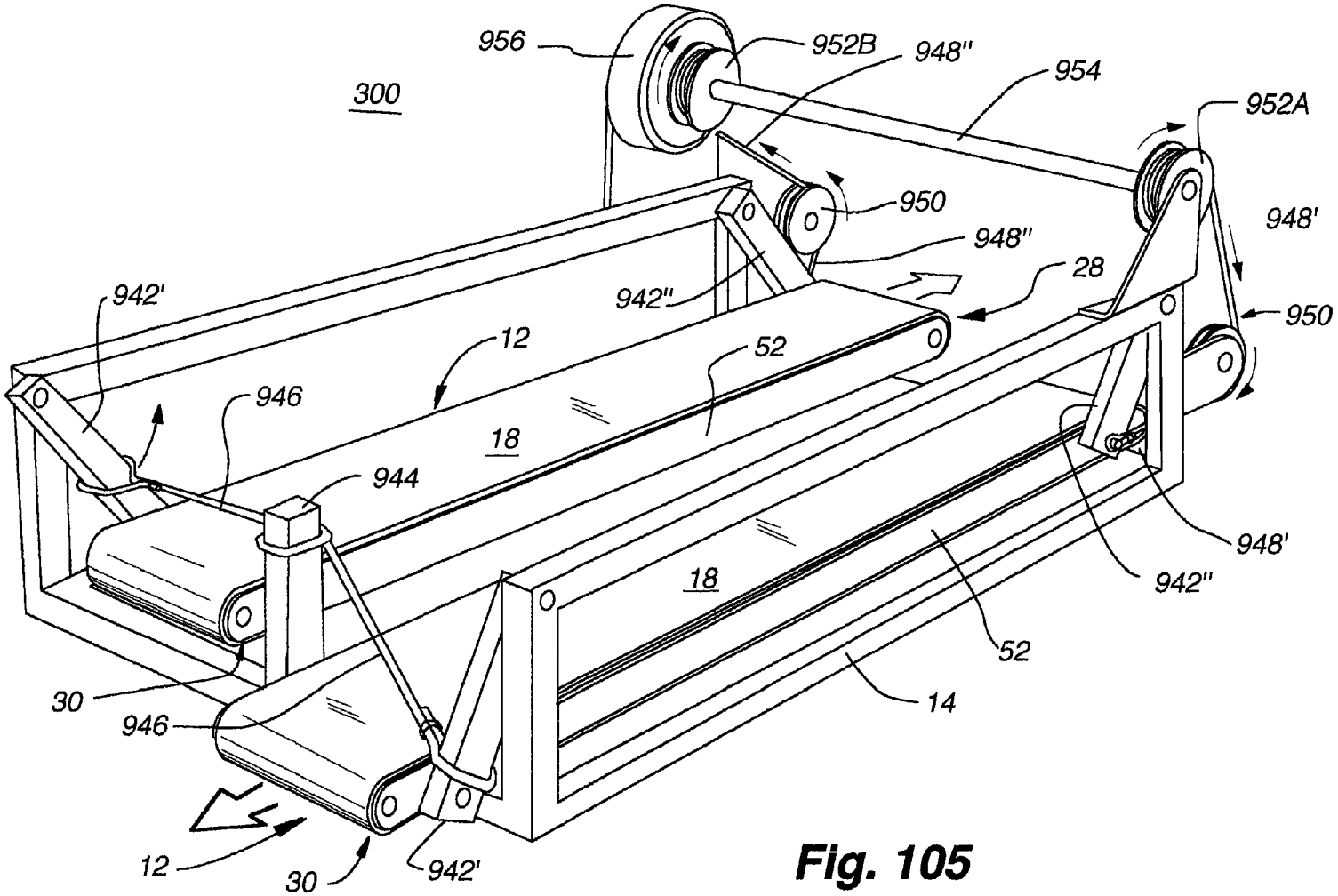

FIG. 105 is an isometric view of the treadle and base frame portion of the exercise machine, according to one embodiment of the invention, wherein each treadle is supported by two swing arms and a cabling system is used to interconnect the left and right treadles and to effect their movement opposite to one another during use of the exercise device.

Figure 106:
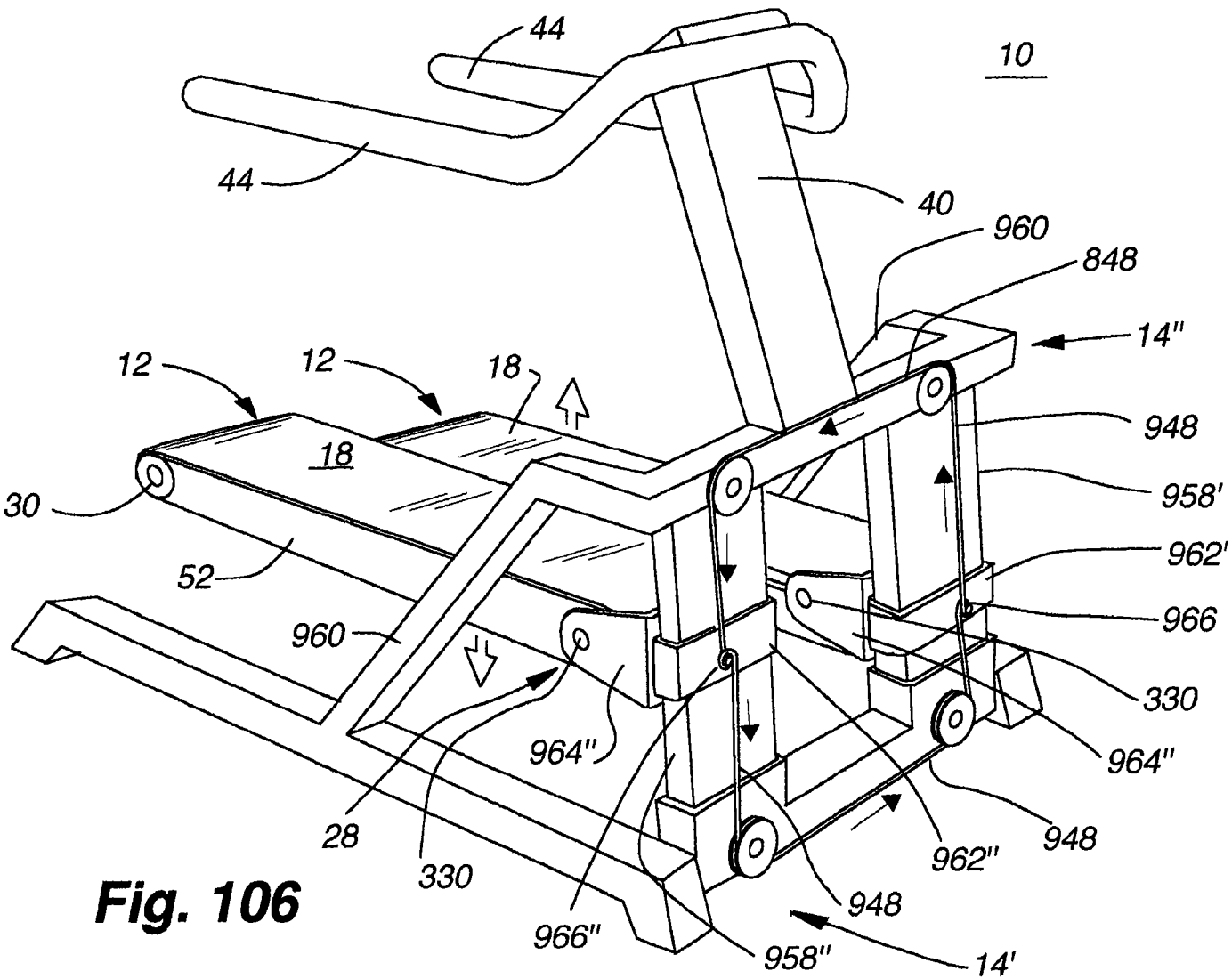

FIG. 106 is an isometric view of the exercise machine, according to one embodiment of the invention, wherein the exercise machine has a pulley and cable system that provides for opposing motion of the left and right treadles relative to one another.

Figure 107:
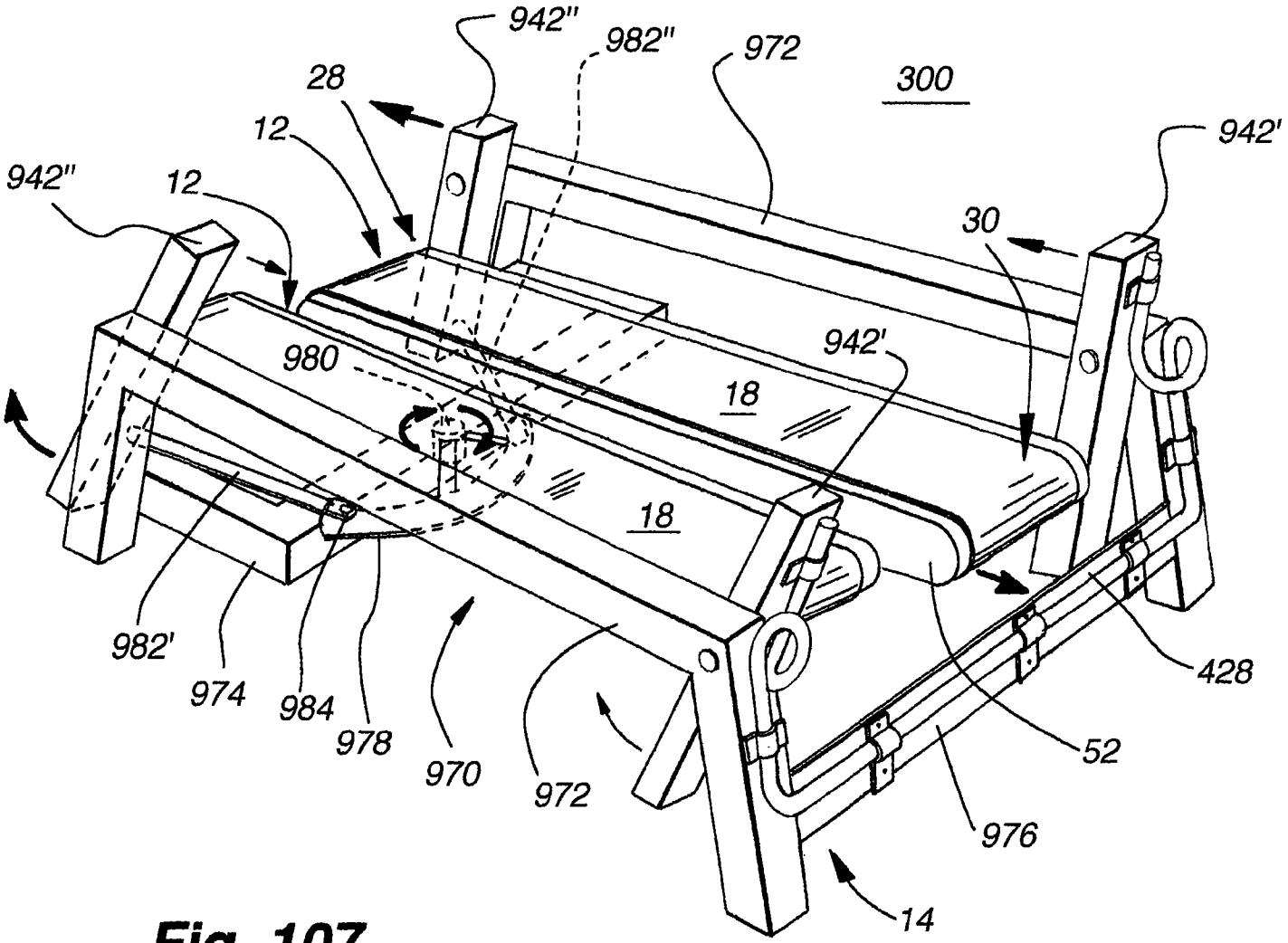

FIG. 107 is an isometric view of the treadle and base frame portion of the exercise machine, according to one embodiment of the invention, wherein the exercise machine has a rocker arm system that provides for opposing motion of the left and right treadles relative to one another.

Figure 108:
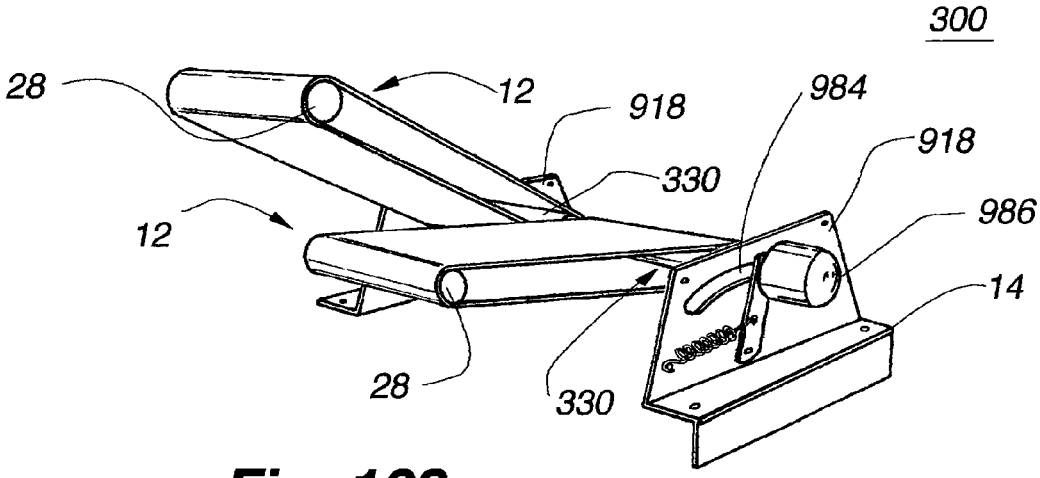

FIG. 108 is an isometric view of the treadle and base frame portion of the exercise machine, according to one embodiment of the invention, wherein the exercise machine has a slotted flange structure for adjusting the position of a treadle with respect to the base frame.

Figure 109:
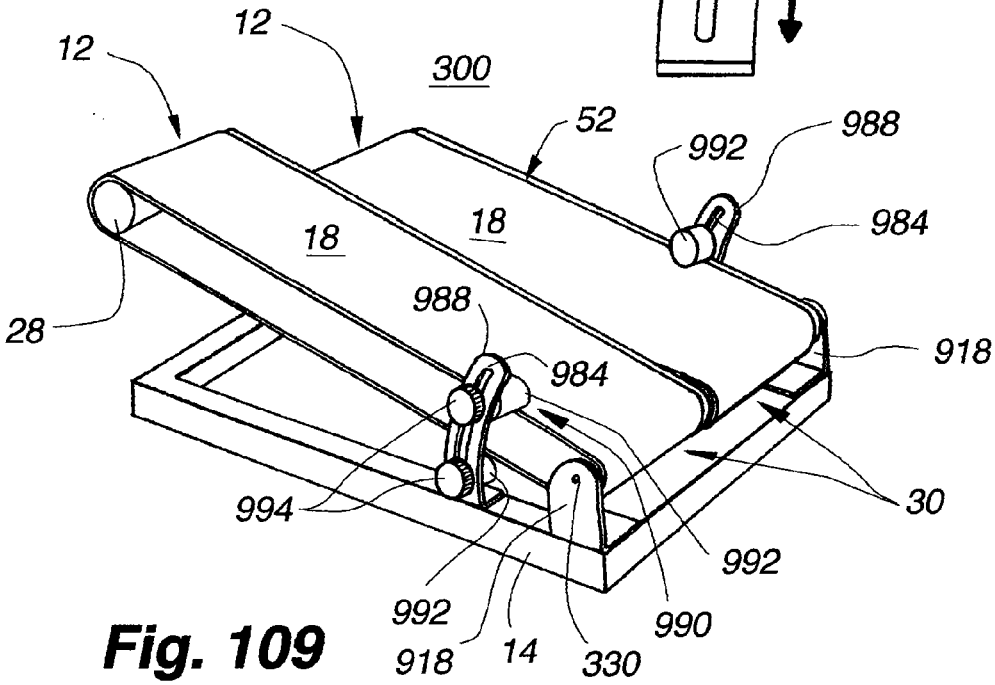

FIG. 109 is an isometric view of the treadle and base frame portion of the exercise machine, according to one embodiment of the invention, wherein a slotted flange structure and a pair of positioning elements are used to adjust the slope of a treadle with respect to the base frame and to limit the angular displacement of the treadle about a pivot point.

Figure 110:
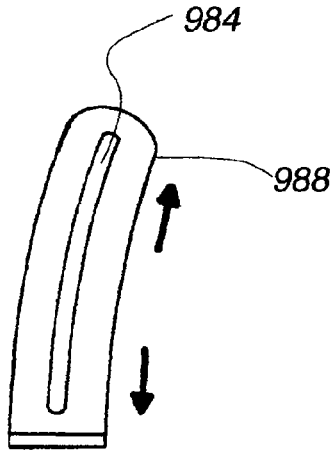

FIG. 110 is a side elevation of the slotted flange structure depicted in FIG. 109.

Figure 111:
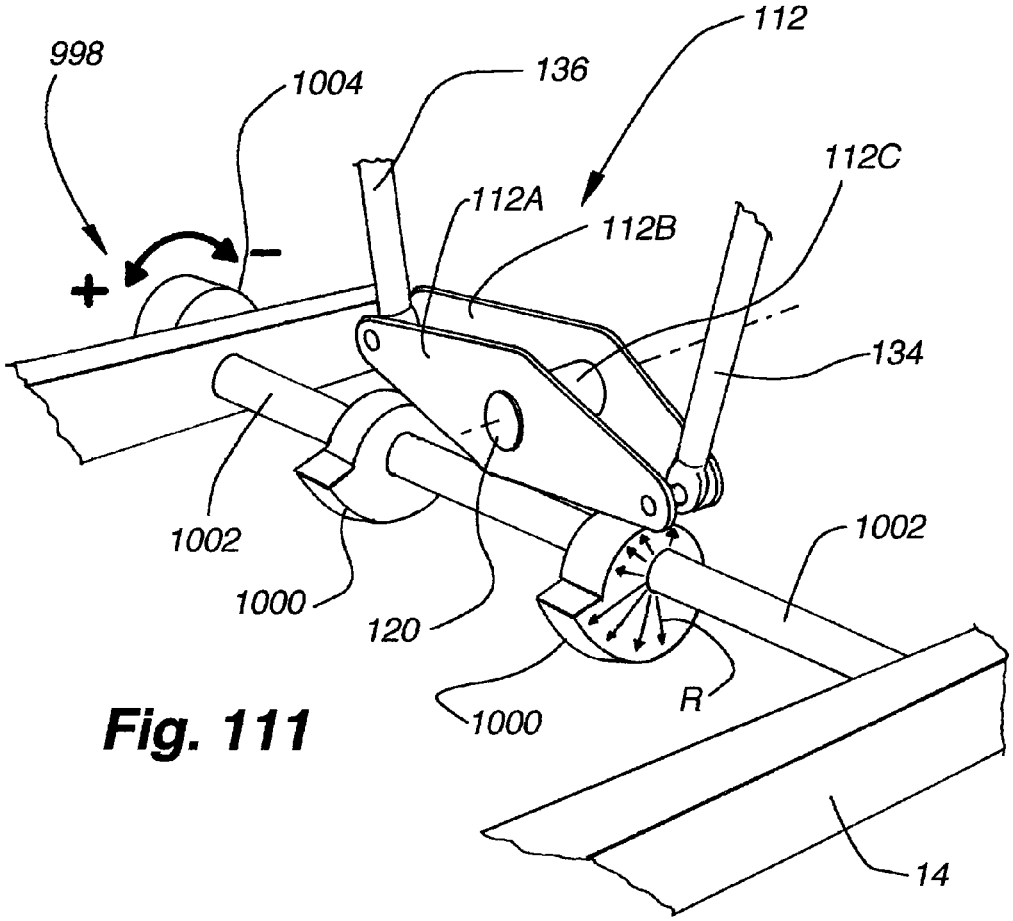

FIG. 111 is an isometric view of a portion of an exercise machine including a pair of cam surfaces for controlling the movement of a rocker arm, according to one embodiment of the invention.

Figure 112:
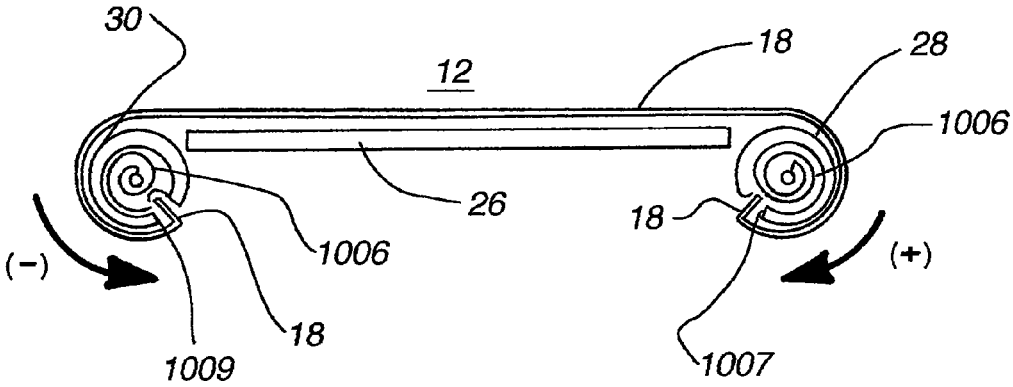

FIG. 112 is a side elevation of the front and rear rollers and the tread belt of an exercise machine employing a non-continuous tread belt, according to one embodiment of the invention.

Figure 113:
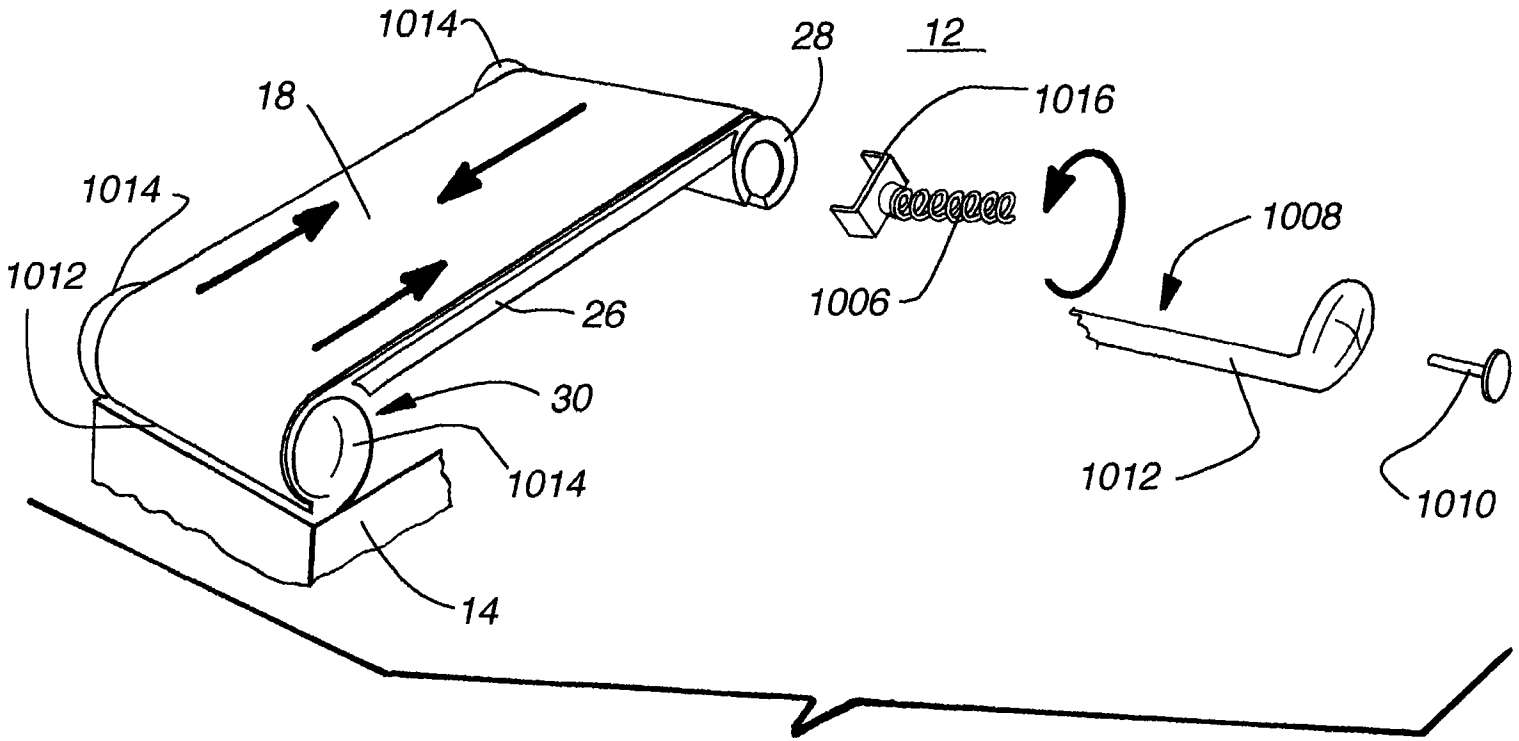

FIG. 113 is a partially exploded isometric view of the tread belt and rollers illustrated in FIG. 112, according to one embodiment.

Figure 114:
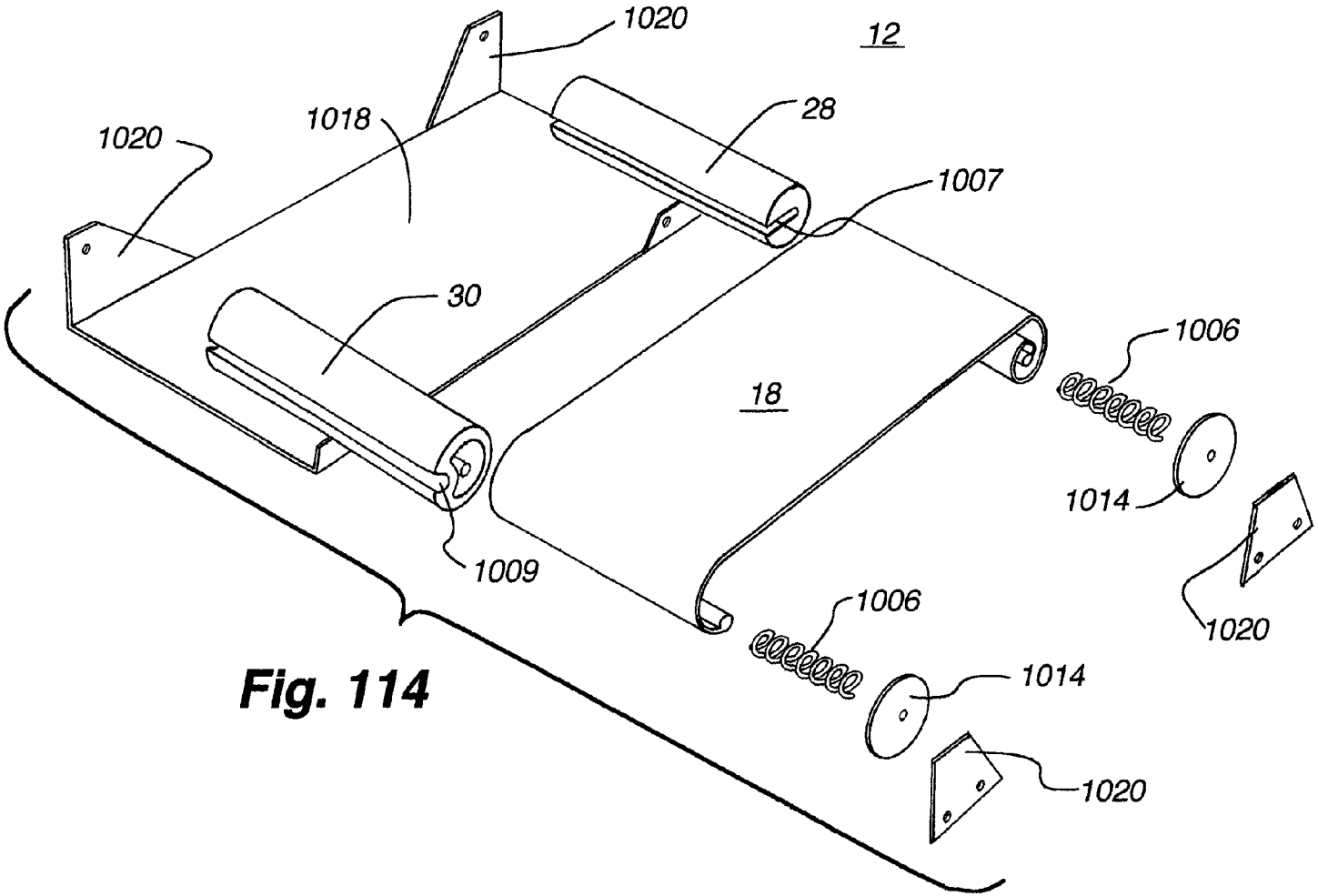

FIG. 114 is a fully exploded isometric view of the tread belt and rollers illustrated in FIG. 112, according to another embodiment.

Figure 115:
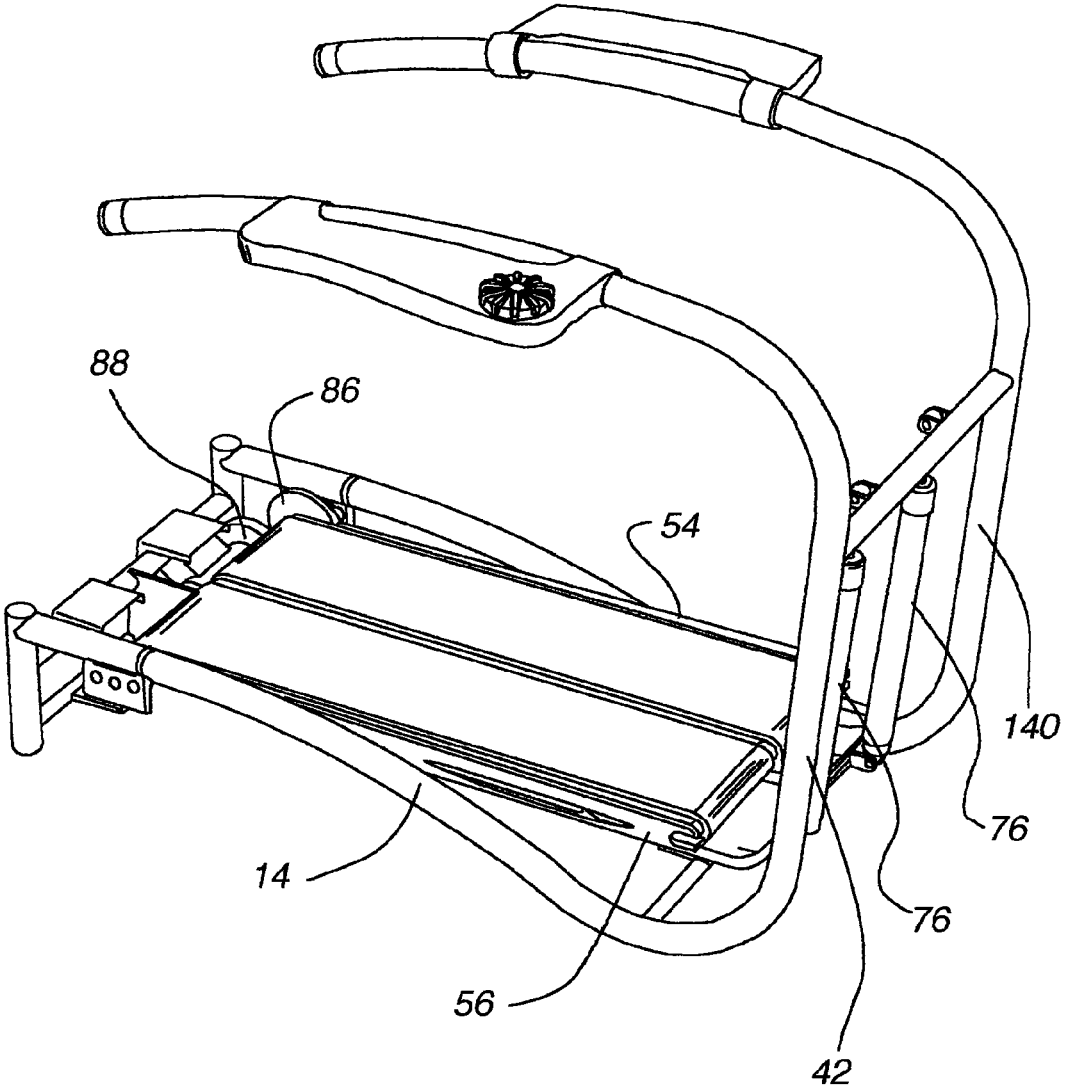

FIG. 115 is an isometric view of an exercise device conforming to aspects of the present invention, the exercise device having tubular frame members and a resistance element, such as a shock, coupled between a frame member extending transversely between the front of treadle side members and a tubular bar extending between the upright.

DETAILED DESCRIPTION

An exercise device 10 conforming to the present invention may be configured to provide a user with a walking-type exercise, a stepping-type exercise or a climbing-like exercise that is a combination of both walking and stepping. The exercise device generally includes two treadmill-like assemblies 12 (referred to herein as a "treadle" or a "treadle assembly") pivotally connected with a frame 14 so that the treadles may pivot up and down about a common axis 16. Each treadle includes a tread belt 18 that provides a moving surface like a treadmill. In use, a user will walk, jog, or run on the treadles and the treadles will reciprocate about the common axis. The treadles are interconnected so that upward movement of one treadle is accompanied by downward movement of the other treadle. The combination of the moving surface of the tread belts and the coordinated and interconnected reciprocation of the treadles provides an exercise that is similar to climbing on a loose surface, such as walking, jogging, or running up a sand dune where each upward and forward foot movement is accompanied by the foot slipping backward and downward. Extraordinary cardiovascular and other health benefits are achieved by such a climbing-like exercise. Moreover, as will be recognized from the following discussion, the extraordinary health benefits are achieved in a low impact manner.

Figure 1:
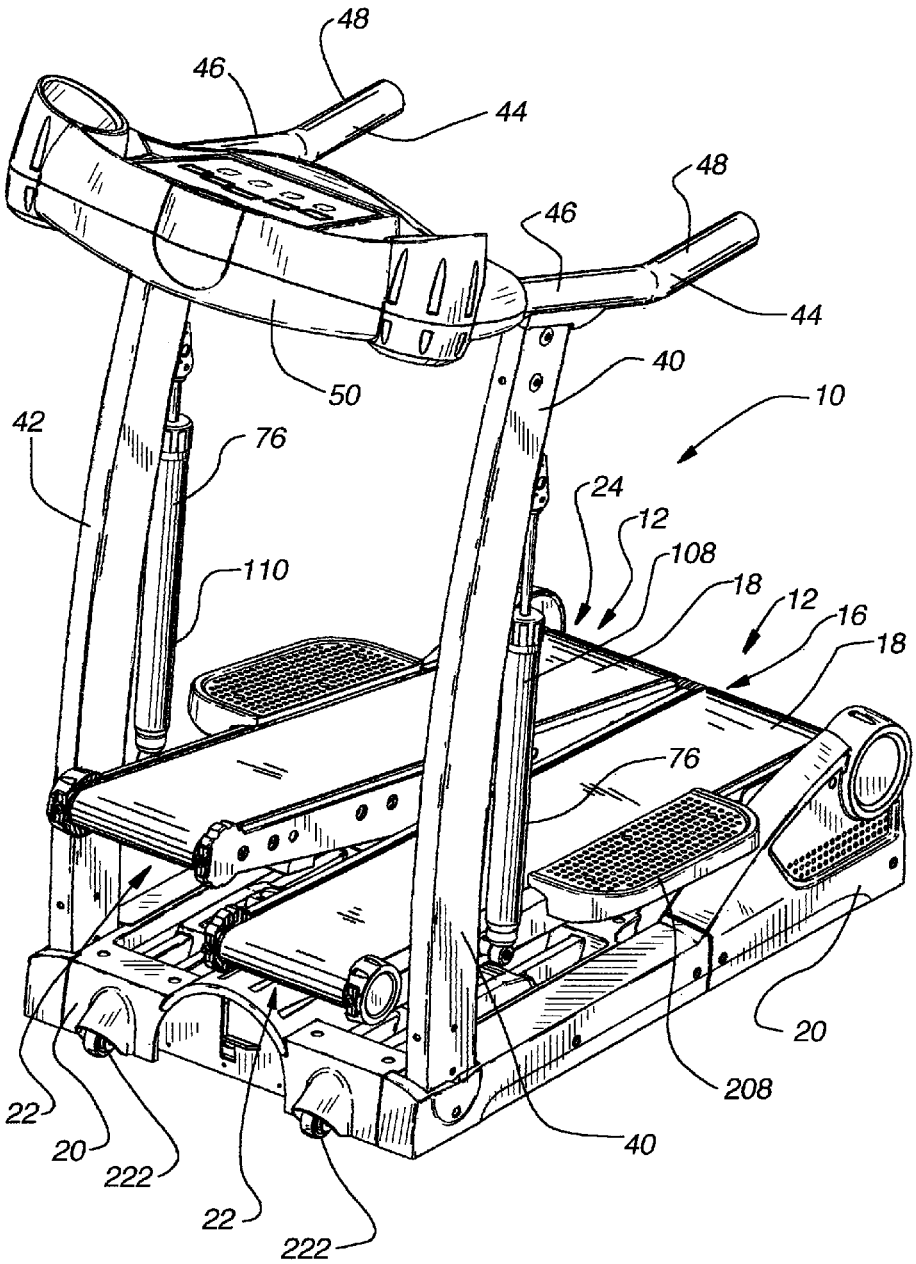
FIG. 1 is an isometric view of one embodiment of an exercise device, in accordance with the present invention.
Figure 2:
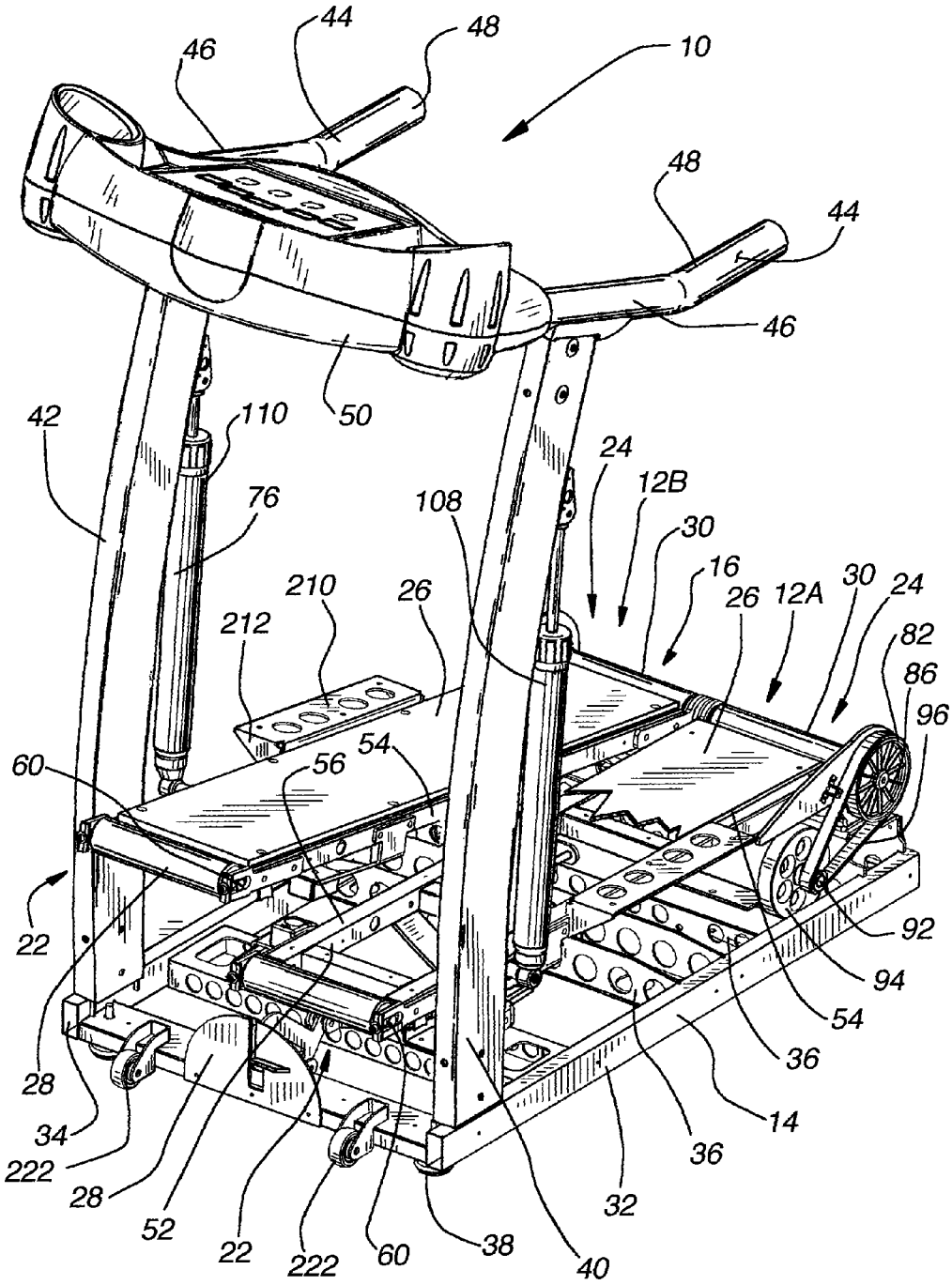
FIG. 2 is an isometric view of the exercise device shown in FIG. 1 with decorative and protective side panels removed to better illustrate various components of the exercise.

FIG. 1 is an isometric view of one example of an exercise device conforming to the present invention. The embodiment of the exercise device illustrated in FIG. 1 includes protective and decorative panels 20, which in some instances obscure the view of some components of the exercise device. FIG. 2 is an isometric view the exercise device illustrated in FIG. 1 with the protective and decorative panels removed to better illustrate all of the components of the device. The other views of the exercise device shown in FIGS. 3-8, and others, in most instances, do not include the protective and decorative panels.

Referring to FIGS. 1, 2 and others, the exercise device includes a first treadle assembly 12A and a second treadle assembly 12B, each having a front portion 22 and a rear portion 24. The rear portions of the treadle assemblies 12 are pivotally supported at the rear of the exercise device 10. The front portions 22 of the treadle assemblies are supported above the frame 14, and are configured to reciprocate in a generally up and down manner during use. It is also possible to pivotally support the treadles at the front of the exercise device, and support the rear of the treadle assemblies above the frame. The treadle assemblies also supports an endless belt or "tread belt" that rotates over a deck 26 and about front 28 and rear 30 rollers to provide either a forward or rearward moving surface.

A user may perform exercise on the device facing toward the front of the treadle assemblies (referred to herein as "forward facing use") or may perform exercise on the device facing toward the rear of the treadle assemblies (referred to herein as "rearward facing use"). The term "front," "rear," and "right" are used herein with the perspective of a user standing on the device in the forward facing manner the device will be typically used. During any method of use, the user may walk, jog, run, and/or step on the exercise device in a manner where each of the user's feet contact one of the treadle assemblies. For example, in forward facing use, the user's left foot will typically only contact the left treadle assembly 12A and the user's right foot will typically only contact the right treadle assembly 12B. Alternatively, in rearward facing use, the user's left foot will typically only contact the right treadle assembly 12B and the user's right foot will typically only contact the left treadle assembly 12A.

An exercise device conforming to aspects of the invention may be configured to only provide a striding motion or to only provide a stepping motion. For a striding motion, the treadle assemblies are configured to not reciprocate and the endless belts 18 configured to rotate. The term "striding motion" is meant to refer to any typical human striding motion such as walking, jogging and running. For a stepping motion, the treadle assemblies are configured to reciprocate and the endless belts are configured to not rotate about the rollers. The term "stepping motion" is meant to refer to any typical stepping motion, such as when a human walks up stairs, uses a conventional stepper exercise device, walks up a hill, etc.

As mentioned above, the rear 24 of each treadle assembly is pivotally supported at the rear of the exercise device. The front of each treadle assembly is supported above the front portion of the exercise device so that the treadle assemblies may pivot upward and downward. When the user steps on a tread belt 18, the associated treadle assembly 12A, 12B (including the belt) will pivot downwardly. As will be described in greater detail below, the treadle assemblies 12 are interconnected such that downward or upward movement of one treadle assembly will cause a respective upward or downward movement of the other treadle assembly. Thus, when the user steps on one belt 18, the associated treadle assembly will pivot downwardly while the other treadle assembly will pivot upwardly. With the treadle assemblies configured to move up and down and the tread belts configured to provide a moving striding surface, the user may achieve an exercise movement that encompasses a combination of walking and stepping.

FIG. 2 is a partial cutaway isometric view of the embodiment of the exercise device 10 shown in FIG. 1. With regard to the left and right treadle assemblies, the tread belt is removed to show the underlying belt platform or "Deck" 26 and the front roller 28 and the rear roller 30. In addition, the belt platform of the left treadle is partially cut away to show the underlying treadle frame components. Referring to FIG. 2 and others, the exercise device includes the underlying main frame 14. The frame provides the general structural support for the moving components and other components of the exercise device. The frame includes a left side member 32, a right side member 34 and a plurality of cross members 36 interconnecting the left side and right side members to provide a unitary base structure. The frame may be set directly on the floor or a may be supported on adjustable legs, cushions, bumpers, or combinations thereof. In the implementation of FIG. 2, adjustable legs 38 are provided at the bottom front left and front right corners of the frame.

Figure 5:
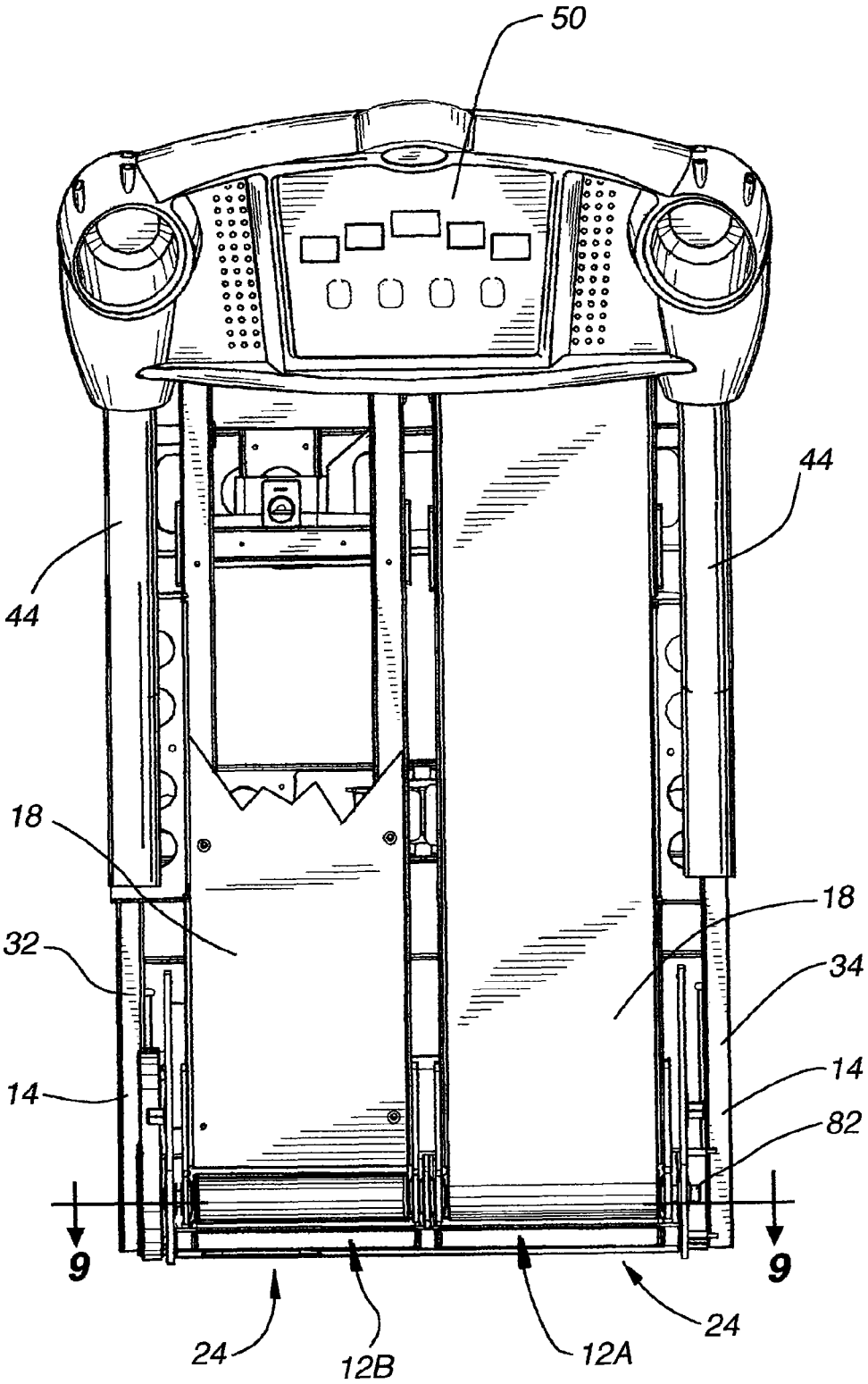
FIG. 5 is top view of the exercise device shown in FIG. 2.
Figure 7:
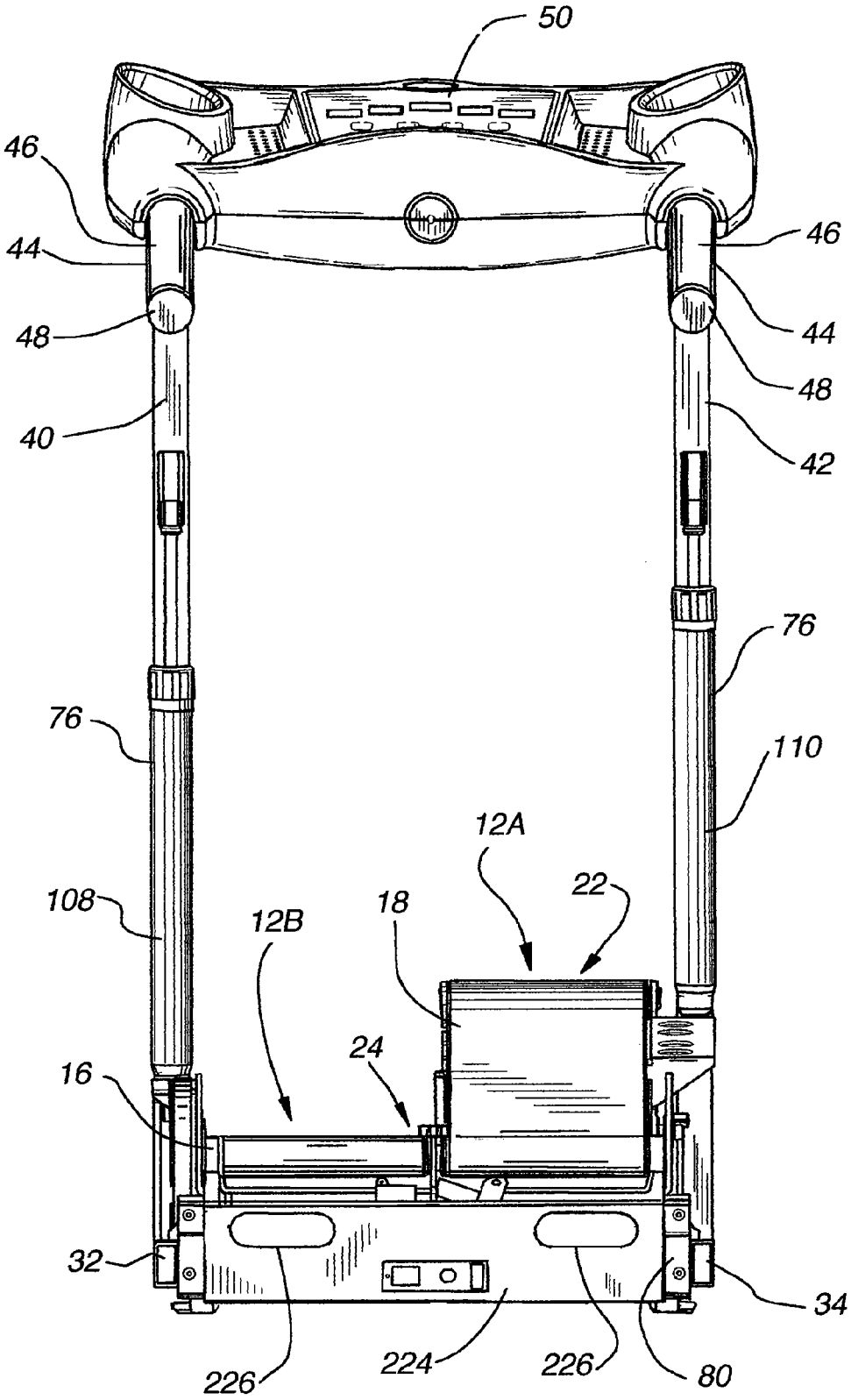
FIG. 7 is a rear view of the exercise device shown in FIG. 2.
Figure 8:
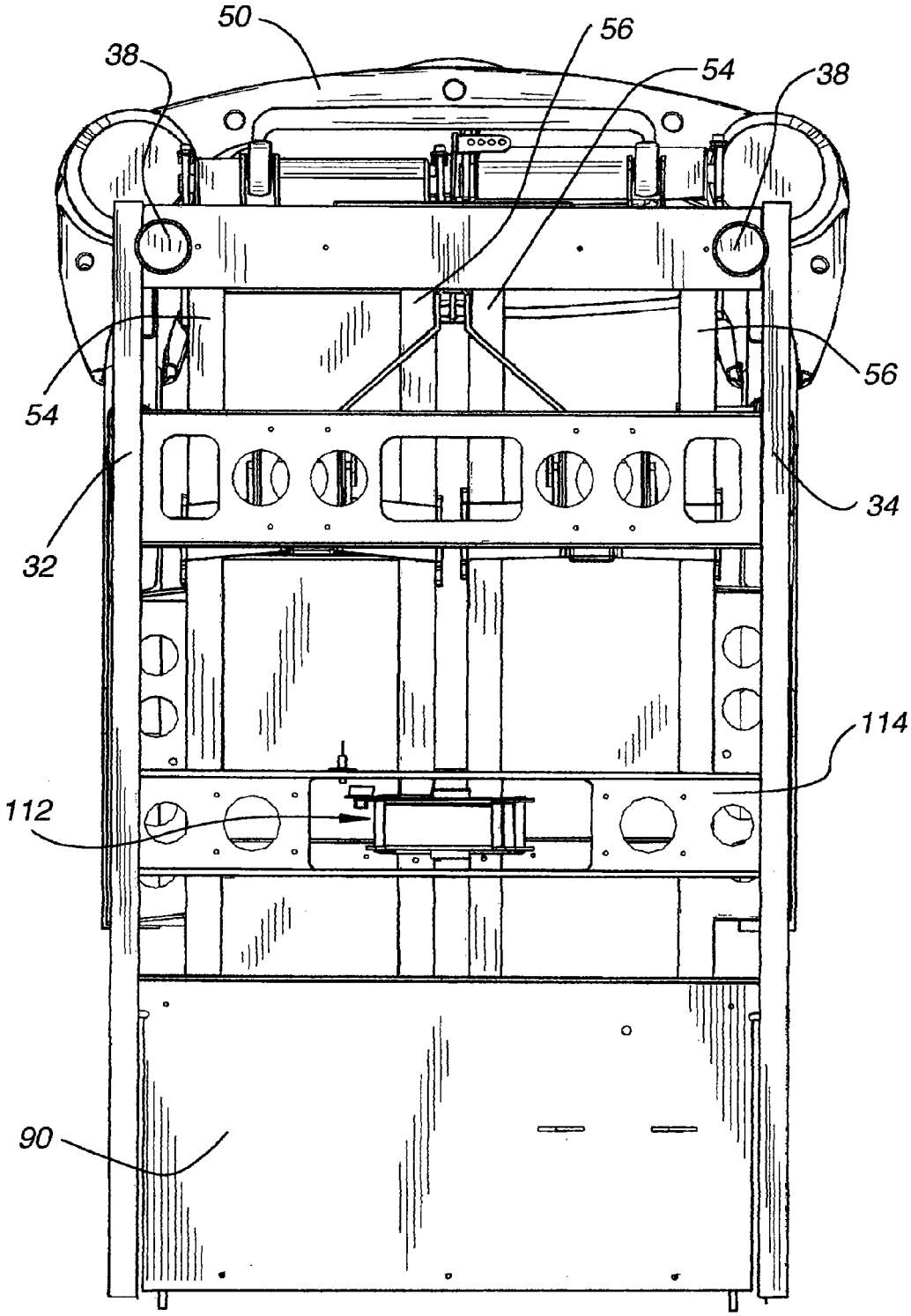
FIG. 8 is a bottom view of the exercise device shown in FIG. 2.

A left upright 40 is connected with the forward end region of the left side member 32. A right upright 42 is connected with the forward end region of the right side member 34. The uprights extend generally upwardly from the frame, with a slight rearward sweep. Handles 44 extend transversely to the top of each upright in a generally T-shaped orientation with the upright. The top of the T is the handle and the downwardly extending portion of the T is the upright. The handles are arranged generally in the same plane as the respective underlying side members 32, 34. The handles define a first section 46 connected with the uprights, and a second rearwardly section 48 extending angularly oriented with respect to the first section. The handle is adapted for the user to grasp during use of the exercise device. A console 50 is supported between the first sections of the handles. The console includes one or more cup holders, an exercise display, and one or more depressions adapted to hold keys, a cell phone, or other personal items. The console is best shown in FIGS. 5 and 7.

Figure 3A:
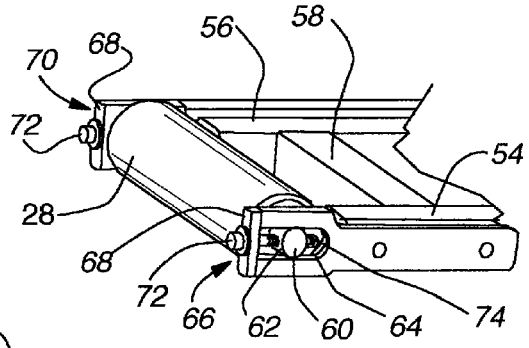
FIG. 3 is a left side view of the exercise device shown in FIG. 2.
Figure 3:
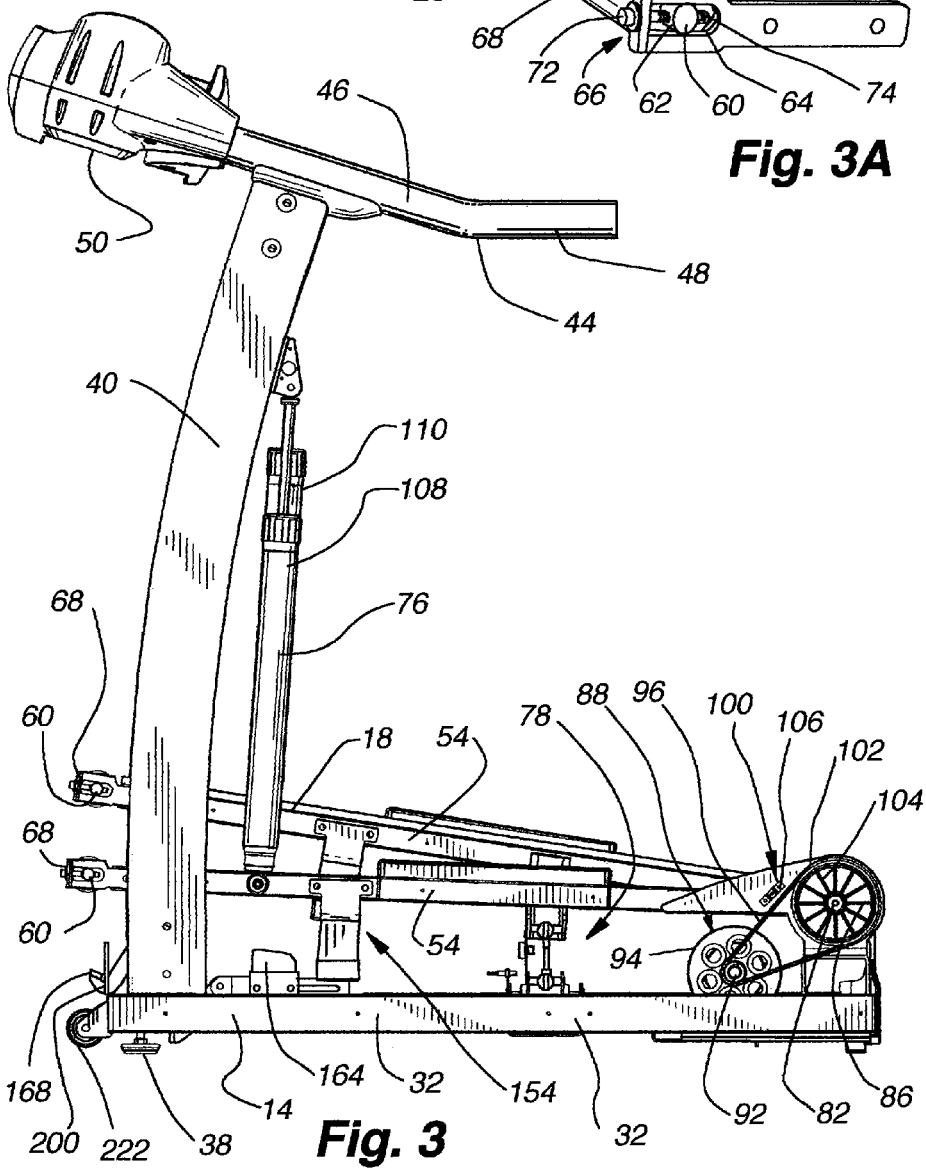
Figure 4:
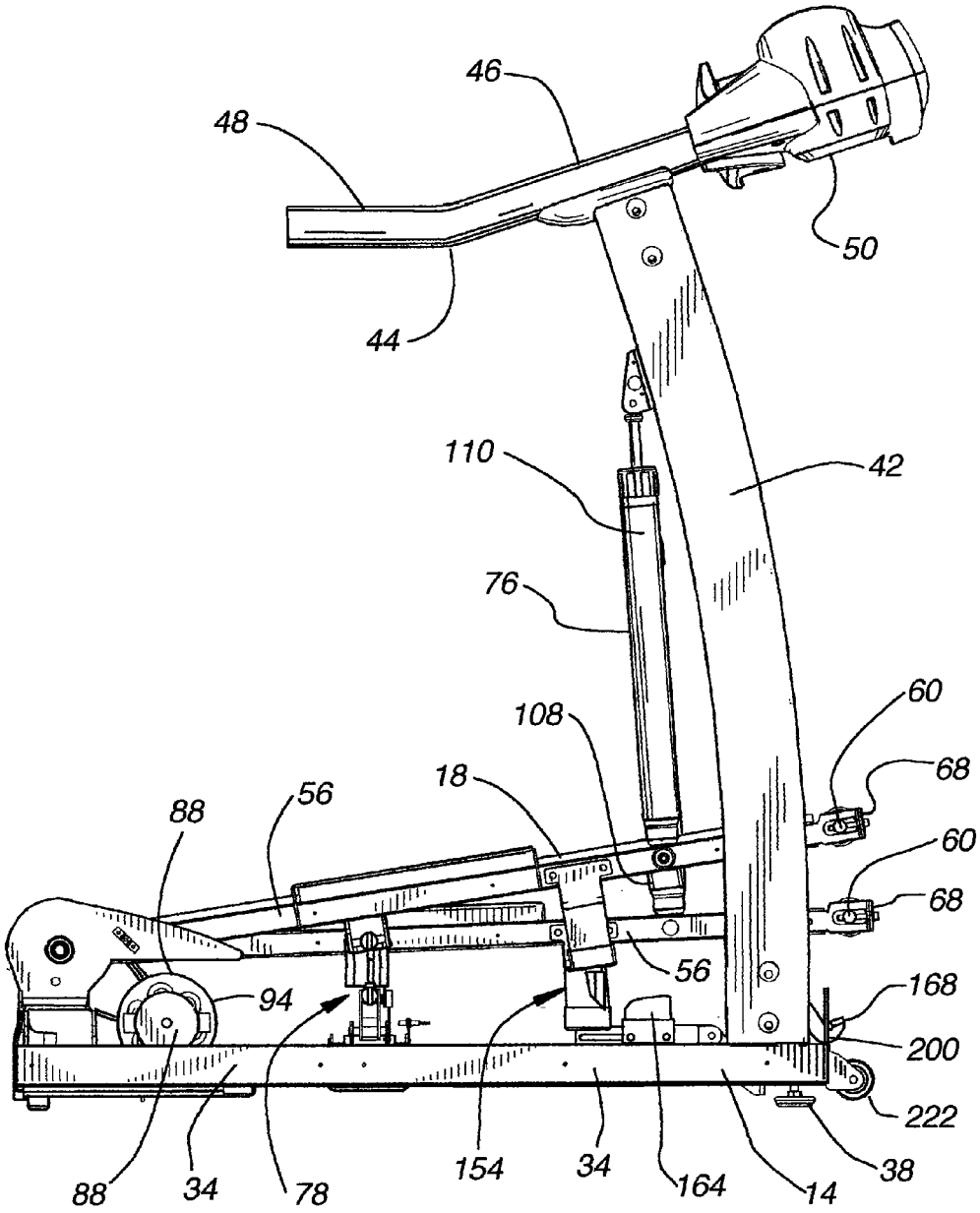
FIG. 4 is a right side view of the exercise device shown in FIG. 2.
Figure 6:
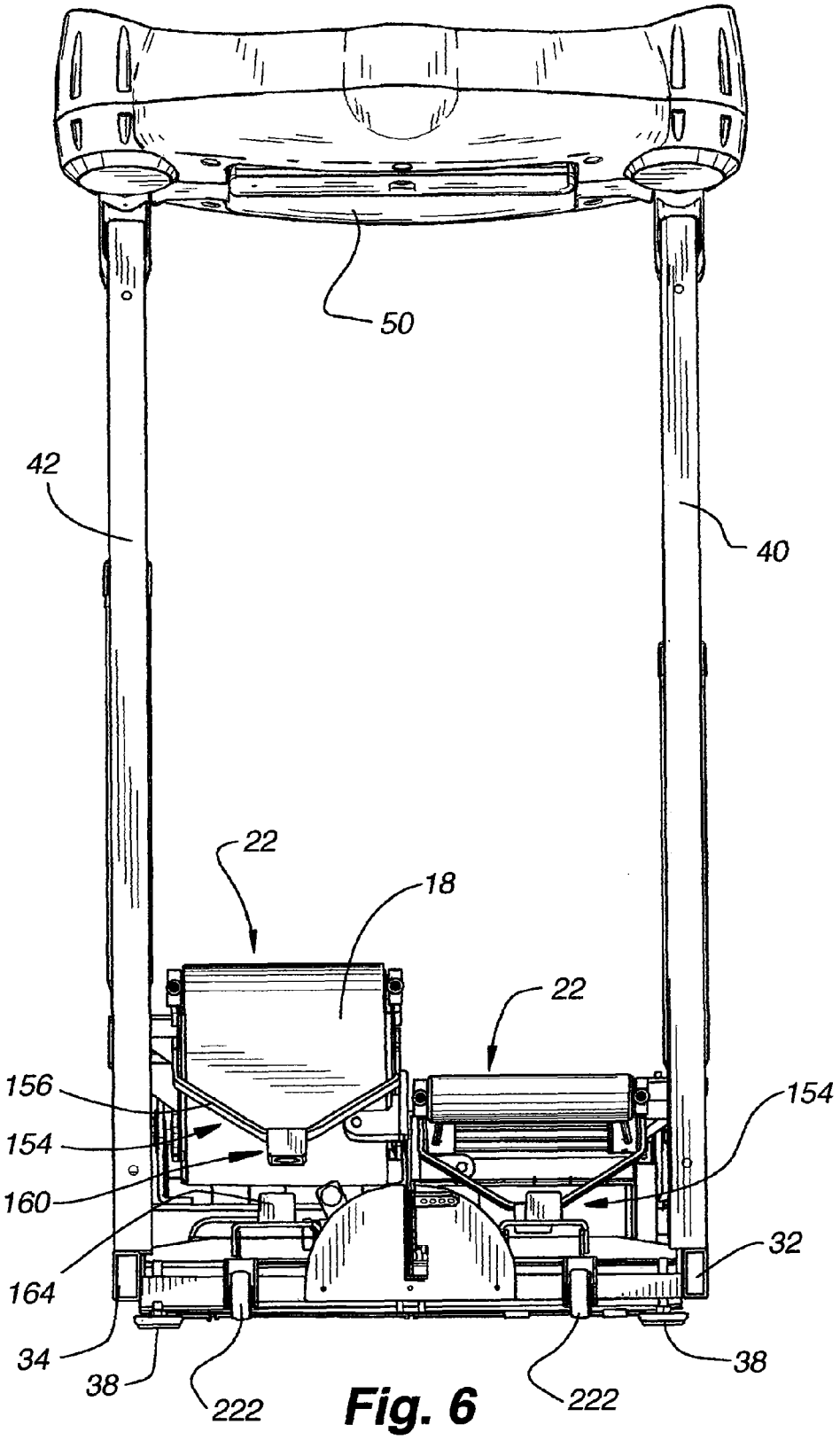
FIG. 6 is a front view of the exercise device shown in FIG. 2.

FIG. 3 is a left side view and FIG. 4 is right side view of the exercise device 10 shown in FIG. 2. FIG. 5 is a top view and FIG. 6 is a front view of the embodiment of the exercise device shown in FIG. 2. Referring to FIGS. 2-6, and others, each treadle assembly includes a treadle frame 52 having a left member 54, a right member 56, and a plurality of treadle cross members 58 extending between the left and right members. The front rollers 28 are rotatably supported at the front of each treadle frame and the rear rollers 30 are pivotally supported at the rear of each treadle frame. To adjust the tread belt tension and tracking, the front or rear rollers may be adjustably connected with the treadle frame. In one particular implementation as best shown in FIGS. 3 and 4, each front roller is adjustably connected with the front of each respective treadle frame. The front roller includes an axle 60 extending outwardly from both ends of the roller. The outwardly extending ends of the axle each define a threaded aperture, 62 and are supported in a channel 64 defined in the forward end of the left 54 and right 56 treadle frame side members. The channel defines a forwardly opening end 66. A plate 68 defining a threaded aperture is secured to the front end of the left and right members so that the centerline of the aperture 70 is in alignment with the forward opening end 66 of the channel 64. A bolt is threaded into the threaded aperture and in engagement with the corresponding threaded aperture in the end of the roller axle 60 supported in the channel. Alternatively, a spring is located between the closed rear portion of the channel and the pivot axle to bias the pivot axle forwardly. By adjusting one or both of the bolts at the ends of the axle, the corresponding end of the axle may be moved forwardly or rearwardly in the channel to adjust the position of the front roller. Adjustment of the front roller can loosen or tighten the tread belt or change the tread belt travel.

The belt decks 26 are located on the top of each treadle frame 52. The deck may be bolted to the treadle frame, may be secured to the frame in combination with a deck cushioning or deck suspension system, or may be loosely mounted on the treadle frame. Each belt deck is located between the respective front 28 and rear 30 rollers of each treadle assembly 12A, 12B. The belt decks are dimensioned to provide a landing platform for most or all of the upper run of the tread belts 18.

Figure 9:
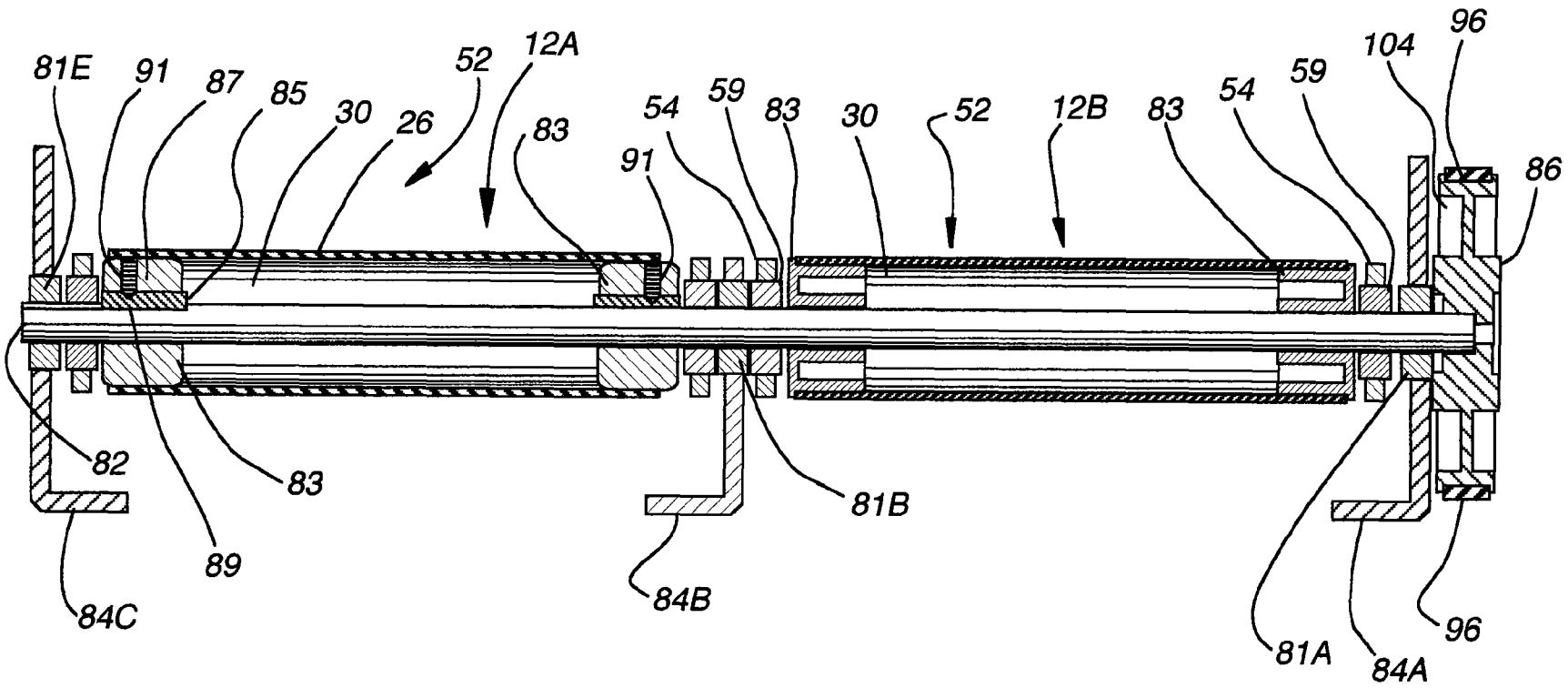
FIG. 9 is a section view taken along line 9-9 of FIG. 5.

The rear of each treadle assembly is pivotally supported at the rear of the frame, and the front of each treadle assembly is supported above the frame by one or more dampening elements 76, an interconnection member 78, or a combination thereof, so that each treadle assembly 12 may pivot up and down with respect to the lower frame. FIG. 7 is a rear view of the embodiment of the exercise device shown in FIG. 2. FIG. 9 is a section view of the rear roller assembly taken along line 9-9 of FIG. 5. Referring to FIGS. 5, 7, 9 and others, each treadle assembly is pivotally supported above a rear cross member 80 of the main frame 14. In one particular implementation, a drive shaft 82 is rotatably supported above the rear cross member by a left 84A, middle 84B, and right 84C drive bracket. The drive shaft rotatably supports each rear roller. Thus, the left and right rear rollers are rotatably supported about a common drive axis 82, which is also the common rear pivot axis of the treadles 12.

A pulley 86 is secured to a portion of the drive shaft 82. As shown in FIGS. 2, 3, 9 and others, in one particular implementation, the drive pulley 86 is secured to the left end region of the drive shaft. However, the drive pulley may be secured to the right end region, or somewhere along the length of the drive shaft between the left and right end regions. A motor 88 is secured to a bottom plate 90 (best shown in the bottom view of FIG. 8) that extends between the right 56 and left 54 side members. A motor shaft 92 extends outwardly from the left side of the motor. The motor is mounted so that the motor shaft is generally parallel to the drive shaft 82. A flywheel 94 is secured to the outwardly extending end region of the motor shaft. A drive belt 96 is connected between the drive shaft pulley and a motor pulley 98 connected with the motor shaft. Accordingly, the motor is arranged to cause rotation of the drive shaft and both rear rollers 30.

A belt speed sensor 100 is operably associated with the tread belt 18 to monitor the speed of the tread belt. In one particular implementation the belt speed sensor is implemented with a reed switch 102 including a magnet 104 and a pick-up 106. The reed switch is operably associated with the drive pulley to produce a belt speed signal. The magnet is imbedded in or connected with the drive pulley 86, and the pick-up is connected with the main frame 14 in an orientation to produce an output pulse each time the magnet rotates past the pick-up.

Both the left and right rear rollers 30 are secured to the drive shaft 82. Thus, rotation of the drive shaft causes the left and right rear rollers and also the associated endless belts 18 to rotate at, or nearly at, the same pace. It is also possible to provide independent drive shafts for each roller that would be powered by separate motors, with a common motor control. In such an instance, motor speed would be coordinated by the controller to cause the tread belts to rotate at or nearly at the same pace. The motor or motors may be configured or commanded through user control to drive the endless belts in a forward direction (i.e., from the left side perspective, counterclockwise about the front and rear rollers) or configured to drive the endless belts in a rearward direction (i.e., from the left side perspective, clockwise about the front and rear rollers).

During use, the tread belt 18 slides over the deck 26 with a particular kinetic friction dependant on various factors including the material of the belt and deck and the downward force on the belt. In some instances, the belt may slightly bind on the deck when the user steps on the belt and increases the kinetic friction between the belt and deck. Besides the force imparted by the motor 88 to rotate the belts, the flywheel 94 secured to the motor shaft has an angular momentum force component that helps to overcome the increased kinetic friction and help provide uniform tread belt movement. In one particular implementation, the deck is a ⅜" thick MDF with an electron beam cured paint coating. Further, the belt is a polyester weave base with a PVC top.

Certain embodiments of the present invention may include a resistance element 76 operably connected with the treadles. As used herein the term "resistance element" is meant to include any type of device, structure, member, assembly, and configuration that resists the pivotal movement of the treadles. The resistance provided by the resistance element may be constant, variable, and/or adjustable. Moreover, the resistance may be a function of load, of time, of heat, or of other factors. Such a resistance element may provide other functions, such as dampening the downward, upward, or both movement of the treadles. The resistance element may also impart a return force on the treadles such that if the treadle is in a lower position, the resistance element will impart a return force to move the treadle upward, or if the treadle is in an upper position, the resistance element will impart a return force to move the treadle downward. The term "shock" or "dampening element" is sometimes used herein to refer to a resistance element, or to a spring (return force) element, or a dampening element that may or may not include a spring (return) force.

Figure 26:
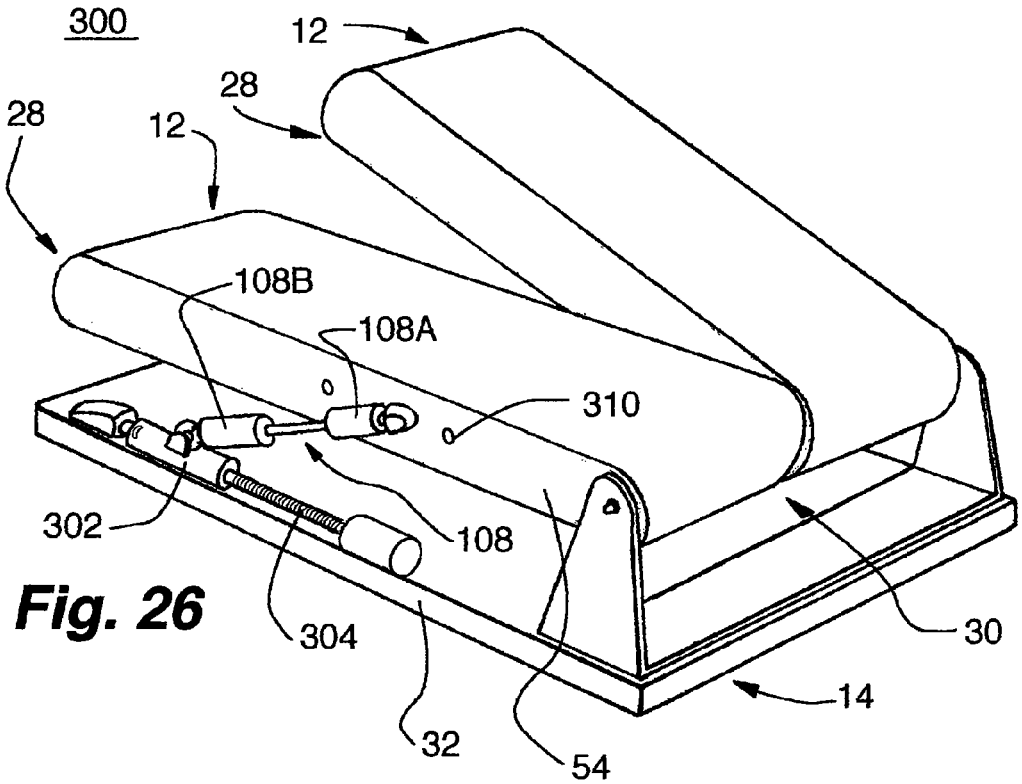
FIG. 26 is an isometric view of a base portion of an exercise device with a variable position shock according to one embodiment of the present invention.

In one particular configuration of the exercise device, a resistance element 76 extends between each treadle assembly 12 and the frame 14 to support the front of the treadle assemblies and to resist the downward movement of each treadle. The resistance element or elements may be arranged at various locations between treadle frame and the main frame. In the embodiments shown in FIGS. 1-7, and others, the resistance elements include a first 108 and a second 110 shock. The shock both resists and dampens the movement of the treadles. More particularly, the first or left shock 108 extends between the left or outer frame member 54 of the left treadle assembly and the left upright frame member 40. The second shock 110 extends between the right or outer frame member 56 of the right treadle assembly and the right upright frame member 42. FIG. 26 illustrates an alternative embodiment of the present invention wherein shocks extend between the outer frame members of each treadle assembly and a portion of the frame below the treadle assembly. In another alternative, the shocks may be connected to the front of the treadles (See FIG. 40) between the inner and outer treadle frame members.

In one particular implementation, the shock (108, 110) is a fluid-type or air-type dampening device and is not combined internally or externally with a return spring. As such, when a user's foot lands on the front of a treadle, the shock dampens and resists the downward force of the footfall to provide cushioning for the user's foot, leg and various leg joints such as the ankle and knee. In some configurations, the resistance device may also be adjusted to decrease or increase the downward stroke length of a treadle. The shock may be provided with a user adjustable dampening collar, which when rotated causes the dampening force of the shock to either increase or decrease to fit any particular user's needs. One particular shock that may be used in an exercise device conforming to the present invention is shown and described in U.S. Pat. No. 5,762,587 titled "Exercise Machine With Adjustable-Resistance, Hydraulic Cylinder," the disclosure of which is hereby incorporated by reference in its entirety.

Generally, the shock includes a cylinder filled with hydraulic fluid. A piston rod extends outwardly from the cylinder. Within the cylinder, a piston is connected with the piston rod. The piston defines at least one orifice through which hydraulic fluid may flow, and also includes a check valve. The piston subdivides the cylinder into two fluid filled chambers. During actuation of the shock, the piston either moves up or down in the cylinder. In downward movement or extension of the shock, the fluid flows through the orifice at a rate governed partially by the number of orifices and the size of the orifices. In upward movement or compression of the shock, the fluid flows through the check valve. The collar is operably connected with a plate associated with the orifice or orifices. Rotation of the collar, will expose or cover orifices for fluid flow and thus reduce or increase the dampening force of the shock. Alternatively, the dampening resistance collar is connected with a tapered plunger directed into an orifice between the hydraulic chambers of the shock. The depth of the plunger will govern, in part, the resistance of the shock. Preferably, the return spring shown in FIG. 4 of the '587 patent is removed.

Another particular shock that may be used in an exercise device conforming to the present invention is shown and described in U.S. Pat. No. 5,622,527 titled "Independent action stepper" and issued on Apr. 22, 1997, the disclosure of which is hereby incorporated by reference in its entirety. The shock may be used with the spring 252 shown in FIG. 10 of the '527 patent. The spring provides a return force that moves or returns the treadles upward after they are pressed downward. Preferably, however, the spring 252 is removed. As such, in one implementation of the present invention, the shock only provides a resistance and does not provide a return force. In an embodiment that does not employ a spring, the shock may be arranged to provide a resistance in the range of 47 KgF to 103 KgF. Alternative resistance elements are discussed in more detail below.

Figure 10:
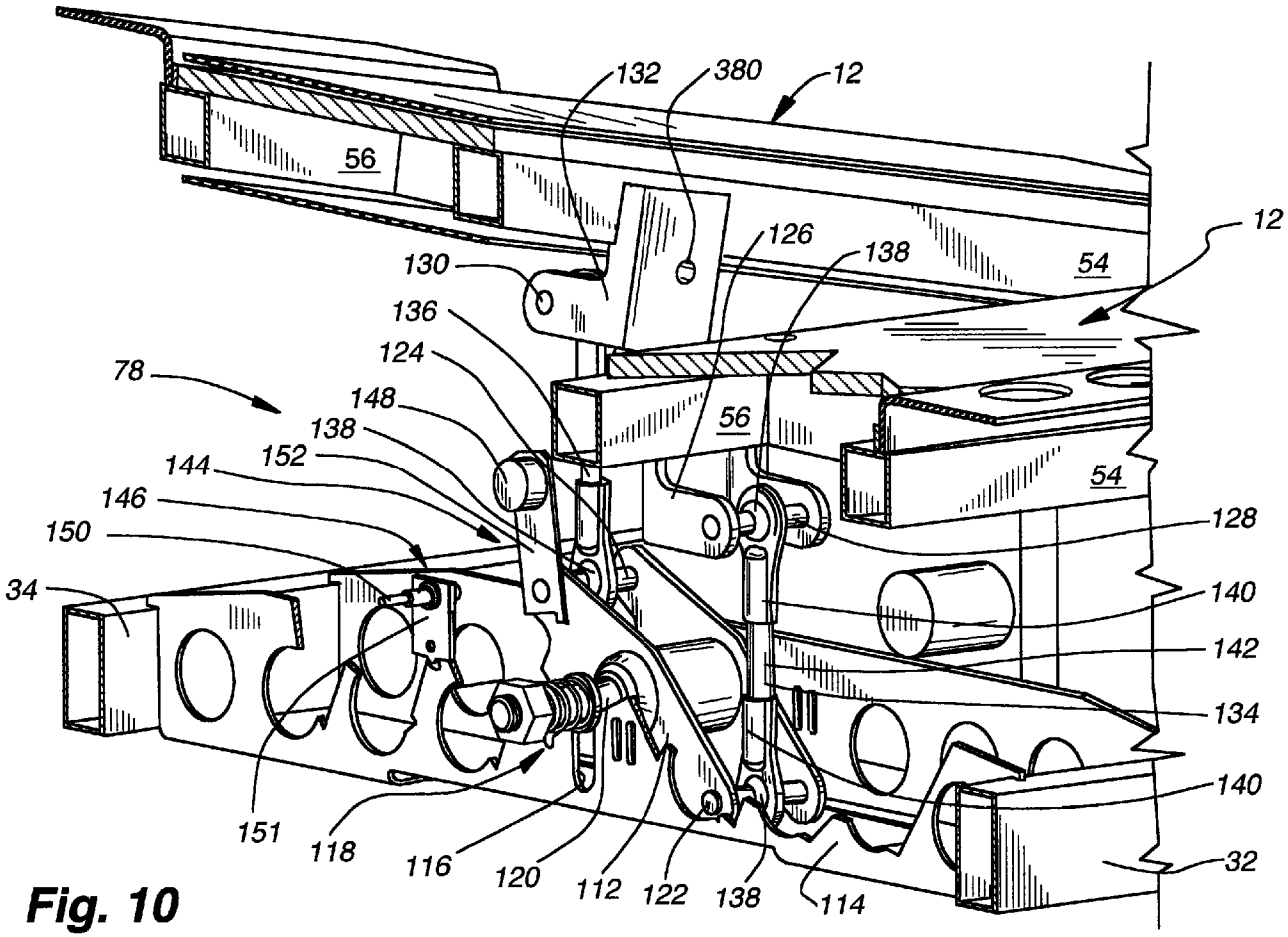
FIG. 10 is a partial cut away isometric view of the exercise device shown in FIG. 2, the view illustrating the rocker arm orientated in a position corresponding with the left treadle in about the lowest position and the right treadle in about the highest position.
Figure 11:
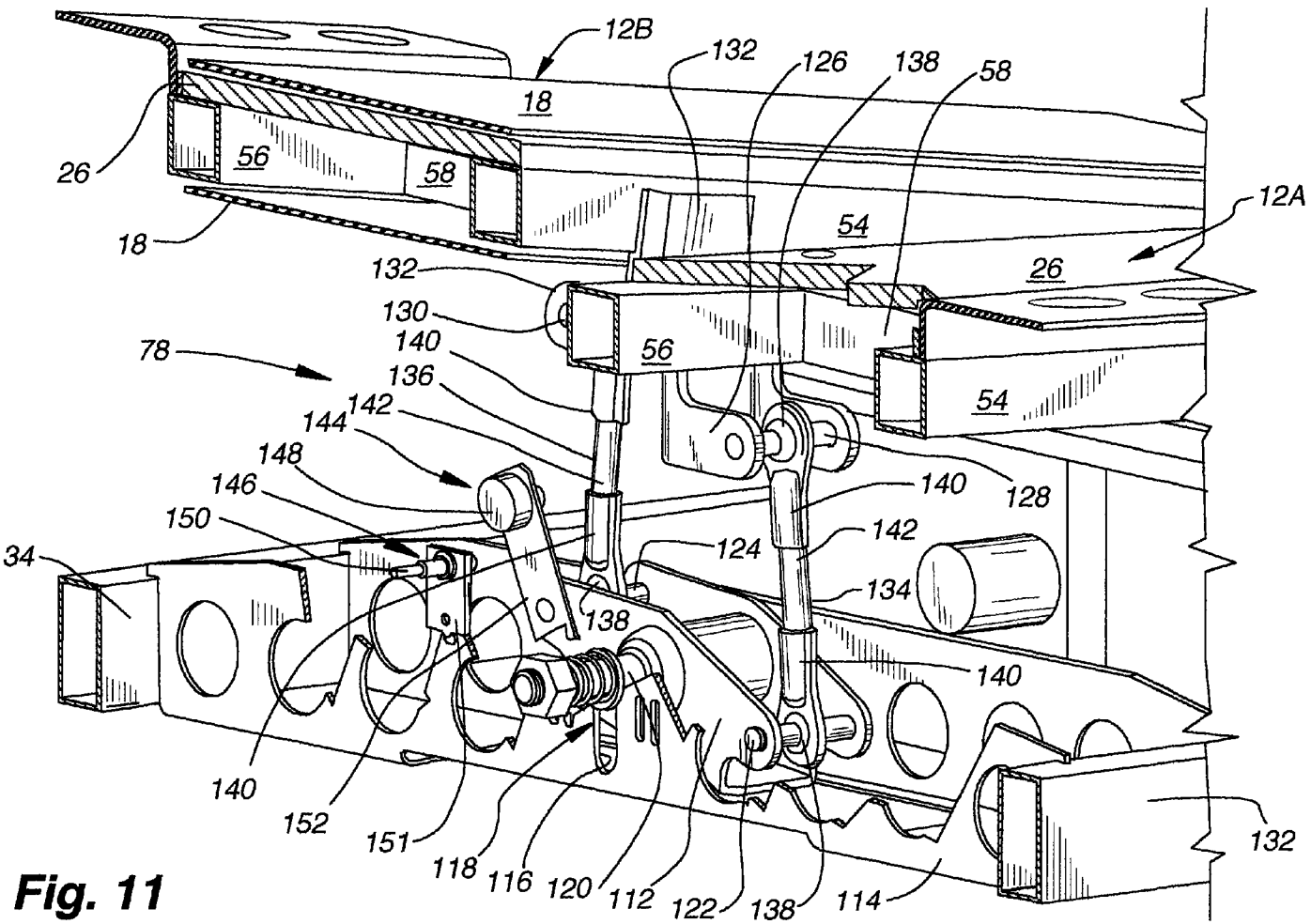
FIG. 11 is a partial cut away isometric view of the exercise device shown in FIG. 2, the view illustrating the rocker arm orientated in a position corresponding with the left treadle in a position higher than in FIG. 10 and the right treadle in a position lower than in FIG. 10.
Figure 12:
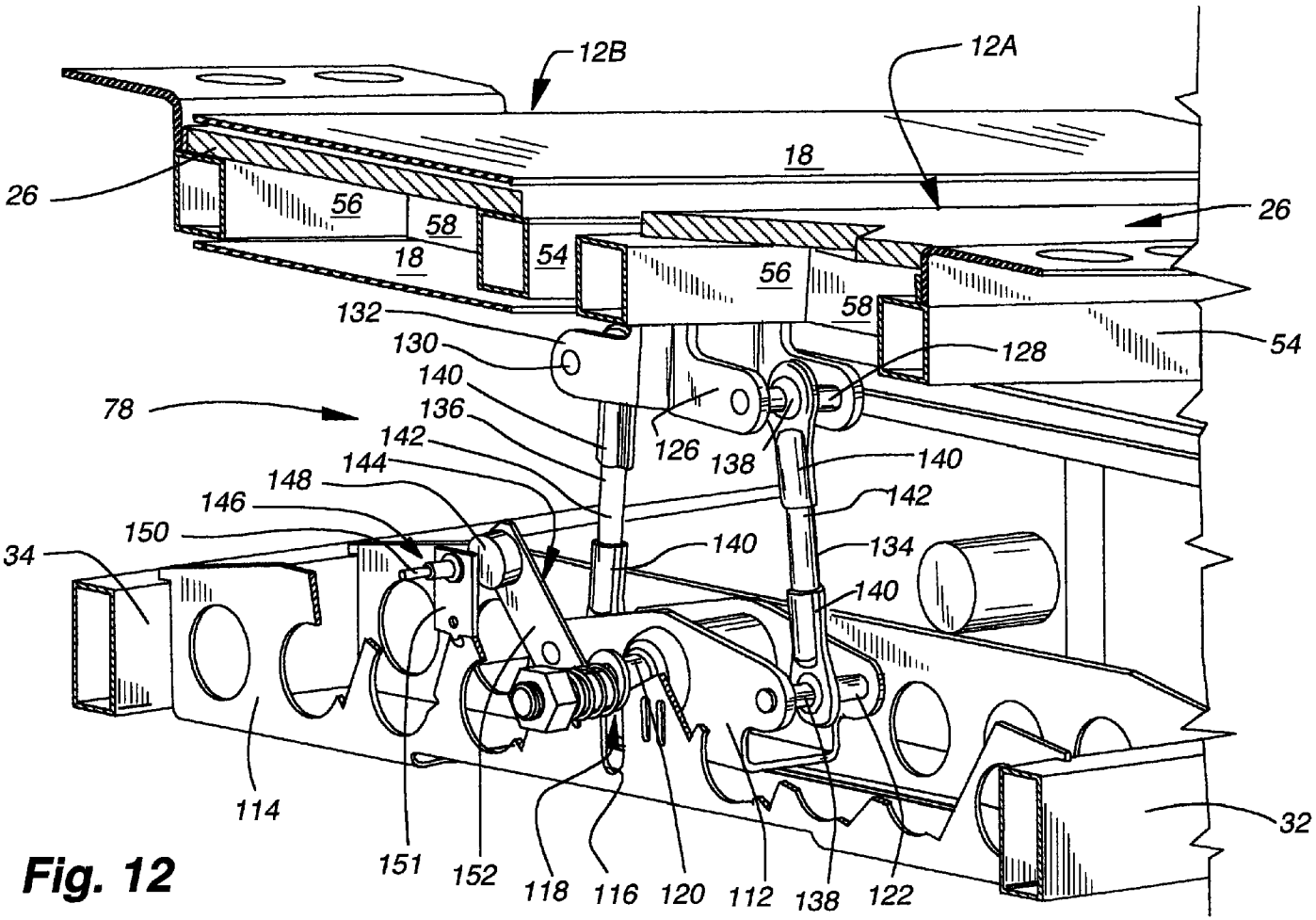
FIG. 12 is a partial cut away isometric view of the exercise device shown in FIG. 2, the view illustrating the rocker arm orientated in a position corresponding with the left treadle about level with the right treadle.
Figure 13:
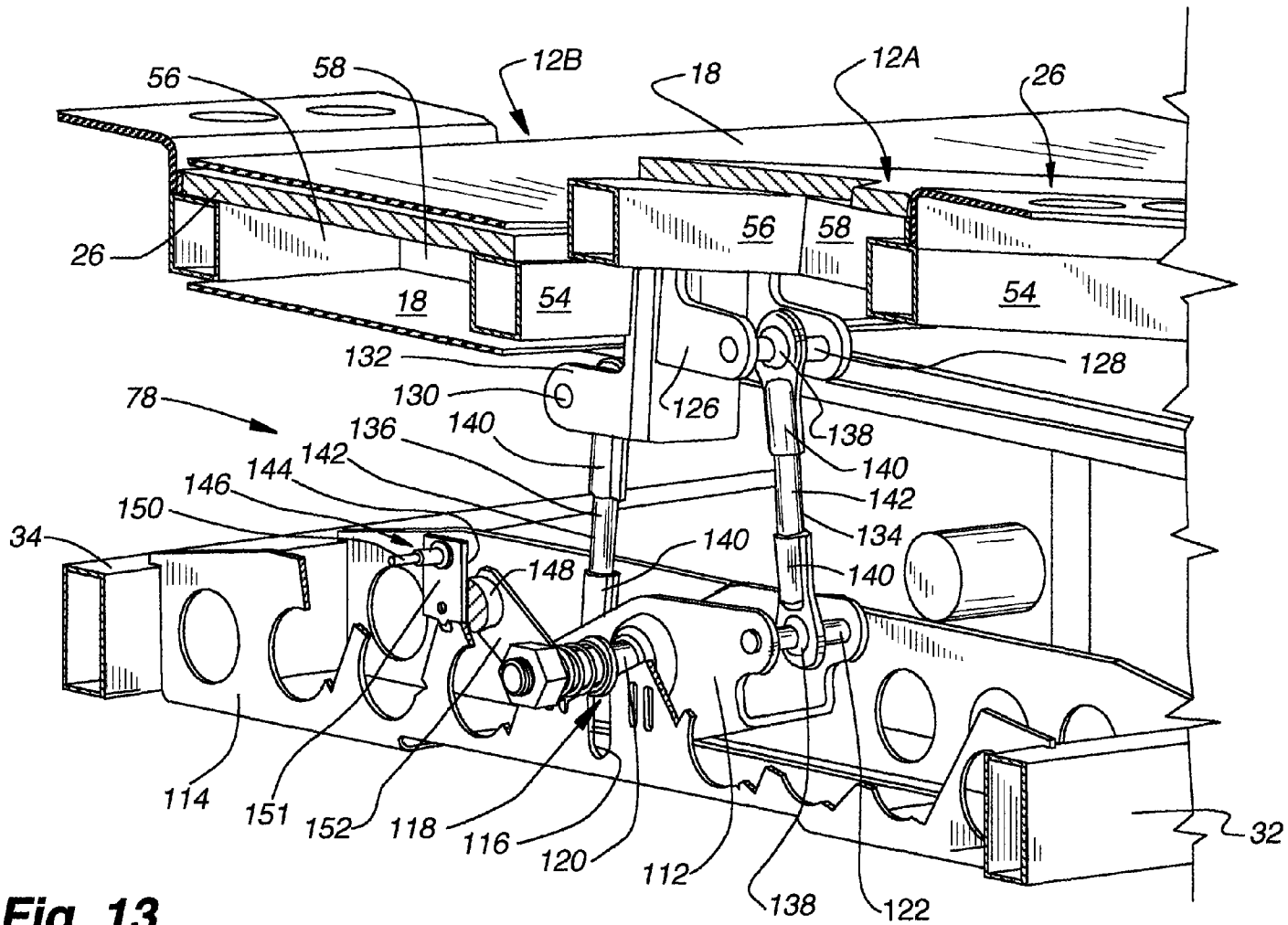
FIG. 13 is a partial cut away isometric view of the exercise device shown in FIG. 2, the view illustrating the rocker arm orientated in a position corresponding with the left treadle in a position higher than in FIG. 12 and the right treadle in a position lower than in FIG. 12.
Figure 14:
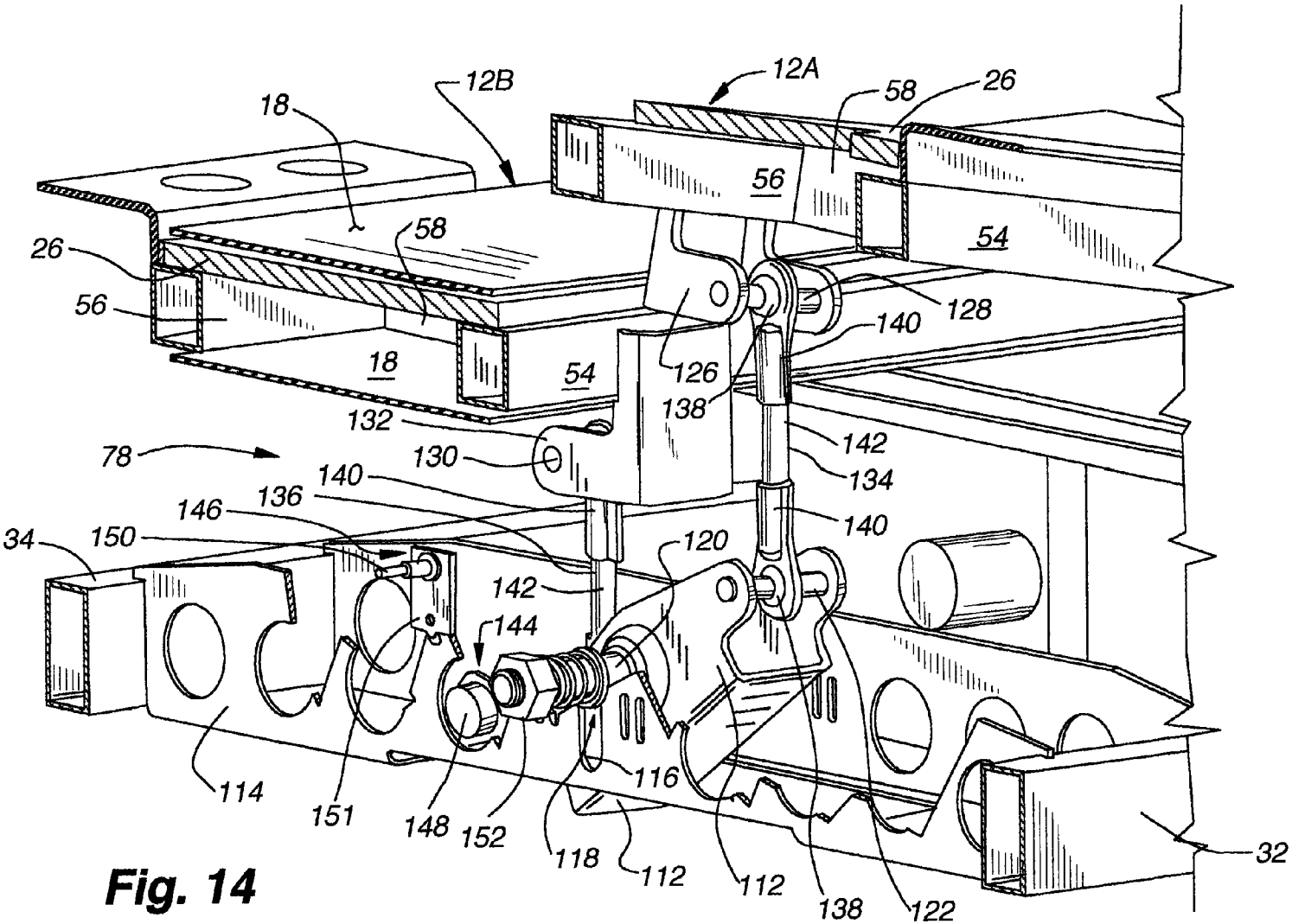
FIG. 14 is a partial cut away isometric view of the exercise device shown in FIG. 2, the view illustrating the rocker arm orientated in a position corresponding with the left treadle in a position higher than in FIG. 13 and the right treadle in a position lower than in FIG. 13.
Figure 15:
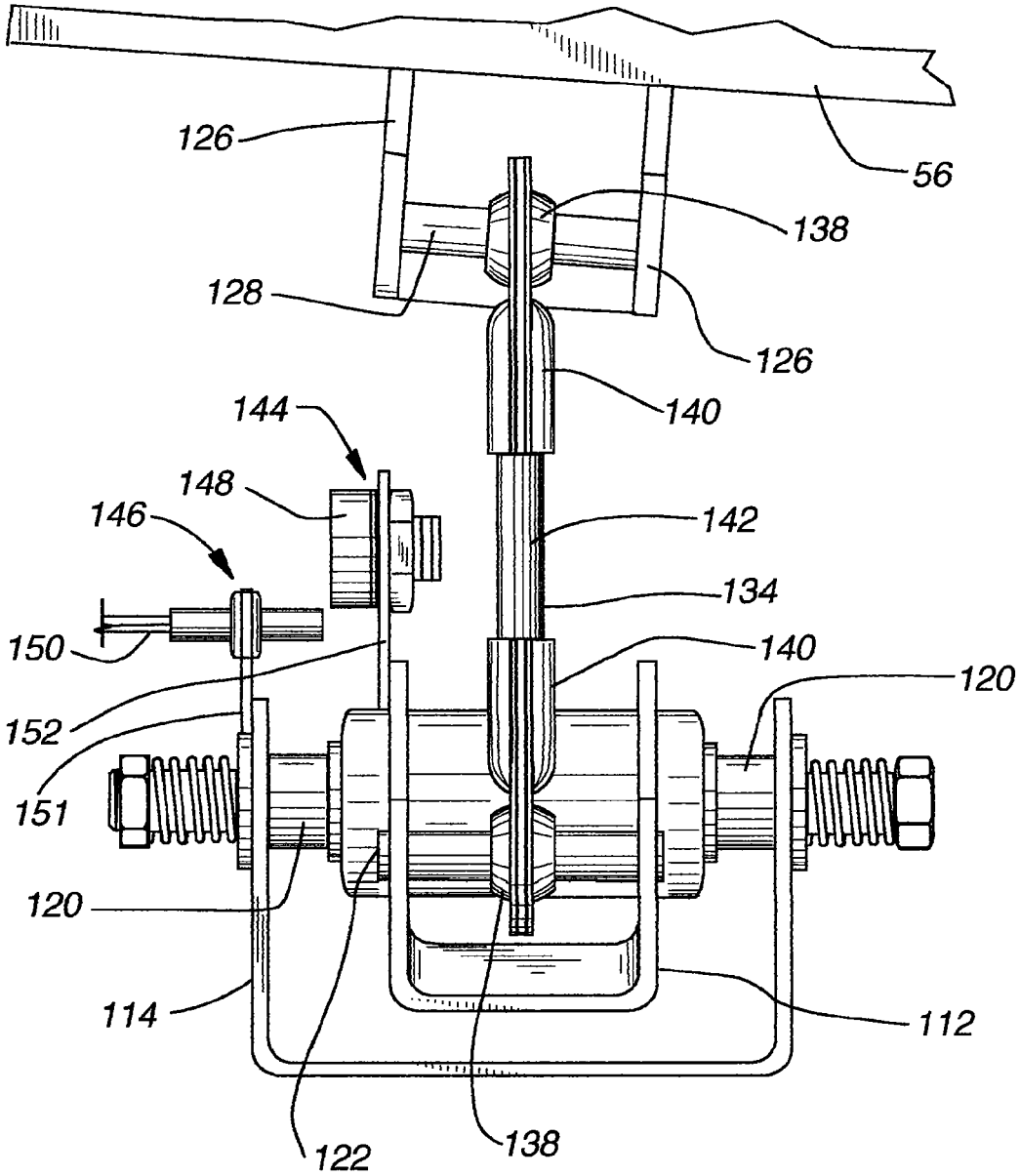
FIG. 15 is a left side view of one embodiment of the rocker arm, in accordance with the present invention.

FIGS. 10-14 are partial isometric views of the exercise device particularly illustrating the treadle interconnection structure 78. Each of FIGS. 10-14 show the interconnection structure in a different position. FIG. 15 is a side view of the treadle interconnection structure in the same position as is shown in FIG. 12. FIGS. 16(A,B)-20(A,B) are isometric views of the exercise device corresponding with the views shown in FIGS. 10-14. In the particular implementation of the interconnection structure illustrated in FIGS. 10-15 and others, the interconnection structure includes a rocker arm assembly 112 pivotally supported on a rocker cross member 114 extending between the left 32 and right 34 side members of the frame. The rocker arm assembly is operably connected with each treadle assembly 12. As best shown in FIG. 15, the rocker cross member defines a U-shaped cross section. Each upstanding portion of the U defines a key way 116, (see, e.g., FIGS. 14 and 25). The top of the key way defines a pivot aperture 116. The rocker arm includes a rocker pivot axle 120 that is supported in and extends between each pivot aperture to pivotally support the rocker arm. As discussed in more detail below, the key way provides a way for the interconnect structure to be moved between a "shipping" position and a "use" position.

The left and right outer portions of the rocker arm include a first or left lower pivot pin 122 and a second or right lower pivot pin 124, respectively. A generally L-shaped bracket 126 supporting a first upper pivot pin 128 extends downwardly from the inner or right side member 56 of the left treadle 12A so that the upper pivot pin is supported generally parallel, below, and outwardly of the inner side member. A second generally L-shaped bracket 128 supporting a second upper pivot pin 130 extends downwardly from the inner or left side tube 54 of the right treadle assembly 128 so that the upper pivot pin is supported generally parallel, below, and outwardly of the inner side member.

A first rod 134 is connected between the left upper 128 and lower 122 pivot pins. A second rod 136 is connected between the right upper 130 and lower 124 pivot pins. The rods couple the treadles to the rocker arm. In one particular implementation, each rod (134, 136) defines a turnbuckle with an adjustable length. The turnbuckles are connected in a ball joint 138 configuration with the upper and lower pivot pins. A turnbuckle defines an upper and a lower threaded sleeve 140. Each threaded sleeve defines a circular cavity with opposing ends to support a pivot ball. The pivot pins are supported in the pivot balls. A rod defines opposing threaded ends 142, each supported in a corresponding threaded sleeve.

As will be discussed in more detail below, the treadle assemblies 12 may be locked-out so as to not pivot about the rear axis 16. When locked out, the belts 18 of the treadle assemblies collectively provide an effectively single non-pivoting treadmill-like striding surface. By adjusting the length of one or both of the turnbuckles 134, 136 through rotation of the rod 142 during assembly of the exercise device or afterwards, the level of the two treadles may be precisely aligned so that the two treadles belts, in combination, provide a level striding surface in the lock-out position.

The interconnection structure 78 (e.g., the rocker arm assembly) interconnects the left treadle with the right treadle in such a manner that when one treadle, (e.g., the left treadle) is pivoted about the rear pivot axis 16 downwardly then upwardly, the other treadle (e.g., the right treadle) is pivoted upwardly then downwardly, respectively, about the rear pivot axis in coordination. Thus, the two treadles are interconnected in a manner to provide a stepping motion where the downward movement of one treadle is accompanied by the upward movement of the other treadle and vice versa. During such a stepping motion, whether alone or in combination with a striding motion, the rocker arm 112 pivots or teeters about the rocker axis 120.

Referring now to FIGS. 10-14 and 16(A,B)-20(A,B), the climbing-like exercise provided by the motion of the exercise device 10 is described in more detail. A representative user (hereinafter the "user") is shown in forward facing use in FIGS. 16B-20B. The user is walking forward and the device is configured for climbing-type use, i.e., so the treadles reciprocate. The foot motion shown is representative of only one user. In some instances, the treadles 12 may not move between the upper-most and lower-most position, but rather points in between. In some instances, the user may have a shorter or longer stride than that shown. In some instances, a user may walk backward, or may face backward, or may face backward and walk backward.

Figure 16A:
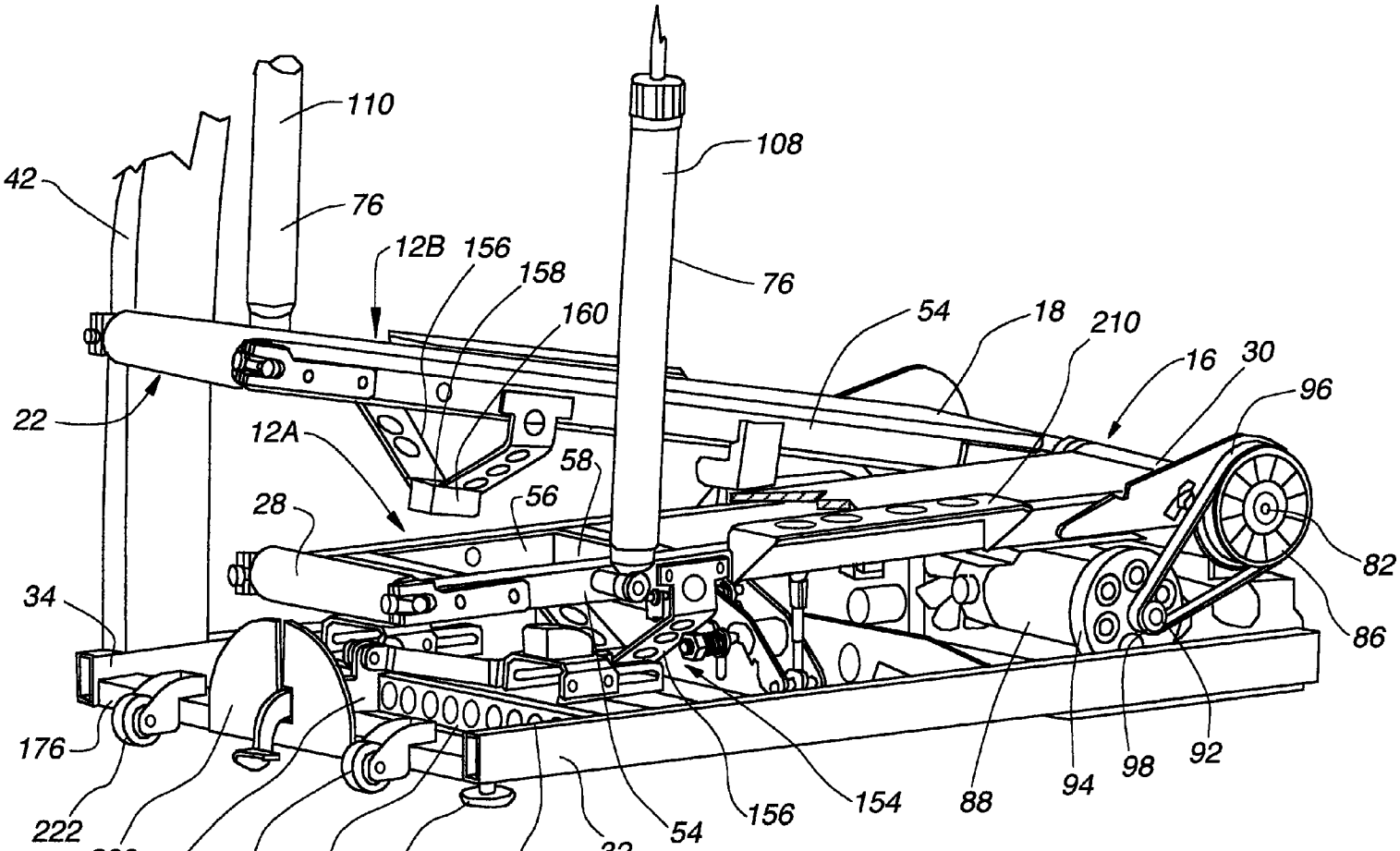
FIG. 16A is an isometric view of the exercise device shown in FIG. 2, the exercise device with the left treadle in about the lowest position and the right treadle in about the highest position.
Figure 16B:
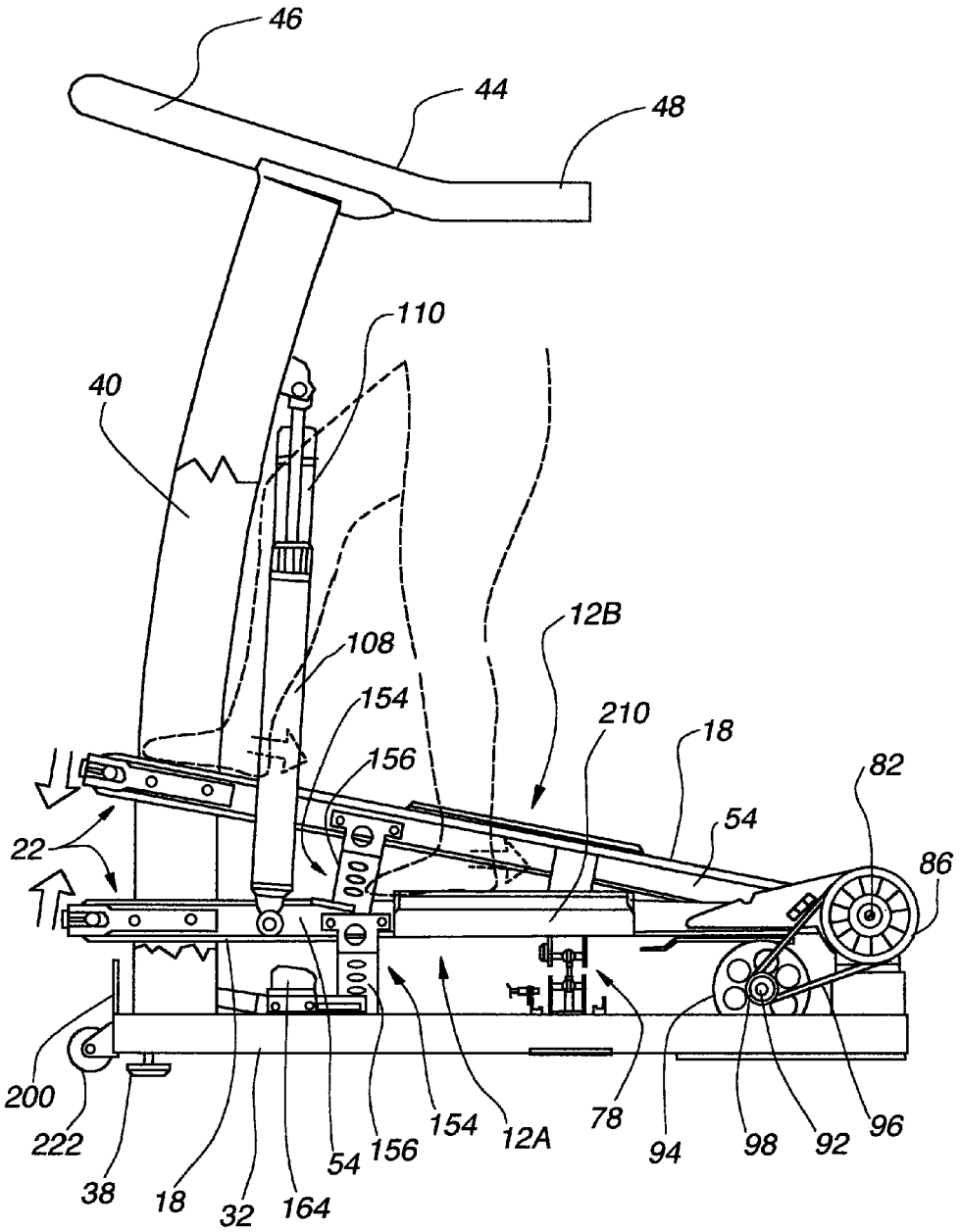
FIG. 16B is a left side view of the exercise device in the orientation shown in FIG. 16A and with a representative user.

In FIGS. 10 and 16A, the left treadle 12A is in a lower position and the right treadle 12B is in an upper position. Referring to FIGS. 10 and 14, the left side of the rocker arm 118 is pivoted downwardly and the right side of the rocker arm is pivoted upwardly. In FIG. 16B, the user is shown with his right foot forward and on the front portion of the right tread belt. In the orientation of the user shown in FIG. 16B, during forward facing climbing-type use, the user's left leg will be extended downwardly and rearwardly with the majority of the user's weight on the left treadle. The user's right leg will be bent at the knee and extended forwardly so that the user's right foot is beginning to press down on the right treadle. From the orientation shown in FIG. 16B, the user will transition his weight to a balance between the right leg and the left leg, and begin to press downwardly with his right leg to force the right treadle downwardly. Due to the movement of the belts, both feet will move rearwardly from the position shown in FIG. 16B.

Figure 17A:
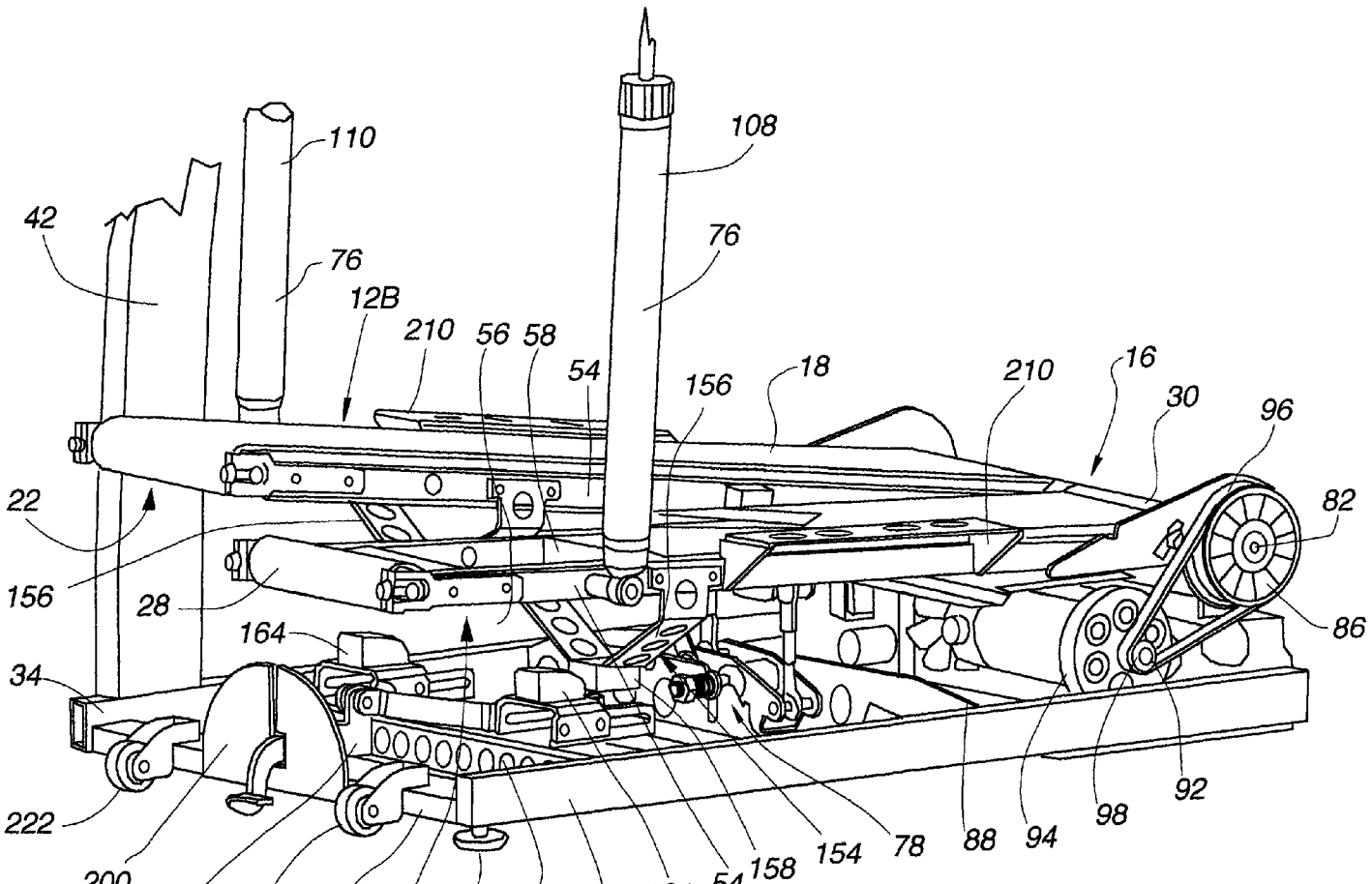
FIG. 17A is an isometric view of the exercise device shown in FIG. 2, the exercise device with the left treadle higher than shown in FIG. 16A, and the right treadle lower than shown in FIG. 16A.
Figure 17B:
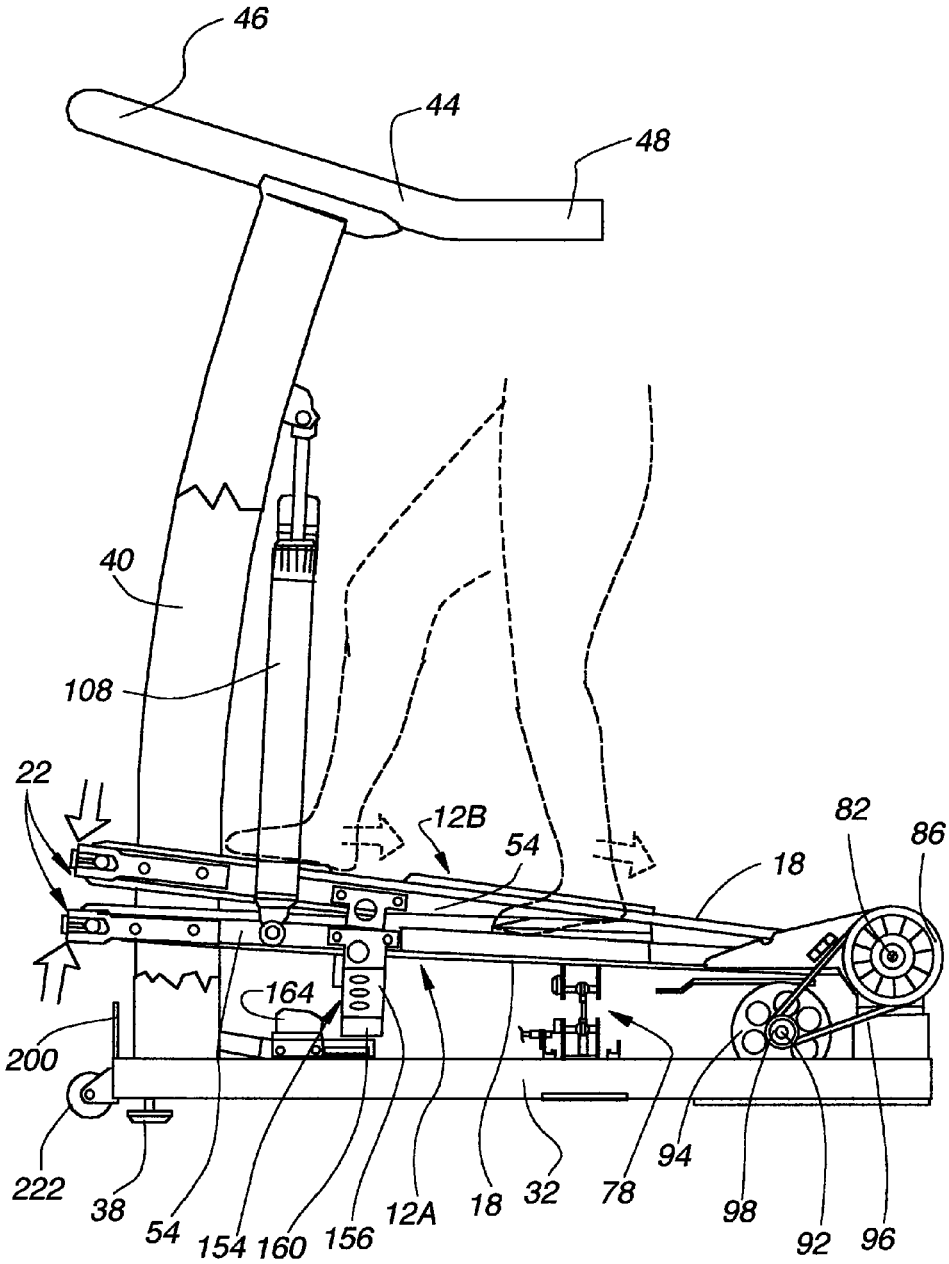
FIG. 17B is a left side view of the exercise device in the orientation shown in FIG. 17A and with a representative user.

FIGS. 11, 17A, and 17B show the orientation of the device 10 and the user in a position after that shown in FIGS. 10, 16A, and 16B. The right treadle 12B is being pressed downwardly, which, via the rocker interconnection structure 78, causes the left treadle 12A to begin to rise. The user's right foot has moved rearwardly and downwardly from the position shown in FIG. 16B. The user's left foot has moved rearwardly and upwardly from the position shown in FIG. 16B.

Figure 18A:
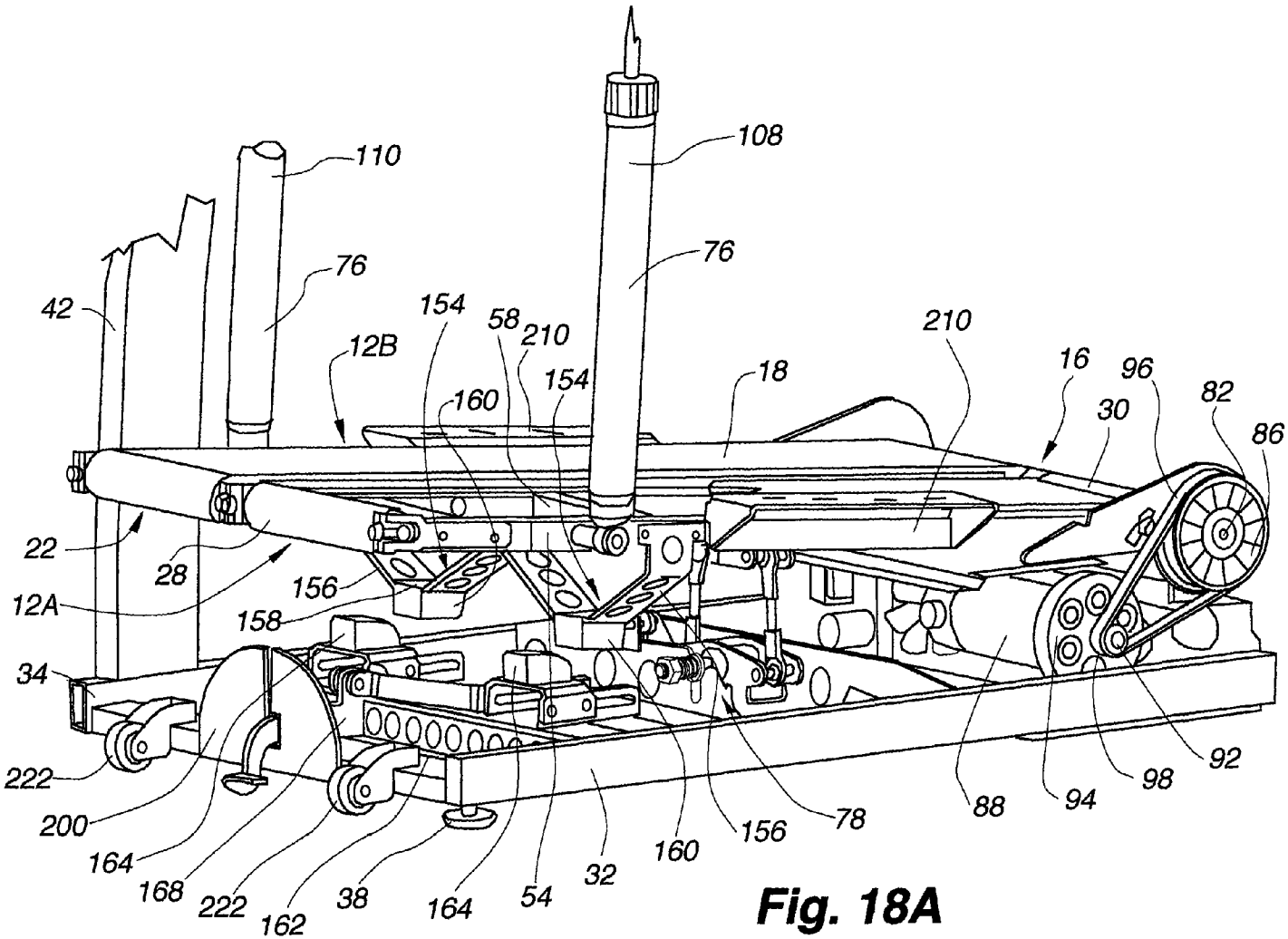
FIG. 18A is an isometric view of the exercise device shown in FIG. 2, the exercise device with the left and right treadle about level and collectively at about a 10% grade.
Figure 18B:
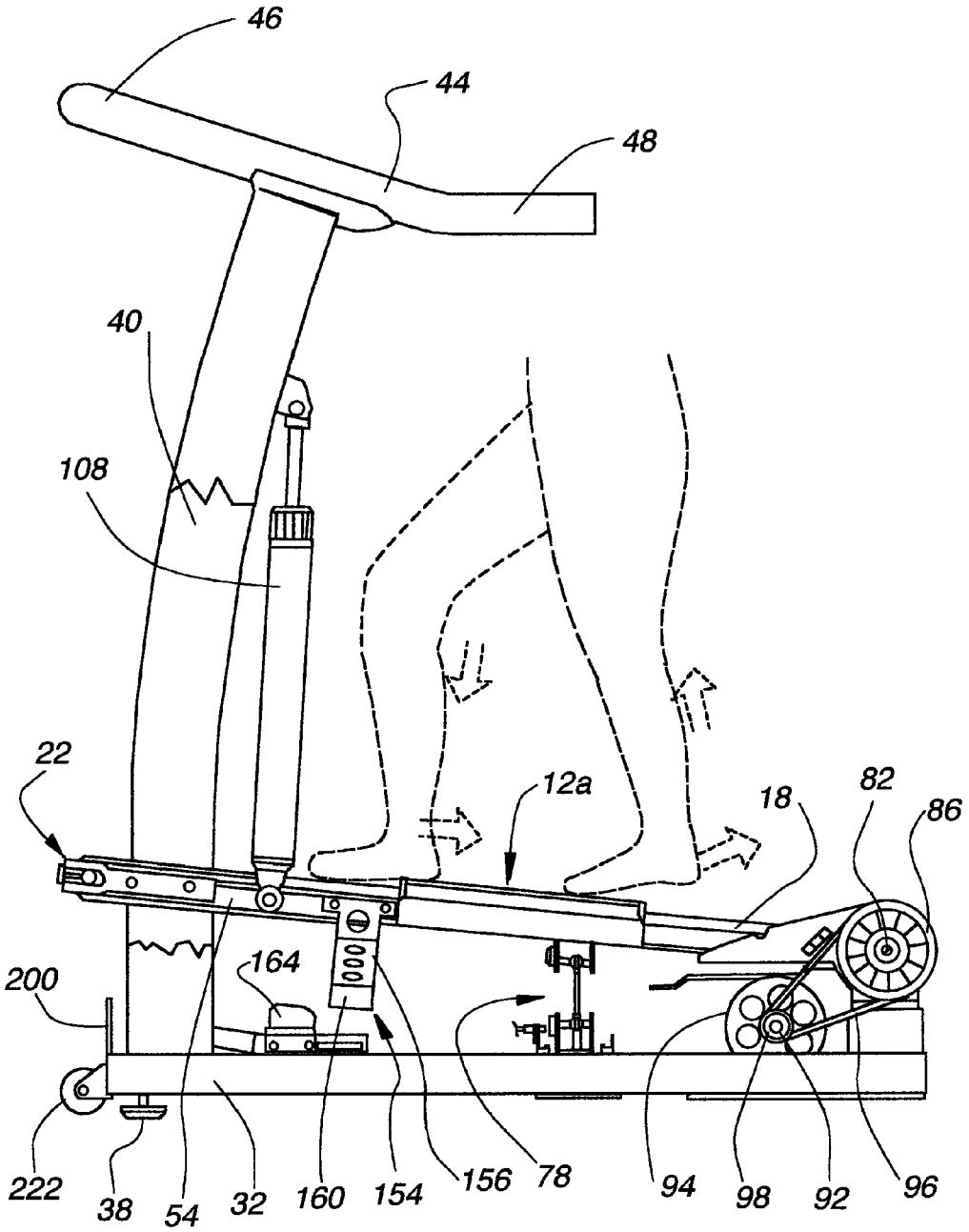
FIG. 18B is a left side view of the exercise device in the orientation shown in FIG. 18A and with a representative user.

FIGS. 12, 18A, and 18B show the right treadle 12B about midway through its upward stroke, and the left treadle 12A about midway through its downward stroke. As such, the treadle assemblies are nearly at the same level above the frame 14 and the endless belts 18 are also at the same level. As shown in FIG. 18B, the user's right foot and leg have moved rearwardly and downwardly from the position shown in FIG. 17B. The user's left foot has moved rearwardly and upwardly from the position shown in FIG. 16B. At this point, the user has begun to lift the left foot from the left tread belt in taking a forward stride; thus, the left heel is lifted and the user has rolled onto the ball of the left foot. Typically, more weight will now be on the right treadle than the left treadle.

Figure 19A:
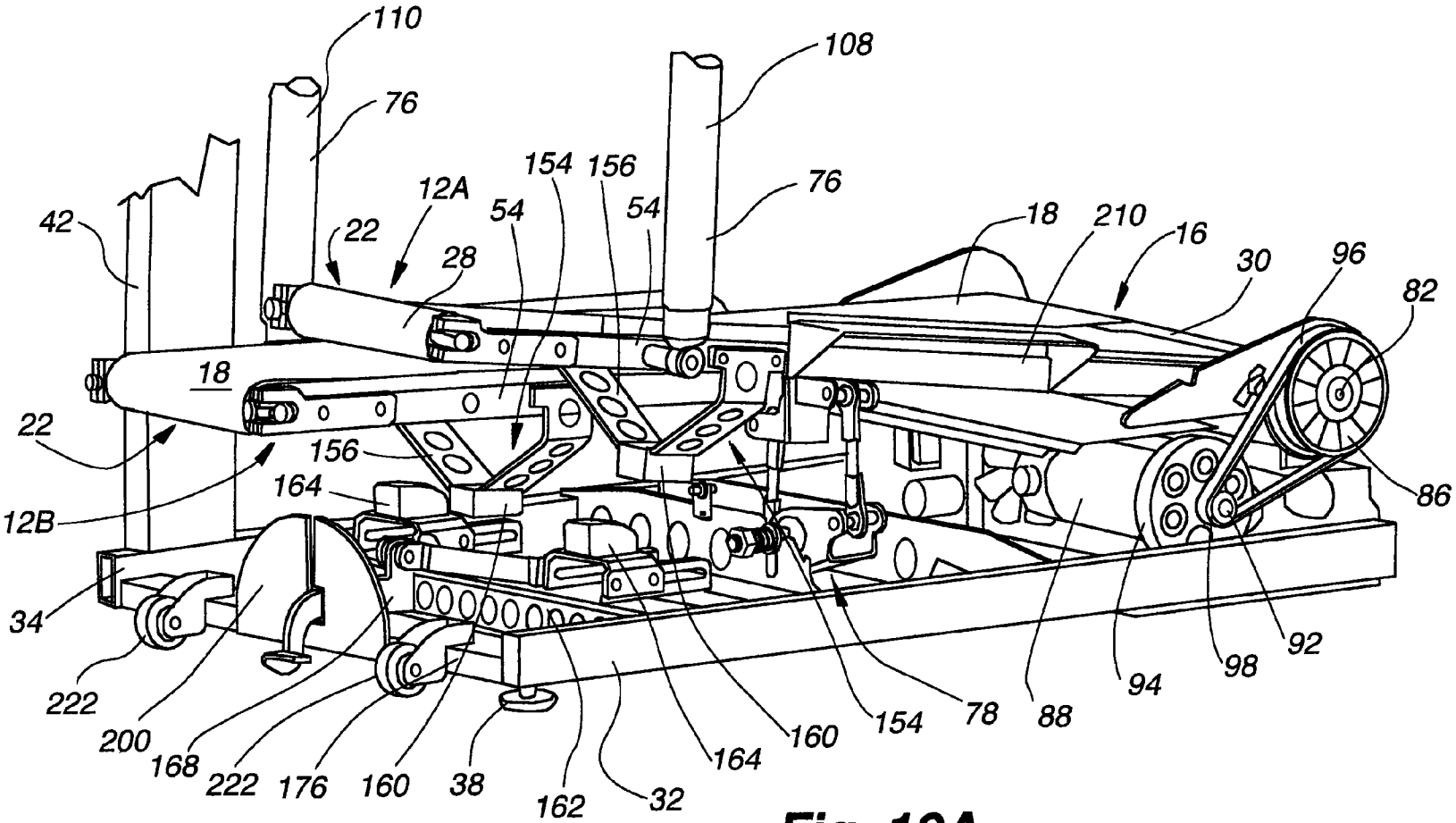
FIG. 19A is an isometric view of the exercise device shown in FIG. 2, the exercise device with the left treadle higher than shown in FIG. 18S, and the right treadle lower than as shown in FIG. 18A.
Figure 19B:
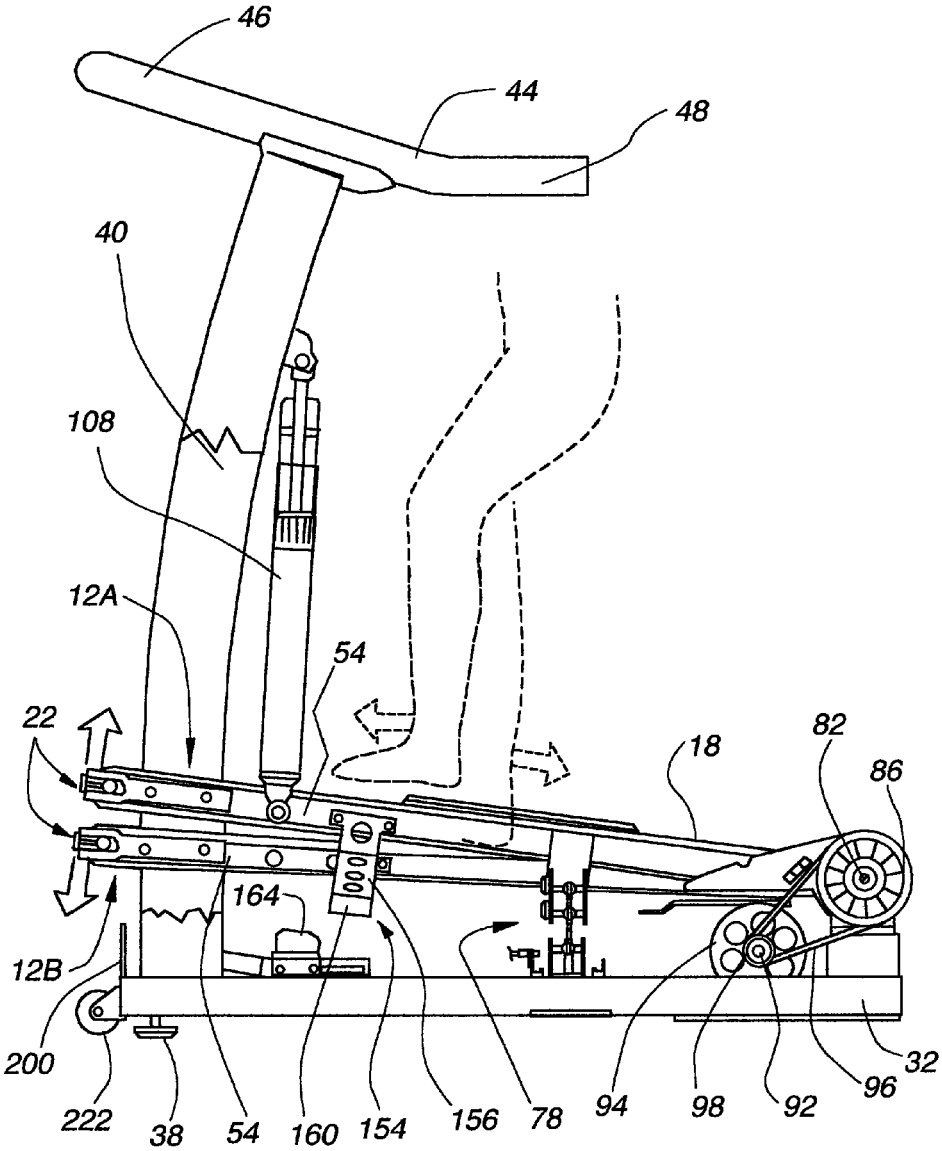
FIG. 19B is a left side view of the exercise device in the orientation shown in FIG. 19A and with a representative user.

After the orientation shown in FIGS. 12, 18A, and 18B, the right treadle 12B continues it downward movement and the left treadle 12A continues its upward movement to the orientation of the device as shown in FIGS. 13, 19A, and 19B. In FIGS. 13, 19A, and 19B, the left treadle is higher than the right treadle, and the rocker arm 112 is pivoted about the rocker pivot axis 120 such that its right side is lower than its left side. In this position, the user's right leg continues to move rearward and downward. The user has lifted the right leg off the left treadle and is moving it forward. At about the upper position of the left treadle, the user will step down with his left foot on the front portion of the treadle belt. All of the user's weight is on the right treadle until the user places his left foot on the left treadle. The user continues to provide a downward force on the right treadle forcing the left treadle up.

Figure 20A:
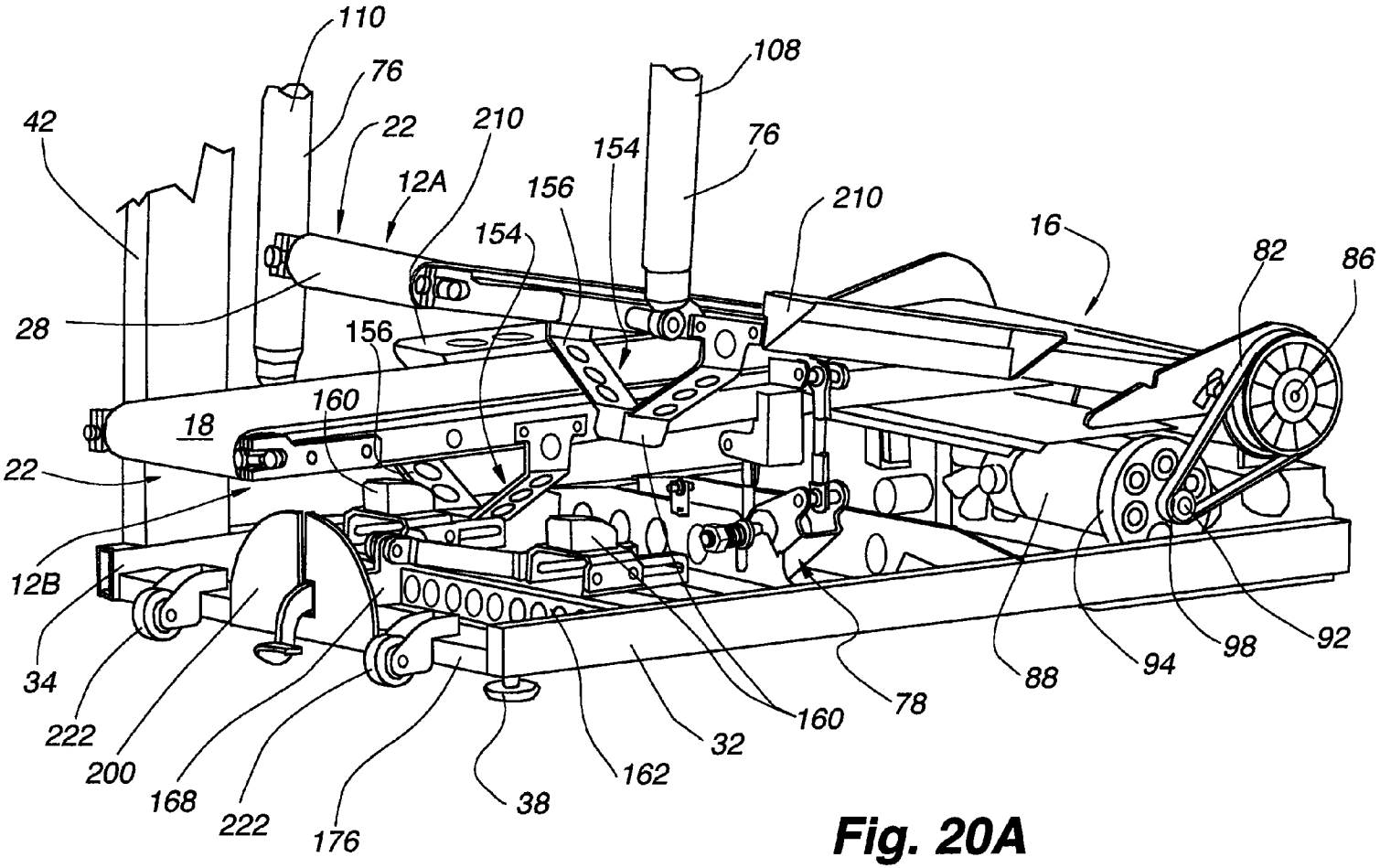
FIG. 20A is an isometric view of the exercise device shown in FIG. 2, the exercise device with the left treadle in about its highest position and the right treadle in about its lowest position.
Figure 20B:
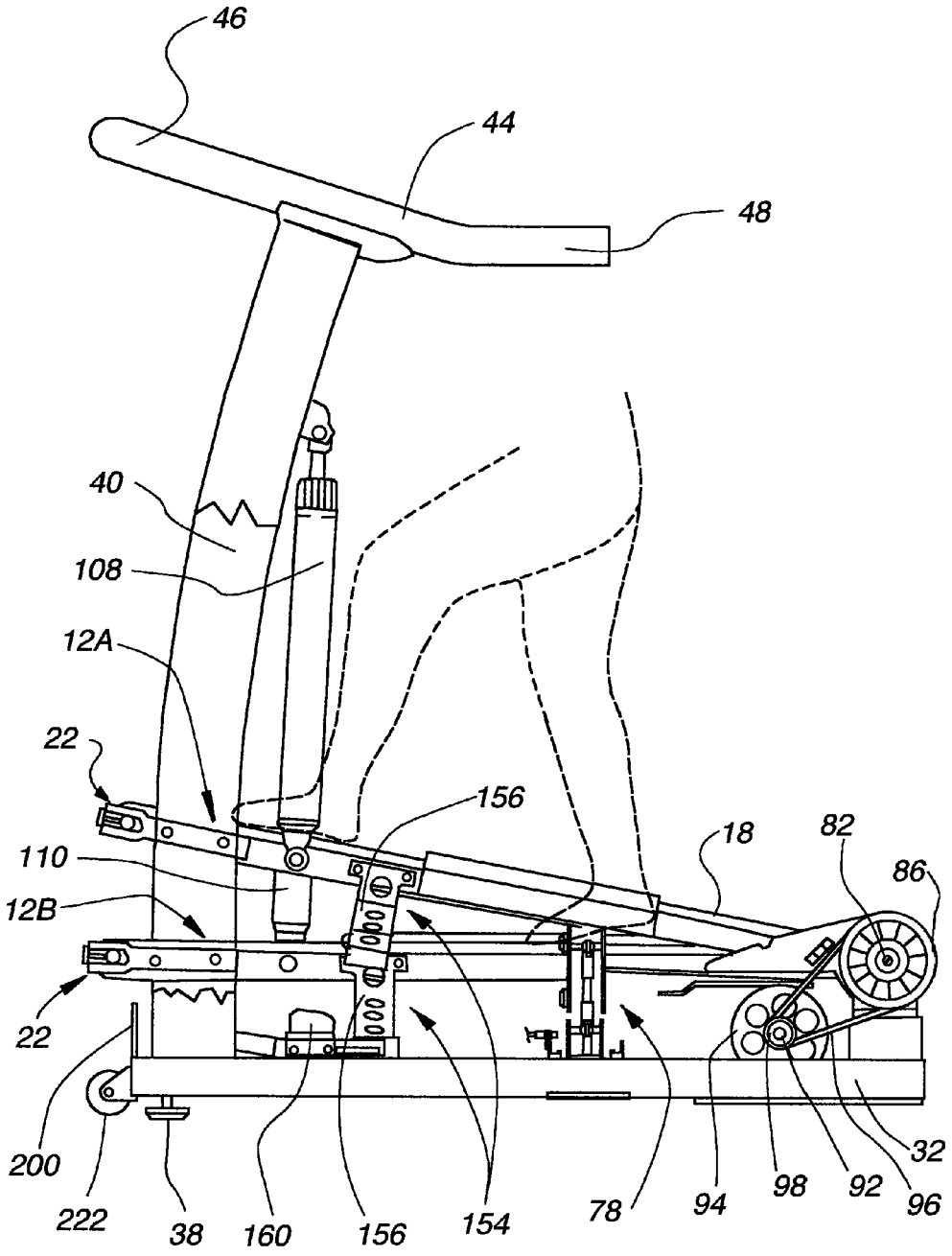
FIG. 20B is a left side view of the exercise device in the orientation shown in FIG. 20A and with a representative user.

FIGS. 14, 20A, and 20B illustrate the right treadle 12B in about its lowest position, and show the left treadle 12A in about its highest position. At this point, the user has stepped down on the front 22 of the left treadle and has begun pressing downward with the left leg. The user is also beginning to lift the right leg. The downward force on the left treadle will be transferred through the interconnection structure 78 to the right treadle to cause the right treadle to begin to rise.

FIGS. 16(A,B)-20(A,B) represent half a cycle of the reciprocating motion of the treadles, i.e., the movement of the left treadle from a lower position to an upper position and the movement of the right treadle from an upper position to a lower position. A complete climbing-type exercise cycle is represented by the movement of one treadle from some position and back to the same position in a manner that includes a full upward stroke of the treadle (from the lower position to the upper position) and a full downward stroke of the treadle (from the upper position to the lower position). For example, a step cycle referenced from the lower position of the left treadle (the upper position of the right treadle) will include the movement of the left treadle upward from the lower position to the upper position and then downward back to its lower position. In another example, a step cycle referenced from the mid-point position of the left treadle (see FIG. 18) will include the upward movement of the treadle to the upper position, the downward movement from the upper position, past the mid-point position and to the lower position, and the upward movement back to the mid-point position. The order of upward and downward treadle movements does not matter. Thus, the upward movement may be followed by the downward movement or the downward movement may be followed by the upward movement.

Referring to FIG. 10 and others, in one particular configuration, the exercise device includes a step sensor 144, which provides an output pulse corresponding with each downward stroke of each treadle. The step sensor is implemented with a second reed switch 146 including a magnet 148 and a pick-up 150. The magnet is connected to the end of a bracket 152 that extends upwardly from the rocker arm 112. The bracket orients the magnet so that it swings back and forth past the pick-up, which is mounted on a bracket connected with the rocker cross member 114. The reed switch 146 triggers an output pulse each time the magnet 148 passes the pick-up 150. Thus, the reed switch transmits an output pulse when the right treadle 12B is moving downward, which corresponds with the magnet passing downwardly past the pick-up, and the reed switch also transmits an output pulse when the left treadle 12A is moving upward, which corresponds with the movement to the magnet upwardly past the pick-up. The output pulses are used to monitor the oscillation, speed, depth of stroke, and stroke count of the treadles as they move up and down during use. The output pulses, alone or in combination with the belt speed signal, may be used to provide an exercise frequency display and may be used in various exercise related calculations, such as in determining the user's calorie burn rate.

As best shown in FIGS. 3, 7, and 14-20, in one particular implementation, each treadle includes a bottom-out assembly 154. The bottom-out assembly includes a generally V-shaped bracket 156 interconnected between the inside and outside members of the treadle frame. The vertex region of the V-shaped bracket is oriented downwardly and generally defines a flat mounting surface 158. A block 160 is fixed to the lower downwardly facing portion of the mounting surface. When the exercise device is assembled it is preferable to arrange the treadles by way of the turnbuckles (134, 136) so that the block 160 is maintained slightly above the underlying lock-out cross member 162 when the treadle is in its lowest position. A bumper 164 may be fixed to the cross member 162 to cushion the treadle should it bottom out. In one example, the block is fabricated with a hard, non-flexible, plastic. The block may also be fabricated with a solid or flexible resilient polymer material. In a flexible resilient form, the block will provide some cushioning should the block bottom-out on the lock-out cross member during use.

As mentioned above, the exercise device 10 may be configured in a "lock-out" position where the treadle assemblies do not pivot upward and downward. In one particular lock-out orientation, the treadle assemblies are pivotally fixed so that the tread belts are level and at about a 10% grade with respect to the rear of the exercise device. Thus, in a forward facing use, the user may simulate striding uphill, and in a rearward facing use the user may simulate striding downhill.

Figure 21:
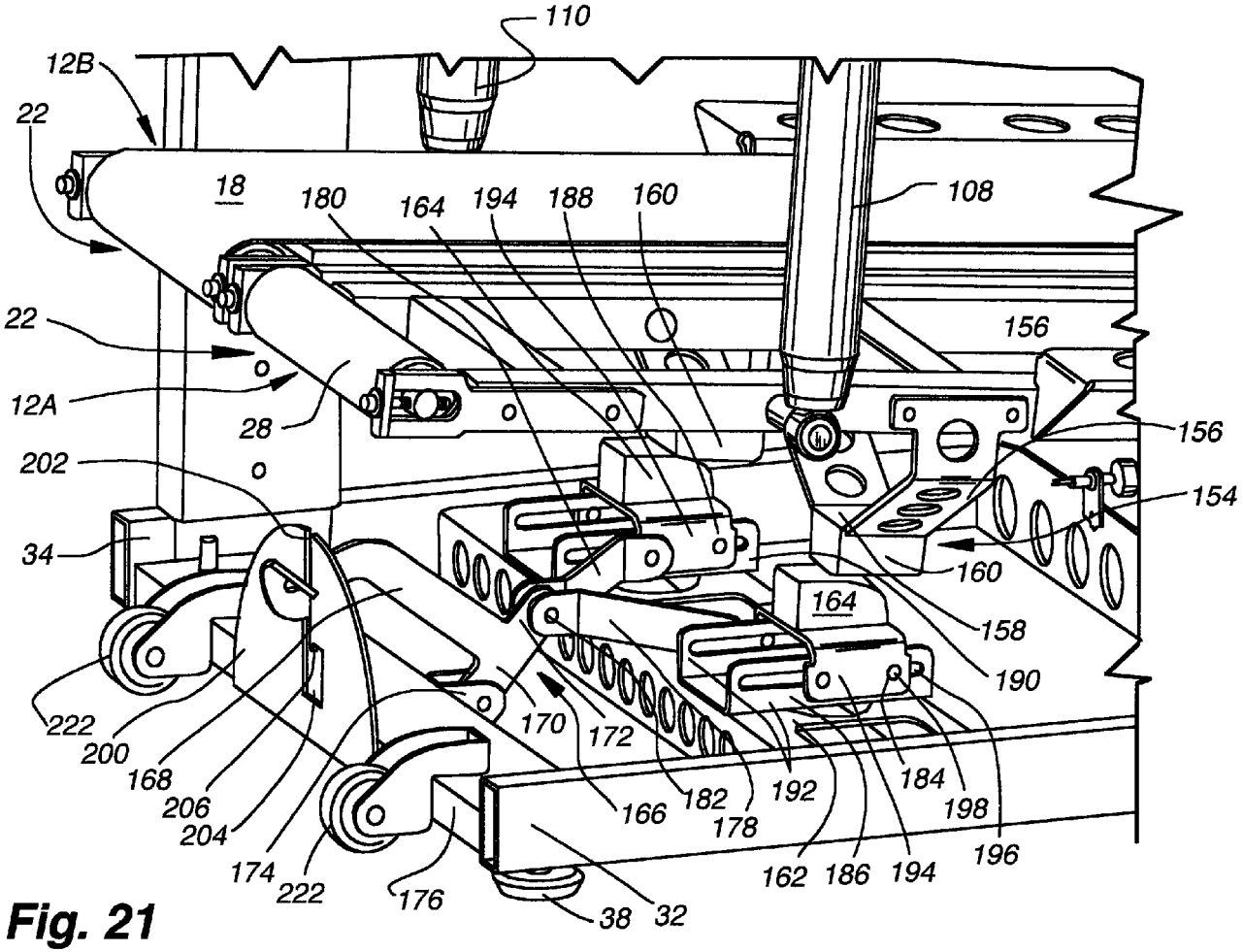
FIG. 21 is a partial cut away isometric view of the exercise device shown in FIG. 2, the view illustrating one embodiment of a lock-out mechanism used to prohibit treadle reciprocation, in accordance with the present invention.
Figure 22:
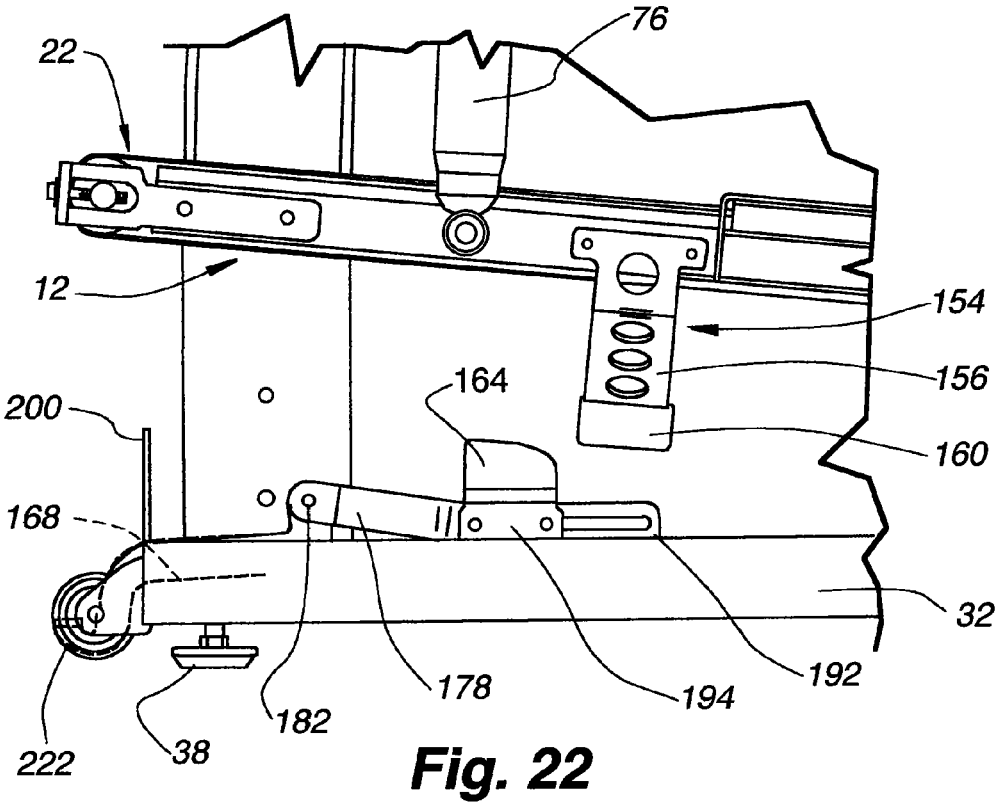
FIG. 22 is a side view of the lock-out mechanism in the unengaged position.
Figure 23:
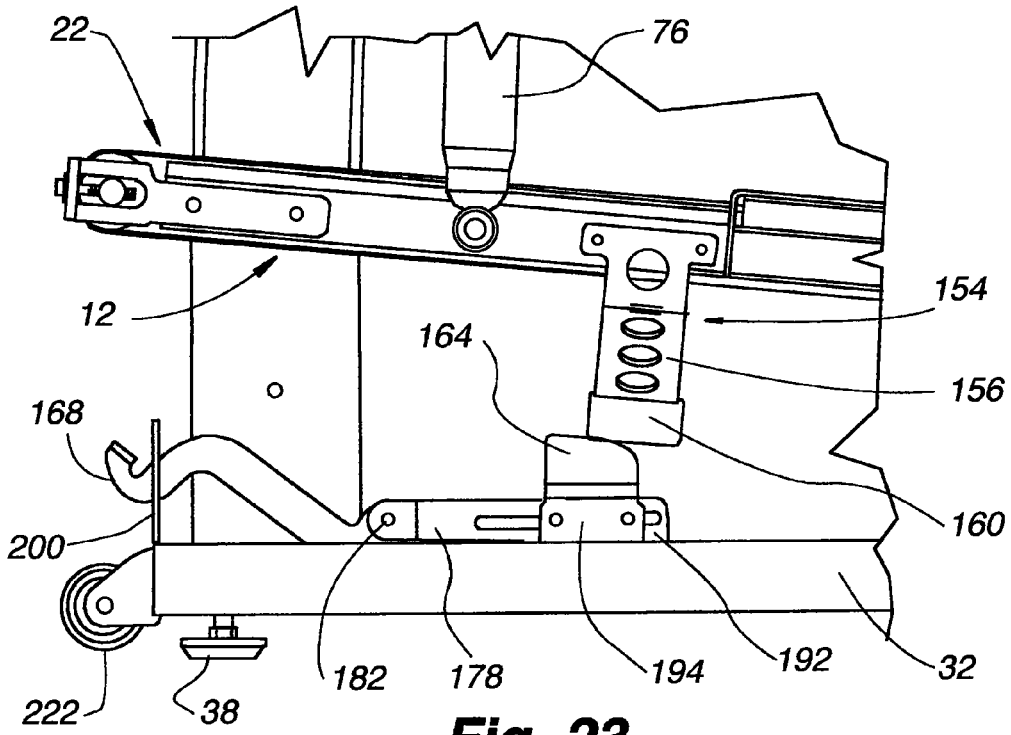
FIG. 23 is a side view of the lock-out mechanism in the engaged or locked out position.

FIG. 21 is a partial isometric view of the left front of the exercise device with the left upright removed to better illustrate one particular lock-out mechanism 166, in accordance with the present invention. FIG. 22 is a partial side view of the left front portion of the exercise device with the lock-out mechanism 166 in the unengaged position. FIG. 23 is a partial side view of the left front portion of the exercise device with the lock-out mechanism in the engaged position. The lock-out mechanism includes a generally T-shaped lever arm 168 with a lower portion 170 and an upper portion 172. The lower portion of the lever arm/latch 168 is pivotally connected with a lever bracket 174 extending rearwardly from the front cross member 176. The upper portion of the latch 168 is pivotally connected with a left 178 and a right 180 latch offset link about a common pivot axis 182. The left offset link is connected with a left slide bracket 184 that is slidably supported on a left guide bracket 186. The right offset link is connected with a right slide bracket 188 that is slidably supported on a second or right guide bracket 190. The two guide brackets are mounted on the upper surface of the lock-out cross member 162 in such a manner that each guide bracket defines a guideway extending generally in a direction between the front and rear of the exercise device. In one implementation, each guideway comprises a pair of upwardly extending sidewalls 192. The slide brackets define downwardly extending sidewalls 194 separated by a distance slightly greater then the distance between the upwardly extending sidewalls of the guide brackets. An elongate longitudinally extending slot 196 is defined in each of the guideway sidewalls. The slots are adapted to receive guide pins 198 that extend inwardly from the downwardly extending sidewalls of the slide brackets. The slide brackets are thus adapted to move forwardly and rearwardly about the guideways. The fore and aft range of the slide brackets is governed by the length of the channels and the fore and aft separation of the guide pins. The lock-out bumper 164 is connected with the top of each of the slide brackets.

As best shown in FIG. 21, an upwardly extending face plate 200 defines an upwardly extending slot 202 adapted to receive the lever arm 168. The bottom of the slot defines an offset slot 204 portion with a short downwardly extending keeper flange 206. In the non-lock out position (see FIG. 22) the lever arm is maintained in the offset slot portion and held in place by the keeper flange. To lock-out the treadles, the lever arm is first pressed downwardly to disengage it from the keeper flange, and then it is moved toward the right or away from the offset slot. Next the lever arm is raised upward in the slot. The upward motion causes the lever arm to pivot upwardly about the pivotal connection to the lever bracket 174. This upward pivoting motion is accompanied by a generally rearward motion of the upper portion 172 of the latch that causes the offset links 178, 180 to slide in the slide brackets 184, 186 and bumpers rearwardly along the guideways. A lever spring (not shown) may be connected between the lock-out assembly and one of the cross members to assist the user in moving the lock-out assembly into the "locked-out" position.

Before actuating the lock-out mechanism 162, the treadle assemblies are oriented generally level with each other, which causes the stop blocks 160 underhanging each treadle to be oriented at about the same vertical location. In this position, the lock-out assembly is moved rearwardly so that the bumpers 164 are moved rearwardly into engagement with the stop blocks 160. The rearward face of the bumpers may be tapered. As such, the bumpers may be wedged under the stop blocks to configure the exercise device in the "lock-out" position with the treadles prohibited from up and down motion.

Figure 27:
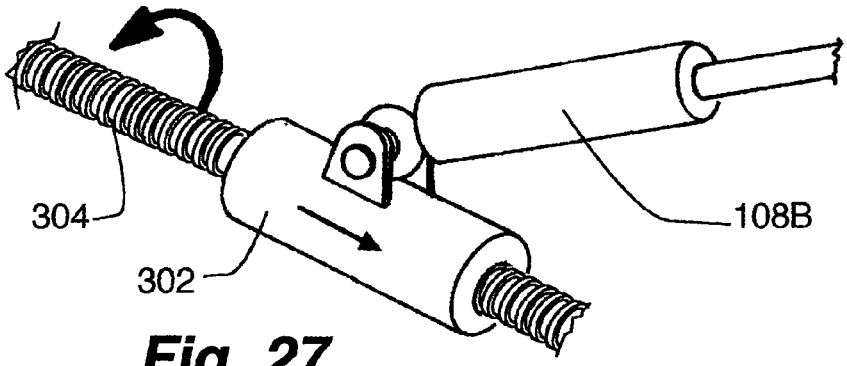
FIG. 27 is a partial detail view of a lead screw and collar continuous adjustment structure from the base portion of FIG. 26.

To mount the device, the user may simply step up onto the treadles 12 and begin exercising. Alternatively, the user may step onto a foot platform 208 extending outwardly from the side of each treadle assembly 12. As shown in FIG. 1, each platform defines a flat mounting surface 210 generally level with the adjacent treadle assembly and upper belt surface. The mounting surface may be knurled or have other similar type features to enhance the traction between the user's shoe or foot and the mounting surface. As shown in FIG. 2 and others, each platform is secured to an outwardly extending platform bracket 212. The platform bracket is secured to and extends outwardly from the left and right treadle frame members 54, 56. FIG. 27 illustrates an exercise device employing an alternative rear mounting platform 214, in accordance with the present invention. The rear mounting platform includes a single foot platform extending rearwardly from and at about the same level as the rear portion of the treadles 12.

Figure 24:
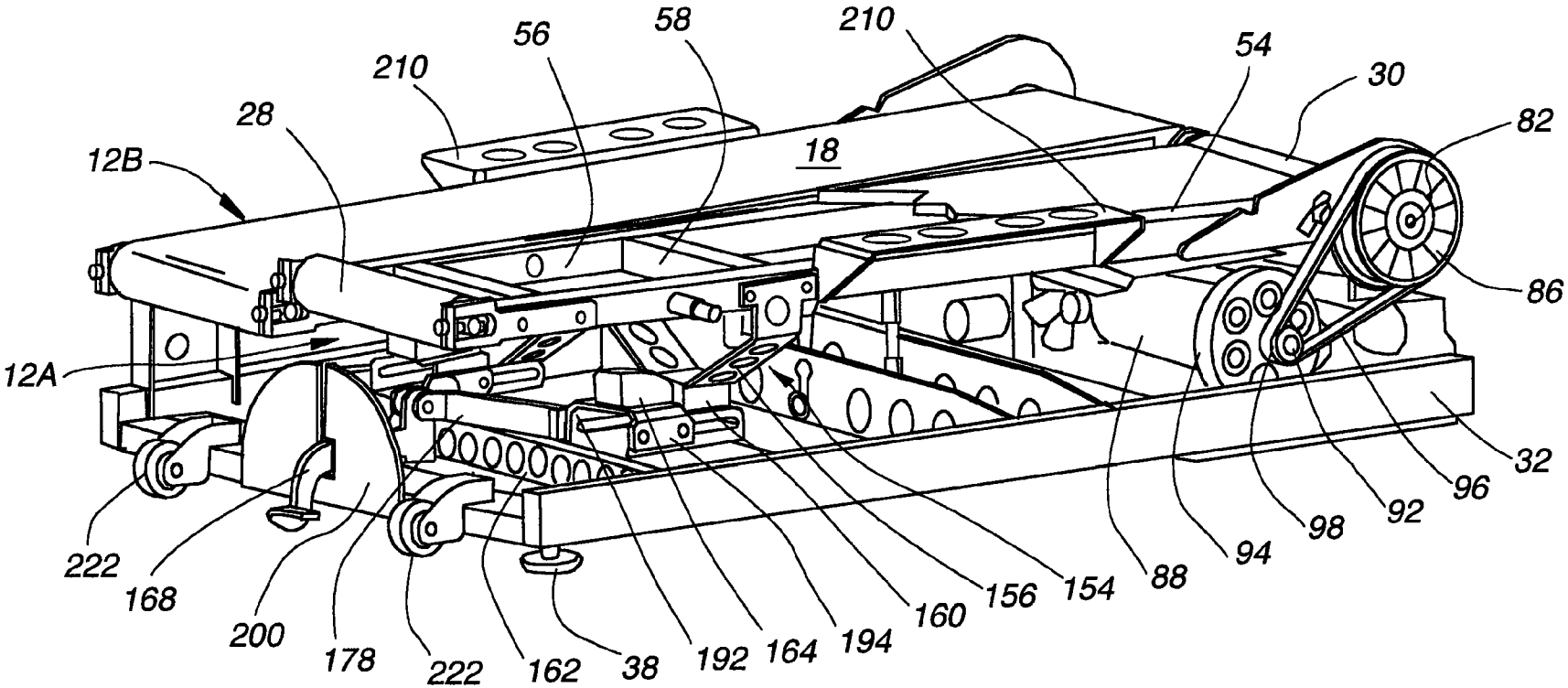
FIG. 24 is an isometric view of the exercise device of FIG. 2 configured in a shipping position.
Figure 25:
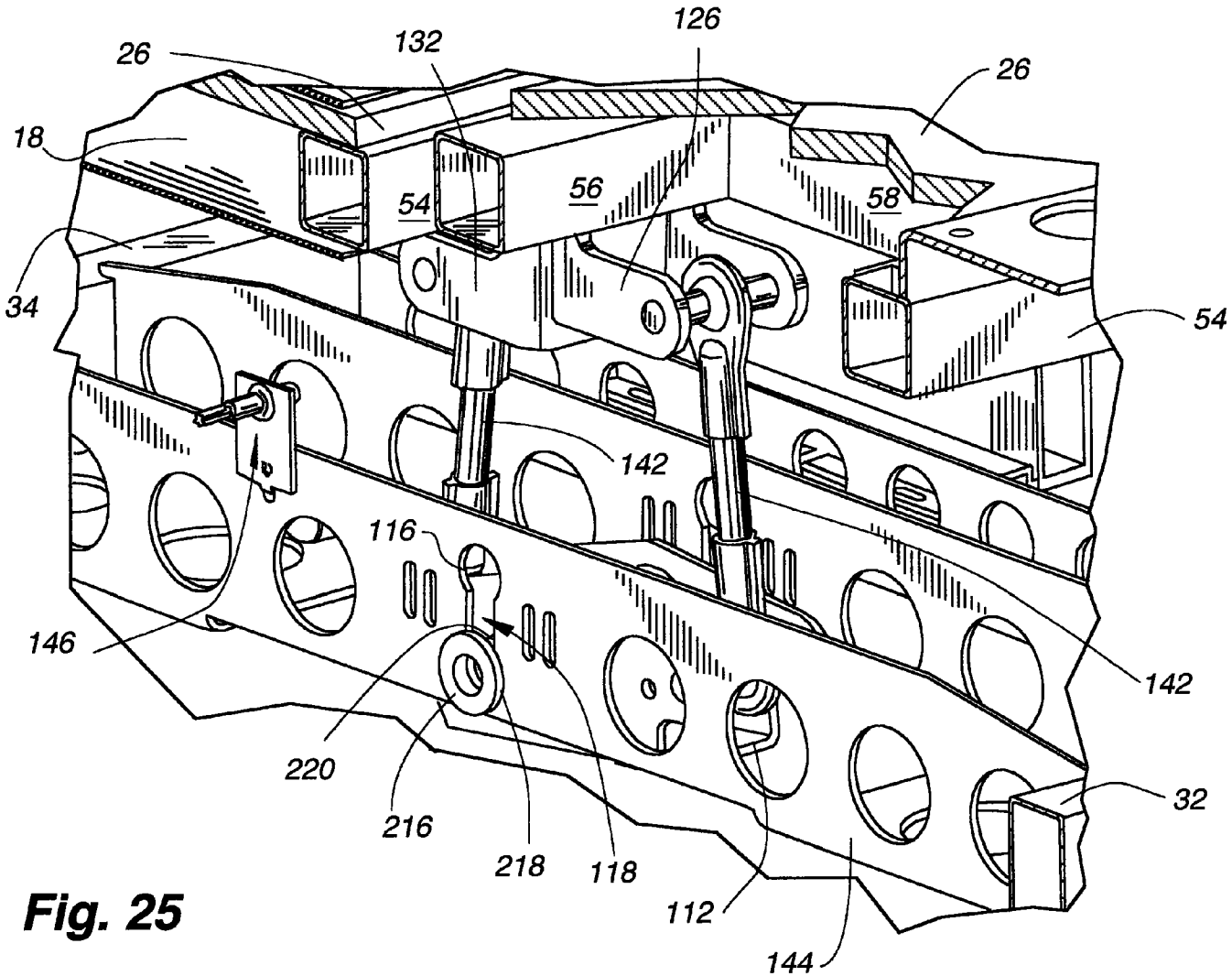
FIG. 25 is a partial cut away isometric view of the exercise device of FIG. 2 and FIG. 24, the view illustrating the rocker arm lowered into the shipping position.

To facilitate shipping the exercise device, some implementations of the exercise device may be configured so that the treadles 12 may be lowered into a shipping position from which the treadles may be easily moved upward and snapped into the operating position. FIG. 24 is an isometric view of the exercise device lowered into the shipping position, and with the left 40 and right 42 uprights and console 50 disconnected from the exercise device 10. FIG. 25 is a partial isometric view of the rocker arm assembly 112 lowered into the shipping position.

For an exercise device configured so that it may be lowered into the shipping position, the rocker arm pivot axle 120 is spring loaded so that it may be lowered in the key ways 116. As best shown in FIG. 15, each end of the rocker arm pivot axle includes an end cap 216. Each end cap includes a circumferential flange 218 of a diameter greater than any portion of the key way 116 including the pivot aperture 118. The end cap also defines a collar 220 arranged inwardly of the flange 218. The collar is of a diameter greater than the downwardly extending key way slot, but less than the diameter of the pivot aperture. The collar supports the rocker assembly 112 in the pivot aperture during use. To lower the rocker assembly, the end caps 216 are extended outwardly from the rocker arm. The collar is supported on a lesser diameter rod (the pivot axle) that is exposed when the cap is pulled out. The pivot axle is dropped down in the key ways, as shown in FIG. 25. Lowering the rocker arm causes the treadles 12 to pivot downwardly until the stop blocks 160 bottom out on the lock-out cross member 162. To configure the exercise device in its exercise or "use" orientation, the rocker assembly is lifted up, such as by lifting the front of the treadles, so that the pivot axle moves upward in the key ways to the pivot aperture. Because the pivot axle is spring loaded, when the axle is aligned with the pivot aperture the collars 220 snap inwardly into the pivot aperture. In this position, the rocker arm is firmly secured in the pivot apertures and ready to use.

A pair of wheels 222 are connected with the front cross member 176. A rear panel 224 (see FIG. 7) of the exercise device 10 includes a pair of handles 226. The handles are elongate apertures, but other handle structures may be used. By lifting the rear of the device, the wheels engage the surface that the device is resting on. In this manner, the user may easily roll the exercise device to a different location. Alternatively, a wheel or wheels may be provided at the rear of the device and handles located at the front. Although two wheels are shown, one or more wheels, slide plates, rollers, or other devices may be used to ease movement of the device.

FIGS. 26-29: Shock Mounting Position Variable Along Base Frame

As discussed above, a shock or shocks 108, 110 (i.e., dampening or resistance elements 76) may be provided as part of the dual deck treadmill exercise device to provide resistance to or dampening of movement of the treadles 12. Typically, one end of the shock 108, 110 is mounted to a treadle 12 while the other end of the shock 108, 110 is mounted to a portion of the frame 14 of the exercise machine (e.g., an upright 40, 42 of the frame as depicted in FIG. 1 or the side frame member 32, 34 of the frame 14 as depicted in FIG. 26). The shock 108, 110 can be a dampening shock, or can have a return spring incorporated into the shock 108, 110. FIGS. 26-29 illustrate an embodiment of the present invention wherein the location of such a shock 108, 110 relative to the frame 14 and the treadle 12 may be varied in order to adjust the no-load position of the treadles 12. Because the angle of action of the shocks 108, 110 acting on the treadles 12 is also affected, the damping or resisting force provided by the shock 108, 110 may also be varied by adjusting its position.

The no-load position of the treadles 12 is the position the treadles 12 will naturally gravitate towards if no load is applied to the treadles 12. The treadles 12 will pivot up and down around the no-load position. Adjustment of the pitch of the treadles 12 will vary the difficulty of a work out. All things being equal, the steeper the angle of the treadle 12, the more strenuous the workout.

Figure 28:
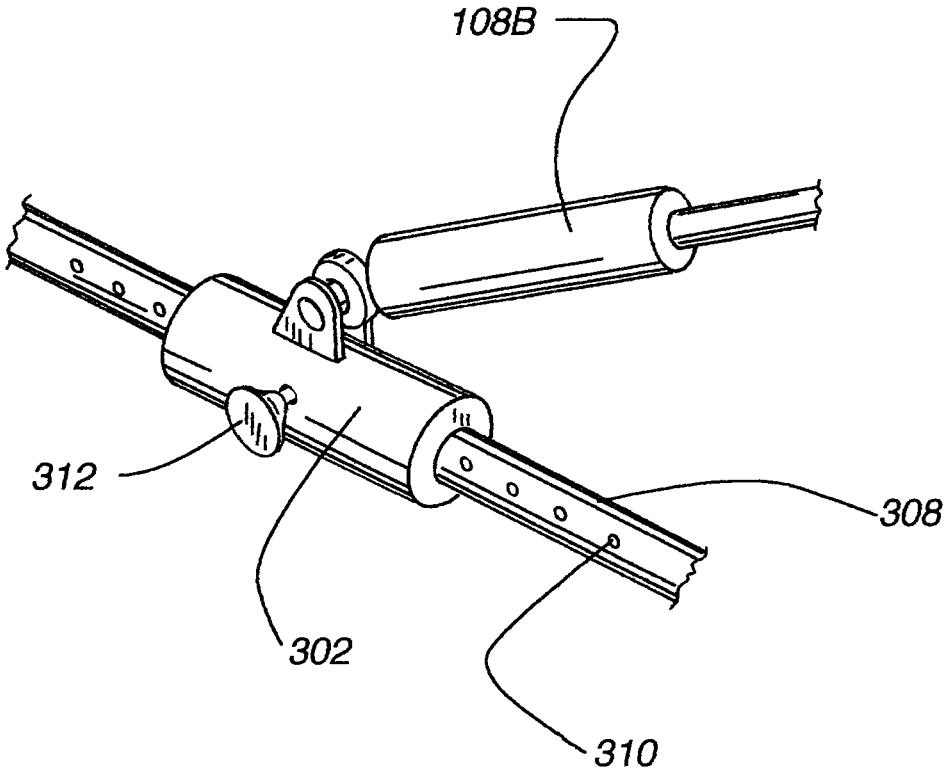
FIG. 28 is an isometric view of a variable position shock adjustment assembly.

FIG. 26 shows the base portion 300 of a dual deck treadmill device 10 having a pair of treadles 12 pivotally supported on a frame 14 as discussed elsewhere herein. In this embodiment, the treadles 12 have a common drive roller (which in this embodiment is a rear roller 30) and separate distal rollers (which in this embodiment are front rollers 28) to allow each treadle 12 to pivot upwardly and downwardly independent of the other; however, other arrangements discussed herein would also work with the variable location shock 108, 110 of FIGS. 26-29. While only the base portion 300 is shown in FIGS. 26 and 28 in order to emphasize the variable shock location, it should be understood that typically the base portion 300 would be incorporated into a frame 14 having uprights 40, 42 including handles 44, a control console 50, a motor control, and other particular features. As shown in FIG. 26, a first end 108A of a shock 108 is attached to the outside frame member 54 of a treadle 12. Other attachment locations on the treadle 12 may be possible. The other end 108B of the shock 108 is attached to a collar 302, which fits around a lead screw 304 incorporated into the base frame 14. The collar 300 traverses the length of the lead screw 304 as the lead screw 304 is rotated, thus changing the position of the lower end 108B of the shock 108. Because the shock 108 has generally a median length at no load, the angle at which the treadle 12 is supported with no load can be adjusted by moving the collar 302.

The movement of the collar 302 along the lead screw 304 is shown in FIG. 27, which shows that the collar 302 translates along the lead screw 300 as the threaded lead screw 304 is rotated. As also seen in FIG. 27, the end 108B of the shock 108 should be connected to the collar 302 such that the angle of the shock 108 relative to the collar 302 can vary as the collar 302 translates along the lead screw 304 or as the treadle 12 moves up and down. The mounting shown in FIG. 27 is a simple pivotal mounting. The lead screw 304 can be turned automatically by a motor controlled by the user, or can be turned manually. If it is turned by a motor, the motor can be controlled by inputs from the user or by program inputs by an on-board computer in order to adjust the incline of the treadles 12 during a user's workout. Preferably both treadles 12 are provided with variable pivot shocks 108, 110 mounted on lead screws 304. In such a case, the control of the location of the collars 302 on both lead screws 304 may be interconnected such that both are adjusted at the same time to insure both treadles 12 have the same relative median position.

Figure 29:
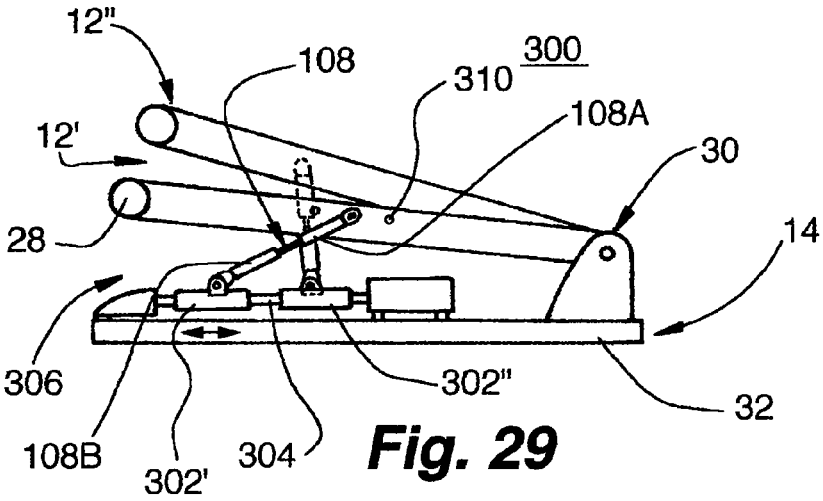
FIG. 29 is a side plan view of a base portion of an exercise device having a variable position shock according one embodiment of the present invention illustrating two positions for the variable position shock.

FIG. 29 shows two examples of different positions of the adjustable shock attachment 306, one with the collar 302' proximate to the left end of the lead screw 304, holding the particular treadle 12' in a lower position. The other example is with the collar 302" to the right end of the lead screw 304 holding the particular treadle 12" in a higher position. The lead screw option provides a continuous adjustment structure that allows nearly infinite possibilities of positioning the bottom end 108B of the shock 108. As the screw 304 turns, the collar 302 translates along the screw 304. Once a desired location for the collar 302 is achieved, the rotation of the screw 304 is stopped, and collar 302 will remain stationary on the lead screw 304, thereby retaining the bottom 108B of the shock 108 in the desired location.

Other types of mechanisms can be used to adjust the position of the lower end 108B of the shock 108 along the frame 14 in order to adjust the angle of the unloaded treadle. For example, the lead screw 304 and collar 302 could be replaced by a discrete adjustment structure such as elongated rod 308 with apertures 310 and a pop pin structure 312, as shown in FIG. 28. The position of the bottom 108B of the shock 108 could be adjusted by sliding the collar 302 along the rod 308 until the desired position was reached, and then inserting the pop pin 312 into the desired aperture 310. A threaded member could be used in place of the pop pin 312. Alternatively, a set screw could be incorporated into the collar 302 to hold the collar 302 in place through friction. It should also be appreciated that a similar effect can be achieved by making the attachment location for the top 108A of the shock 108 variable on the side 54 of the treadle 12 via apertures 310 adapted to receive a pop pin on the top 108A of the shock 108, as seen in FIG. 29.

Figure 37:
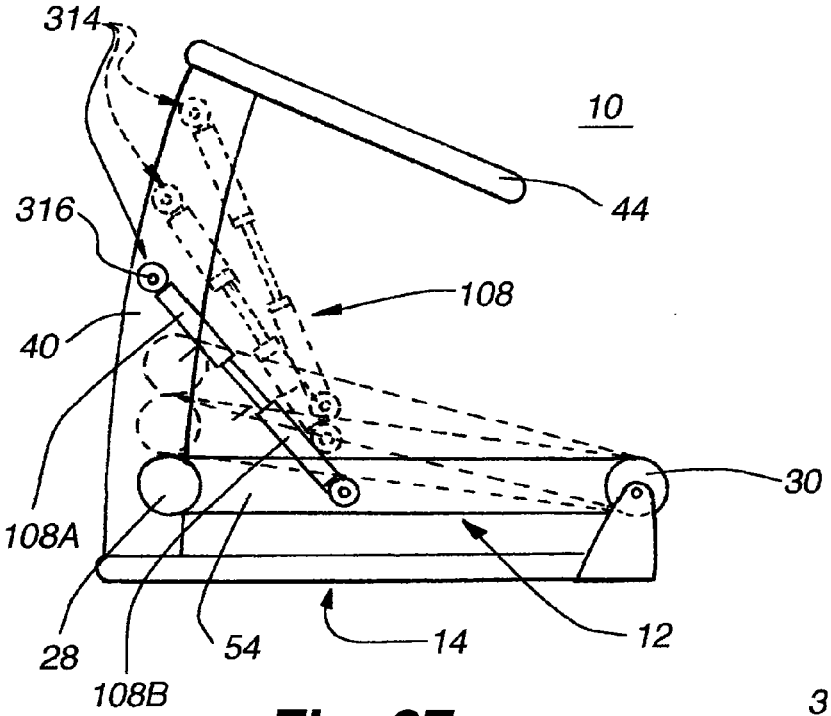
FIG. 37 is a side elevation view of an exercise device according to the present invention that includes an adjustable position shock to adjust the grade of a treadle.
Figure 38:
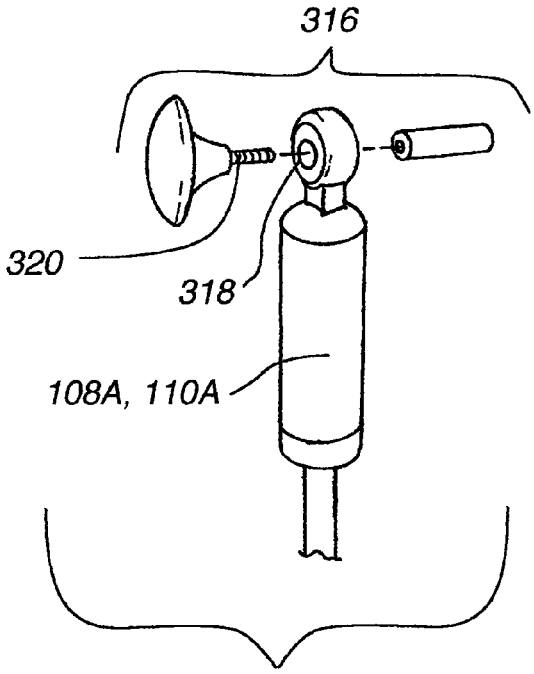
FIG. 38 is a detail view of a pop-pin arrangement that can be used in adjusting the location of the adjustable position shock of FIG. 37.
Figure 39:
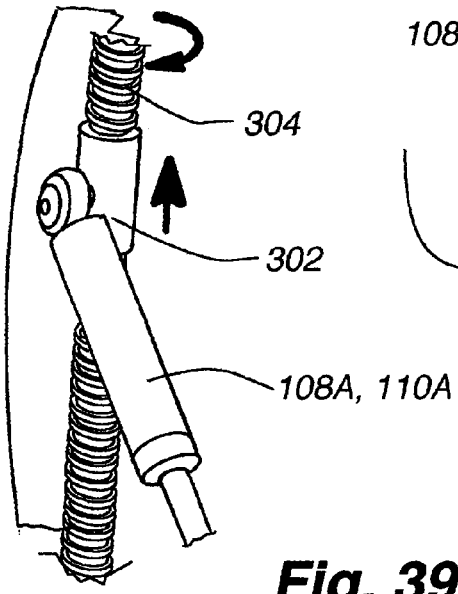
FIG. 39 is a detail view of a lead screw and collar arrangement that can be used in adjusting the location of the adjustable position shock of FIG. 37.

FIGS. 37-39: Shock Mounting Position Variable Along Frame Upright

Instead of mounting the shock 108, 110 (i.e., dampening or resistance elements 76) between the treadle 12 and the base portion 14 of the frame as shown in FIGS. 26-29, and as described above, the shock 108, 110 may be mounted between the treadle 12 and an upright portion 40, 42 of the frame as shown in FIG. 37. FIG. 37 illustrates an arrangement that permits a user to adjust the position of a treadle 12 on a dual deck exercise device 10 (as described elsewhere herein) by adjusting the attachment point of a shock 108, 110 connected between the treadle 12 and a frame 14, 40, 42 of the exercise device 10. The lower end 108B of the shock 108 is attached to the side frame 54 of the treadle 12 and the upper end 108A of the shock 108 is attached on the upright member 40 of the frame. The upright member 40 of the frame is provided with a range of attachment points 314 at different heights on the upright member 40. This range of attachment points 314 provides different angular orientations for the treadle 12 for the desired exercise impact on the user.

Each treadle may be provided with its own shock 108, 110 so that the two treadles 12 can be adjusted to have different nominal slopes. In this manner the user can customize the workout to be more strenuous on one leg than the other.

The multiple shock attachment locations 314 can be discrete. For instance, as shown in FIGS. 37 and 38, a pin 316 is used to attach the top end 108A, 110A of the shock to the upright 40, 42. The top end 108A, 110A of the shock 108, 110 is provided with a passage 318 for engaging the pin 316. The upright 40, 42 is provided with a series of apertures 314 that can be engaged by the pin 316 at the desired height. To adjust the attachment location of the shock 108, 110, the passage 318 at the end of the shock 108A, 110A is aligned with the desired aperture 314 in the side of the upright 40, 42, and the pin 316 is inserted into the aperture 314. The pin 316 may be a threaded device 320, or may be spring-loaded to be held in place in the aperture 314. To readjust the position of the shock 108, 110, the pin 316 is withdrawn from the aperture 314, which leaves the top end 108A, 110A of the shock 108, 110 free to be realigned with a different aperture 314.

Alternatively, the attachment locations can be continuous as through the use of structure such as that shown in FIG. 39. The upper end 108A, 110A of the shock 108, 110 could be fashioned to move within a groove provided in the upright of the frame based on, for instance, the rotation of a lead screw 304. The positioning of the top end 108A, 110A of the shock 108, 110 could be virtually infinite between the ends of the lead screw 304. Rotation of the lead screw 304 to adjust the top end 108A, 110A of the shock 108, 110 can be automatic, as by an electric motor, or manual with a crank. The treadles 12 can be adjusted to different heights or to the same heights depending on the user's desire. FIG. 39 shows a lead screw 304 embodiment for the adjustment of the top end 108A, 110A of the shock 108, 110. The top end 108A, 110A of the shock 108, 110 is attached to a collar 302, which collar 302 is threadedly engaged with the lead screw 304. When the lead screw 304 is rotated, the collar 302 moves upwardly or downwardly depending on the engaged threads and the rotation direction of the lead screw 304. This adjustment of the attachment position of the top 108A, 110A of the shock 108, 110 can be vertical, angled, or curvilinear or in any other direction supported by the particular structure utilized.

Figure 30:
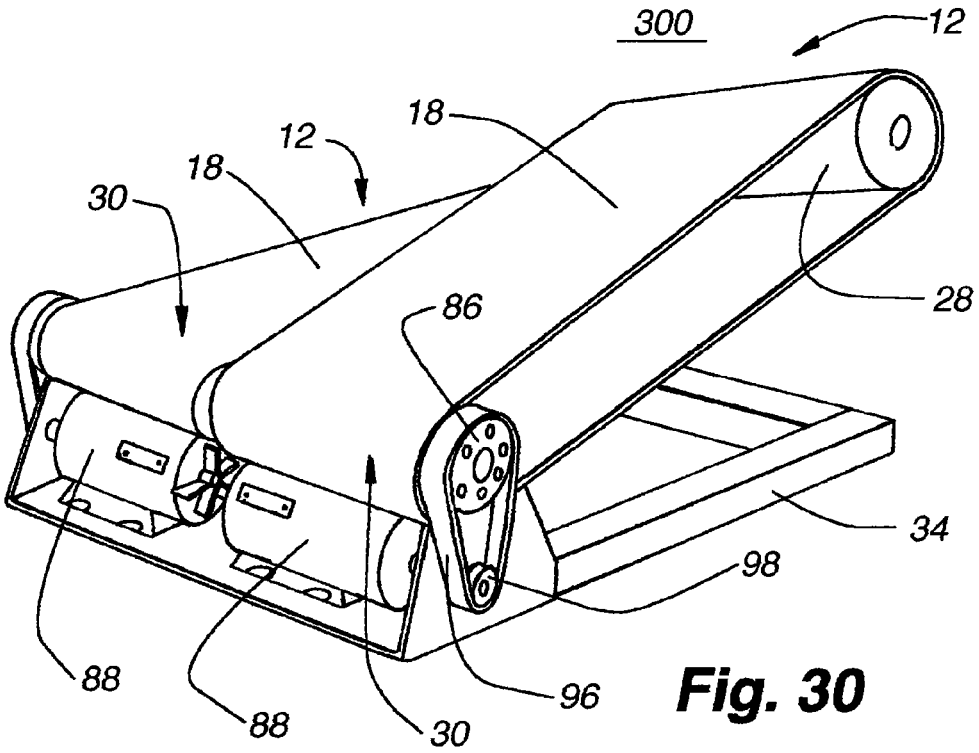
FIG. 30 is an isometric view of a base portion of a dual tread exercise device, wherein each tread is provided with its own driver roller and motor.

FIG. 30: Dual Treadle Exercise Device Having Two Motors

Heretofore arrangements have been discussed wherein a single driver roller and motor was used to drive both tread belts 18 on a dual deck exercise device 10. FIG. 30 illustrates an embodiment wherein each tread belt 18 is provided with its own driver roller 30 and motor 88. FIG. 30 shows the base portion 300 of a dual deck exercise device 10 having two adjacent treadles 12. Each treadle 12 has a pair of end rollers 28, 30 at opposite ends of the treadle 12. A continuous tread belt 18 is provided around the end rollers 28, 30. One of the two end rollers 28, 30 for each treadle 12 is the driver roller, though it should be appreciated that the driver roller could be located intermediately on the treadle 12 as well. In the embodiment shown in FIG. 30, the driver rollers 30 are the rear rollers 30. Additional rollers (i.e., intermediate rollers 916 as depicted in FIG. 84) or support structures 324 may be provided between the end rollers 28, 30 (e.g., FIGS. 31-34 and accompanying discussion). It will be noted that each treadle 12 can be operably associated with a dampening device such as a shock 108, 110, a spring device for returning the treadle 12 to its upper position, and an interconnect (e.g., the rocker arm assembly 112 depicted in FIG. 10) to create a dependency between the motions of the treadles 12 (as one treadle is pushed down, the other treadle 12 is pushed up by the dependency device 112).

FIG. 30 is meant to emphasize that the driver roller 30 does not have to be common between the two adjacent treadles 12. In other words, more than one driver roller 30 can be utilized, such as one for each treadle 12. Each driver roller 30 is driven by its own motor 88 through a pulley 86, 98 and belt 96 system. A common controller (not shown) may be provided to assure that the motors 88 operate synchronously to make sure that the tread belts 18 are driven at the same speed. However, it is contemplated that each motor 88 can be separately controlled in order to have the tread belts 18 on the treadles 12 be driven at different speeds if desired by the user. While in FIG. 30 the drive rollers 30 are shown having axially aligned center lines, this is not a requirement for the instant invention, and each of the drive rollers 30 can have non-aligned axes of rotation. It should also be appreciated that while a belt 96 and pulley 86, 98 system is shown, any functionally equivalent arrangement such as cogs and gears, chain drives, direct drive, or friction drive would work as well. For information regarding alternative drives see FIGS. 44A, 44B, and accompanying discussion.

FIGS. 31-34: Deck Suspension Systems

Figure 31:
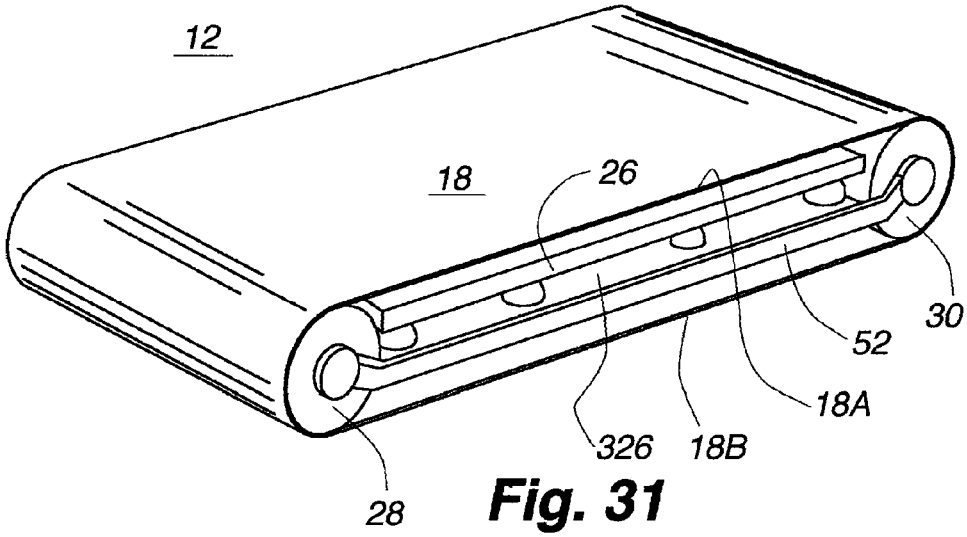
FIG. 31 is an isometric view of a treadle assembly according to one embodiment of the present invention.

FIGS. 31-34 highlight a variety of types of deck 26 suspensions for use on the treadles 12 of the instant dual deck exercising apparatus 10. FIG. 31 shows a treadle 12 assembly that includes a pair of rollers 28, 30 at opposite ends of a frame 52. A continuous tread 18 is provided around the rollers 28, 30 such that it loops around the frame 52 and rollers 28, 30 to form an upper span 18A of the tread 18 and a lower span 18B of the tread 18. A top surface of the upper span 18A of the tread 18 provides the surface on which a user steps while using an exercise device 10 that incorporates the treadle 12 assembly. Preferably the continuous tread 18 is under tension such that it will frictionally engage the rollers 28, 30. The rollers 28, 30 may be provided with teeth to engage notches in the tread 18 for a more positive drive than relying on friction. Rotation of the rollers 28, 30 will thereby cause the tread 18 to move in a circuit around the rollers 28, 30. With continued reference to FIG. 31, if the rollers 28, 30 rotate in a clockwise direction, the upper span 18A will move generally to the right, while the lower span 18B will translate to the left.

An upper deck 26 and a lower deck 326 are positioned between the spans 18A, 18B of the tread 18. A suspension system 324 is provided between the upper and lower decks 26, 326 in order to properly position and cushion the upper deck 26. The embodiment shown in FIG. 31 uses the lower deck 326 as the primary frame structure 52 for supporting the rollers 28, 30. Alternatively, the lower deck 326 could be attached to a framework 52 that independently supports the rollers 28, 30. The upper deck 26 should have a generally flat and smooth top surface. The dimensions of the top surface of the upper deck 26 should correspond roughly with the length and width of the upper span 18A of the tread 18. The upper deck 26 can be a generally rectangular sheet of wood, such as ply wood or pressed board, or other like material positioned underneath the top span 18A of the tread 18. A friction reducing coating may be provided on the top surface of the upper deck 26 so that the upper span 18A of the tread 18 will slide easily across the top surface of the upper deck 26.

The suspension system 324 can be any arrangement that appropriately retains the upper deck 26 in position directly below the upper span 18A of the tread 18. The upper deck 26 may be positioned in supporting contact with the upper span 18A of the tread 18, or may be spaced slightly below the tread 18 under no load conditions. The suspension system 324 should also provide cushioning such that when a user steps on the upper span 18A of the tread 18, the momentum of the user's weight, as applied to the upper deck 26 through the tread 18, is dissipated somewhat smoothly rather than in a sharp jolt.

The suspension system 324 of FIG. 31 includes an array of resilient rubber bumpers 324 provided between the lower and upper decks 26, 326. Under no load conditions as shown in FIG. 31, the upper deck 26 rests on the bumpers 324 and is held in position immediately under the upper span 18A of the tread 18. In order to retain the upper deck 26 in place, the upper deck 26 may be adhered or otherwise attached to the bumpers 324. As a user impacts the upper tread 18A, the tread 18 deflects slightly downwardly against the top surface of the upper deck 26. Under load, the upper deck 26 deflects towards the lower deck 326. As the upper deck 26 is pressed towards the lower deck 326 by the weight and momentum of the user, the rubber bumpers 324 compress and deform to smoothly transfer the weight to the lower deck 326 and ultimately the frame 52. Other resilient materials that are well suited for absorbing shocks may be used rather than rubber to form the bumpers 324.

Figure 32:
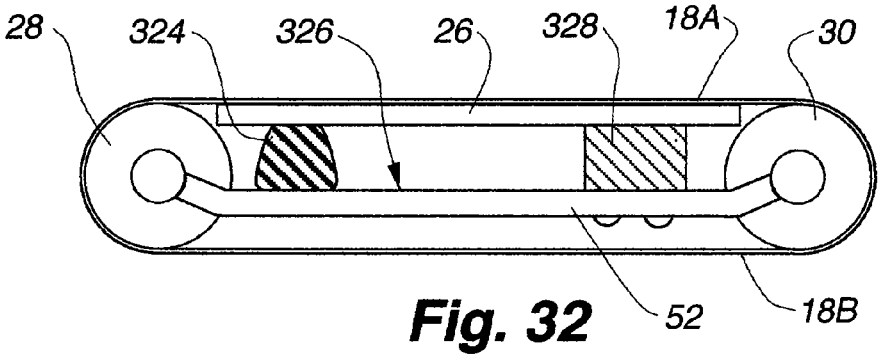
FIG. 32 is a side elevation view of a treadle assembly according to one embodiment of the present invention illustrating a treadle that uses a soft bumper and a hard bumper to support an upper deck.

An alternative arrangement is shown in FIG. 32. A rigid bumper 328, such as hard plastic, wood, or metal, is positioned near the drive wheel (which is the rear roller 30 in FIG. 32) and is meant to restrict deflection of the upper deck 26 towards the lower deck 326 in the region of the rigid bumper 328. This prevents additional surface area of the tread 18 from contacting the drive roller 30, which can cause uneven driving of the tread 18 around the rollers 28, 30. This rigid bumper 328 is fixedly attached to both the upper and lower decks 26, 326. The opposite end of the upper deck 26 (the left end as viewed in FIG. 32) is free and is spaced apart from the lower deck 326 by a softer resilient bumper 324, such as a foamed rubber piece. Thus, the upper deck 26 is mounted in a generally cantilever fashion above the lower deck 326. The natural resiliency of the upper deck 26 acts as a flat spring that provides some cushioning effect in addition to the cushioning provided by the resilient bumper 326. The resilient bumper 324 can be positioned at any point between the rigid bumper 328 and the free end of the upper deck 26, and more than one bumper 324 can be used. The soft bumper 324 can be shorter than the distance between the two decks 26, 326, or can fit snugly between the two decks 26, 326 and contact the top and bottom deck 26, 326 before any deflection of the top deck 26 takes place.

Figure 33:
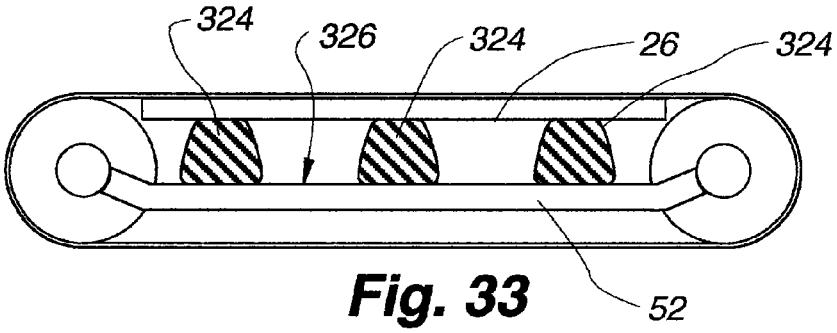
FIG. 33 is a side elevation view of a treadle assembly according to one embodiment of the present invention illustrating a treadle that uses multiple soft bumpers to support an upper deck.

FIG. 33 shows another embodiment of the suspension structure, and includes a plurality of relatively soft bumpers 324, such as those made by rubber or other similar materials, positioned between the upper and lower decks 26, 326. The multiple bumpers 324 can be positioned in arrays, randomly, or with one bumper 324 positioned near the centerline of the forward end of the upper deck 26.

Figure 34:
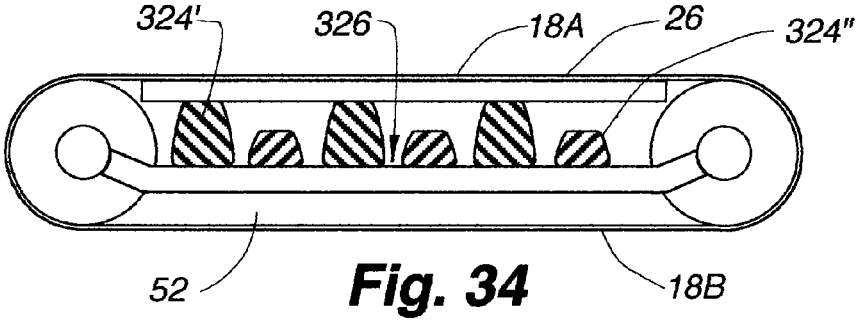
FIG. 34 is a side elevation view of a treadle assembly according to one embodiment of the present invention illustrating a treadle that uses multiple bumpers of varying heights and hardness to support an upper deck.

FIG. 34 shows another embodiment of the suspension structure which incorporates relatively tall soft bumpers 324' and relatively short hard bumpers 324" in combination between the upper and lower decks 26, 326. This arrangement allows substantial upper deck 26 deflection initially when a load is applied to the upper deck 26 through the upper span of the tread 18A; however it prevents excessive deflection once the weight is applied to the shorter hard bumpers 324". Initial downward deflection of the upper deck 26 occurs with the deck 26 in contact only with the tall soft bumpers 324". Once the deflection is sufficient that the upper deck 26 is brought in contact with the short hard bumpers 324", the short hard bumpers 324" prevent the upper deck from significant further deflection. Therefore, the initial shock of the user's weight and momentum is cushioned by the tall resilient bumpers 324', but excessive deflection is prevented by the short hard bumpers 324'.

Other types of resilient deck suspension structures for being positioned between the upper deck 26 and any deck below it can be utilized. Non-discrete structures, such as a single sheet of pliable material or other such resilient structure can be used between the upper and lower decks 26, 326 to dampen the impact force of the user's foot on the deck 26 during use.

Figure 35:
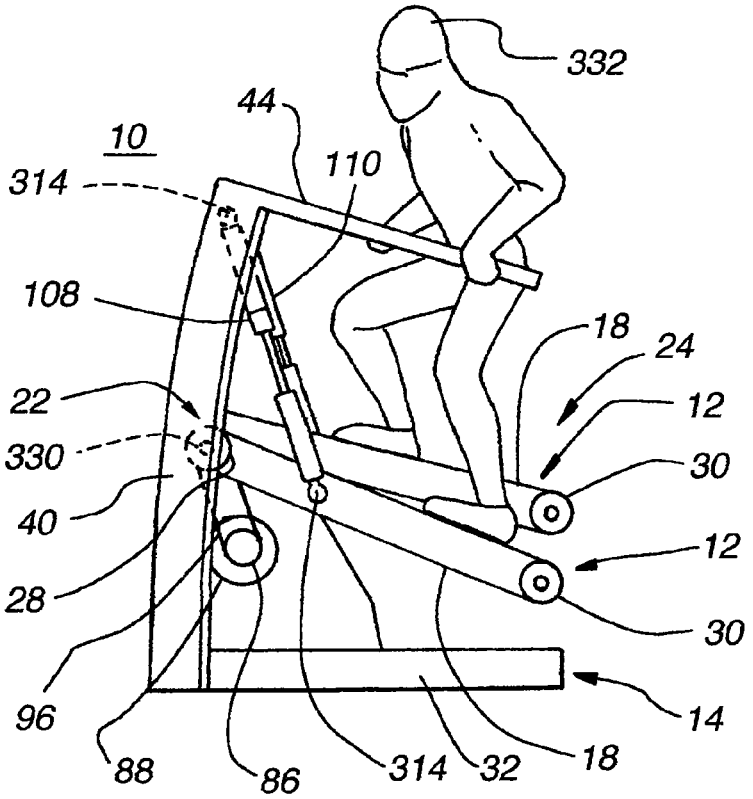
FIG. 35 is a side elevation view of an exercise device according to the present invention having front pivoting treadles, a side shroud is removed to reveal the pivot connection and motor.

FIG. 35: Front Pivoting Treadle Assemblies

Heretofore, most of the discussion herein has described treadles 12 that pivot about an axis 16 that is at or near the rear portion of the treadles 12 (e.g., see FIGS. 1, 26, 30 and 37). FIG. 35 shows a dual deck treadle device 10 similar to those described elsewhere herein, but wherein the treadles 12 pivot about a pivot axis 330 at or near a front portion 22 of the treadles 12. As seen in FIG. 35, a frame 14 is provided that includes an upright 40 at the front of the frame 14. Each treadle 12 is attached at its front end 22 to the upright portion 40 of the frame 14 in a pivotal relationship, with the rear end 24 of the treadle 12 suspended freely. Therefore, the front portion 22 of the treadle 12 is pivotally restrained, while the rear portion 24 of the treadle 12 will move in a generally vertical arc.

A motor 88 is mounted to the frame 14 in order to drive a moving tread 18 provided on the treadles 12. Connection of the motor 88 to the tread 18 can be by any of the means described in more detail throughout this description. For the purposes of illustration, a pulley 86 and drive belt 96 are shown in FIG. 35. The drive belt 96 attaches to a driver roller 28 at the front 22 of each treadle 12. There can be one motor 88 for a common front drive roller 28, or there could be two drive rollers 28, one for each treadle 12, each having its own drive motor 88. A housing or shroud may be provided at the front of the frame to cover the motor 88 and pivot 330. The left side cover has been removed in FIG. 35 so that the motor 88 and pivot 330 are visible.

With continued reference to FIG. 35, a shock absorber 108, 110 or other dampening or resistance device is provided between each treadle 12 and the frame 14. In the example shown, the treadles are suspended by shocks 108, 110 that connect to the upright 40, 42. Motion of the treadles 12 in the vertical plane is thereby resisted and dampened. The no-load position of the treadles 12 could be adjusted by varying the attachment point 34 of the shock 108, 110 to the upright 40, 42 or the treadle 12. While not shown in the figures, it should be understood that the shock absorber 108, 110 or other dampening device could connect to the lower portion 32 of the frame 14 rather than the upright 40, 42. An interconnecting device (not shown) might also be provided to make the motion of the treadles 12 complementary with each other.

When the user 332 faces forward and walks or runs forwardly, each treadle 12 pivots downwardly around its front pivot point 330 while the user's foot is in contact therewith during a forward to rearward motion of the foot. The foot is then picked up and brought back to the front end 22 of the treadle 12 during which time the treadle 12 moves from a downwardly angled position to an upwardly angled position, or at least a position having less of a downward angle, to be ready for the user 332 to reengage with the user's foot. The shocks 108, 110 can be spring-loaded for an automatic retraction to a higher position, or the shocks 108, 110 can be merely dampeners with external springs associated with the treadles 12 to bias the treadles 12 in an upward position. A single spring could be used or a double spring could be used or no spring could be used. This device could be utilized with the user 332 facing away from the upright post 40, 42 and running forward or backward, or with the person 332 facing towards the upright post 40, 42 as shown with the user 332 climbing forwardly or rearwardly.

Figure 36:
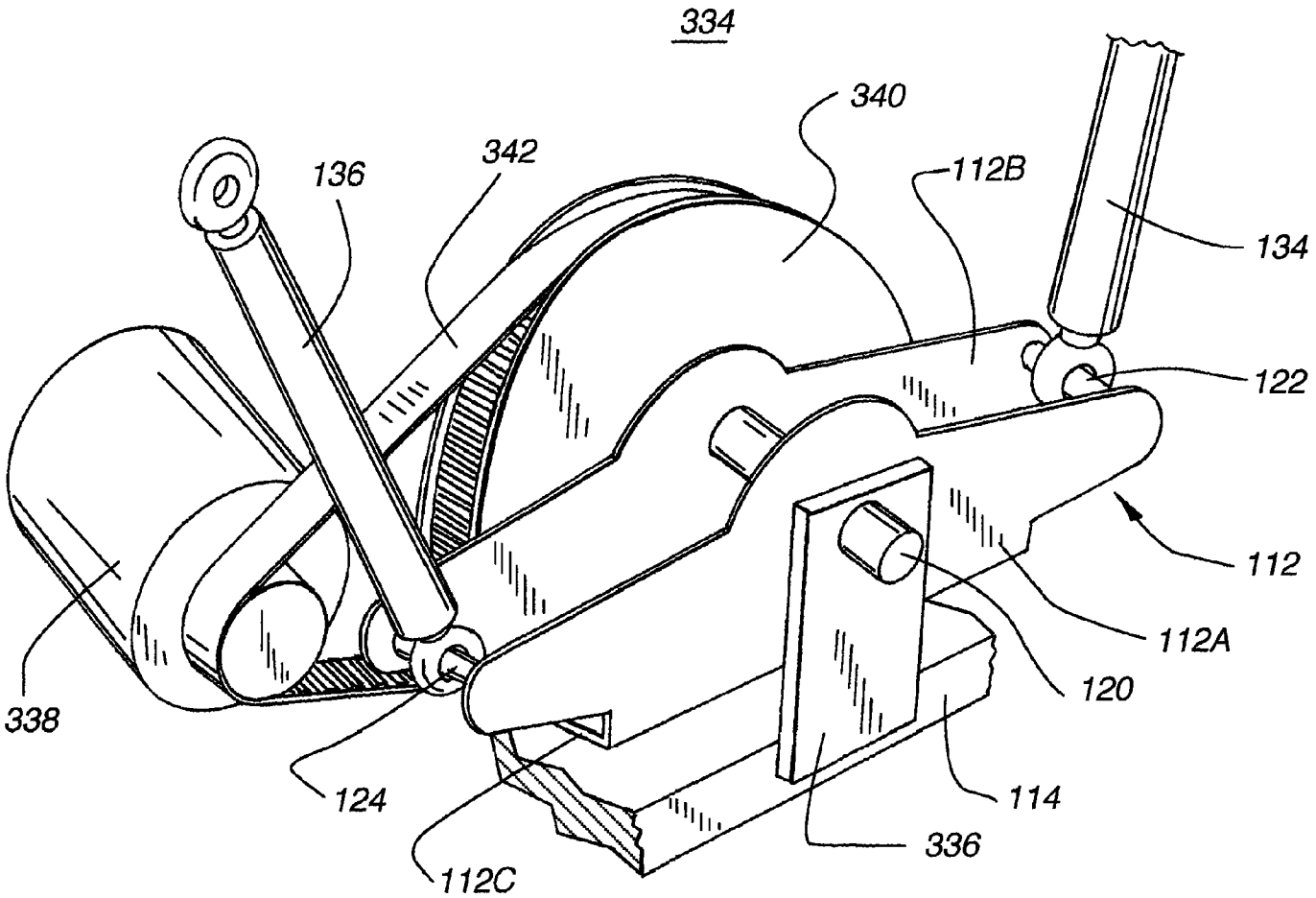
FIG. 36 is a partial isometric view of a dependency structure for interconnecting the movement of two treadles in a dual-deck exercise machine.

FIG. 36: Dampening Device Associated with Dependency Structure

FIG. 36 shows an interconnecting device 334 for use in coordinating the movement of the treadles 12. This coordination is desirable so that a stepping action can be produced by the treadles 12 wherein the movement of the two treadles 12 is always 180 degrees out of phase. For example, when the left treadle 12 is at the top of its movement, the right treadle 12 will be at the bottom. Any downward motion in the left treadle 12 will result in a corresponding upward movement by the right treadle 12, and vice versa. One basic structure for interconnecting the treadles 12 in this fashion is a rocker-arm structure 112. Each treadle 12 is attached to a different side of the rocker arm 112 by a tie rod 134, 136. Any movement of one treadle 12 causes a reaction force in the opposite direction because the movement is transmitted to the other treadle 12 through the rocker arm 112. This action is described in more detail below with specific reference to FIG. 36.

The interconnecting device 334 of FIG. 36 includes a rocker arm 112 pivotally associated with a pivot pin 120. The pivot pin 120 is supported by a bracket 336. The bracket 336 is preferably securely mounted to the base frame 114 below the treadles 12. A mounting pin 122, 124 for supporting a tie rod 134, 136 is provided at each end of the rocker arm 112 (preferably equidistance away from the pivot pin 130 but not required). A tie rod 134, 136 is pivotally attached to each mounting pin 122, 124 and extends generally upwardly to a bottom portion of a corresponding treadle 12 (not shown). The rocker arm 112 of FIG. 36 is formed with two facing plates 112A, 112B connected by a lower web 112C; however, other structures may be used to form the rocker arm 112, and the one illustrated in FIG. 36 should be considered illustrative only. The mounting pins 122, 124 for pivotally supporting the tie rods 134, 136 are positioned between the plates 112A, 112B of the rocker arm 112.

The rocker arm 112 interconnects the movement of the treadles 12 in the manner described herein. As one treadle 12 is pushed down and the corresponding tie rod 134 is pushed down, which pushes a first end of the rocker arm 112 down. The other end of the rocker arm is moved upwardly by the pivoting action of the rocker arm 112 about the pivot pin 120. This upward movement of the other end of the rocker arm 112 causes the other tie rod 136 to be pushed upwardly, and thus pushes the other treadle 12 upwardly. If the tie rods 134, 136 are of equal length and are equally spaced apart from the pivot point 120 of the rocker arm 112, the corresponding movements of the treadles 12 will be equal with each other.

It should also be appreciated that any resistance applied to the movement of one treadle 12 will be transmitted through the interconnecting device 334 as resistance to the opposite movement of the other treadle 12. If desired, resistance can be applied to the treadles 12 through the interconnecting device 334 rather than directly to the treadles 12. FIG. 36 illustrates the use of a rotational brake 338 for providing resistance to movement of the treadles by applying resistance to the interconnecting device 334. According to this embodiment, a pulley 340 is attached to the pivot pin 120. Optionally, the pulley 340 could be attached directly to the rocker arm 112. The pulley 340 is connected by a belt 342 to a rotational brake mechanism 338. The brake mechanism 338, by engaging with the pulley belt 342, provides resistance to turning of the pulley 340, and thereby provides resistance to the motion of the rocker arm 112, which in turn provides resistance to the motion of each of the treadles 12. The brake 338 can be adjusted from low load effect to a high load effect as desired by the user through normal motor controls. The brake 338 shown in FIG. 36 could be a brake motor, a rotational brake, or an electro-magnetic brake.

Figure 41A:
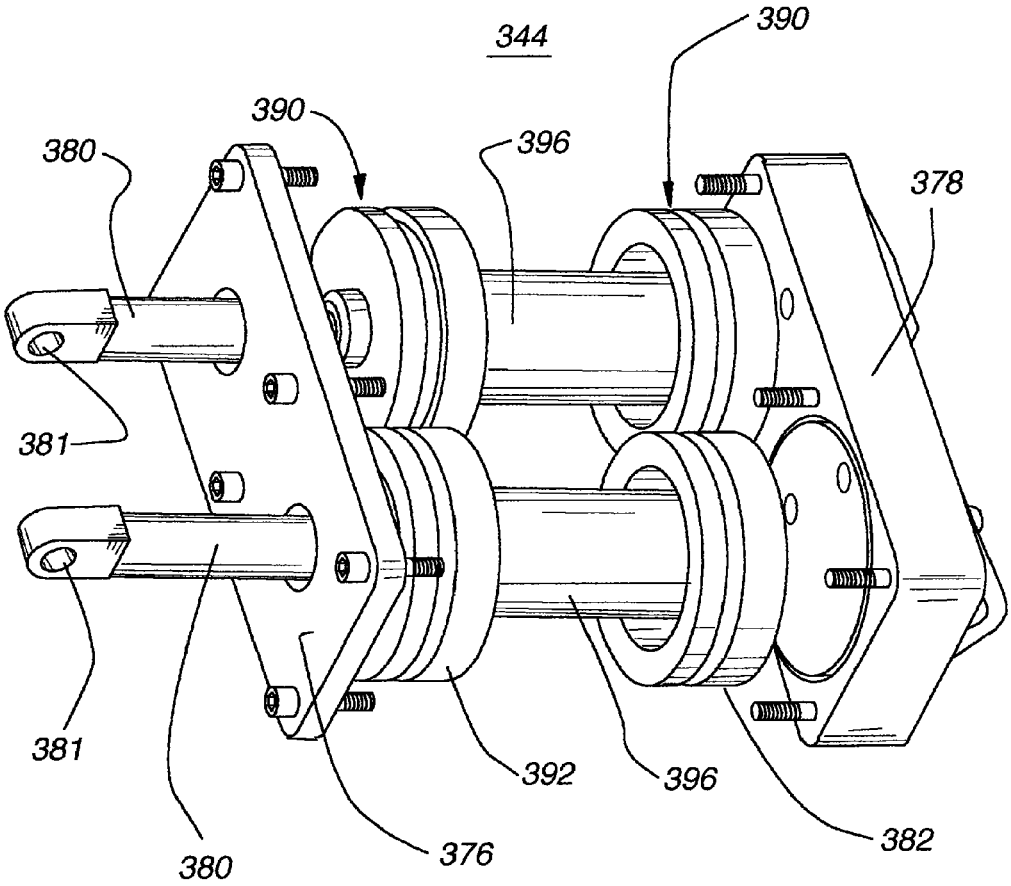
FIG. 41A is an isometric view of an embodiment of a dual-cylinder dampening device for use in a dual deck exercise machine with a portion of the housing removed to allow viewing of the internal structure of the dampening device.

Other types of brakes can be applied directly to the rocker arm or to a pulley system such as shown in FIG. 36. For example, a simple friction brake that resists rotation could be applied to the pin 120 of the rocker arm 112. Also, other types of resistance could be applied. For example a two-cylinder hydraulic dampening device 344, such as shown in FIG. 41A, and described in detail in the discussion of that figure, can be connected to the rocking arms 112 to resist movement of the treadles 12.

Figure 40A:
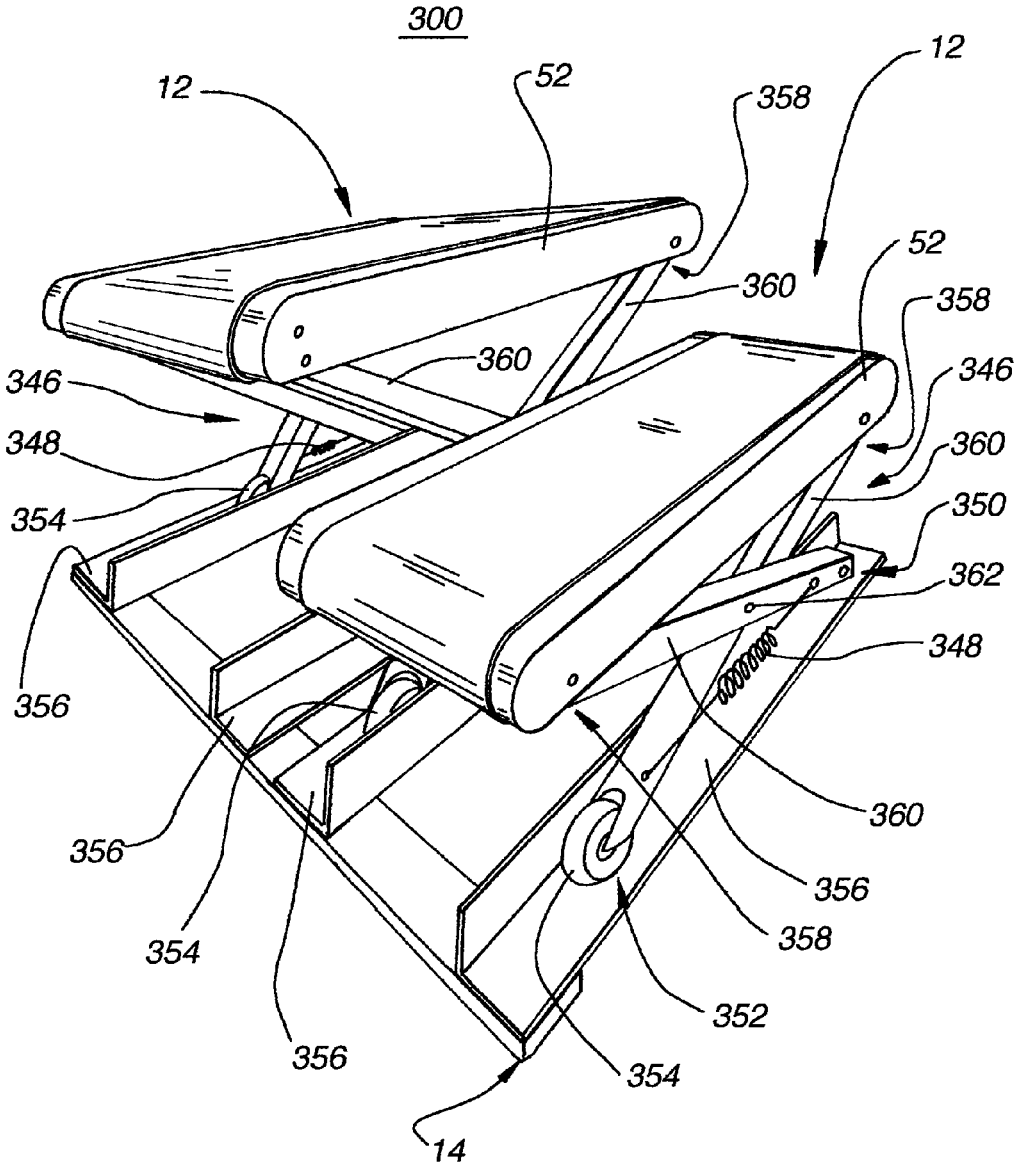
FIG. 40A is an isometric view of a base of a dual deck exercise machine that uses a scissor truss structure to support treadles according to one embodiment of the present invention.
Figure 40B:
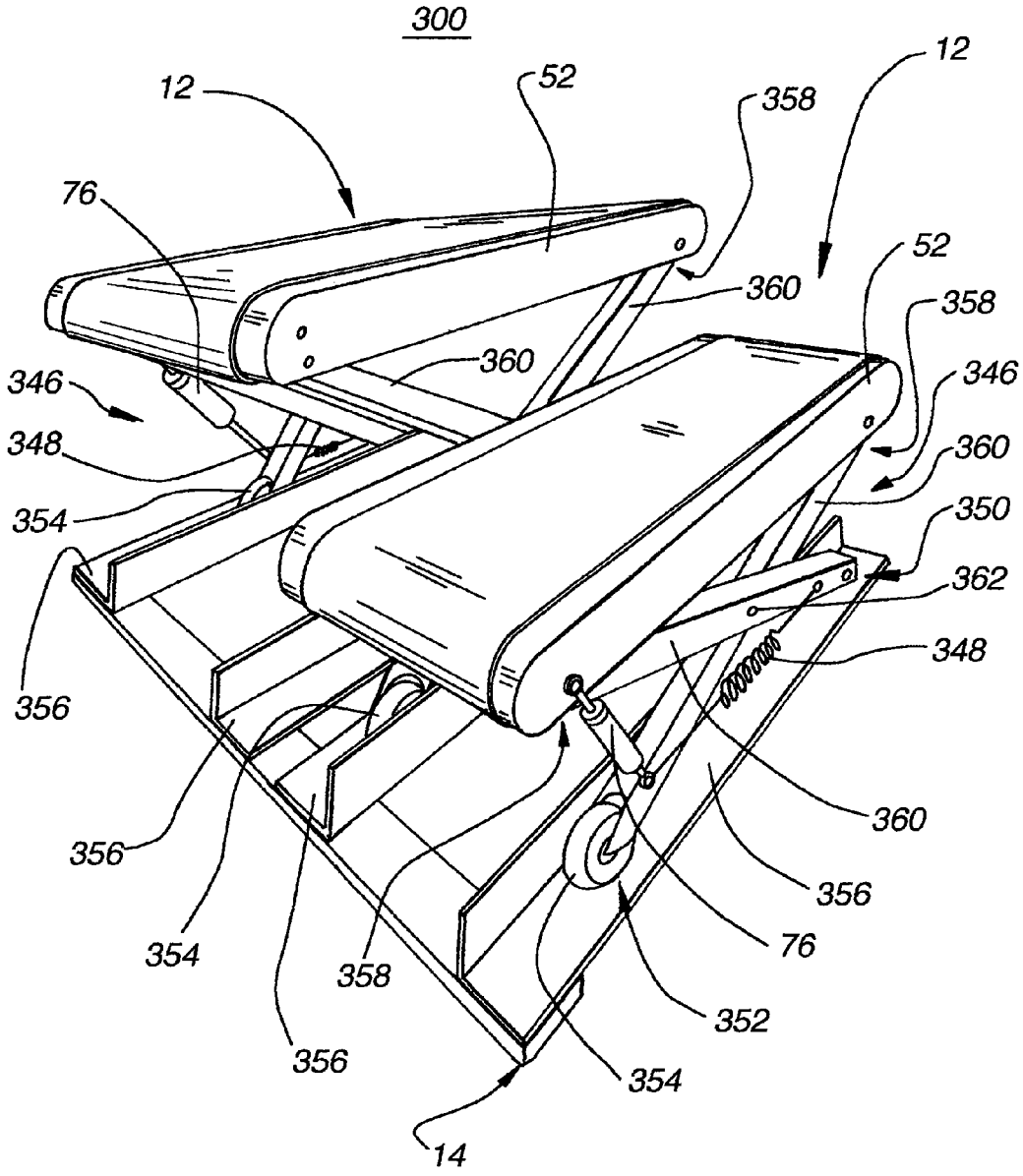
FIG. 40B is an isometric view of a base of a dual deck exercise machine that uses a scissor truss structure to support treadles and a shock to dampen the reciprocal movement of the treadles, according to one embodiment of the present invention.

FIGS. 40A-40B: Scissors Truss for Supporting Treadles

FIG. 40A shows a base portion 300 of the dual deck tread exercise device 10 as described elsewhere herein utilizing a scissor-type truss support mechanism 346 to allow the treadles 12 to move downwardly and facilitate their upward motion under the force of a retracting spring 348. At the lower end of the scissor truss 346, one end 350 of the scissor truss is attached to the frame 14, while the other end 352 is slidably supported by the frame 14. Preferably the slidable end 352 of the truss 346 is provided with a wheel 354 that rides in a track 356 provided on the base 14. At the upper end of the particular scissor truss both ends 358 are attached to the treadle 12. Typically there are two scissor trusses 346 for each treadle 12, with one scissor truss attached to each side frame 52 of the treadle. This provides for stability and robustness of design, however, is not required as only one scissor truss 346 could be used if appropriately positioned directly below the treadle.

FIG. 40B shows the right hand treadle 12 in the lower position and the left hand treadle 12 in a higher position. The spring 348 shown with respect to the right hand scissor truss 346 pulls the bottom ends 350, 352 of the scissor truss together and biases the treadle 12 towards the upper position. Alternatively, a spring could be placed between the two front ends of the scissor truss or the two back ends of the scissor truss to urge those ends apart from each other. In use, the scissor frame 346 collapses and expands under the force of the user. An interconnect device 334 can be implemented to force one treadle up while the other treadle is being pushed down and vice versa. Dampeners 76, such as shown in FIG. 41, can be included in the structure to react with the scissor truss 346 or with the movement of the treadle 12 to create a dampening environment requiring more energy to actuate if desired.

The motion of the treadles 12 shown in FIG. 40A is such that they remain parallel to the floor or any support surface upon which they are resting. Accordingly, a slope could be added to the treadles by tilting the portion of the frame 14 on which the scissor trusses 346 are supported. This could be accomplished for example by making the support track 356 on which the wheels 354 slide movable relative to the base 14 and providing a lift mechanism to raise one end of the track 356. Alternatively, an initial slope or tilt could be added to the treadles 12 by varying the lengths of the links 360 or moving the scissor point 362 of the scissor truss. Articulating motion of the treadles on the top of the scissor structure can be created by having additional structural links and springs and/or dampeners to allow the treadle 12 to move to a horizontal position either slightly or to a greater degree, depending on the complexity of the design.

FIGS. 41A-41D: Two Chamber Hydraulic Dampening Device

FIGS. 41A-D show a dual-cylinder shock 344 for operable attachment to the treadles 12 of a dual deck exercise device 10 as described herein, in order to provide resistance to movement of the treadles 12. The dual-cylinder shock 344 includes two cylinders 364. Each cylinder 364 has a reservoir portion 366 for containing a hydraulic fluid, such as oil. The reservoir portions 366 of the two cylinders 364 are connected via a connection line 368, which has a valve 370 positioned therein. A plunger 372 is positioned in each of the cylinders 364. Each treadle 12 is connected to a plunger 372 in order to alternatingly push in and pull out the corresponding plunger 372. As the plungers 372 are pushed in and pulled out of their respective cylinders 364, they pump the hydraulic fluid back and forth between the reservoirs 366 through the connection line 368 and valve 370. The resistance to flow of the hydraulic fluid provided by the connection line 368 and valve 370 is transmitted to the treadles to dampen their movement.

Figure 41B:
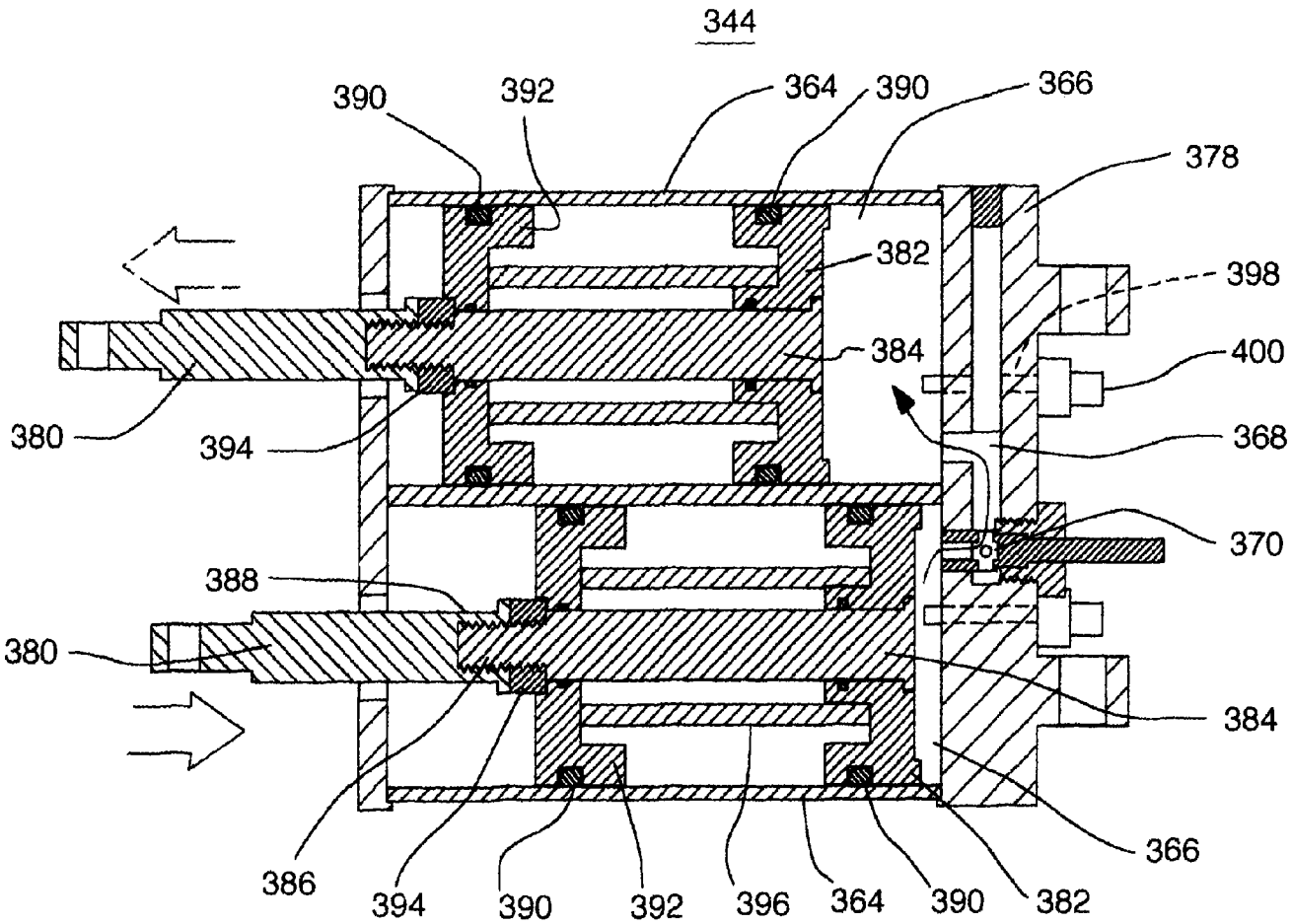
FIG. 41B is a cross-section view taken along line A-A of the dual-cylinder dampening device of FIG. 41.
Figure 41C:
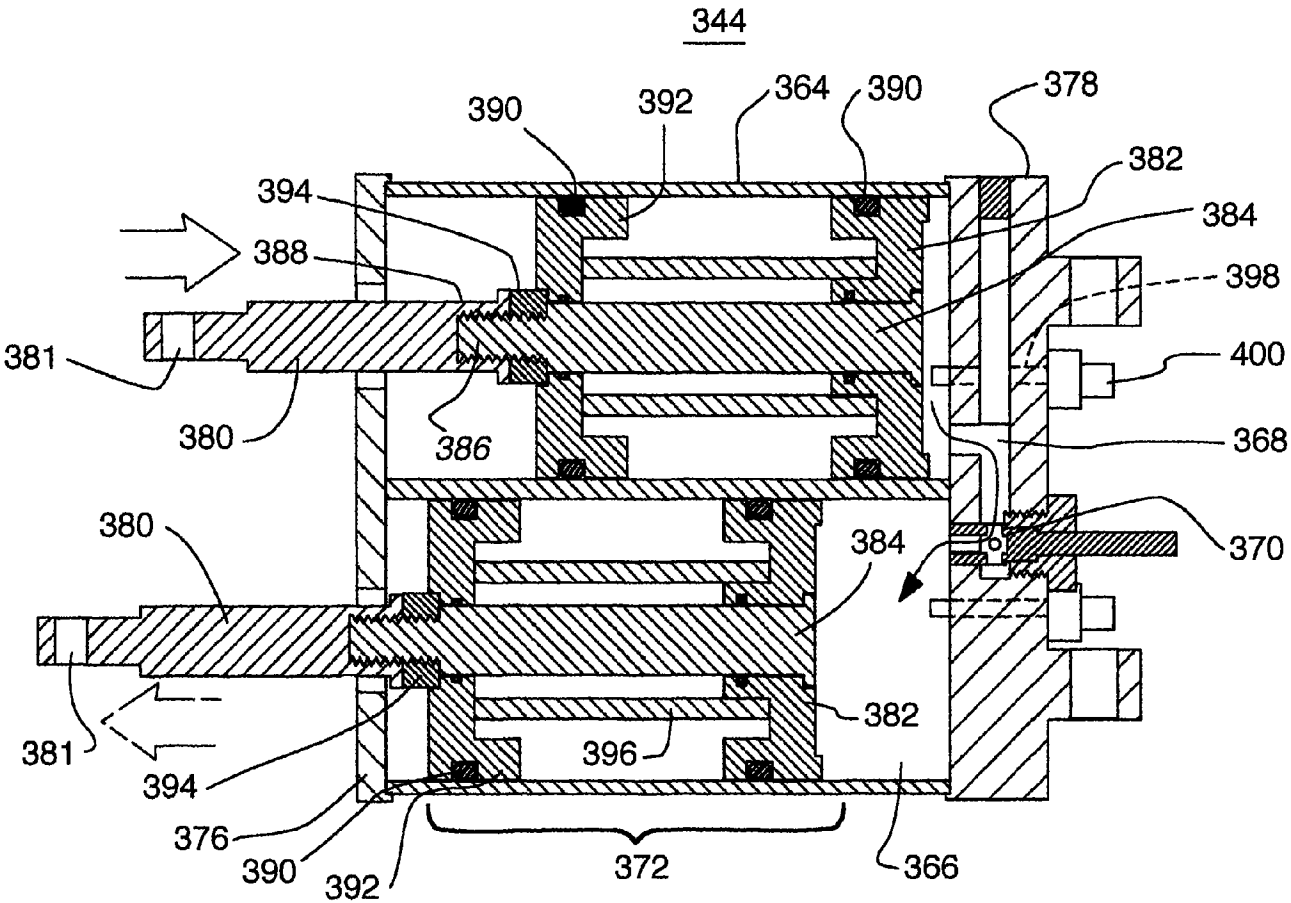
FIG. 41C is a cross-section view taken along line A-A of the dual-cylinder dampening device of FIG. 41A, with the plungers adjusted to a different position within the cylinders.
Figure 41D:
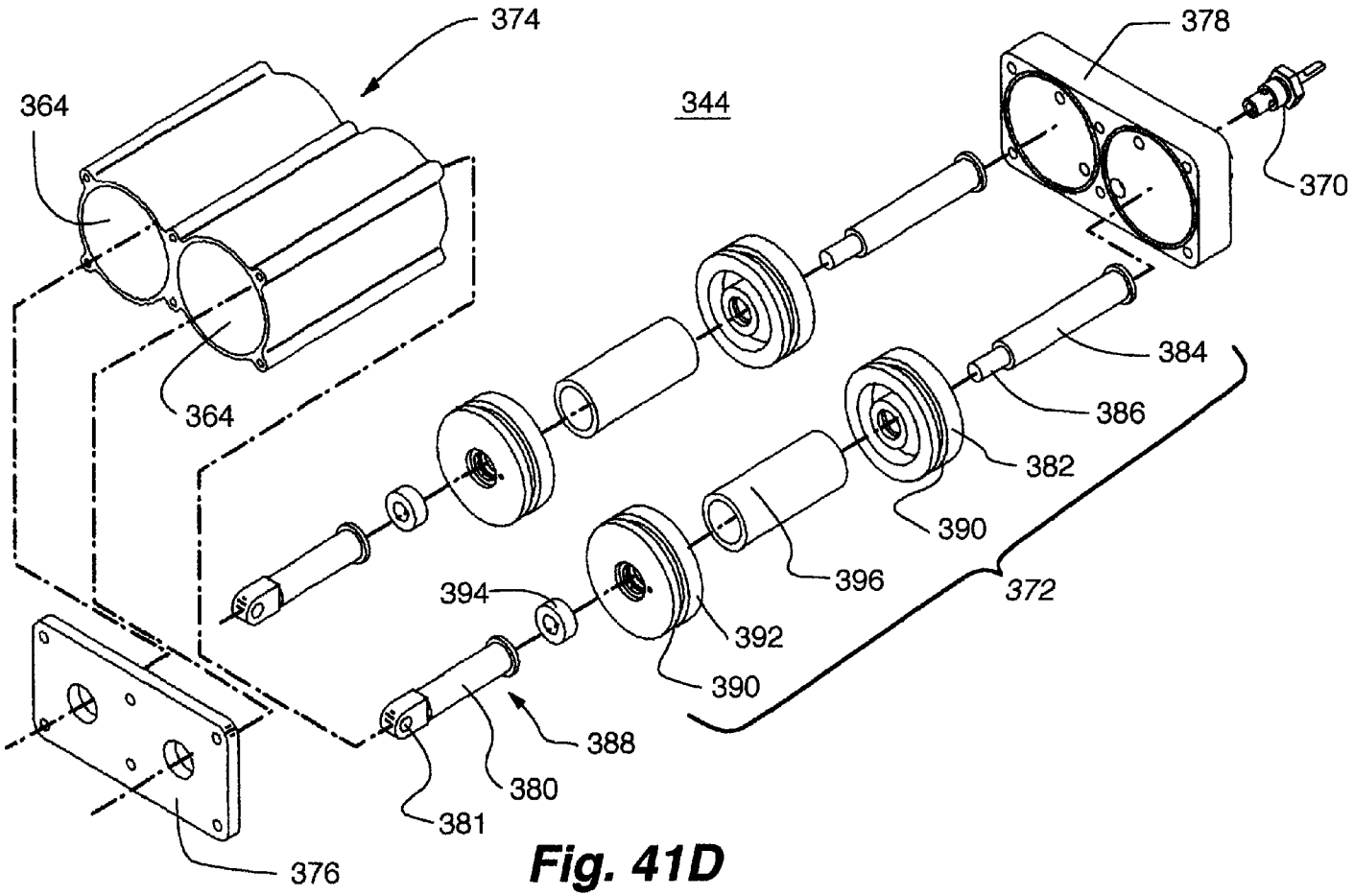
FIG. 41D is an exploded view of the dual-cylinder dampening device of FIG. 41A.

FIG. 41D provides an exploded view of the embodiment of FIGS. 41A-D. It can be seen that the two cylinders 364 are formed side-by-side in a unitary body 374. A treadle end cap 376 and a reservoir end cap 378 are provided at opposite ends of the unitary body 374 to enclose the cylinders 364. The end caps can be connected to the unitary body by fasteners such as threaded bolts. Connection rods 380 are provided to connect the plungers 372 to the treadles or dependency structure. The plungers 372 are formed by pistons 382 and piston rods 384. The piston rods 384 are fixed to the pistons at one end, and are threadably engaged by the connection rods 380 at the other end. The threadable connections between each piston rod 384 and connection rod 380 is formed by a male portion 386 on the piston rod 384 and a female portion 388 of the connection rod 380. The pistons 382 slide within their cylinders 364 and are sealed to the interior of the cylinders by sealing rings 390. A push plate 392 may also be provided within each cylinder 364 at the junction between the connection rod 380 and the piston rod 384. The push plate 392 should be slidable within its cylinder, and fixed with respect to its corresponding piston 382. The push plate 392 may also be sealed with the cylinder 364 by sealing rings 390, although this is not required. A spacer 394 may be provided between each connection rod 380 and its corresponding push plate 392. A cylindrical structure 396 surrounds each piston rod 384 and helps to maintain the faces of the piston 382 and push plate 392 perpendicular to the side walls of the cylinder 364.

As seen in FIG. 41B, the reservoir end cap 378 is in sealed engagement with the cylinders 364. The space between the piston 382 and the end cap 378 forms the reservoir portion 366 of each cylinder. A passage 368 in the reservoir end cap 378 forms the connection line 368 between the two reservoir portions 366. The passage 368 may be extended to an opening 398 in the reservoir end cap 378 in order to allow filling of the reservoirs 366. A removable plug 400, preferably threaded, is provided in the opening 398 to keep the passage sealed. An adjustable needle valve 370 extends into this connection line 368. The needle valve 370 can be adjusted by turning it to vary the size of the aperture that permits flow of fluid between the reservoirs 366. The smaller the aperture, the more restricted the flow, and the higher the resistance.

In operation, as a treadle 12 is pushed downward by a user, the treadle pushes against its corresponding connection rod 380 either directly or through a dependency structure to urge the connection rod into the unitary body 374. As the connection rod 380 is pushed inward into the unitary body 374 by the treadle, the corresponding plunger 372 moves towards the end cap 378. In other words, the piston 382 moves towards the reservoir end cap 378.

FIGS. 41B and 41C serve to illustrate the above described functioning of the dual-cylinder shock 344. FIG. 41B is a cross-section view showing the upper plunger 372 nearly fully extended outwardly and the lower plunger 372 nearly fully pushed inward. FIG. 41C shows the same dual-cylinder shock 344 after the treadles to which the plungers 372 are operably connected have been moved. In FIG. 41C, the upper plunger 372 has been pushed into its cylinder towards the reservoir end cap 378, and the lower plunger 372 has been withdrawn to expand its reservoir 366. In order to move from the position of FIGS. 41B to 41C, it was necessary to force hydraulic fluid from the upper reservoir 378 into the lower reservoir 378 through the adjustable needle 370 valve and the connection line. The force required to pump the fluid from one reservoir 366 to the other provides resistance to movement of the treadles 12.

Each of the connection rods 380 have a pin receiving hole 381 for connecting with either the treadle or to a portion of the dependency structure. If an incompressible fluid is used as the hydraulic fluid, the dampening device can serve as the dependency structure.

Figure 42:
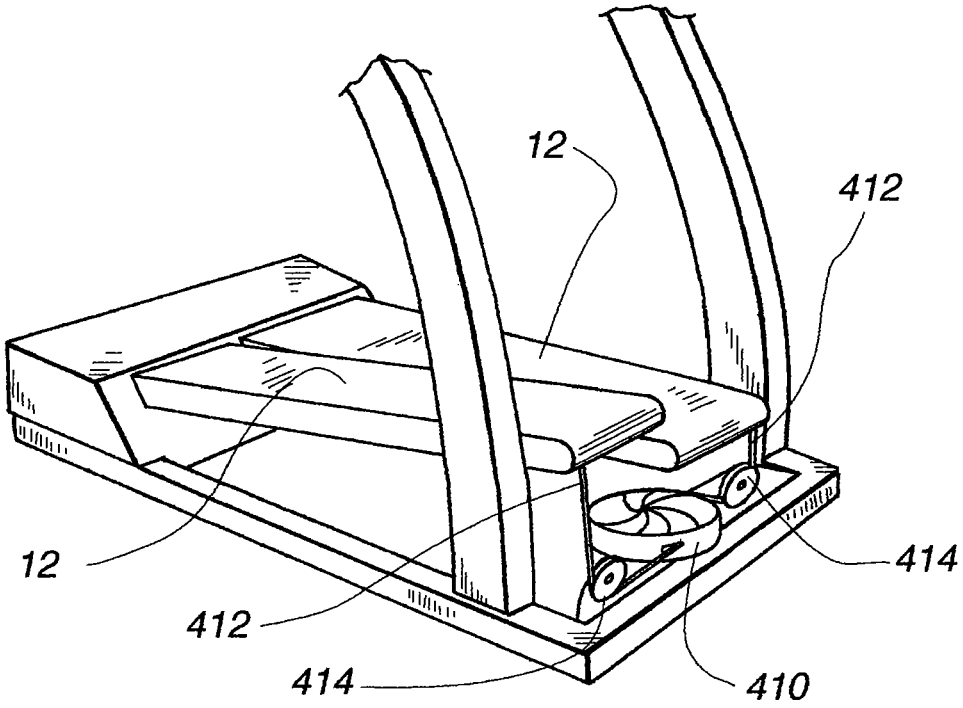
FIG. 42 is a partial isometric view of an embodiment of a dual-deck exercise machine according to the present invention that utilizes a Spiraflex® dampening device.

FIG. 42: Spiraflex® Dampening Device

FIG. 42 shows the use of a Spiraflex® resistance mechanism 410 as a damper for the downward motion of the treadles 12. The Spiraflex® mechanism 410 is described in U.S.

patent application Ser. No. 09/802,835, filed Mar. 8, 2001, which is hereby incorporated by reference, and owned by the assignee of the present invention. A dependency structure between the treadles 12 interconnects the motion of the treadles such that upward motion of one treadle cause downward motion of the other treadle, and vice versa. The treadles 12 are tied to the Spiraflex® mechanism 410 by cables 412 and pulleys 414. As described in the aforementioned patent application, the Spiraflex® 410 is a resistance mechanism that provides nearly constant resistance.

The upward motion of either treadle 12 is resisted by the Spiraflex® mechanism 410. This resistance to upward movement is transferred through the dependence structure to the other treadle 12, such that the Spiraflex® mechanism 410 effectively provides resistance to depression of either treadle 12. One of the treadles 12 is connected to rotational means within the Spiraflex® by a cable 412 routed through a pulley 414 while the other treadle 12 is connected to another rotational means within the Spiraflex® through another cable 412 and pulley 414 arrangement. As shown, the Spiraflex® 410 is mounted on the base frame 14, however it could be positioned in any functional location on the frame structure.

Figure 43:
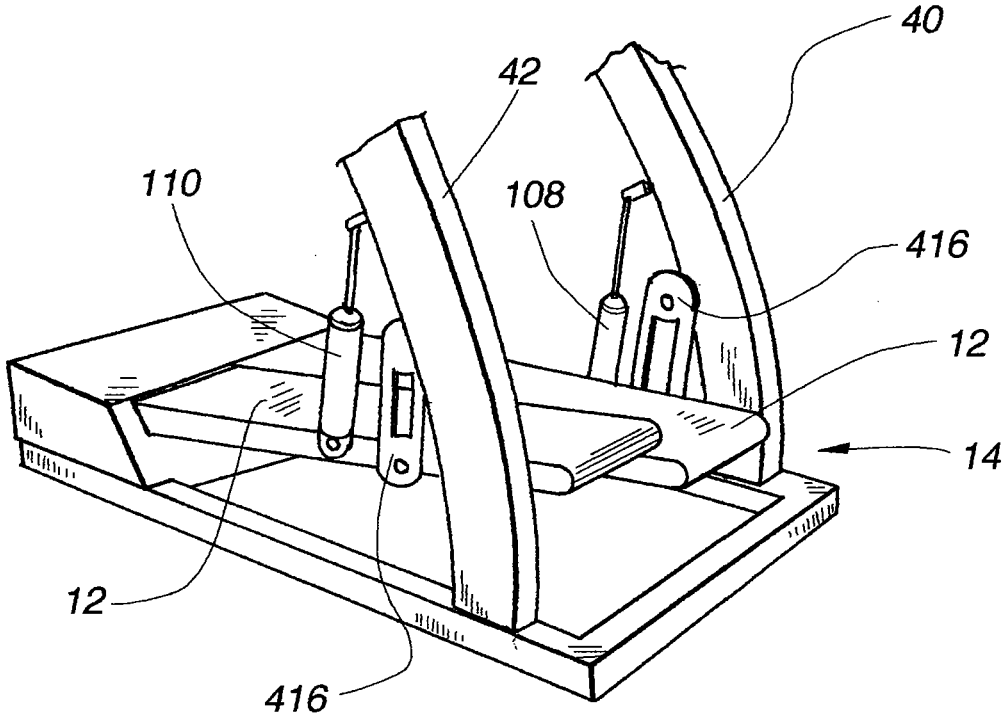
FIG. 43 is a partial isometric view of an embodiment of a dual-deck exercise machine according to the present invention that includes dampening devices and return springs mounted between the treadles and the frame of the exercise machine.

FIG. 43: Combination Dampening and Biasing

FIG. 43 shows a dual deck tread climber 10 as described elsewhere herein, with shock-like dampeners 108, 110 used in conjunction with elastomeric spring return devices 416. The dampeners 108, 110 provide the primary resistance to movement of the treadles 12, while the elastomeric spring devices 416 act to return the treadles to a raised position. The shock-like dampeners 108, 110 are mounted to extend from one treadle to the frame upright 40, 42, in order to dampen the downward movement of the treadle 12 to provide resistance to the user. The dampener 108, 110 also resists the upward movement of the treadle, and based on the design of the dampener, can dampen the upward movement significantly or let it move relatively freely upwardly. This dampening of the upward movement can be desirable as it prevents the treadle 12 from snapping upwardly too quickly upon the user's weight being removed from the treadle during exercise.

The elastomeric spring 416 shown in FIG. 43 is attached between the treadle 12 and the frame upright 40, 42 to provide the return force to return the treadle to its high or upper position. If an interconnect is used between the treadles 12, such as a rocker arm 112, then the elastomeric springs 416 will cause the treadles to rise to a position where they are generally flush with one another, but not at the upper position. It should be noted that if an interconnect is used, the elastomeric spring 416 could be attached to the interconnect device rather than directly to the treadles 12. As shown, the left treadle 12 is pushed downwardly to stretch the spring 416. The elastomeric spring 416 in this example is a Soloflex® weight band, but it could also be some other type of elastomer or other similar type of material having elastic, resilient properties sufficient for the intended use. The position of the elastomeric spring 416 can be modified as long as the downward movement of treadle 12 loads the elastomeric spring in such a way as to create biasing force opposite the movement. For example, if the spring 416 is in the form of a material that when compressed has sufficient resilient properties to push the treadle 12 upwardly, the elastomeric spring could be positioned such that downward movement of the corresponding treadle compresses, rather than stretches, the spring.

Figure 44A:
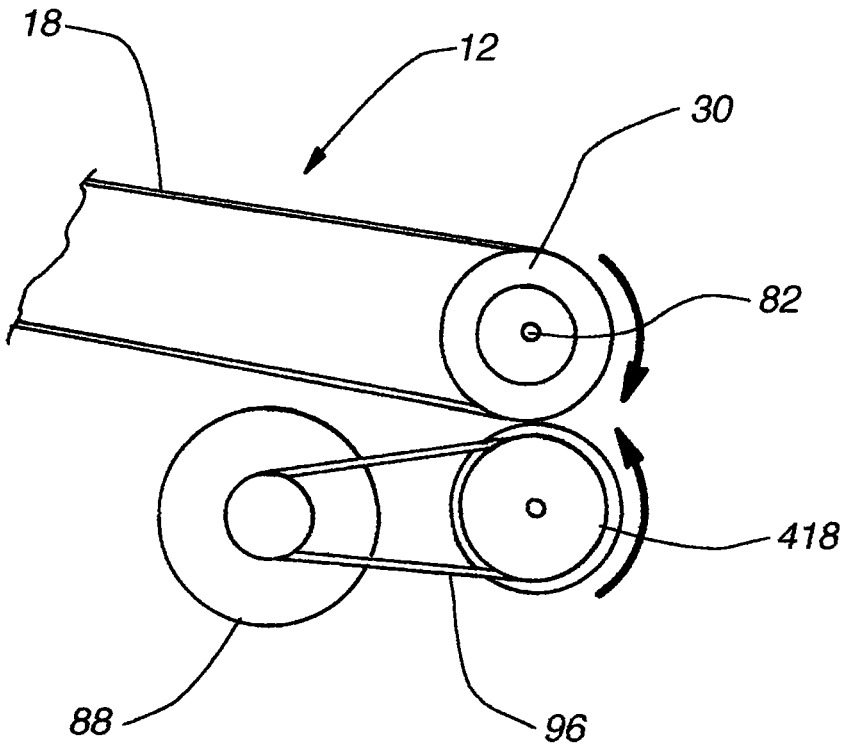
FIG. 44A is a partial side view of a drive roller mechanism and treadle assembly according to one embodiment of the present invention.
Figure 44B:
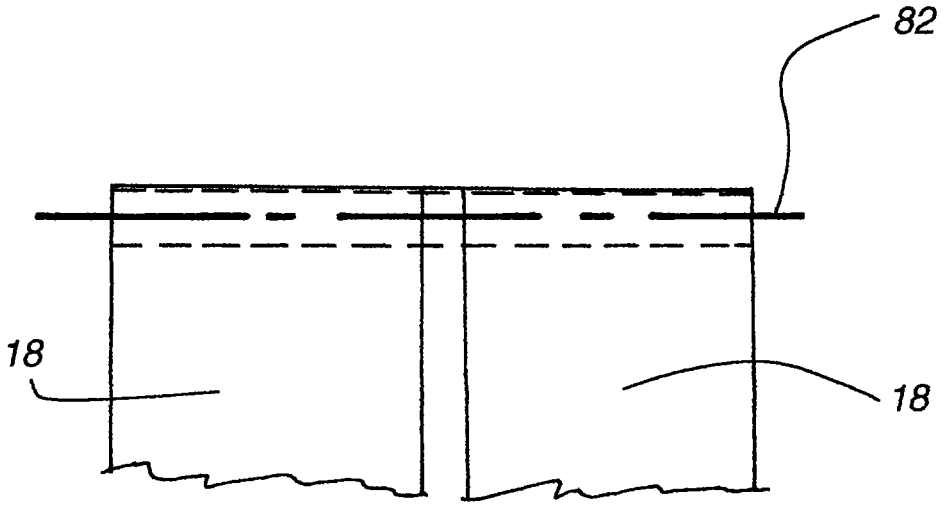
FIG. 44B is a partial top view of the drive roller mechanism and treadle assembly of FIG. 44.

FIGS. 44A and 44B: Drive Roller Exterior to Treadle Assembly

FIGS. 44A and 44B show an alternative embodiment for driving the continuous tread belt 18 on each treadle 12, either individually or in combination. Instead of directly driving one of the rollers 28, 30 in the treadle structure (such as shown elsewhere) to drive the tread 18, the instant embodiment utilizes a drive roller 418 that is external to the treadle structure to drive the tread 18. In the embodiment shown in FIGS. 44A and 44B, the external drive roller 418 frictionally drives the tread 18 by impinging upon the tread and pinching it against one of the passive rollers 28, 30 in the treadle 12. The drive roller 418 is driven by a motor 88 and belt drive assembly 96. As the drive roller 418 is rotated by the motor 88, it creates a friction force against the tread 18 that causes the tread to translate between the rollers 30, 418.

The structure can include means for engaging and disengaging the drive roller 418 from the tread 18. This can be something that simply moves the drive roller up/down and into/out of contact with the tread. The drive roller 418 can drive the tread 18 in either of the two directions, depending upon which direction the drive roller is spinning. The speed of the tread 18 can be adjusted by adjusting the speed at which the motor 88 turns the drive roller 418. Preferably, the drive roller 418 and the tread 18 are in a no-slip relationship, in order to reduce wear on the tread. If the pivot axis of the treadle 12 is the same as the pivot axis 82 for the treadle roller 30, the drive roller 418 will remain in tangential contact with the tread as the angle of the treadle is adjusted, without the need for any additional structure to maintain contact. Structure is contemplated to maintain contact between the drive roller 418 and the tread 18 where the pivot axis of the treadle is forward, rearward, above or below the pivot axis 82 of the treadle roller 30.

Alternatively, instead of contacting the continuous tread 18 directly, the drive roller 418 could be in direct friction contact relation with a roller 30 on the treadle 12 to tangentially drive the roller 30 and cause the tread 18 to move. In this arrangement, the drive roller 418 is put in pressure contact with the front or rear roller 28, 30 to create a frictional interface with the front or rear roller 28, 30. As the drive roller 418 is rotated by the motor 88, it in turn rotates the treadle roller 28, 30 it is in contact with. The roller 28, 30 being driven rotates and thus drives the tread 18. The drive roller 418 can drive the tread 18 in either of the two directions. The structure can include means for engaging and disengaging the drive roller 418 from the treadle roller 30. The drive roller 418 can be controlled by the user from the console to adjust the speed to the desired level.

The drive roller 418 can be positioned such that it contacts the tread 18 or roller 30 of both treadles 12 simultaneously so that both treads 18 are driven by a single motor 88. The treads 18 would move synchronously in this arrangement, which is generally advantageous. Alternatively, each treadle 12 could be provided with its own motor 88.

Again, if the pivot axis of the treadle is the same as the pivot axis 82 for treadle roller 30, the drive roller 418 will remain in tangential contact with the tread as the angle of the treadle is adjusted, without need for any additional structure to maintain contact. Structure is contemplated to maintain contact between the drive roller 418 and the tread 18 where the pivot axis of the treadle is forward, rearward, above or below the pivot axis 82 of the treadle roller.

Rather than relying on friction, the drive roller 418 could be in positive engagement with the treadle roller 30 through a cog belt or gear (not shown) coupled to the treadle roller 30. In this instance, the drive roller 418 could be provided with teeth that engage a gear coupled to the treadle roller 30. As the drive roller 418 rotates, its teeth would engage and drive the gear. The turning gear would rotate the treadle roller 30 to move the tread 18. If the treadle rollers 30 shared a common gear, a single motor 88 could drive both treads 18. Similar controls as discussed above could be provided to move the teeth of the drive roller 418 in and out of contact with the gear, and to control the speed of the motor 88 to adjust the speed of the treads 18.

Figure 45B:
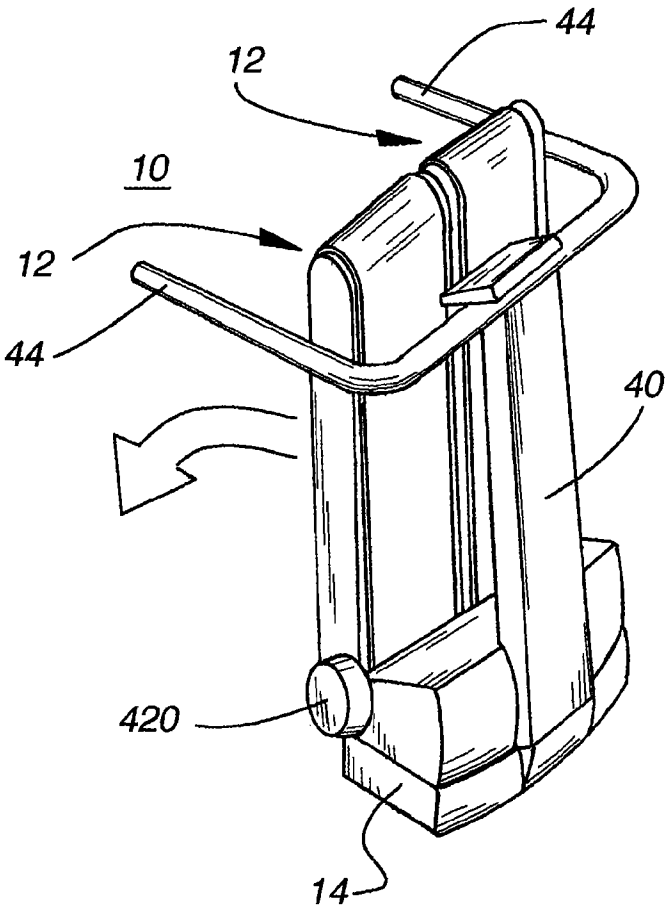
FIG. 45B is an isometric view of the dual deck exercise machine of FIG. 45 folded into a storage position.
Figure 45A:
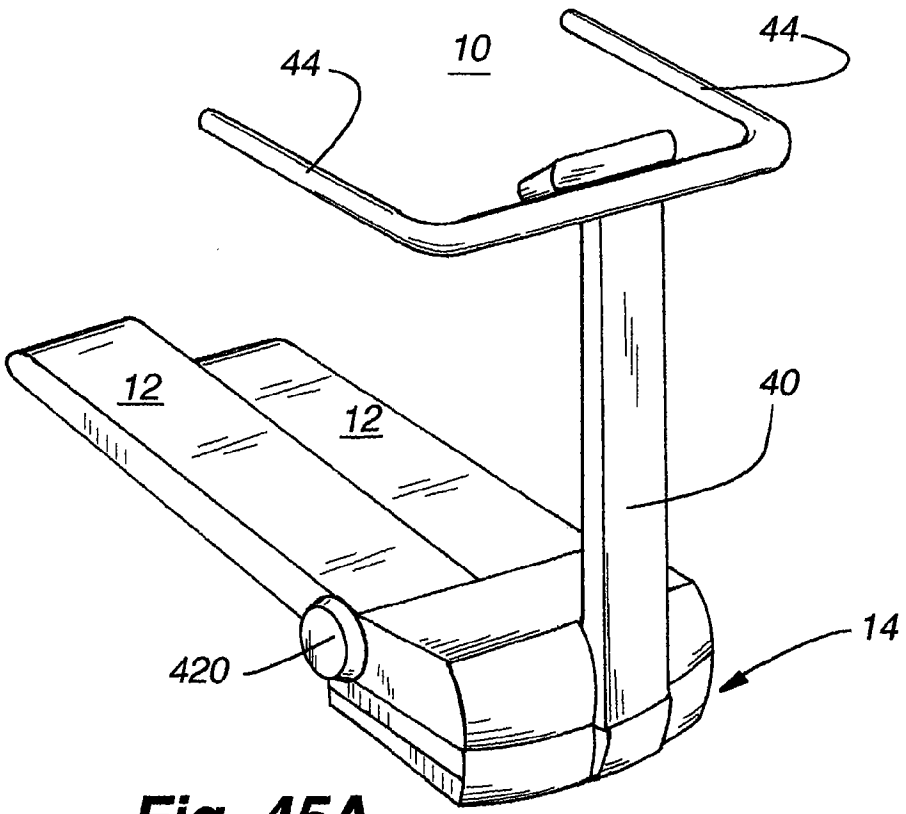
FIG. 45A is an isometric view of an embodiment of a dual deck exercise machine having front mounted treadles according to the present invention.

FIGS. 45 (A, B)-47 (A, B): Dual Deck Exercise Machine Foldable into Storage Position When not in use, it is desirable to be able to fold the exercise device 10 described herein into a more compact storage position. FIGS. 45A and 45B show a dual deck exercise device 10 in an extended FIG. 45A and folded position FIG. 45B. As described elsewhere herein, the dual deck exercise device's basic components include a base frame 14, a pair of treadles 12 pivotally attached to the base frame, either directly or by some structural means, an upright 40 extending from the base frame 14, and side hand rails 44 extending laterally from the upright and generally along the length of the treadles.

The device 10 shown in FIGS. 45A and 45B has a folding feature, where the treadles 12 fold up about their pivotal connection 420 to the base frame, and extend upwardly generally parallel to the upright 40 in a storage position. The folding nature of the device 10 allows it to take up less floor space when the device is stored or otherwise not in use. The device 10 is shown with treadles 12 extended, in an operating position, in FIG. 45A, and with treadles 12 pivoted to the storage position in FIG. 45B. A releasable latch mechanism can be used to attach the treadles to the handrails or uprights in the storage position. Preferably the treadles 12 can pivot "over center" in order to stand upright more securely. In the device of FIGS. 45A and 45B, the base frame 14 is provided at the front of the unit 10, and remains stationary to support the device 10 in the extended use position of FIG. 45A and in the free standing storage position of FIG. 45B.

Various mechanisms are possible to retain the treadles 12 in the upright storage position of FIG. 45B. For example, a cable can be strung between the side rails to retain the treadles 12 in the upright position. A catch could be provided on the outside of each of the treadles 12 that selectively, or automatically engages a corresponding latch provided on each of the handles 44. Alternately, a releasable latch mechanism may be incorporated into the pivotal connection 420, holding the treadles 12 in place until a user releases the latch.

Figure 46A:
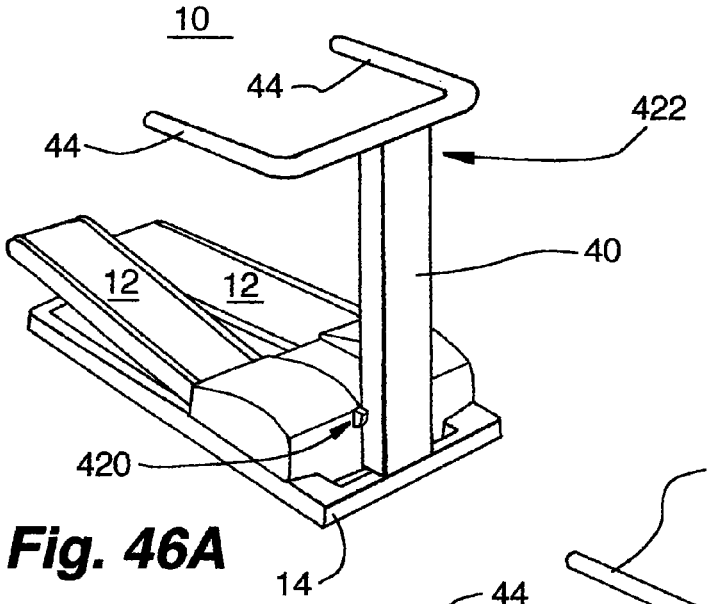
FIG. 46A is an isometric view of an embodiment of a dual deck exercise machine having front mounted treadles, wherein a base frame extends beneath the treadles according to the present invention.
Figure 46B:
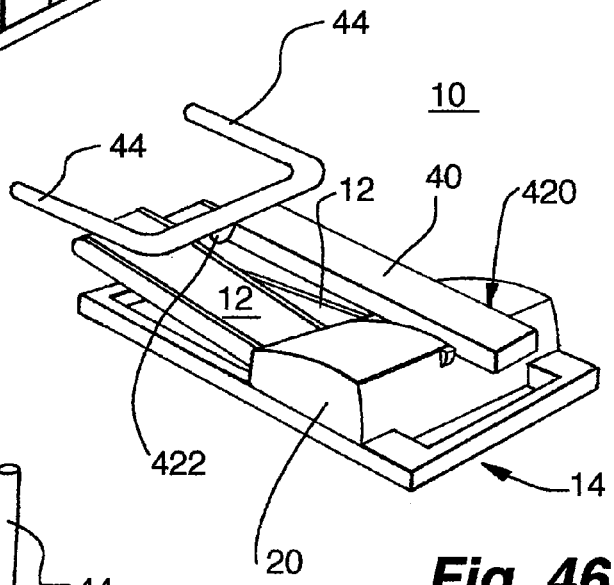
FIG. 46B is an isometric view of the exercise device shown in FIG. 46A adjusted to a folded position.
Figure 46C:
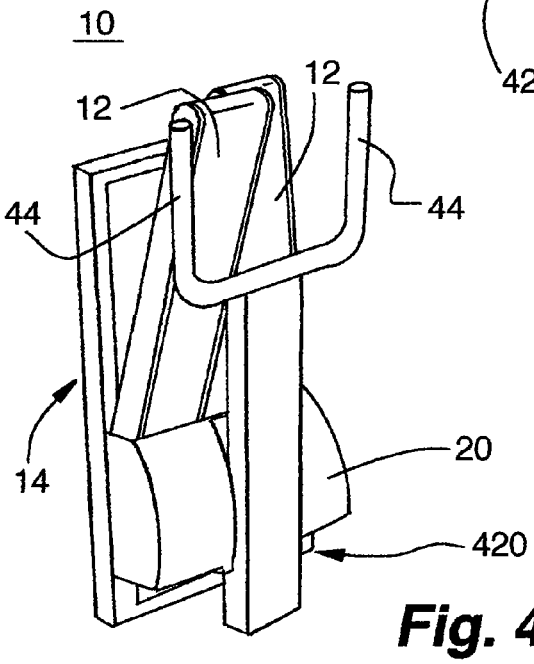
FIG. 46C is an isometric view of the exercise device shown in FIG. 46A adjusted to a free standing storage position.

FIGS. 46A-C display an alternate embodiment of a dual deck exercise device 10 in operational FIG. 46A, folded FIG. 46B, and storage FIG. 46C positions. In the device of FIGS. 46A-C, the base frame 14 is provided under substantially the entire unit 10 when in the operational position of FIG. 46A. As with the embodiment shown in FIGS. 45A and 45B, the present embodiment may be folded to create a smaller device footprint. The present embodiment's basic components here include a left and right treadle 12 assembly, a base frame 14, a housing 20, an upright 40, and a left and right side rail 44. Generally, the treadle 12 assemblies are pivotally attached to the base frame 14, either directly or by a structural means, within or next to the housing 20. The upright 40 is pivotally attached to the housing 20 by an upright pivot 420. The left and right side rails 44 are pivotally attached to the upright 40 by a side rail pivot 422.

As shown in FIG. 46A, when the embodiment is in an operating position, the bottom portion of the upright 40 extends beyond the upright pivot 420, and generally contacts the base frame 14. In alternate embodiments, the upright 40 may stop short of the base frame 14. Further, the left and right side rails 44, which serve as hand rails 40, extend generally perpendicularly from the upright 40 and parallel to the base frame 14 when the embodiment is in operating position.

The embodiment is shown in a folded position in FIG. 46B. In this position the upright 40 has been pivoted around the upright pivot 420 so the upright 40 is generally prone and parallel to the base frame 14 and treadles 12. The upright pivot 420 should be located such that the base of the upright 40 will not extend beyond the front edge of the base frame 14 when the upright is rotated into the folded position shown in FIG. 46B. Most preferably, the upright pivot 420 is located so that the base of the upright 40 will be aligned with the front edge of the base frame 14 when the upright is rotated into the folded position of FIG. 46B.

The left and right side rails 44 may be rotated about the side rail pivot 422 so that they are also generally prone and parallel to the base frame 14 and treadles 12. Although the side rails 44 are shown rotated clockwise about the pivot 422 in FIG. 46B from their operating position of FIG. 46A, in alternate embodiments the side rails 44 may rotate counterclockwise. In yet other embodiments, the clockwise rotational angle of the side rails 44 about the side rail pivot 422 may terminate with the side rails 180 degrees beyond the position shown in FIG. 46B so that the side rails point generally towards the housing 20. A mechanism may be provided for locking the upright 40 and the side rails 44 in the folded position relative to the base frame 14.

Once the side rails 44 and upright 40 have been pivoted into the folded position of FIG. 46B, the embodiment may be stood on its front edge to reduce the overall footprint, as shown in FIG. 46C. The device 10 may simply be grasped and moved through a 90 degree angle to stand on its front edge. The unit is free standing on the front edge of the frame 14 and the bottom portion of the upright 40. Alternately, a base frame pivot (not shown) may be affixed to the bottom front edge of the base frame 14, and the device 10 may pivot about the base frame pivot. Further, one or more lateral stabilization elements (not shown) may project outwardly from the base frame pivot at a 90 degree angle from the device's final storage position (i.e., the position shown in FIG. 46C to provide additional support against tipping of the device 10. The base of the upright 40 and front of the base frame 14 also act as lateral supports when the device 10 is raised into the final storage position shown in FIG. 46C.

Figure 47A:
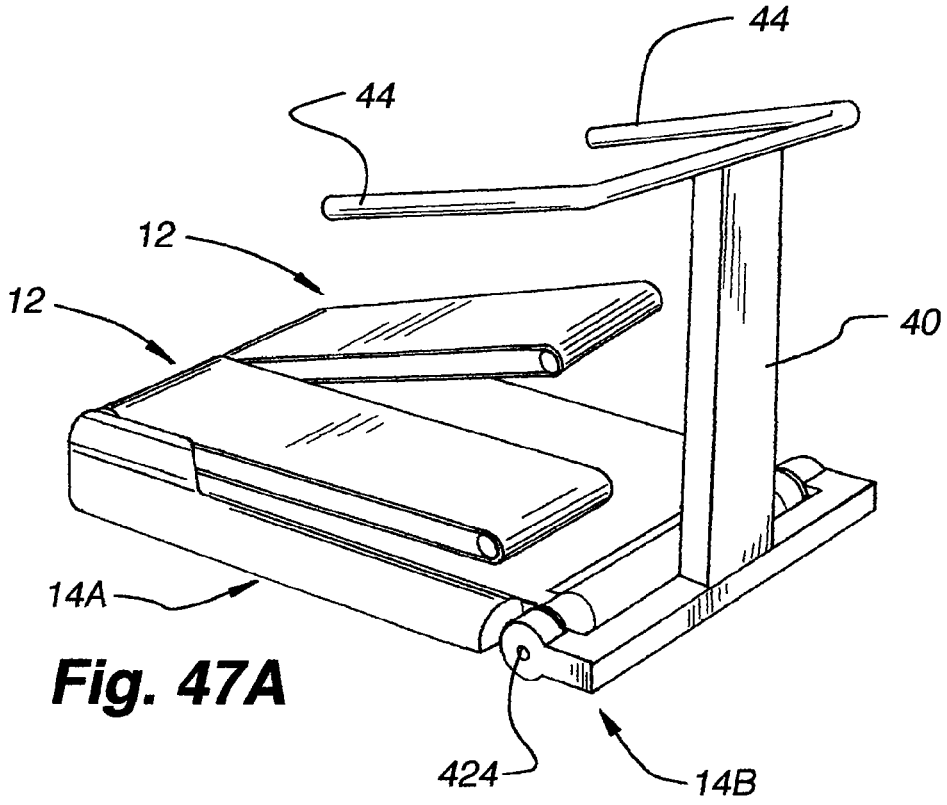
FIG. 47A is an isometric view of an exercise device having rear mounted treadles.
Figure 47B:
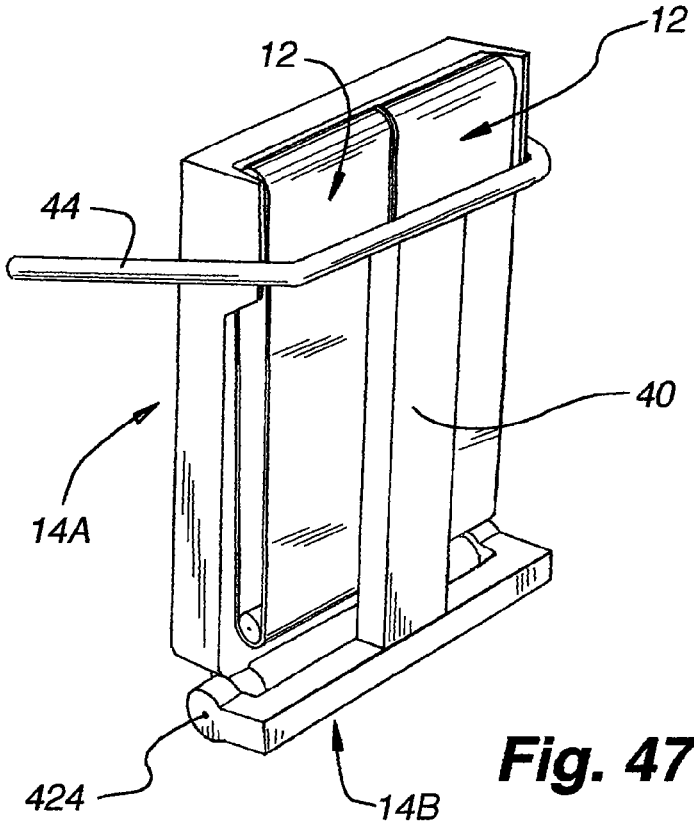
FIG. 47B is an isometric view of the exercise device shown in FIG. 47A adjusted into a storage position.

The exercise device 10 shown in FIGS. 47A and 47B differs from those shown in FIGS. 45 and 46 in that the device of FIGS. 47A and 47B has the treadles 12 mounted at the rear of the base frame 14, rather than the front. The exercise device 10 of FIG. 47A is shown in an unfolded operational position, whereas FIG. 47B illustrates the same device 10 folded into a storage position. The base frame 14 includes a rear base portion 14A on which the treadles 12 are mounted and a front base portion 14B on which the upright 40 is mounted. Side rails 44 are provided at the top of the upright 40. Optionally, the side rails 44 are selectively pivotal with respect to the upright 40 so they can be folded down generally parallel with the upright 40 if desired. The front and rear portions 14A, 14B of the base frame 14 are hinged together for pivotal movement with respect to each other. Preferably the hinge mechanism 424 is provided with a stop to prevent the two sections 14A, 14B from rotating past the operational position shown in FIG. 47A. Also, preferably, the hinge mechanism 424 is provided with a locking mechanism to lock the front and rear base portions 14A, 14B into the operational position shown in FIG. 47A.

To adjust the exercise device 10 to the storage position shown in FIG. 47B, the locking mechanism would be released, and the rear base portion 14A pivoted upwards around the hinge 424 until it is generally upright and proximate to the upright 40. Preferably the rear base portion 14A can pivot to an over-center orientation so that it holds itself in the storage position. Any suitable latching mechanism may be used to retain the rear base portion 14A in the folded-up storage position of FIG. 47B. The front base portion 14B will support the entire unit 10 when adjusted to the storage position of FIG. 47B. As noted above, optionally the side rails 44 may be collapsed down so that they are generally parallel with the upright, to even further reduce the space occupied by the exercise device 10 in the storage position. The unit 10 could also be laid flat for storage on the rear base portion 14A if the side rails 44 are collapsed. Rollers (not shown) may be provided on the front edge of the front base 14B portion to aid in moving the device 10 when in the storage position.

Figure 48A:
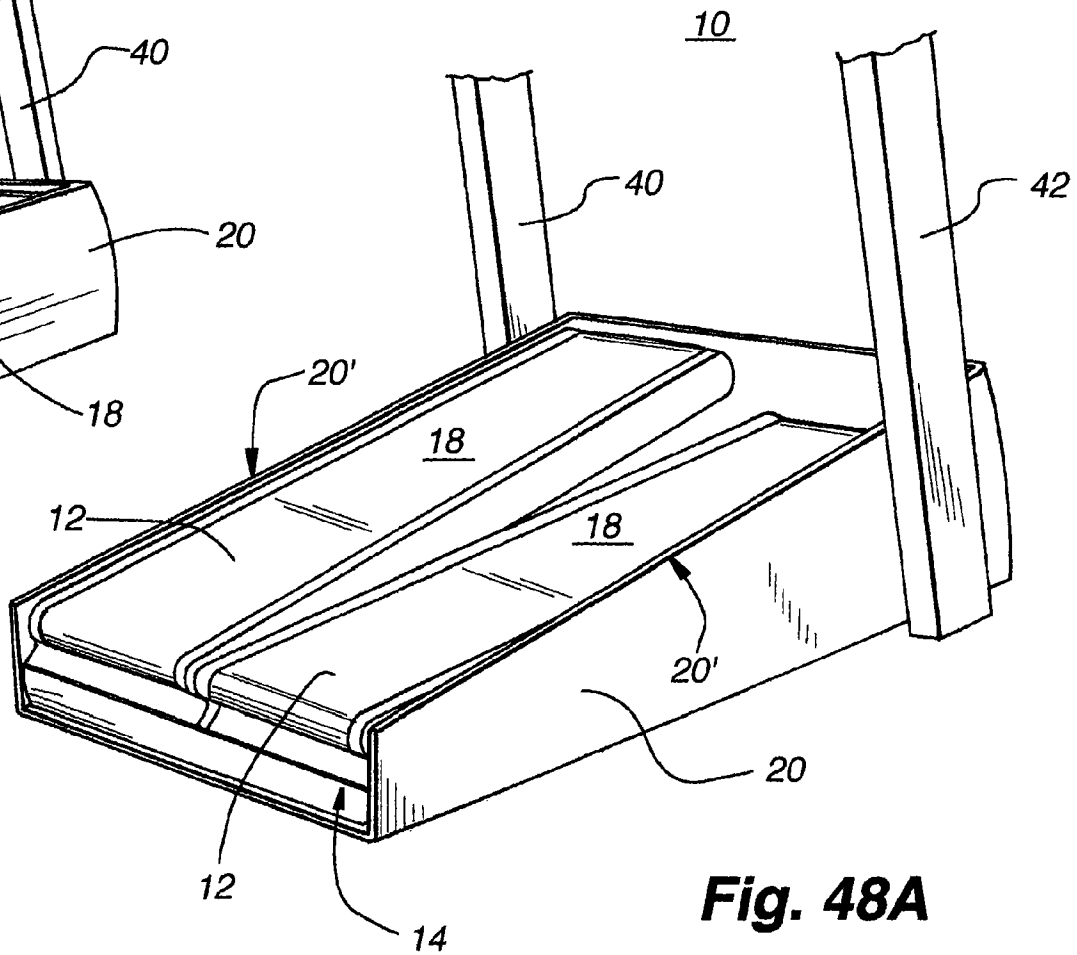
FIG. 48A is an isometric view of a housing on an exercise device according to one embodiment of the present invention.
Figure 48B:
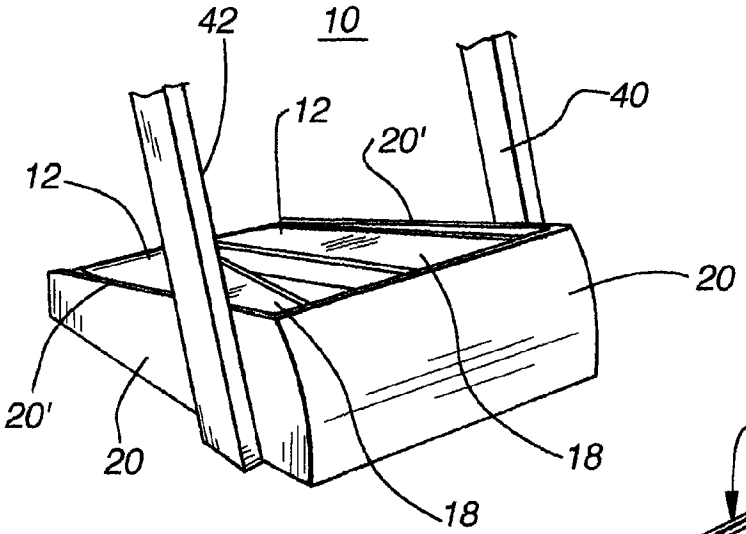
FIG. 48B is an additional isometric view of a front portion of the housing of FIG. 48A.

FIGS. 48A and 48B: Protective Shroud

FIGS. 48A and 48B display an embodiment of an exercise device 10 incorporating a protective housing 20. Generally, the housing 20 is of single-piece construction, and extends about the front, left side, and right side of the exercise device main frame 14. FIG. 48A displays an isometric view of the housing 20 generally from behind and to the right of the housing, while FIG. 48B shows an isometric view from generally in front of the housing 20. The housing 20 protects the inner workings of the exercise device 10 to make it less likely that a hand or foot could be pinched by the reciprocating treadles 12 or caught in the moving tread belt 18 of the treads. The housing 20 also helps keep out dust and other debris that could foul the workings of the exercise device 10.

Typically, the housing 20 extends sufficiently vertically to encompass the treadles 12 at all times, including while the treadles 12 are in motion. Accordingly, the upper side wall 20' of the housing 20 is sloped from back to front at an angle approximating the treadle throw. Generally, the height of the shroud 20 is equal to the deck height of the treadles 12 at maximum treadle extension.

The housing 20 may incorporate a spring, shock, or other resistive element to act against the vertical motion of the front of the treadle 12. In such cases, the resistive element is generally affixed to a portion of the treadle 12 at one end and to the housing 20 at the other end. Alternately, the housing 20 may include an interconnection device (as described elsewhere herein) to transfer motive force between the treadles 12. Preferably the shroud 20 is a hard durable material such as a molded plastic. The shroud 20 may be attached to the frame 14 by bolting or similar removable fasteners to permit removal of the shroud 20 for repair or maintenance of the device 10.

Figure 49:
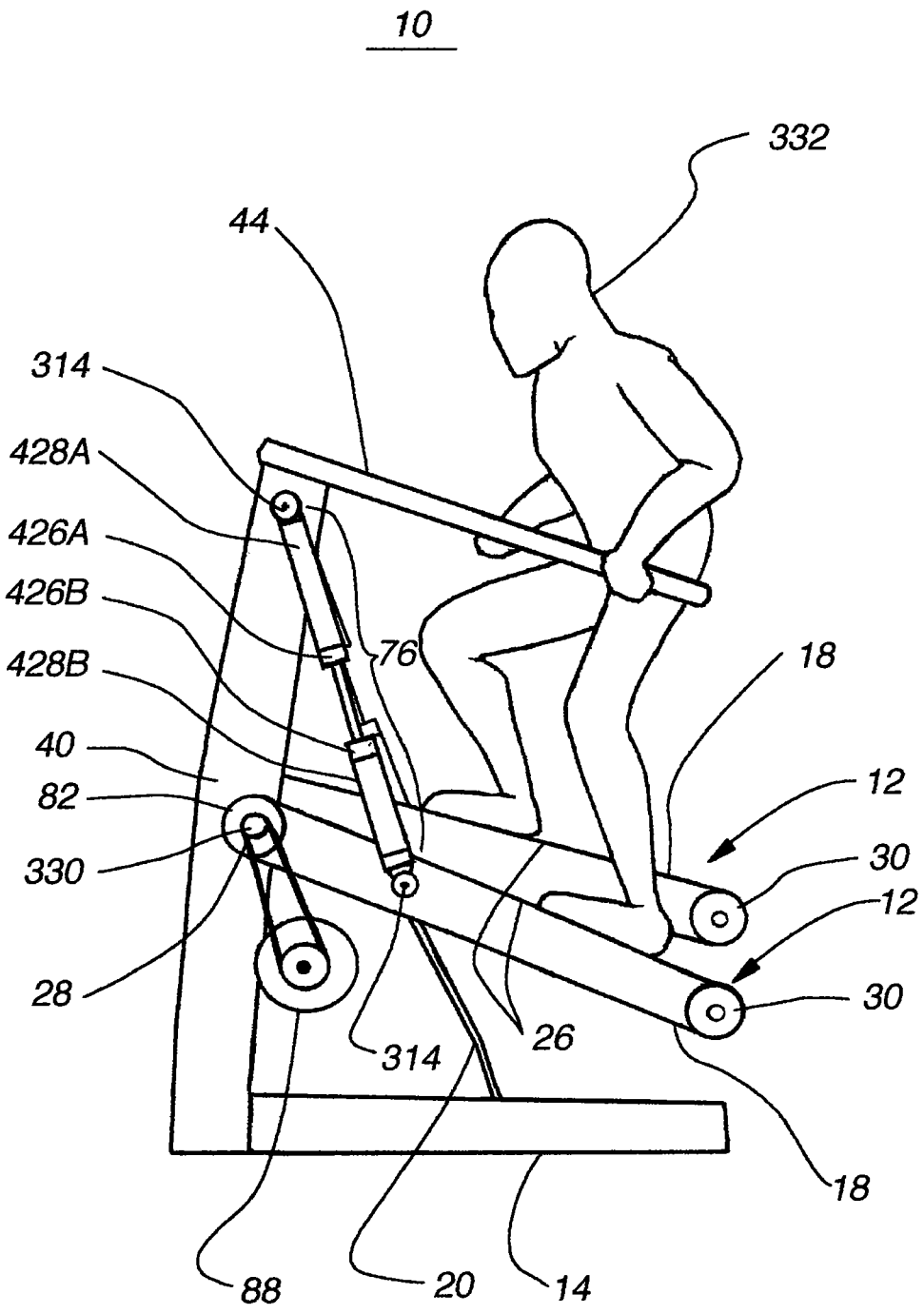
FIG. 49 is a side view of an embodiment of an exercise device according to the present invention wherein a pair of movable treadle assemblies are pivotally attached to a front upright portion of a frame, and a combination biasing and dampening device is connected between the treadles and the frame, a shroud portion has been removed to better reveal certain aspects of the device.

FIG. 49: Dampening and Biasing of Front Drive Exercise Machine, and Combination Stepper and Treadmill In the front drive exercise machine 10 of FIG. 49, an upright frame member 40 extends upwardly from the base frame 14. The frame members 40 are of any desired shape possessing sufficient rigidity and strength so as not to deform or fail in use. The frame members 40 are joined by any suitable technique such as welding or bolting. If desired, the upright 40 is removably coupled to the base frame 14 for convenience of shipping and storage. A console and handlebar 44 assembly (also referred to herein as side rails) is removably coupled to the upright 40, for convenience of shipping and storage. With a few exceptions, the same arrangements of components as used in the rear drive embodiment described elsewhere in this document are generally suitable for the front drive embodiment of FIG. 49. For additional description related to front drive embodiments see FIG. 35 and related discussion.

Two treadle assemblies 12, a right assembly and a left assembly, are pivotally coupled to the upright 40 on the respective sides thereof and along a common axis 330, although a common axis is not required. If desired, two uprights (not shown) may be used instead of a single upright, and the right and left treadle assemblies may be pivotally coupled between the two uprights (not shown). The treadle assemblies 12 pivot about an axis 330. Illustratively, the pivot axis 330 is the axis of a drive shaft 82 that drives both the front roller 28 of the left treadle assembly 12 and the front roller 28 of the right treadle assembly 12. A single driven roller 28 may be used instead of separate driven rollers 28. The pivot axis 330 may be offset from the drive shaft 82 if desired, with other structures supporting the pivoting action. The pivot 330 may be fixed as shown, or may be variable. Different mechanisms may be used for establishing variable pivot points, including mounting the right and left treadle assemblies 12 and the drive shaft 82 in a sub-frame, and providing a variable position locking mechanism between the sub-frame and the upright 40 or uprights 40, 42. (See for example FIGS. 26-29 and 37-39 and related discussion.) An illustrative variable position locking mechanism is an array of holes 314 in the upright (as illustrated in FIG. 37) and a spring-loaded peg mechanism in the sub-frame. Others include collar and lead screw, notches, clamps and ledges.

Each of the treadle assemblies 12 is a separate treadmill with its own belt 18, deck 26, and front and rear rollers 28, 30. Although each of the treadle assemblies may be driven by its own motor 88 if desired, advantageously both treadle assemblies 12 are driven by a common drive shaft 82 and the same motor 88. This assures that each belt 18 travels at the same speed. The treadle assemblies 12 also are interconnected to provide a balanced relationship between the right and left sides during a workout and to provide some additional cushioning. The balanced relationship may be achieved in a variety of ways, including by a rocker assembly 112 or a belt assembly. If desired, the left and right assemblies 12 may be locked together at an incline to get a traditional treadmill workout.

Pivotal movement of the treadle assemblies 12 about the pivot point 82 is controlled by the user's stepping action (stride, gait, weight, and so forth) together with a dampening effect and a biasing effect imposed by the combination dampening and biasing devices 76 (such as shocks 108, 110 as discussed in other areas of this specification). A dampening force is one that resists movement of the treadles 12 in at least one direction. Typically the desired dampening device 76 resists downward motion of its associated treadle 12. A biasing force tends to urge the treadle 12 towards a neutral position. If the treadle 12 is displaced from the neutral position, the biasing device 76 urges it back towards the neutral position. Typically, the biasing devices 76 will urge the treadles 12 back towards an upper position, after the treadles 12 have been depressed to a lower position.

A suitable device 76 for providing both dampening and biasing is disclosed in U.S. Pat. No. 5,622,527, issued Apr. 22, 1997 and incorporated herein in its entirety by reference thereto. If desired, separate devices may be used for dampening and biasing. The ends of the dampening and biasing devices 76 pivot either at fixed positions 314 on the upright 40 and treadle assembly 12, or at variable positions on one or both of the upright and treadle assembly, as illustrated in FIGS. 26-29 and 37-39). The ability to vary the pivot positions 314 allows the biasing force to be adjusted, and allows the bias angle (deck inclination) of the deck 26 to be adjusted with respect to the horizontal. The degree of the dampening resistance and the biasing force may be fixed or adjustable as desired. In the combination dampening and biasing device 76 shown in FIG. 49, illustratively both the degree of dampening resistance and the biasing force are respectively adjustable by dials 426A, 426B located on an upper cylinder 428A and/or on a lower cylinder 428B. The dampening effect may be achieved using any suitable resistance devices such as hydraulic cylinders, flywheels, brakes, and so forth. The biasing effect may be achieved using any suitable devices such as coil springs, torsion springs, elongate elastomeric members, and so forth.

To operate the exercise machine 10 of FIG. 49 in a normal mode, the user 332 adjusts the dampening effect and the biasing effect as desired, steps upon right and left side foot support platforms (not show), adjusts the workout profile on the console as desired (the respective belts 18 of the right and left treadle assemblies 12 begin to move), and steps from the right and left foot support platforms onto the right and left belts 18, respectively. The exercise machine 10 may also be operated in a treadmill mode by locking the left and right treadle assemblies 12 together, or may be operated in a stepper mode by maintaining the belts 18 stationary (motor off).

In normal mode operation as shown in FIG. 49, the user 332 has just stepped on the moving belt 18 of the right treadle assembly 12 and has shifted his weight from the left foot (which has been carried to the rear of the treadle assembly 12 by the moving belt 18) to the right foot. The downward force exerted by the right foot on the treadle 12 tends to rotate the right treadle 12 downward around the pivot 330. This motion of the treadle 12 is opposed by a biasing force and a dampening force. The dampening force is variable depending on the speed at which the treadle 12 is rotating. The faster the treadle 12 rotates, the more resistance the dampening device 76 will provide. The biasing force is dependent on how far the treadle 12 has been displaced from its neutral position. The left treadle assembly 12 begins to rise because the left foot has been unweighted and because the downward force on the right treadle 12, due to the weighted right foot, is transferred by the rocker assembly as an upward force into the left treadle 12. Next, the left foot becomes fully unweighted as it is raised and moved from the rear of the deck 26 of the left treadle assembly 12 toward the front of the deck 26 of the left treadle assembly 12. Meanwhile, the fully weighted right foot is carried toward the rear of the deck 26 of the right treadle assembly 12 with the moving belt 18, and the inclination of the right treadle assembly 12 increases due to the weight while the inclination of the left treadle assembly 12 decreases due to the biasing force and the transferred force. At a slow belt speed (slow pace), the treadle assemblies 12 travel through a greater arc range than at high belt speeds (fast pace), all else being equal.

If desired, the belts 18 of the treadle assemblies 12 may be run in reverse, permitting the user to step away from the upright 40 or uprights 40, 42, either by stepping backward or by turning around and stepping forward.

As the user slows his pace at the end of the workout, the left and right treadle assemblies 12 may bottom out by striking against the base frame 14. Bottoming out may also occur if the biasing force is not properly set. The exercise machine 10 should include a mechanism such as a bumper structure or bottom out assembly 154 (not shown in FIG. 49, but see FIG. 60, and accompanying discussion) to absorb some of the force of the impact in order to both cushion the user and avoid damage to the exercise machine.

Figure 50:
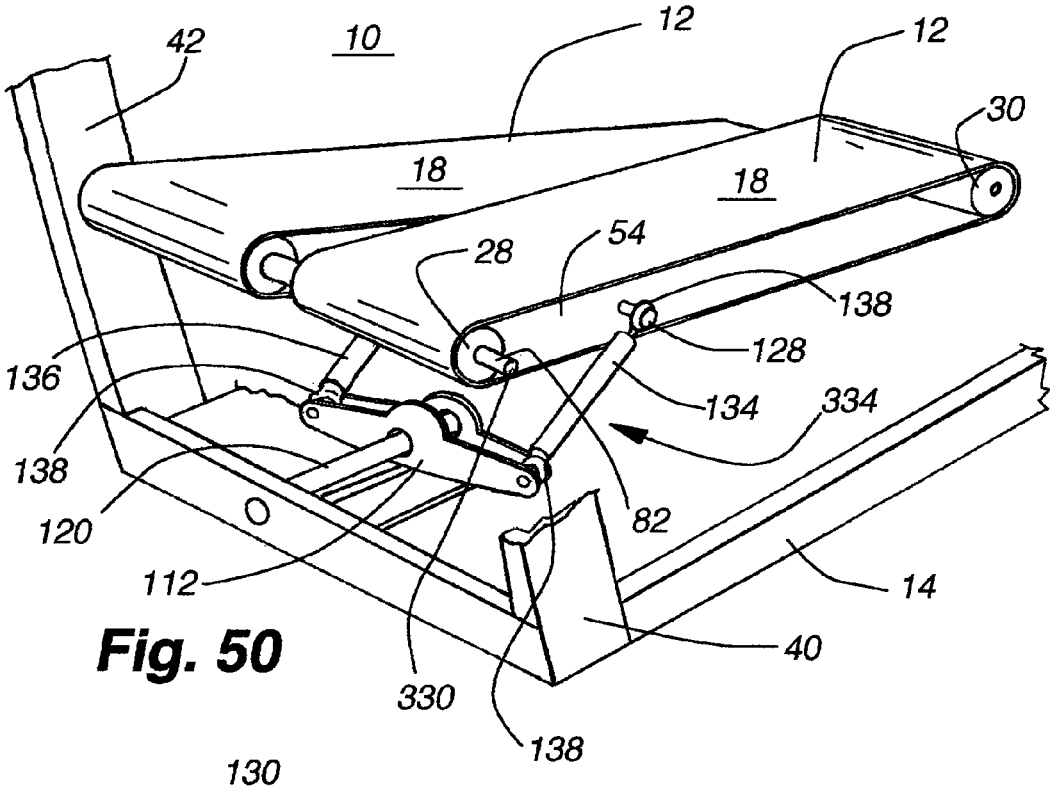
FIG. 50 is a partial isometric view of an embodiment of an exercise devise according to the present invention illustrating a rocker arm interconnecting device between a pair of pivotal treadles.
Figure 51:
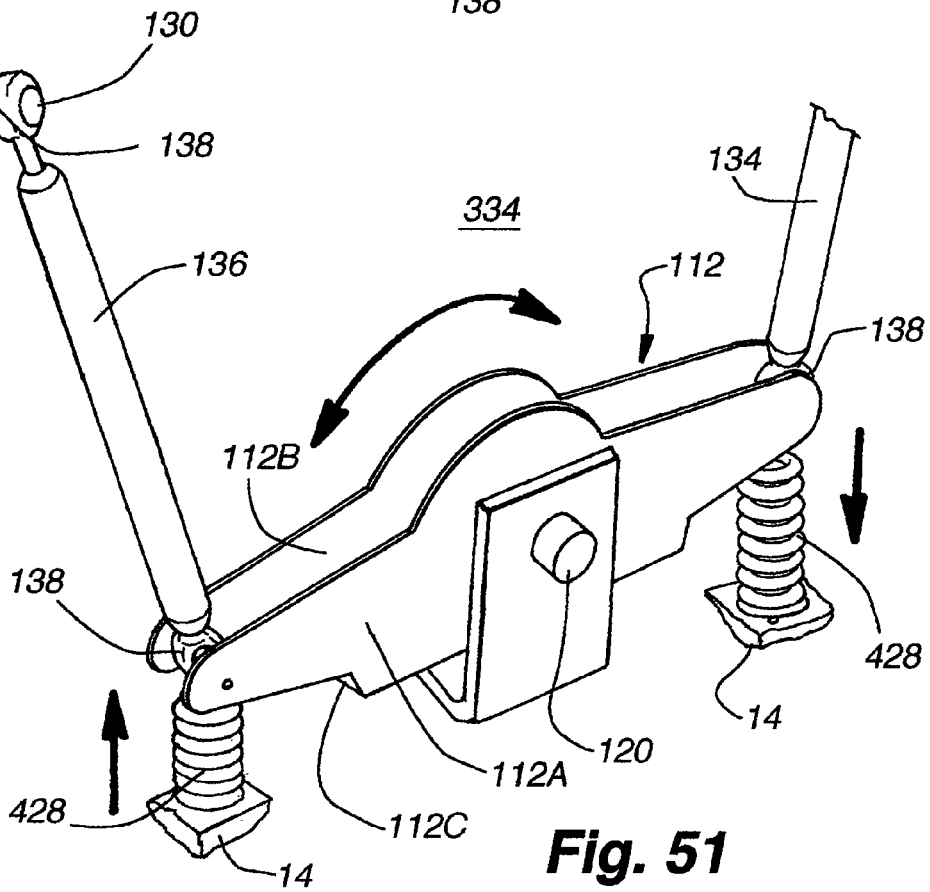
FIG. 51 is a detail isometric view of a rocker arm interconnecting device associated with a pair of biasing devices.

FIGS. 50-51: Rocker Arm Assembly Having Universal Joint and/or Biasing Effect As shown in FIG. 50, for a front drive exercise machine 10, two treadle assemblies 12, a right assembly and a left assembly, are pivotally coupled between two uprights 40, 42. Alternatively, a single upright 40 may be used and the treadle assemblies 12 may be pivotally coupled to the single upright 40 on the respective sides thereof and along a common axis. Also, as discussed elsewhere herein, the treadle assemblies 12 may be pivotally connected to the frame at a rear portion of the frame 14. Each of the treadle assemblies 12 is a separate treadmill with its own belt 18, deck 26, and front and rear rollers 28, 30. The treadle assemblies pivot about a pivot point 330, which illustratively is a drive shaft 82 that drives both the front roller 28 of the left treadle assembly 12 and the front roller 28 of the right treadle assembly 12. The pivot point 330 may be fixed as shown, or may be variable. Although each of the treadle assemblies 12 may be driven by its own motor 88 if desired, advantageously both treadle assemblies 12 are driven by a common drive shaft 82 and the same motor 88. This assures that each belt 18 travels at the same speed.

The treadle assemblies 12 are interconnected such that as one treadle assembly 12 is pushed down, the other treadle assembly 12 is correspondingly pushed up. This interconnection provides a balanced relationship between the right and left sides during a workout and provides some additional cushioning. The interconnection mechanism 334 in the embodiment shown in FIG. 50 is a rocker assembly. A central portion of a rocker arm 112 is pivotally coupled to the front of the base frame 14 by a pivot rod 120. The ends of the rocker arm 112 are coupled to respective tie rods 134, 136 using respective universal joints 138. The left tie rod 134 is coupled to a pivot 128 on a side frame 54 of the left treadle assembly. Similarly, the right tie rod is coupled to a pivot on a side frame of the right treadle assembly 12. Ball joints 138 should be used at the ends of the rocker arm 112 and where the tie rods 134, 136 are coupled to their respective treadle assemblies 12 because the pivots 128, 130 on the side frame members 54, 56 of the treadle assemblies 12 move in an arcuate path along one plane while the rocker arm ends move in an arcuate path along a perpendicular plane, which imposes a complex relative motion at the ends of the tie rods 134, 136.

In one embodiment, as illustrated in FIG. 51, the rocker arm 112 is fabricated with two opposing sheet metal arm forms 112A, 112B, interconnected by an integrated metal section 112C bent at right angles from each of the arm forms. The ball joints 138 are located between the arm forms 112A, 112B at each end of the rocker arm 112.

The term "tie rod" 134, 136 is inclusive of fixed length rods as well as variable length rods such as turnbuckles. A variable length tie rod 134, 136 can be used to adjust the angle of its associated treadle assembly 12. As the variable length rod 134, 136 is made longer, it will increase the pitch of the treadle assembly 12.

The rocker arm assembly 112, depicted in FIG. 50, functions as follows. Pivotal movement of the treadle assemblies 12 about the pivot point 120 is controlled by the user's stepping action (stride, gait, weight, and so forth) together with a dampening effect and a biasing effect imposed on each of the treadle assemblies 12. As the user steps down on, say, the belt 18 of the left treadle assembly 12, the left treadle assembly 12 pivots in a downward direction about the left driven roller 28 and drives the left tie rod 134 downward. This causes the left end of the rocker arm 112 to be pushed down, which causes the right end of the rocker arm 112 to raise. The upward movement of the rocker arm 112 is transmitted through the right tie rod 136 to urge the right treadle assembly 12 to pivot in an upward direction about the right driven roller 28.

The rocker arm assembly 112 may be provided with biasing devices, if desired. FIG. 51 shows right and left springs 428 as the biasing devices. The springs 428 are coupled between the respective ends of the rocker arm 112 and respective mounts on the base frame 14. When the treadle assemblies 12 are at the same inclination ("neutral inclination"), the springs 428 are under the same degree of compression or extension. As the user steps down on, say, the belt 18 of the left treadle assembly 12, the left treadle assembly pivots in a downward direction about the left driven roller 28. The left end of the rocker arm 112 is pushed down, causing the right end of the rocker arm 112 to push up and urge the right treadle assembly 12 to pivot in an upward direction about the right driven roller 28. At the same time, the left spring 428 is placed in greater compression (or extension depending on the arrangement of the spring with respect to the rocker) and the right spring 428 is placed in tension (or at least in less compression than the left spring), creating a net biasing force that opposes the downward force exerted by the user's weighted foot on the belt 18 of the left treadle assembly 12. When the user transfers his weight from the left foot to the right foot, the biasing devices 428 work in concert with the user's weighted right foot to cause the right treadle assembly 12 to pivot in a downward direction. However, as the neutral inclination position is passed through, the biasing devices 428 begin to oppose downward force exerted by the user's weighted right foot, as described above for the weighted left foot.

The biasing devices 428 shown in FIG. 51 may be used with rocker arms 112 that do not employ ball joints 138. Moreover, the precise location on the rocker arm 112 to which the ends of the biasing devices 428 are attached and the manner of attachment are not critical. Moreover, the other ends of the biasing devices 428 may be coupled directly to the frame 14, or to other structures that are independent of movement of the rocker arm 112. These other structures preferably are in the general plane of movement of the rocker arm 112, but otherwise may reside below the rocker arm 112 (for example, the position shown in FIG. 51) or above the rocker arm 112 (for example, 180 degrees displaced from the position shown in FIG. 51).

Figure 52A:
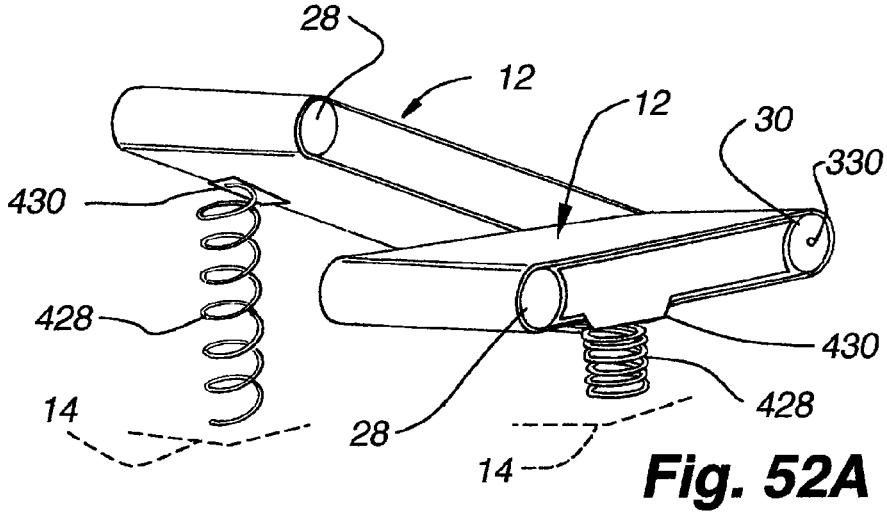
FIG. 52A is an isometric view of a pair of treadle assemblies each having a biasing spring operably provided below the treadle assembly.
Figure 52B:
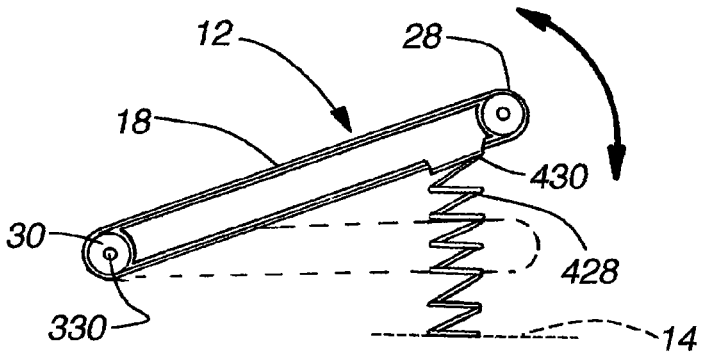
FIG. 52B is a side view of the treadle assemblies of FIG. 51.

FIGS. 52A-52B: Under-Treadle Biasing Device

As noted above, in a dual-movable belt treadle assembly exercise machine 10, pivotal movement of the treadle assemblies 12 about their pivot axes 330 is controlled by the user's stepping action (stride, gait, weight, and so forth) together with a dampening effect and/or a biasing effect imposed upon the treadle assemblies 12. The dampening and the biasing effects may be imposed upon each treadle assembly 12 by one device or by separate devices.

FIG. 52A shows an example of the use of biasing devices 428 under each of the treadle assemblies 12. The biasing devices 428 urge the treadle assemblies 12 upward to a no-load, or neutral position. The biasing devices 428 shown in FIG. 52A illustratively are springs 428 that are coupled between the bottom 430 of each of the treadle assemblies 12 and the base frame 14. Preferably the compression and tension properties of the springs 428 are generally equal and the attachment points 430 on the treadle assemblies 12 are mirrored so that the treadle assemblies 12 are biased at the same inclination and exert generally equal biasing forces to the user's left and right feet for the same weightings. When the treadle assemblies 12 are at the no-load, or neutral inclination, the springs 428 are under the same degree of compression due to the weight of the treadle assemblies 12. As the user steps down on, say, the belt 18 of the left treadle assembly so that his foot frictionally engages the belt 18, the left treadle assembly 12 pivots in a downward direction about its pivot axis 330 and compresses the left spring 428 (see FIG. 52B). The compression of the left spring 428 creates a biasing force that pushes up to oppose the downward force exerted by the user's weighted foot on the belt 18 of the left treadle assembly 12. As the user's foot is unweighted, which occurs as the user steps on the belt 18 of the right treadle assembly 12, the biasing force tends to restore the left treadle assembly 12 to its neutral inclination position. Dampening devices (not shown) preferably, but not necessarily, are used along with the springs 428. The dampening devices preferably resist downward movement of the treadle assemblies 12. The dampening devices may also resist the upward movement of the treadle assemblies 12 caused by the springs 428 to prevent the treadles 12 from snapping back too quickly.

The top ends of the springs 428 are coupled to the treadles 12 so as to exert a push-up biasing force on the treadle assemblies 12. The mechanism shown in FIG. 52A includes a flange 430 that extends in a sideward direction from a lower portion of the frame 52 of the treadle assembly 12. The flange 430 should be lower than the level of the belt surface 18 engaged by the user's foot to avoid contact of the spring 428 by a user's foot. Other suitable attachment mechanisms include the right and left side foot support platforms (not shown) as well as areas of the housing (not shown), provided they possess sufficient rigidity and strength so as not to deform or fail in use.

Where a housing is used that extends along the bottom of a treadle assembly 12, the spring 428 attachment point 430 may be along the longitudinal centerline of the treadle assembly 12, rather than offset therefrom. If desired, a flange 430 extending from the frame 52 of a treadle assembly 12 may be bent under the treadle assembly 12, which would also permit the attachment point 430 to be along the longitudinal centerline of the treadle assembly 12 rather than offset therefrom.

The bottom ends of the springs 428 may be attached directly to the base frame 14, or to any other structure that is stable relative to the movement of the treadle assemblies 12.

If the ability to adjust the inclination of the treadles is desired, a variable height mechanism (not shown) may be used with the springs, illustratively at the attachment points 430. A variety of variable height mechanisms are well known, including, for example, screw-type mechanisms and pin-in-hole mechanisms. The variable height mechanisms permits the inclination to be identical or different between the treadle assemblies 12, as desired by the user.

An example of a suitable variable height mechanism for the lower ends of the springs 428 is a movable platform that rises from the base frame 14 and may be positioned at a variable distance therefrom. The lower ends 428 of the springs are attached to this platform, and the user varies the distance of the platform from the base frame 14 to adjust the inclination of the treadle assemblies 12. The height of the platform may be manually adjusted or adjusted by motor under user control from the user console.

If the ability to adjust the user-perceived biasing force is desired, the distance between the spring and the pivot point of the treadles may be made adjustable as disclosed elsewhere in this specification.

The neutral angle of inclination of the treadle assemblies 12 can also be adjusted by varying the attachment location of the biasing device 428 relative to the pivot point 330. The closer the biasing device 428 is moved to the pivot point 330, the steeper the incline. In order to accomplish this there would need to be multiple attachment locations for the biasing device on the base frame 14 and on the treadle assembly 12. It should be noted that a change in the location relative to the pivot point 330 will also vary the biasing force because of a change in leverage. The closer the biasing device is placed to the pivot point 330, the less resistance to pivoting of the treadle assembly 12.

FIGS. 54-59: Biasing Mechanisms for Exercise Machine

Figure 54:
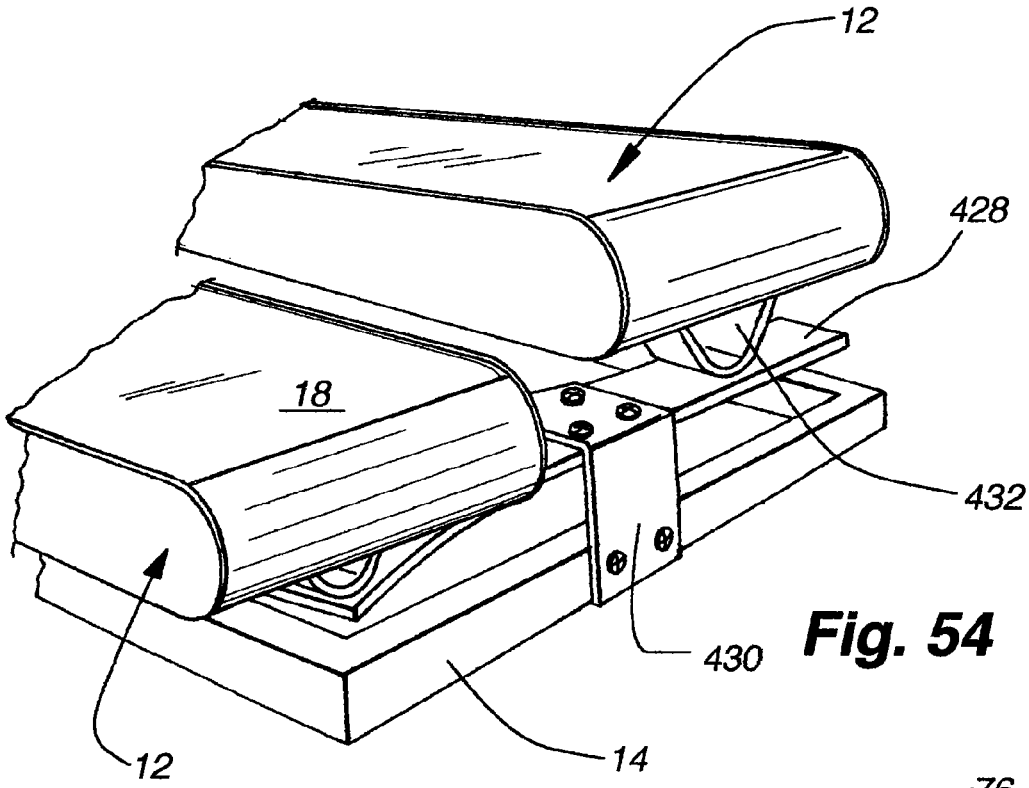
FIG. 54 is a partial isometric view of a front end of a base frame of an exercise device that utilizes flat springs as biasing devices to urge treadle assemblies upwards.

FIGS. 54-59 show various additional embodiments of biasing mechanisms 428 that can be provided directly underneath the treadle assemblies 12. FIG. 54 shows one type of biasing mechanism. The treadle assemblies may be linked by a reciprocating linkage (not shown in FIGS. 54-59), such as any of the various rocker arm assemblies shown and described elsewhere in this document. An elongated flat spring 428, preferably metallic, is supported above the base frame 14 by a spring support bracket 430, and extends in both directions toward the right and left sides of the exercise machine, underneath the left and right treadle assemblies 12. Respective protrusions 432 project downward from the left and right treadle assemblies 12, illustratively generally from the longitudinal centerline thereof although they may be located anywhere provided that the arms of the flat spring 428 are sufficiently long to engage the protrusions 432. If an interconnecting device is not used, the arms of the flat spring 428 are in engagement with the protrusions 432 during all or substantially all of the stroke of the left and right treadle assemblies 12. If an interconnecting device is used, the protrusions 432 will typically engage the arms of the flat spring 428 at the neutral inclination and below, but will be disengaged as the treadle assemblies 12 move upwards above the neutral position. Where the left and right treadle assemblies 12 are provided with a sturdy and rigid housing 20, the protrusions 432 may project from the lower housing panel 20 (hidden in the figure). Where the housings 20 are not sufficiently sturdy and rigid or where they are not used, the protrusion 432 for each of the treadle assemblies 12 may be a part of and project from a bracket (not shown, but see the bracket 156 in FIG. 60 for an example) that extends beyond the width of the belt 18 of the treadle assembly 12 and that has one upward-extending flange or two upward-extending flanges that couple to the internal frame (not shown) of the treadle assembly 12.

The protrusions 432 may be made of any material, although the material should be such that it readily slides across the flat spring 428 as the flat spring 428 deforms upon engagement by the protrusions 432. Suitable materials include hard plastics and composites, as well as metals coated with a low friction material.

The biasing mechanism 428 of FIG. 54 functions as follows in the operation of the left treadle assembly 12. The function of the biasing mechanism 428 is identical for the right treadle assembly 12. As the user steps on the belt 18 of the left treadle assembly 12 and weights his foot, the left treadle assembly 12 moves downward about its pivot axis. The arm of the metal flat spring 428 is engaged by the protrusion 432 of the left treadle assembly 12 and the flat spring 428 resiliently deforms, thereby imposing a progressively increasing biasing force in opposition to the arcuate downward motion of the left treadle assembly 12. As the user completes his step and begins to unweight his foot, the biasing force causes the left treadle assembly 12 to return to its neutral inclination.

Preferably the flat spring 428 is located near the free ends of the treadle assemblies 12 to exert maximum leverage on the treadle assembly 12. In this fashion the restitution force of the flat spring 428 can be minimized for a desired biasing force. Alternatively, the biasing effect and inclination of the treadle assemblies 12 could be varied by providing the flat spring 428 on a movable support bracket that can be adjusted forwardly and rearwardly on the base frame 14. As the support bracket is moved rearwardly, it will exert a smaller biasing force on the treadle assemblies 12 due to the shorter lever arm that results from being moved closer to the pivot point. The inclination of the treadle assemblies 12 would be increased as the flat spring 428 moves closer to the pivot point.

Figure 55:
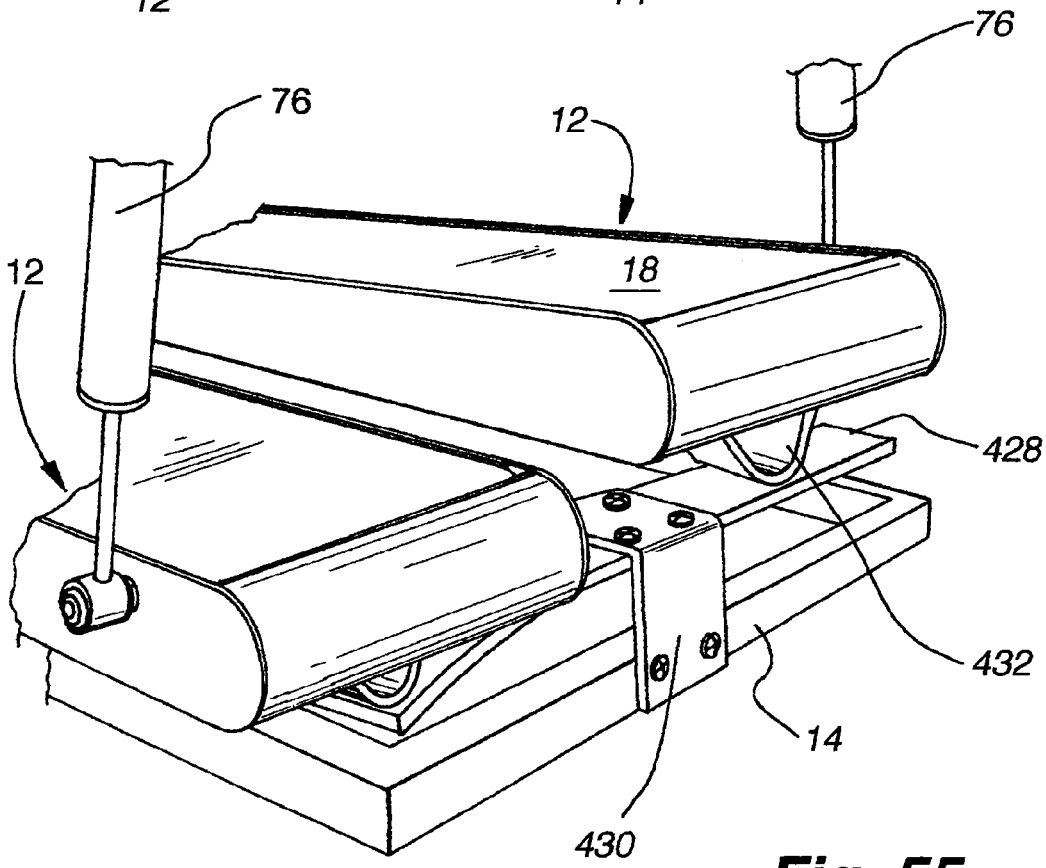
FIG. 55 is a partial isometric view of the front portion of a dual deck exercise device that uses a flat spring as a biasing device to urge treadle assemblies upwards, and includes dampening devices attached to the treadle assemblies.

FIG. 55 shows a biasing mechanism 428 used with right and left treadle assemblies 12 that have respective right and left dampening devices 76, illustratively of the hydraulic cylinder type. The biasing mechanism 428 shown in FIG. 55 is identical to the biasing mechanism 428 shown in FIG. 54. The right dampening device 76 has one end pivotally mounted to the outside side of the right treadle assembly 12, and another end mounted to a right upright frame member (not shown). The left dampening device has one end pivotally mounted to the outside side 54 of the left treadle assembly 12, and another end mounted to a left upright frame member (not shown). The dampening devices 76 will provide resistance to downward movement of their respective treadle assemblies 12. The resistance provided by the dampening devices 76 may be dependent on the speed at which the treadle assemblies 12 are moving. The damping devices 76 may also provide some resistance to upward movement of the treadle assemblies 12 in order to show the rate at which the unweighted treadle assemblies are pushed upwards by the flat springs 428.

Figure 56:
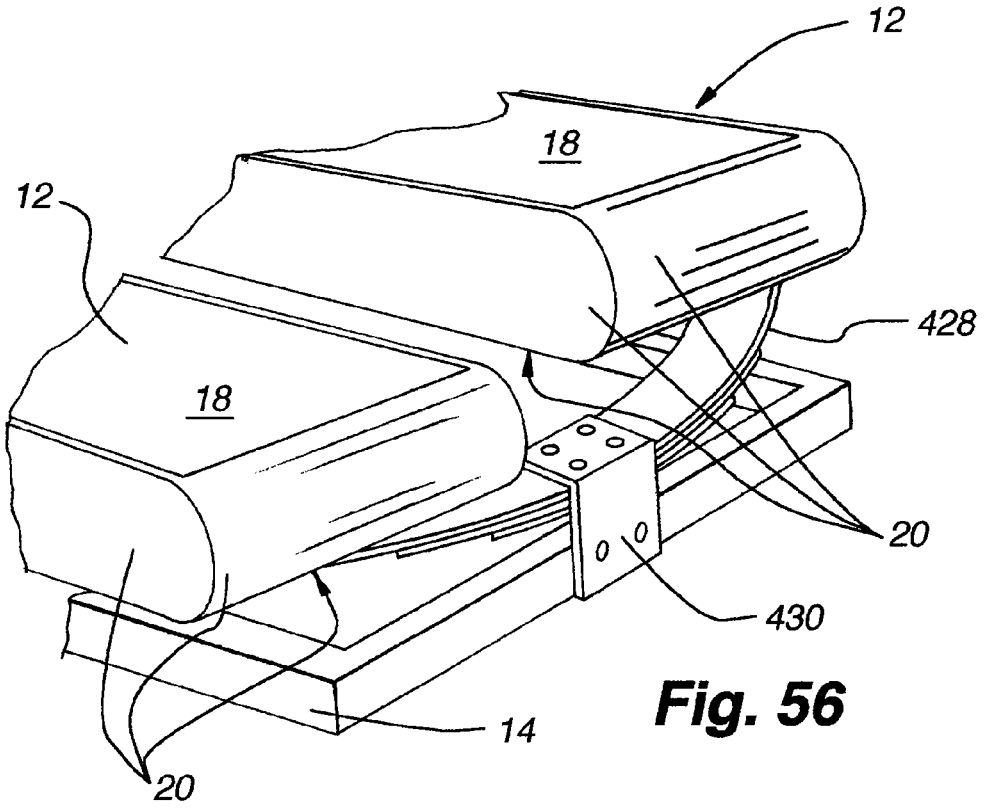
FIG. 56 is a partial isometric view of the front portion of an exercise device utilizing a concavely mounted leaf spring structure as a biasing device.

FIG. 56 shows a biasing mechanism 428 uses a leaf spring 428 is supported in a concave aspect relative to the treadle assemblies 12 by a short spring support bracket 430*he* arms of the leaf spring 428 and in both directions toward the right and left sides of the exercise machine and into engagement with the underside of the left and right treadle assemblies 12. If a reciprocating linkage is not used, the arms of the leaf spring 428 are in engagement with the treadle assemblies 12 throughout all or substantially all of the stroke thereof. If a reciprocating linkage is used, the treadle assemblies 12 may disengage from the leaf spring 428 during the upper portion of their range of motion. The upturned ends of the leaf spring 428 engage the housing bottom panels 20 of the treadle assemblies 12 illustratively about the longitudinal centerline thereof, although they may be made shorter or longer to engage the housing bottom panels 20 in an area other that about the longitudinal centerlines thereof, if desired. Where the treadle assemblies 12 are provided with a sturdy and rigid housing 20, the leaf spring ends may engage the housing panels 20 directly. However, where the housings 20 are not quite sufficiently sturdy and rigid, strike plates may be used in the area engaged by the leaf spring ends. Where a housing is not used or is very weak, a bracket (not shown) that extends beyond the width of the belt 18 of the treadle assembly 12 and that has one upward-extending flange or two upward-extending flanges that couple to the internal frame (not shown) of the treadle assembly 12 may be used to provide a strike plate. The strike plate may be made of any material, although the material should be such that the end of the leaf spring 428 readily slides across it as the leaf spring 428 deforms upon engagement by the strike plate. Suitable materials include hard plastics and composites, as well as metals coated with a low friction material. The use of the concave leaf spring 428 of FIG. 56, as opposed to the flat spring 428 of FIG. 54, is advantageous because it permits the spring 428 to contact the treadle assembly 12 over a relatively longer range of motion.

The biasing mechanism 428 of FIG. 56 functions as follows in the operation of the left treadle assembly 12. The function of the biasing mechanism 428 is identical for the right treadle assembly 12. As the user steps on the belt of the left treadle assembly 12 and weights his foot, the left treadle assembly 12 moves downward about its pivot axis. Depending on the embodiment, the arm of the leaf spring 428 is engaged by the bottom of a housing 20, a strike plate, or a protrusion 432 and the leaf spring 428 resiliently deforms, thereby imposing a progressively increasing biasing force in opposition to the arcuate downward motion of the left treadle assembly 12. As the user completes his step and begins to unweight his foot, the biasing force causes the left treadle assembly 12 to return to its neutral inclination.

Figure 57:
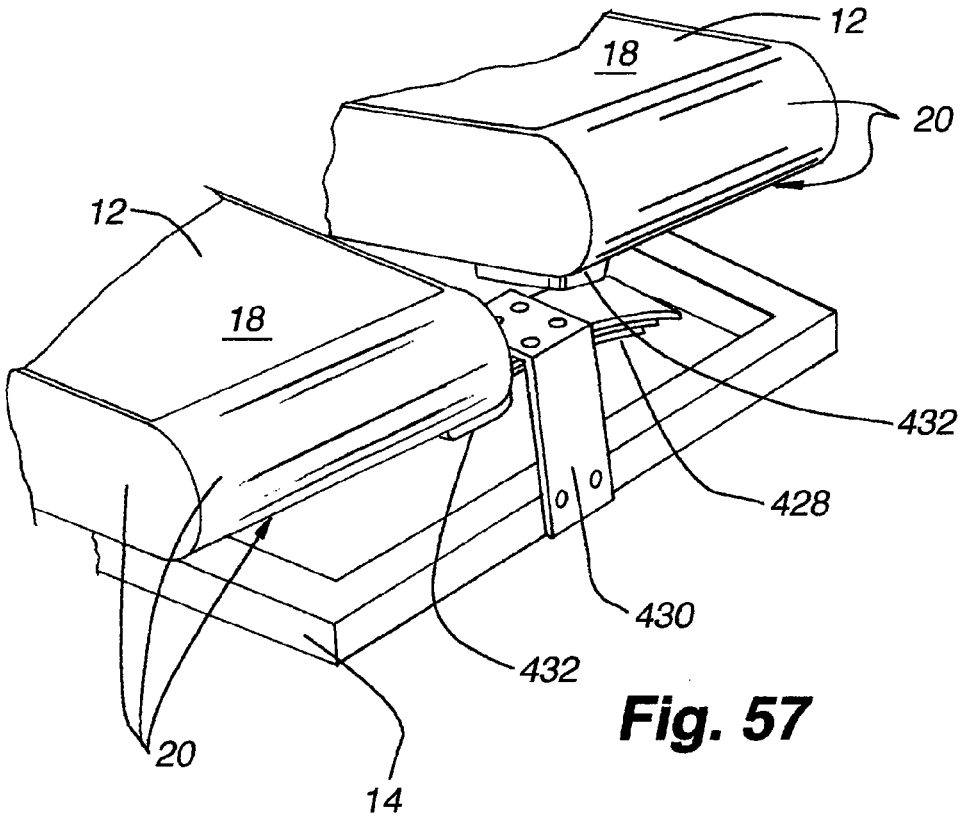
FIG. 57 is a partial isometric view of a front portion of an exercise device utilizing a convexly curved leaf spring as a biasing device.

FIG. 57 shows a biasing mechanism 428 that uses a relatively short leaf spring 428 that is supported in a convex aspect relative to the treadle assemblies 12 by a long spring support bracket 430. The leaf spring 428 extends a relatively short distance in both directions toward the right and left sides of the exercise machine 10, underneath the treadle assemblies 12. If a reciprocating linkage is not used, the arms of the leaf spring 428 are in engagement with the treadle assemblies 12 throughout all or substantially all of the stroke thereof. The protrusions 432 on the bottom of the treadle assemblies 12 engage the leaf spring engage 428 at the inside edges thereof, near where the leaf spring 428 is supported by the spring support bracket 430. Where the treadle assemblies 12 are provided with a sturdy and rigid housing 20, the leaf spring 428 may engage the housing panels 20 directly. However, where the housings 20 are not quite sufficiently sturdy and rigid, a strike plate may be used in the area engaged by the leaf spring 428. Where a housing 20 is not used or is very weak, a bracket (not shown) that is coupled to the internal frame (not shown) of the treadle assembly 12 and extends downward just beyond the bottom of the housing 20 or roller may be used to provide a strike plate. The strike plate may be made of any material, although the material should be such that the end of the leaf spring readily slides across it as the leaf spring 428 deforms upon engagement by the strike plate. Suitable materials include hard plastics and composites, as well as metals coated with a low friction material.

Figure 58:
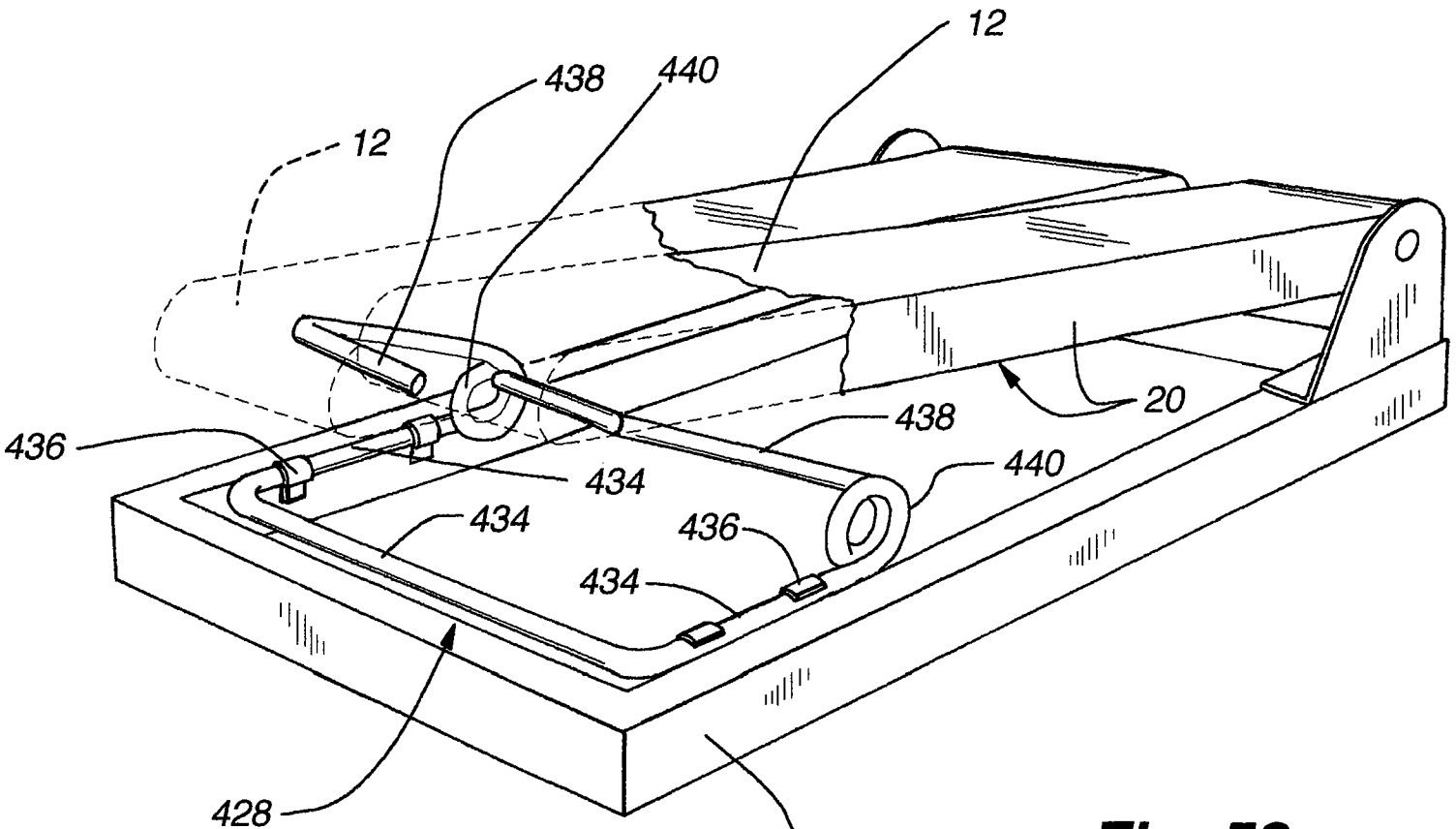
FIG. 58 is an isometric view of the base portion of an exercise device utilizing a torsion spring as a biasing device.

FIG. 58 shows a biasing mechanism 428 that uses a multiple section torsion spring 428 that is supported on the base frame 14. The treadle assemblies 12 are shown in an exaggerated lifted position so that the multiple section torsion spring 428 is more clearly visible. The base section 434 of the torsion spring 428 is mounted to the base frame 14 by a number of mounting clips 436. The free ends 438 of the torsion spring 428 extend inward from coils 440. The free ends 438 engage the housing bottom panels of the treadle assemblies 12 along the bottoms thereof, and the torsion spring 428 resiliently deforms to provide the biasing effect. If a reciprocating linkage is not used, the free ends 438 are in engagement with the treadle assemblies 12 throughout all or substantially all of the stroke thereof. As in the other embodiments of the biasing mechanism 428, the inward-extending free ends 438 of the torsion spring 428 may engage the housing 20 directly if it is sturdy and rigid enough, or may engage any suitable strike plate.

In a variation of the FIG. 58 embodiment, the coils of the torsion spring 428 may be located near the centerline of the base frame and the free ends 438 of the torsion spring 428 may extend outwardly rather than inwardly. To adequately support such a torsion spring 428, a center frame member (not shown) may be provided, and the multiple section torsion spring may be secured by clips 436 along the center frame member.

Figure 59:
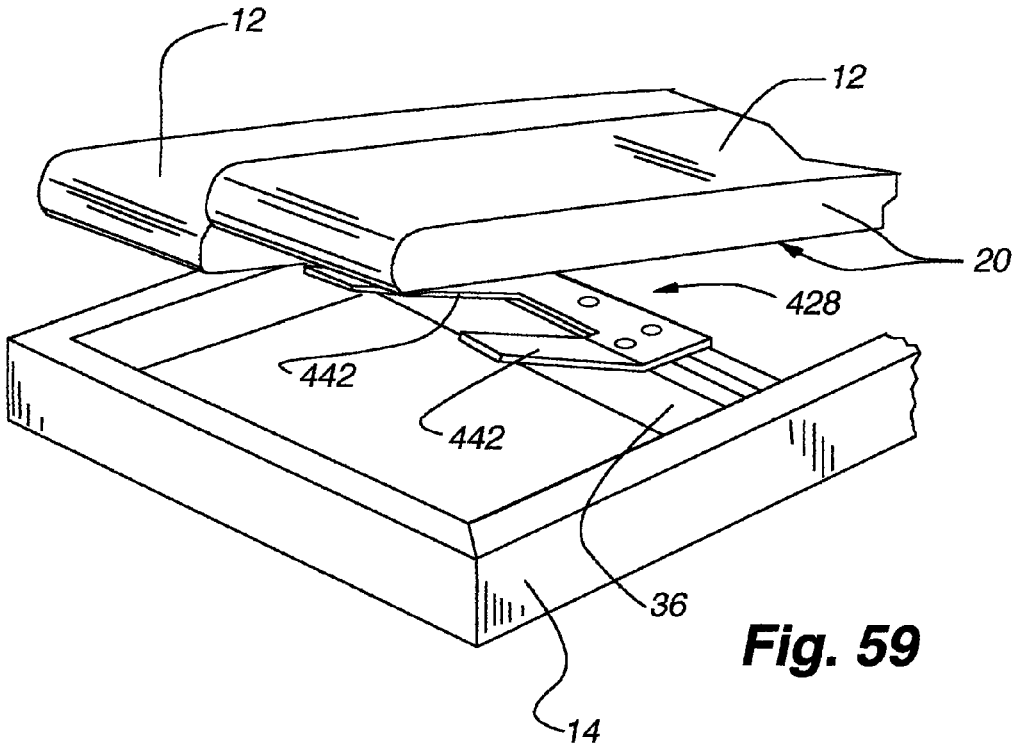
FIG. 59 is a partial isometric view of a front portion of the base frame of an exercise device that utilizes a dual pronged flat spring as a biasing device.

FIG. 59 shows a biasing mechanism 428 that uses a dual pronged flat metallic spring 428 that is supported on cross members 36 of the base frame 14, and wherein the prongs 442 are bent in an upward direction to engage the housing bottom panels of the treadle assemblies 12 along the bottoms thereof. The treadle assemblies 12 are shown in an exaggerated lifted position so that the flat spring 428 and its bent prongs 442 are more clearly visible. These prongs 442 resiliently deform when engaged by their respective treadle assemblies 12 to provide the biasing effect. If a reciprocating linkage is not used, the prongs 442 are in engagement with the treadle assemblies 12 throughout all or substantially all of the stroke thereof. As in the other embodiments of the biasing mechanism 428, the ends of the prongs 442 may engage the housing 20 directly if it is sturdy and rigid enough, or may engage any suitable strike plate.

Where the term "metallic spring" is used, it will be appreciated that other materials having properties similar to metallic springs may be used.

The position of the biasing mechanisms 428 may be made variable to adjust the inclination of the treadle assemblies 12. Illustratively, the supporting brackets 430 shown in FIGS. 54-57 may be made to have a user-adjustable variable length using any suitable mechanism such as a peg-in-hole mechanism or a turnbuckle mechanism. The torsion spring 428 of FIG. 58 and the flat spring 428 with raised prongs 442 of FIG. 59 may be mounted on a sub-frame whose position relative to the base frame 14 may be adjusted by the user.

It should be noted that such adjustment of the position of the sub-frame would also vary the biasing resistance force. The closer the spring member 428 is moved to the pivot point of the treadle assemblies 12, the smaller the biasing force will be, due to reduced leverage.

Figure 53:
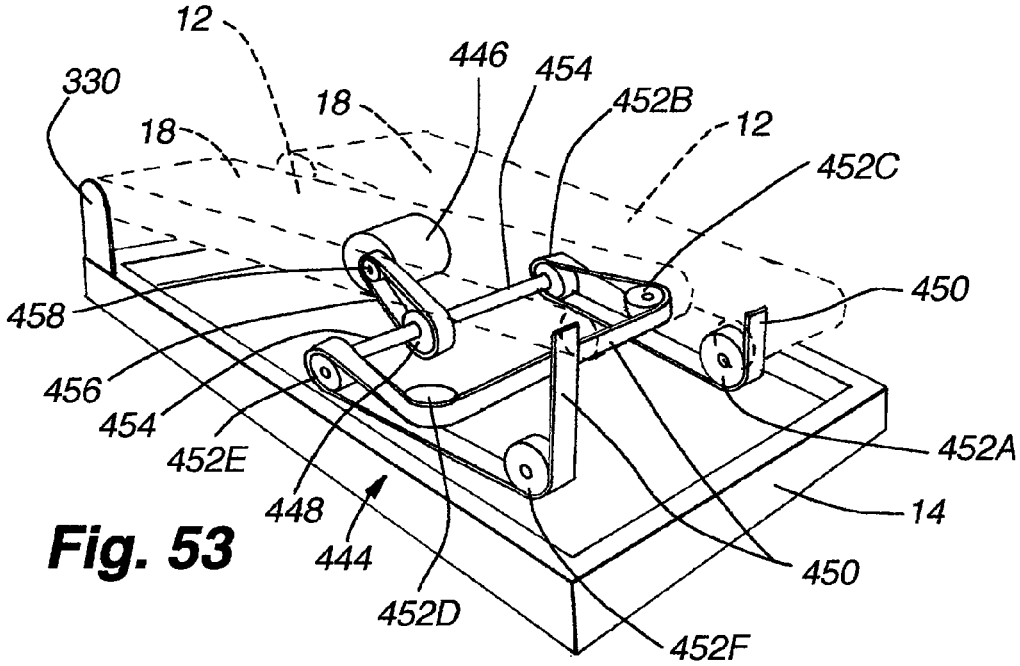
FIG. 53 is an isometric view of a brake in combination with a belt and pulley system for use as a dampener in a dual deck exercise device according to an embodiment of the present invention.

FIG. 53: Brake-Based Dampening Assembly

FIG. 53 shows an example of a dampening assembly 444 that employs a brake 446 for the dampening effect. The brake 446 provides resistance to the rotation of an attached brake pulley 448. The assembly 444 includes an elongated dampening belt 450 that runs from the treadle assemblies 12 to the brake pulley 448 through a system of pulleys 452 in order to transfer the rotational resistance of the brake pulley 448 to the up and down motion of the treadle assemblies 12. Preferably reciprocation of the treadle is coordinated by an interconnection assembly.

An illustrative system of pulleys 452 is shown in FIG. 53. A first end of the dampening belt 450 is attached to a treadle assembly 12 at a point distant from the pivot axis 330 of the treadle assembly 12. The more distant the attachment point from the pivot axis 330, the greater the leverage that is realized. A first end of the dampening belt 450 is attached to the right treadle assembly 12. The dampening belt 450 then runs through pulley 552A to change direction by about 90 degrees, from generally vertical to generally horizontal and within the general plane of the base frame 14. The dampening belt 450 next runs through pulley 452B rotatably supported with a one-way bearing, which is mounted on a shaft 454 that connects to a first side of the differential freewheel 448. Pulley 452B changes the direction of the dampening belt 450 about 180 degrees so that the dampening belt 450 remains within the general plane of the base frame 14. The dampening belt 450 is twisted about 90 degrees and is run through pulley 452C, which changes the direction of the belt 450 by about 90 degrees so that it traverses the base frame 14 and is run through pulley 452D on the opposite side. Pulley 452D changes the direction of the belt 450 by about 90 degrees, and the belt 450 is then twisted about 90 degrees and runs through pulley 450E, which is also rotatably supported with a one-way bearing. Pulley 450E is mounted on a shaft 454 that connects to a second side of the differential freewheel 448. Pulley 452E changes direction of the dampening belt 450 about 180 degrees so that the dampening belt 450 remains within the general plane of the base frame 14 and is directed to pulley 452F. The dampening belt 450 then runs through pulley 452F to change direction by about 90 degrees, from generally horizontal and within the general plane of the base frame 14 to generally vertical. The second end of the dampening belt 450 is attached to the left treadle assembly 12 at a point distant from the pivot axis 330 of treadle assembly 12.

When pulley 452E is turned counterclockwise (as viewed from the left side of the base frame 14) by an upward movement of the left treadle assembly 12, the freewheel engages 448 so that the brake 446 is turned via the brake belt 456 and a pulley 458 mounted on the brake 446 to assert a dampening force in opposition to the upward movement of the left treadle assembly 12. An upward movement of the left treadle assembly 12 turns pulley 452B clockwise (when viewed from the same point, i.e., the left side of the base frame 14) by pulling the dampening belt 450. The clockwise rotation of pulley 452B does not engage the freewheel 448 because the one-way bearing of the differential freewheel 448 is engaged only by counter clockwise rotation as viewed from the left side of the frame 14.

It will be appreciated that the various locations of the pulleys in the pulley system of FIG. 53 are not critical. The purpose of the pulley system is to transfer the generally vertical motion of the treadle assemblies 12 to a brake 446 through a differential freewheel 448. Hence, any pulley system that is able to transfer the generally vertical motion of the treadle assemblies 12 to a differential freewheel 448 may be used. It is also advantageous, but not necessary, that as much of the dampening belt length as possible be within the general plane of the base frame 14, so that it does not interfere with the aesthetics and operation of the exercise machine 10.

To accommodate various bias positions (inclinations), the length of the dampening belt 450 may be made variable. This may be achieved in a variety of different ways. In one technique, a spooling mechanism is placed at the attachment point in one or both of the treadle assemblies 12. The bias and spool settings are adjusted until the desired inclination is achieved with no slack in the dampening belt 450. The spool adjustment may be manual or motor driven under control from the user console. In another technique, pulleys 452C and 452D are mounted on a moveable sub-frame. The bias and sub-frame position settings are adjusted until the desired inclination is achieved with no slack in the dampening belt 450. The sub-frame position adjustment may be manual or motor driven under control from the user console. A spring may also be used to tension the sub-frame in order to take slack out of the dampening belt 450, although some of the dampening force may be lost in tensioning the spring.

The brake-based dampening 444 assembly operates as follows. As the user steps down on, say, the belt 18 of treadle assembly 12 so that his foot frictionally engages the belt 18, the left treadle assembly 12 pivots in a downward direction about its pivot axis 330. This has no significant effect on the dampening belt 450, which does not compress. However, as the user steps down on the left treadle assembly 12 he unweights the right treadle assembly 12, which begins to pivot in an upward direction about its pivot axis 330 due to the action of the interconnecting device (not shown, but typically a reciprocating linkage such as the rocker arm discussed elsewhere in the specification). The interconnecting device converts the downward force of the user's weighted foot on the left treadle assembly 12 to an upward force on the right treadle assembly 12. As the right treadle assembly 12 rises, it pulls the dampening belt 450, which in turn rotates pulley 452B counterclockwise such that the differential freewheel 448 engages. The differential freewheel 448 is coupled to the brake pulley 458 by the brake belt 458, so that the brake 446 asserts a dampening force on the movement of the right treadle assembly 12. This dampening force opposes the upward force on the right treadle assembly 12, which in effect dampens the downward movement of the left treadle assembly 12 through the reciprocating linkage.

Next, the user steps on the belt 18 of the right treadle assembly 12 so that his foot frictionally engages the belt 18. The right treadle assembly 12 now pivots in a downward direction about its pivot axis 330. As the user steps down on the right treadle assembly 12 he unweights the left treadle assembly 12, which begins to pivot in an upward direction about its pivot axis 330 due to the action of the interconnection device. The interconnection device converts the downward force of the user's weighted foot on the right treadle assembly 12 to an upward force on the left treadle assembly 12. As the left treadle assembly 12 rises, it pulls the dampening belt 450, which in turn rotates pulley 452E counterclockwise to engage the differential freewheel 448 so that the brake 446 asserts a dampening force on the movement of the left treadle assembly 12. This dampening force opposes the upward force on the left treadle assembly 12, which in effect dampens the downward movement of the right treadle assembly 12 through the interconnecting device. It will be appreciated that in this embodiment, the brake 446 need turn in only one direction.

In a variation of the embodiment of FIG. 53, two dampening belts 450 are used instead of one continuous belt 450. With reference to FIG. 53, the section of belt 450 between pulleys 452C and 452D is eliminated, and pulleys 452C and 452D are replaced with take-up reels, springs, or other such devices. As the left treadle assembly 12 moves in an upward direction in this variation, the attached dampening belt 450 is drawn from the take-up reel or drawn as the spring stretches so that pulley 452E turns in a counterclockwise direction, causing the differential freewheel 448 to engage so that the brake 446 asserts a dampening force on the movement of the left treadle assembly 12. As this is occurring, the right treadle assembly 12 is moving in a downward direction, which tends to cause slackening in the dampening belt 450 that is attached to the right treadle assembly 12. The slack is taken up by the take-up reel or spring. Since the pulley 452B is rotated clockwise, the freewheel 448 does not engage as a result of the rotation of the pulley 452B.

The differential freewheel 448 is eliminated in the following variation (not shown) of FIG. DC5, which uses a bi-directional brake 446 and a single continuous dampening belt 450. Either the shaft 454 from pulley 452E or the shaft from pulley 452B of FIG. 53 is retained, but not both. Assuming the shaft 454 from pulley 452E is retained, a brake pulley 448 is mounted on the shaft 454 from pulley 452E, and the brake belt 456 of FIG. 53 runs through the brake pulley 448. If desired, the brake 446 may be designed to be mounted directly to the shaft 454 from the pulley 452E. Otherwise, this variation is identical to the FIG. 53 embodiment. In operation, upward movement of either treadle assembly is coupled to the brake 446 due to rotation of pulley 452E.

In another variation of the embodiment of FIG. 53, the differential freewheel 448 may be eliminated and two brakes 446 are used, one with pulley 452E and the other with pulley 452B. A single continuous dampening belt 450 may be used in this variation, or two separate dampening belts 450 may be used in this variation.

The term "continuous belt" refers to the structural continuity of the belt 450, and not to whether the materials in the belt 450 are homogeneous. An example of a continuous belt 450 is a belt having three sections, the end sections being of flat material and the middle section being a tensioning device such as a spring or a variable length rod such as a turnbuckle. The tension device or variable length rod are useful in conjunction with a biasing device to set the inclination of the treadle assemblies 12 while avoiding slack in the dampening belt 450. Although a flat belt is advantageous, the belt is not limited to a flat form and may be any desired shape with any desired surface finish, texture, or features such as corrugation and the like.

With reference to the brake embodiment of FIG. 53, a flywheel may be substituted for the brake 446 and brake pulley 458. The other components would remain the same, except that the brake 446 and brake pulley 458 would be replaced by the flywheel. As the user built up speed, the dampening effect supplied by the flywheel would be reduced by the conserved momentum of the fly wheel. If a differential fly wheel is used, it could be mounted on the split shaft 454 connecting pulleys 352B and 352E, and the brake belt 450 and differential free wheel 448 could also be eliminated.

Figure 60:
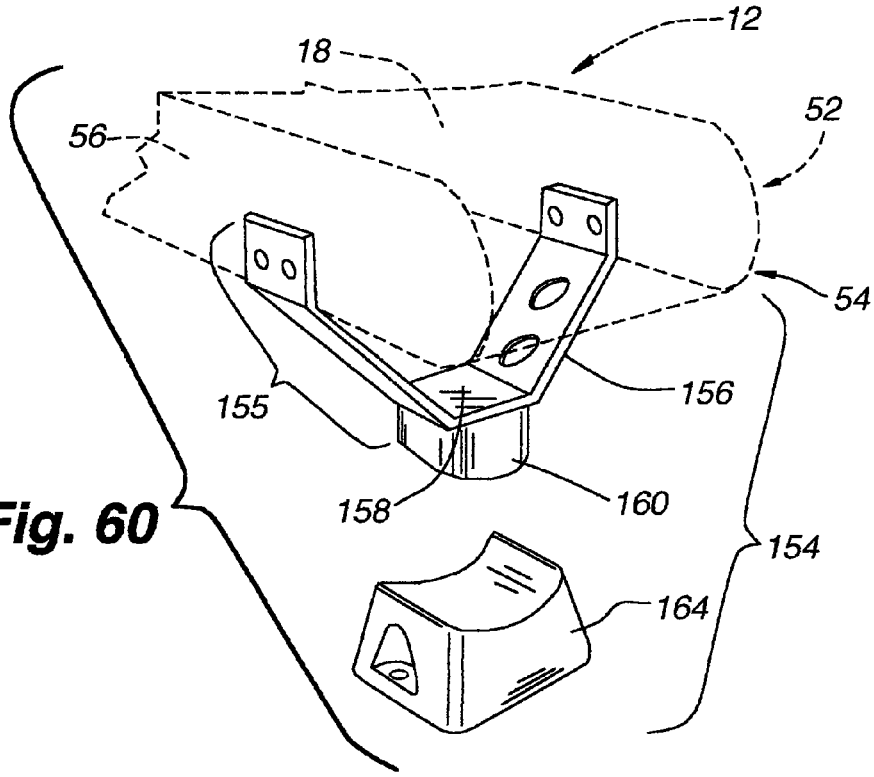
FIG. 60 is an isometric view of a cushioning mechanism for use in association with a dual treadle exercise device.

FIG. 60: Cushioning Mechanisms for Exercise Machine

FIG. 60 illustrates one embodiment of a cushioning mechanism 154 to cushion the impact that can occur if one of the treadle assemblies 12 bottoms out at the bottom of its travel. This can occur as the user relaxes his pace at the end of the workout, and the left and right treadle assemblies 12 are pushed down by the weight of the user towards the base frame or the floor. Bottoming out may also occur during a workout if the biasing force is not properly set. The exercise machine 10 therefore preferably includes a mechanism to absorb some of the force of the impact of the treadle assemblies 12, to both cushion the user and to avoid damage to the exercise machine 10 or the underlying floor.

The cushioning mechanism 154 of FIG. 60 uses a hard plastic protrusion 160 from a mounting 155 bracket that extends beyond the width of the belt 18 of the treadle assembly 12 and that has two upward-extending flanges 156 that couple to the internal side frame members 54, 56 of the treadle assembly 12. A soft rubber bumper 164 is coupled to the base frame 14, either directly or by a bracket, and is located so that it is engaged by the plastic protrusion 160 as the treadle assembly 12 approaches a bottoming out condition. The soft rubber bumper 164 resiliently deforms when contacted by the hard rubber protrusion 160 to provide the cushioning effect. The hard and resilient portions 160, 164 of the cushioning mechanism 154 could be reversed such that a resilient protrusion 164 is provided on the mounting bracket 155, and a relatively harder bumper 160 is provided on the frame 14.

Figure 61B:
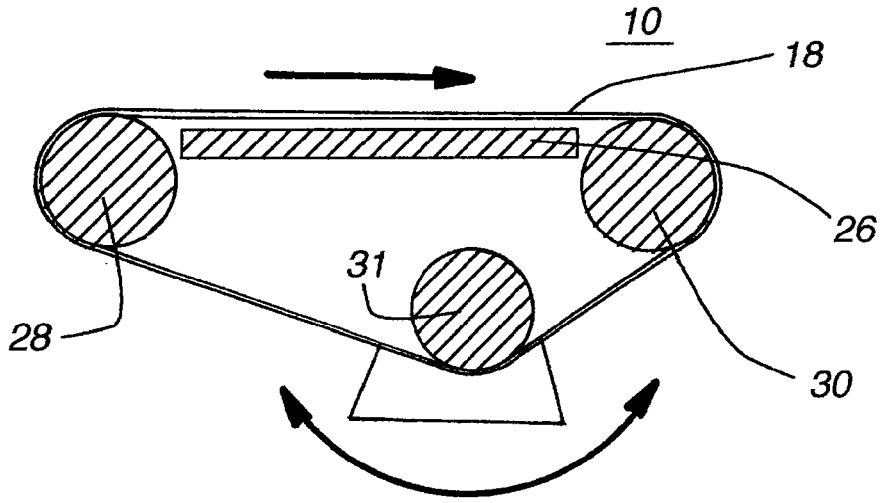
FIG. 61B is a side view of the base portion of an exercise device shown in 61A.
Figure 61A:
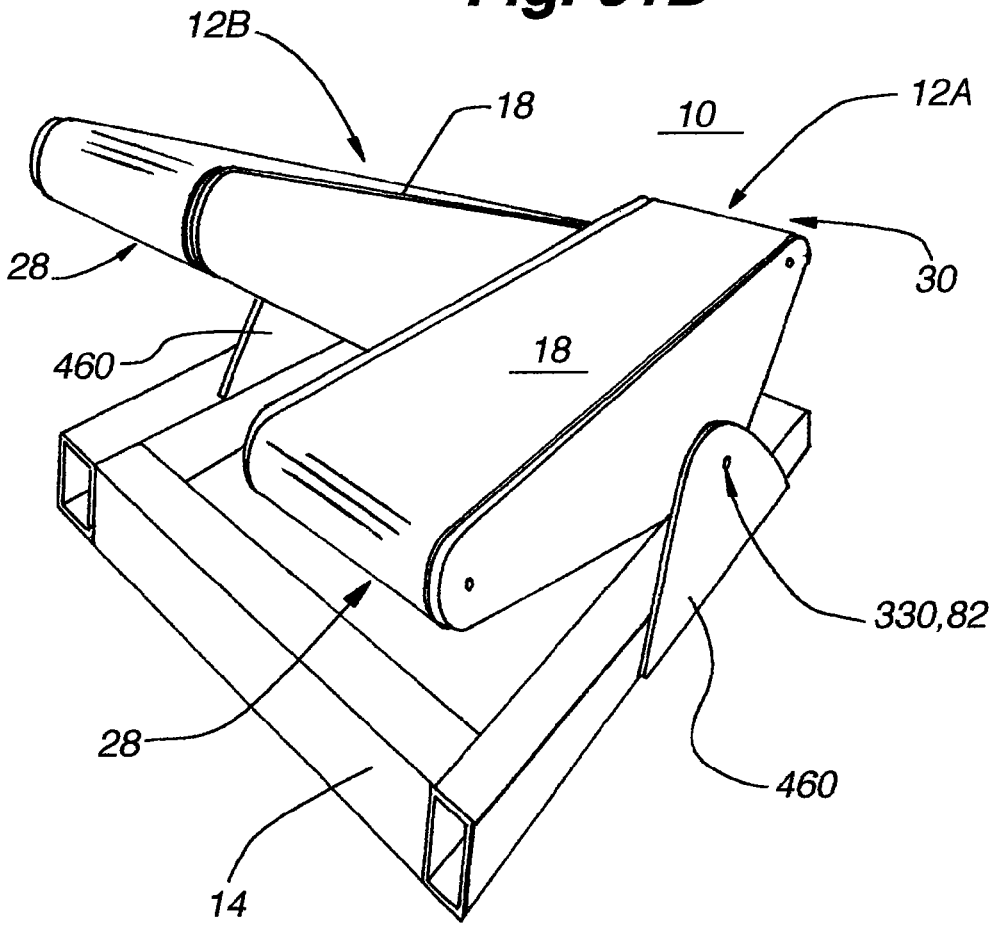
FIG. 61A is an isometric view of a base portion of a dual deck exercise machine with treadle assemblies that include three rollers.

FIGS. 61A-61B: Bottom Drive Exercise Machine

The bottom drive exercise machine 10 of FIGS. 61A and 61B has two treadle assemblies 12, a right assembly 12 and a left assembly 12. Each of the treadle assemblies 12 is essentially a separate treadmill with its own tread belt 18, deck 26, and front, rear and offset rollers 28, 30, 31. Although each of the treadle assemblies 12 may be driven by its own motor 88 if desired, advantageously both treadle assemblies 12 are driven by a common driveshaft and the same motor. This assures that the belts travel at the same speed. If desired, a single drive roller for both of the treadle assemblies 12 may be used instead of separate drive rollers for each. The treadle assemblies 12 also are interconnected to provide a balanced relationship between the right and left sides during a workout and to provide some additional cushioning. The balanced relationship may be achieved in a variety of ways, including by a reciprocating linkage such as any of the rocker arm assemblies described in this document. The exercise machine 10 may be operated in a treadmill mode by locking the left and right treadle assemblies 12 together at a desired incline such as 10% to get a traditional treadmill workout, or may be operated in a stepper mode by maintaining the belts 18 stationary (motor off). With a few exceptions, the same arrangements of components as used in the rear drive embodiment described elsewhere in this document are generally suitable for the bottom drive embodiment of FIG. 61A.

The treadle assemblies 12 are pivotally coupled to the base frame 14 of the exercise machine 10 along a common axis 330, although a common axis is not required. The treadle assemblies 12 pivot about their axes 330. Illustratively, the pivot axes 330 of the treadle assemblies 12 are the axes of the drive shafts 82 that drive the respective drive rollers of the treadle assemblies 12. The ends of the drive shaft 82 rest in bearings in each of the pivot brackets 460, which project from the base frame 14. In one embodiment, the driver roller is the offset roller 31. In other embodiments, the drive roller is the front roller 28 or the rear roller 30. In each of the treadle assemblies 12, the offset roller 31 and the front and rear rollers 28, 30 form an inverted triangle, with the front and rear rollers 28, 30 delineating the base of the triangle and the offset roller 31 the apex. The height of the triangle as perpendicularly measured from the base to the apex may be quite large, as shown in FIG. 61B, or quite small by bringing the offset roller 31 nearly in line with the front and rear rollers 28, 30.

The pivot axes 330 of the treadle assemblies 12 may be offset from the drive shaft 82 if desired, with other structures supporting the pivoting action. The pivot 330 may be fixed as shown, or may be variable. Different mechanisms may be used for establishing variable pivot points, including mounting the right and left treadle assemblies 12 and the drive shaft 82 in a sub-frame, and providing a variable position locking mechanism between the sub-frame and the base frame 14. An illustrative variable position locking mechanism is an array of holes in the pivot bracket 460 and a spring-loaded peg mechanism in the sub-frame. Others includes notches, clamps and ledges.

To operate the exercise machine 10 of FIG. 61A in a normal mode, the user adjusts the dampening effect and the biasing effect as desired, steps upon right and left side foot support platforms (not shown in FIG. 61A but described elsewhere in this document), adjusts the workout profile on the console as desired (the respective belts 18 of the right and left treadle assemblies 12 begin to move), and steps from the right and left foot support platforms onto the right and left belts 18, respectively. The preferred step area in the FIG. 61A embodiment is the area of the deck between the front roller 28 and a line on the deck 26 intersected by an imaginary perpendicular plane extending from the deck 26 through the pivot axis 330 (see FIG. 61B). The weight of the user will thus tend to pivot the deck 26 about the pivot axis 330.

With reference to FIG. 61, assume the user is walking or running in the direction of roller 28 (the arrow shows the movement of the belt 18, which is in a direction opposite the direction the user has taken). In normal mode operation as shown in FIG. 61B, the user has shifted his weight from the right treadle assembly 12A (which has been carried along the right treadle assembly 12A by the moving belt 18) to the left treadle assembly 12B. The force exerted on the left treadle assembly 12B is opposed by the dampening resistance, which may be speed dependent and increases with speed, and the biasing force, which is dependent on the attachment position or biasing force of the biasing device. The right treadle assembly 12A begins to rise because the foot thereon has been unweighted and because the downward force on the left treadle assembly 12B is being transferred as an upward force to the right treadle 12A through the reciprocating linkage (not shown). Next, the foot on right treadle 12A becomes fully unweighted as it is lifted and moved from the rear of the step area of the treadle assembly 12A toward the front of the step area of the treadle assembly 12A. Meanwhile, the full weighted foot on the left treadle 12B is carried toward the rear of the deck of the treadle assembly 12B with the moving belt 18, and the inclination of the left treadle assembly 12B decreases due to the weight while the inclination of the right treadle assembly 12A increases due to the biasing force and the transferred force. At a slow belt speed (slow pace), the treadle assemblies 12 travel through a greater arc range that at high belt speeds (fast pace), all else being equal.

If desired, the belts 18 of the treadle assemblies 12 may be run in reverse. If desired, either of the front and rear rollers 28, 30 may be made into a drive roller.

Figure 62A:
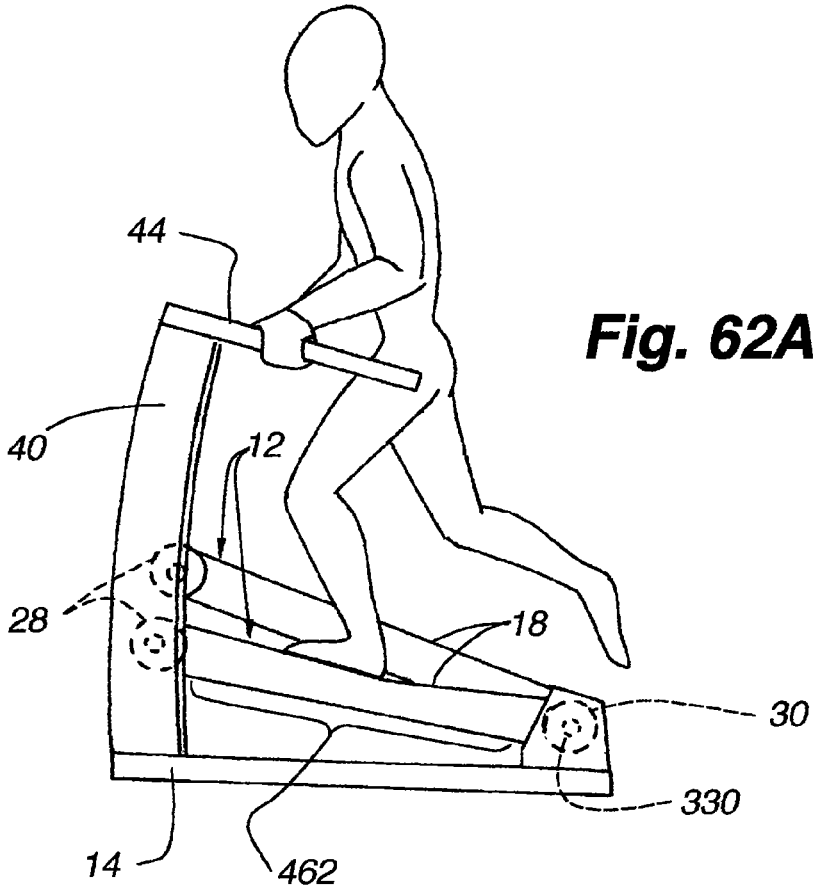
FIG. 62A is a side view of a dual treadle exercise machine according to the present invention, wherein the treadle assemblies do not include a deck portion.
Figure 62B:
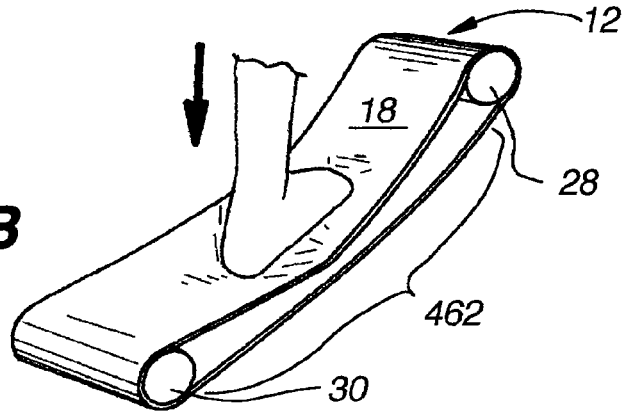
FIG. 62B is an isometric view of one of the treadles from FIG. 62 in use with a user deflecting a movable belt provided on the treadle assembly.
Figure 62C:
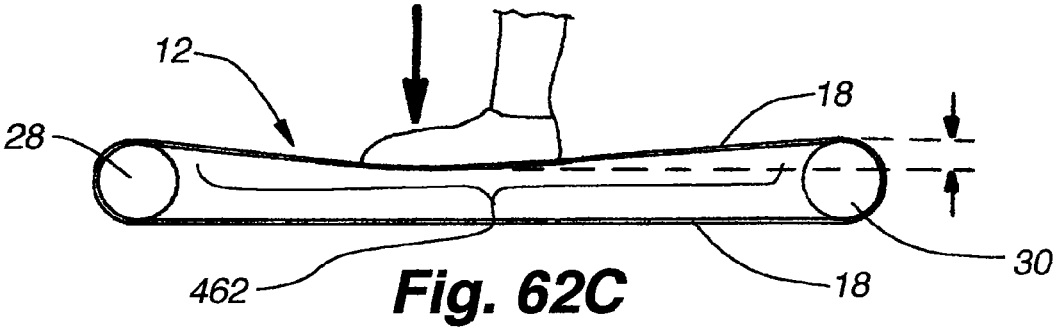
FIG. 62C is a left side view of the treadle assembly from the FIG. 62.

FIGS. 62A-62C: Deckless Exercise Machine

The treadle assembly shown in FIG. 62A differs from those described and shown elsewhere herein in that no deck or deck suspension is present.

Decks 26 are common in standard treadmills, wherein they provide stability and a degree of cushioning to contribute to the comfort of the legs and feet with prolonged use. To provide additional cushioning for the legs, feet and back, treadmills may use a suspension directly under the deck. In one approach, rubber bushings are used under a flexible deck 26. Traditional treadmill belts 18 typically have walking/running surfaces ranging from 17" to 22" wide and 51" to 61" long. FIGS. 27-32 illustrate deck-type suspensions for treadle assemblies 12 according to the present invention.

A deckless treadmill known as the Orbiter™ treadmill is available from Orbiter Treadmills of Highlands, Tex. As stated in a testimonial in the product literature, "Sold largely to medical rehab centers, the Orbiter™ treadmill has a rubbery, suspended running surface that stretches when your foot lands on it. (It felt like I was running on a trampoline.)" While the Orbiter treadmill may be effective in absorbing shock and providing an effective workout, the stretching may cause some users to feel a sense of instability. The surface length of the belt is 56" and the width is 20".

The treadle assemblies 12 shown in FIGS. 62A, 62B, 62C have no deck and no underlying suspension, which provides shock absorbing properties to the step area 462. Good stability is realized in the treadle assemblies because of the relatively small size of the step area 462, illustratively 40 inches long and 8 inches wide in the rear drive machine shown in FIGS. 62A, 62B, and 62C. Overall stability may be improved by using reinforced belt material. Transverse stability may be improved in a variety of ways, such as by reinforcing the edges of the belt 18 with a fiber bead or a steel cable. Additionally, the rollers 28, 30 over which the belt 18 passes may be provided with grooves to receive the reinforced edges and maintain the belt 18 in a degree of transverse tension in the area of the rollers, and additional grooved wheels or channels may be provided along both edges of the step area 462 to engage the reinforced edges of the belt 18 and maintain the belt 18 in a degree of transverse tension throughout the step area 462.

The treadle assemblies 12 may be provided with decks 26 that can be locked in place just under the belt 18 in the step area to provide a stable and reasonably well cushioned walking/running surface for a normal workout, or may be parked in a position away from the step area to provide a low impact walking/running surface particular well suited for persons who are unable to tolerate the shock associated with a normal workout. The three roller embodiment of the movable belt treadle assembly, described in detail elsewhere in this document is particularly well suited for such a displaceable deck 26 because of the ample volume existing within the treadle assembly for the necessary mechanisms.

The front 22 of the right treadle assembly 12A and the front 22 of the left treadle assembly 12B move up and down opposite from each other by pivoting about an axis 330 positioned at their respective rear ends 24. As the treadle frame side tubes located on the inside of the adjacent right and left treadle assemblies 12 pass by each other during this movement, a gap or space alternately opens and closes. To help keep this gap from allowing undesired access to the internal framework of the treadles 12 and the base frame 14, such as debris and sweat, a shroud or similar structure is used to eliminate the gap. The shrouds described below can also attach to the framework of the exercise apparatus so as to not interfere with motion of treadles.

Figure 63A:
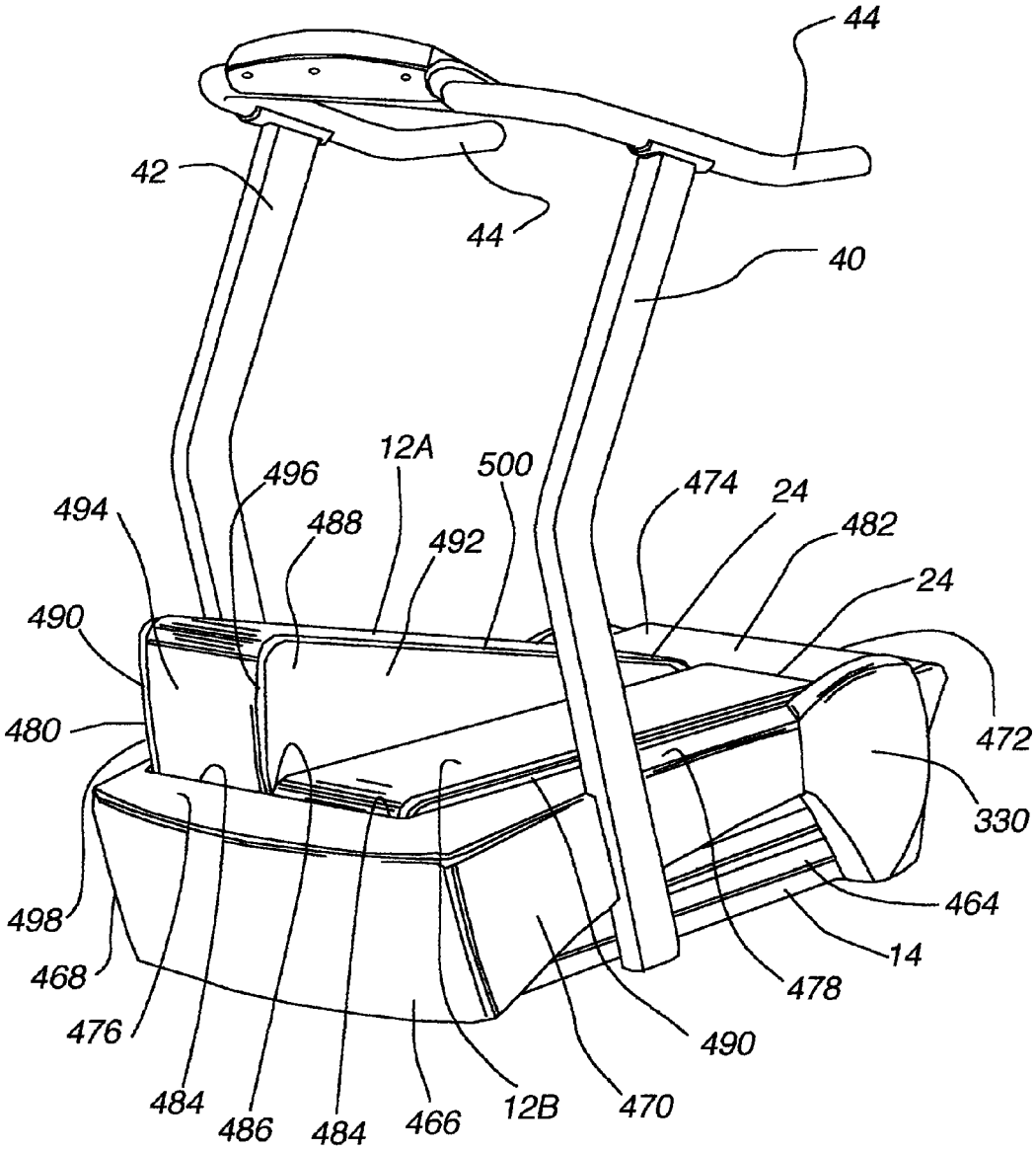
FIG. 63A is a front left-side perspective view of the exercise apparatus depicting treadle shroud assemblies separated by a center strip on a base shroud.
Figure 63B:
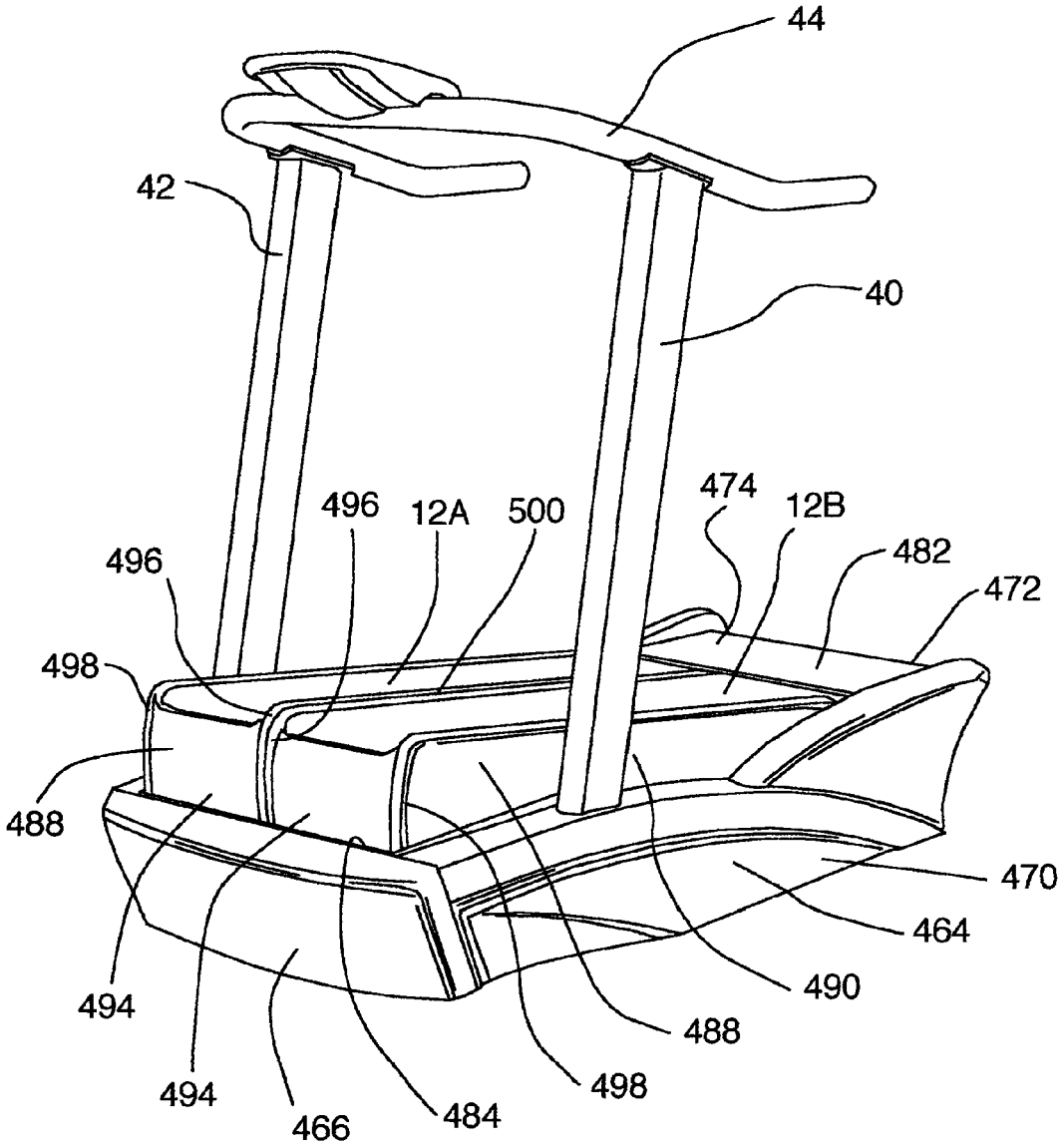
FIG. 63B is a front left-side perspective view of the exercise apparatus depicting adjacent treadle shroud assemblies.
Figure 63C:
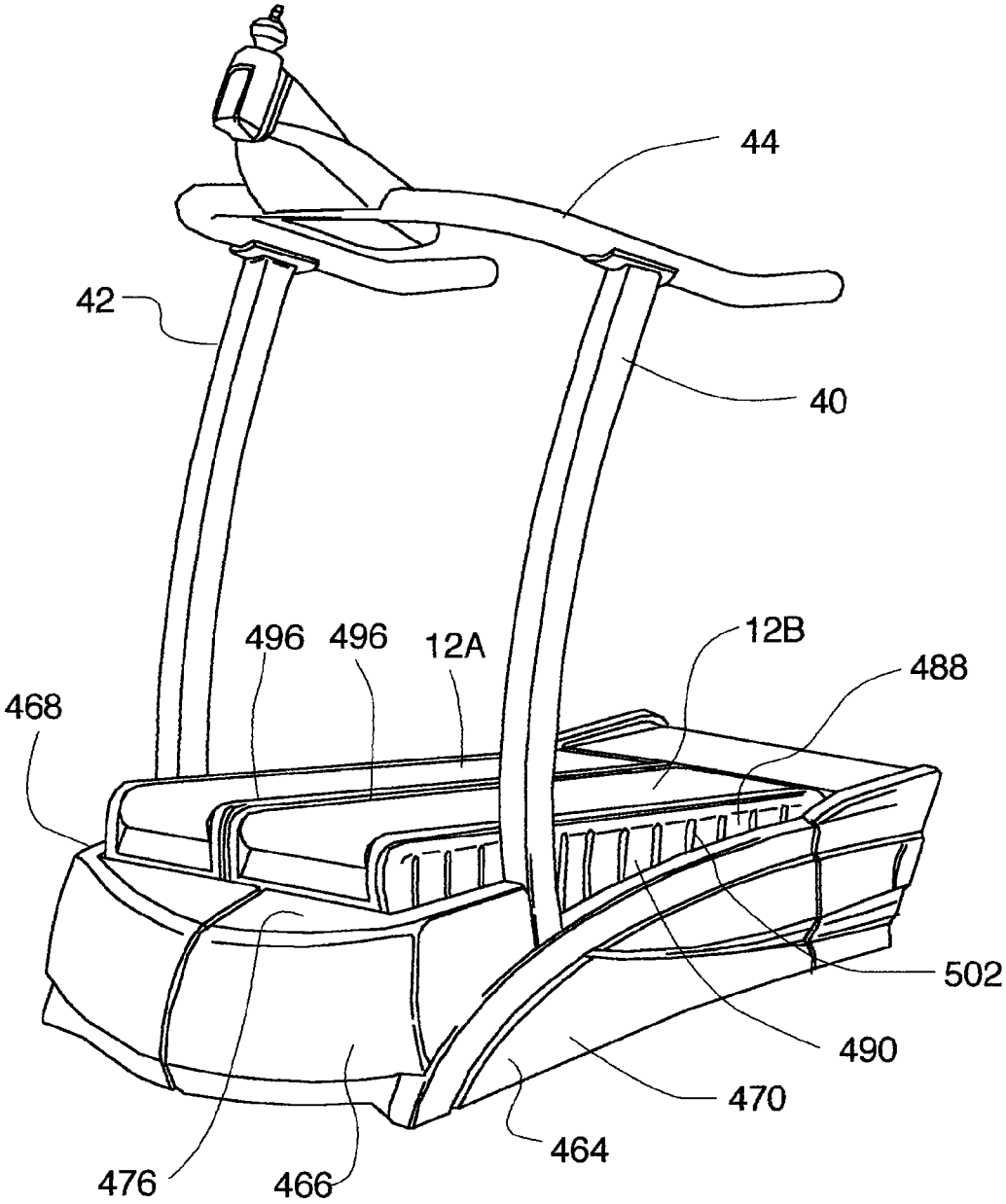
FIG. 63C is a front left-side perspective view of the exercise apparatus depicting treadle shroud assemblies with front side shields.
Figure 63D:
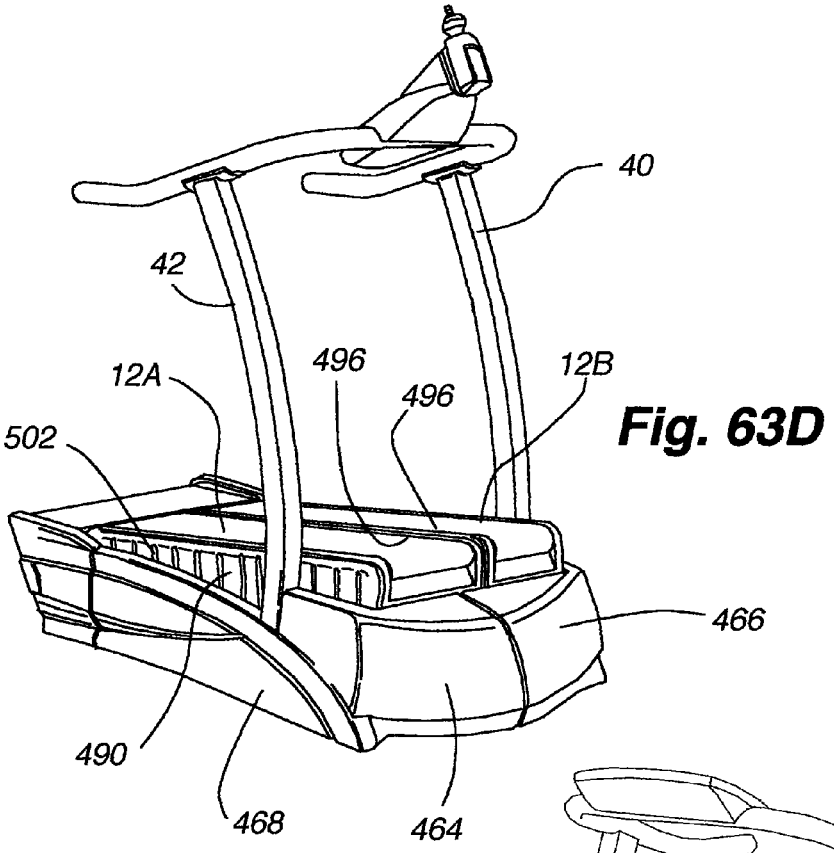
FIG. 63D is a front right-side perspective view of the exercise apparatus shown in FIG. 63.
Figure 63E:
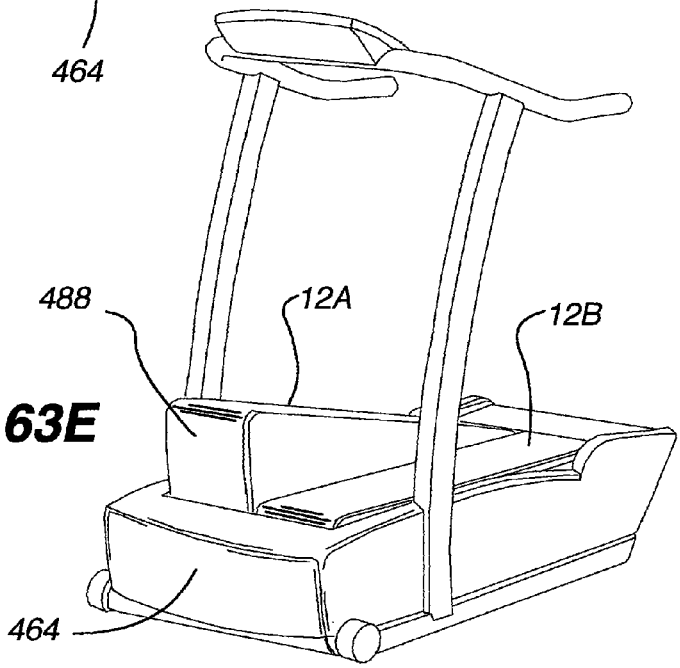
FIGS. 63E-63X show treadle shroud assemblies in various other views and incorporated in alternative embodiments of the present invention.
Figure 63F:
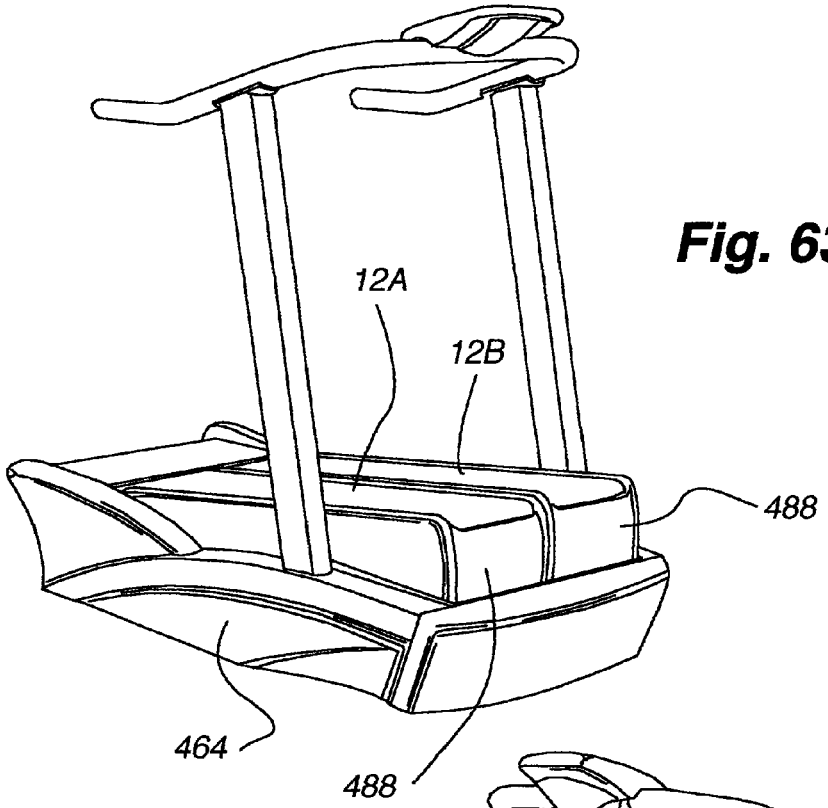
Figure 63G:
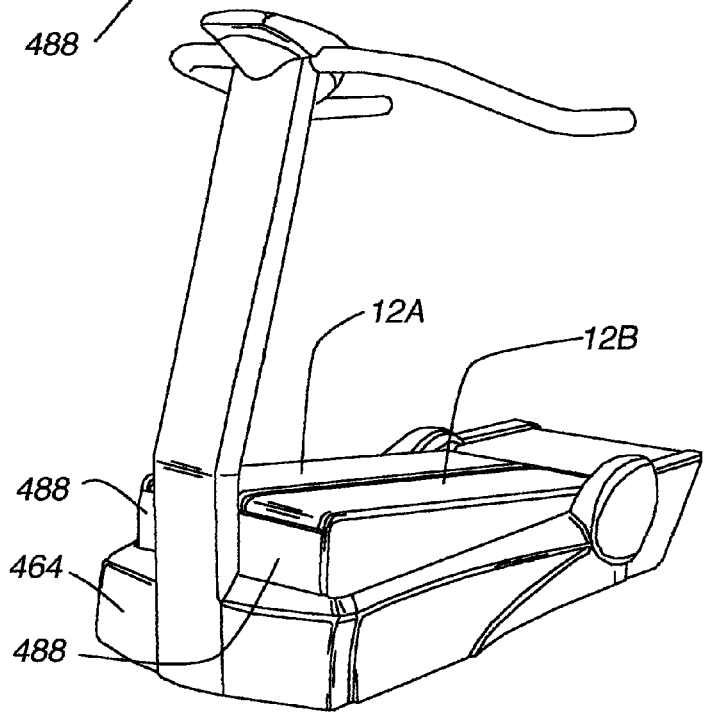
Figure 63H:
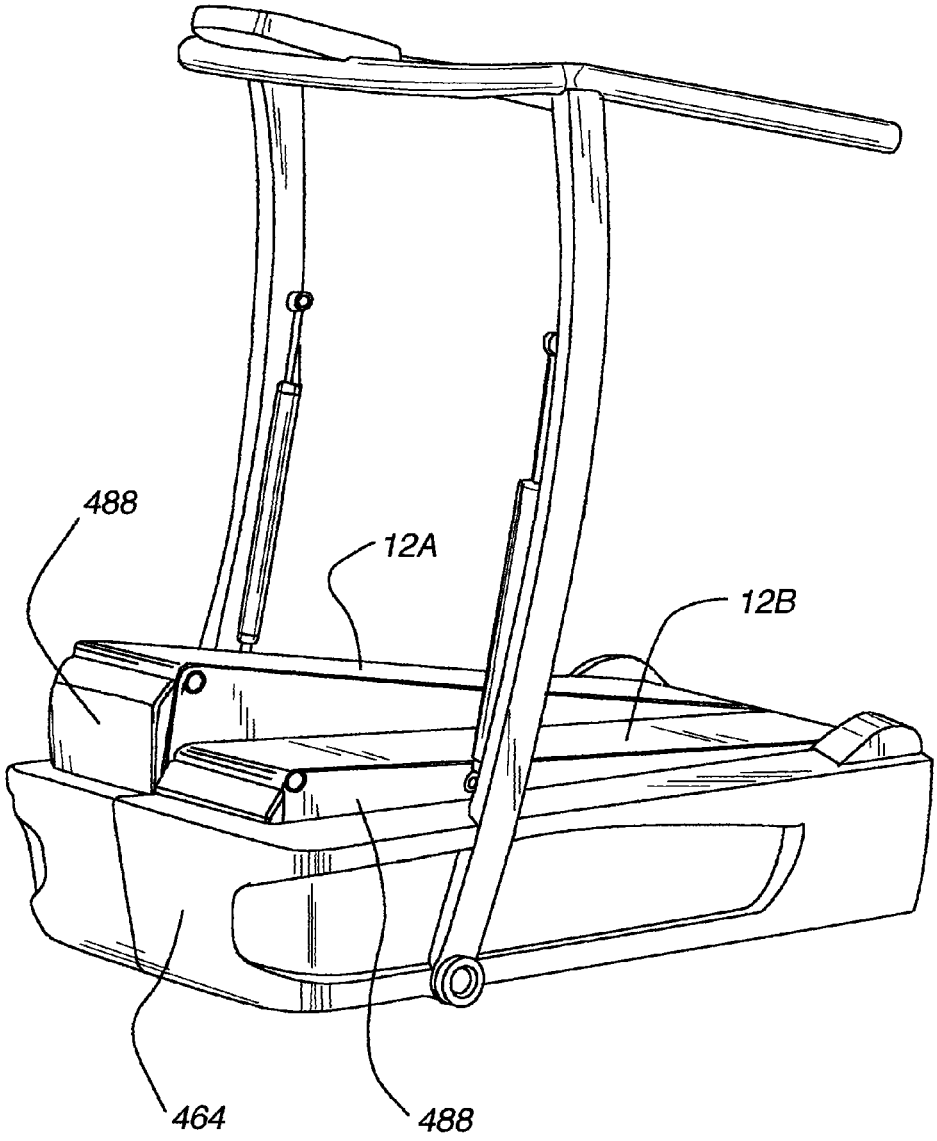
Figure 63I:
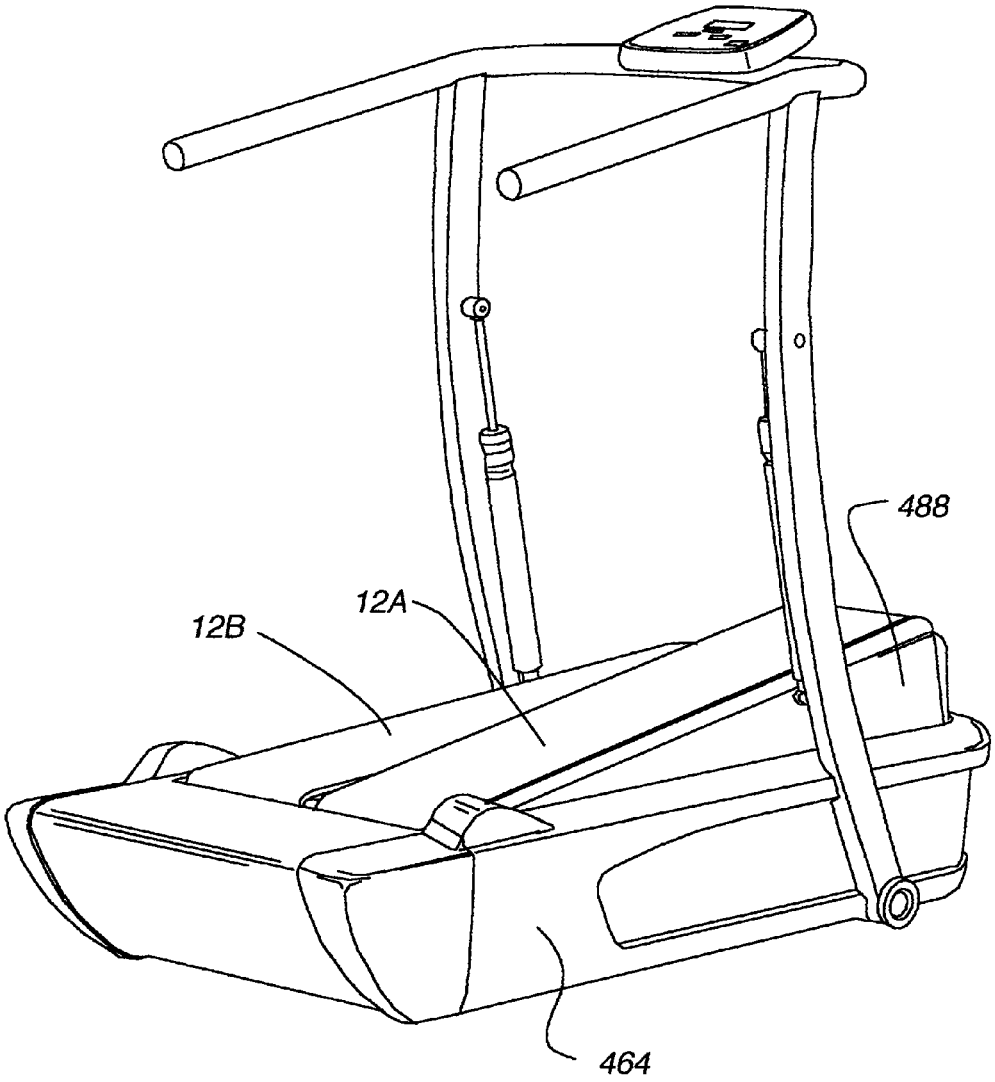
Figure 63J:
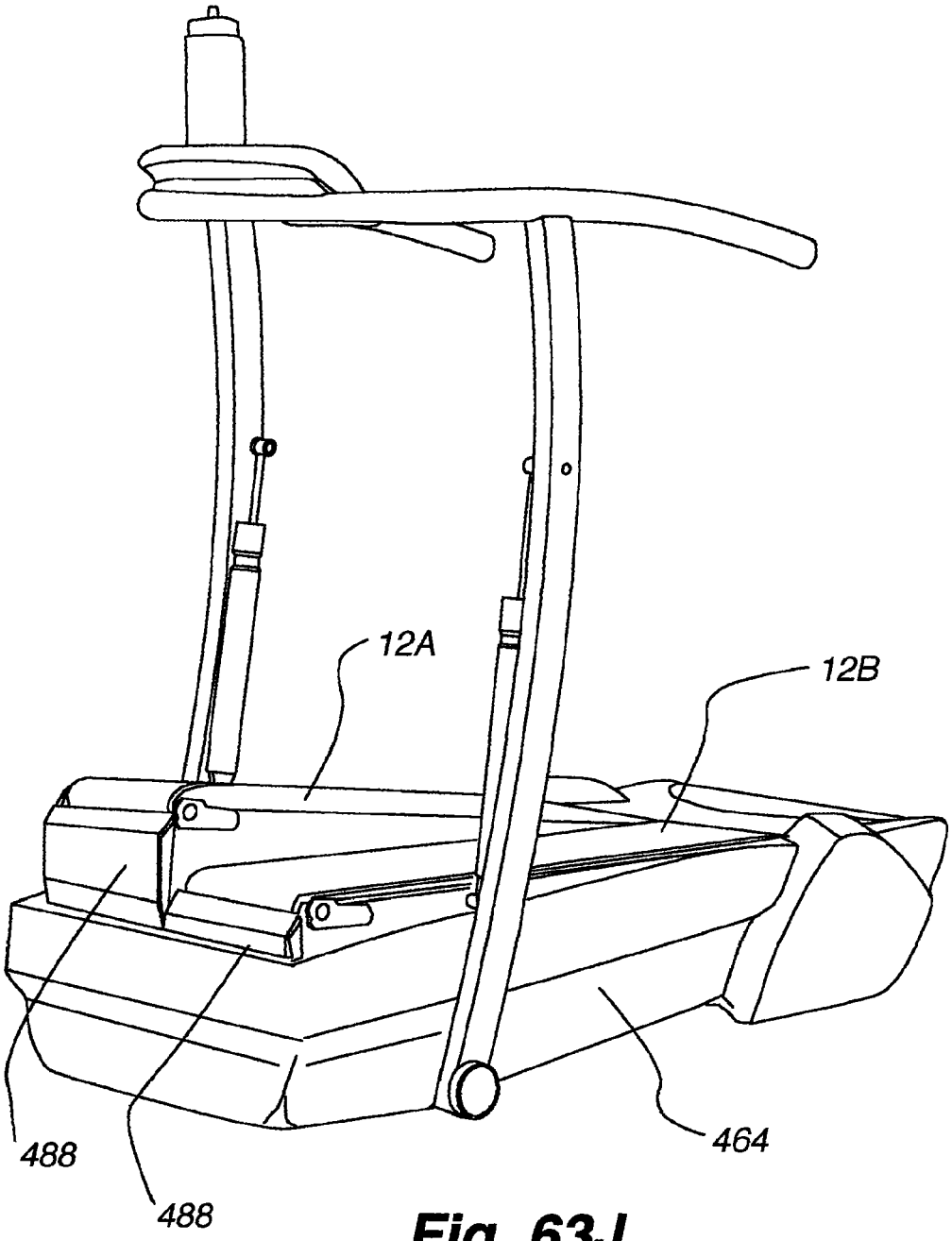
Figure 63K:
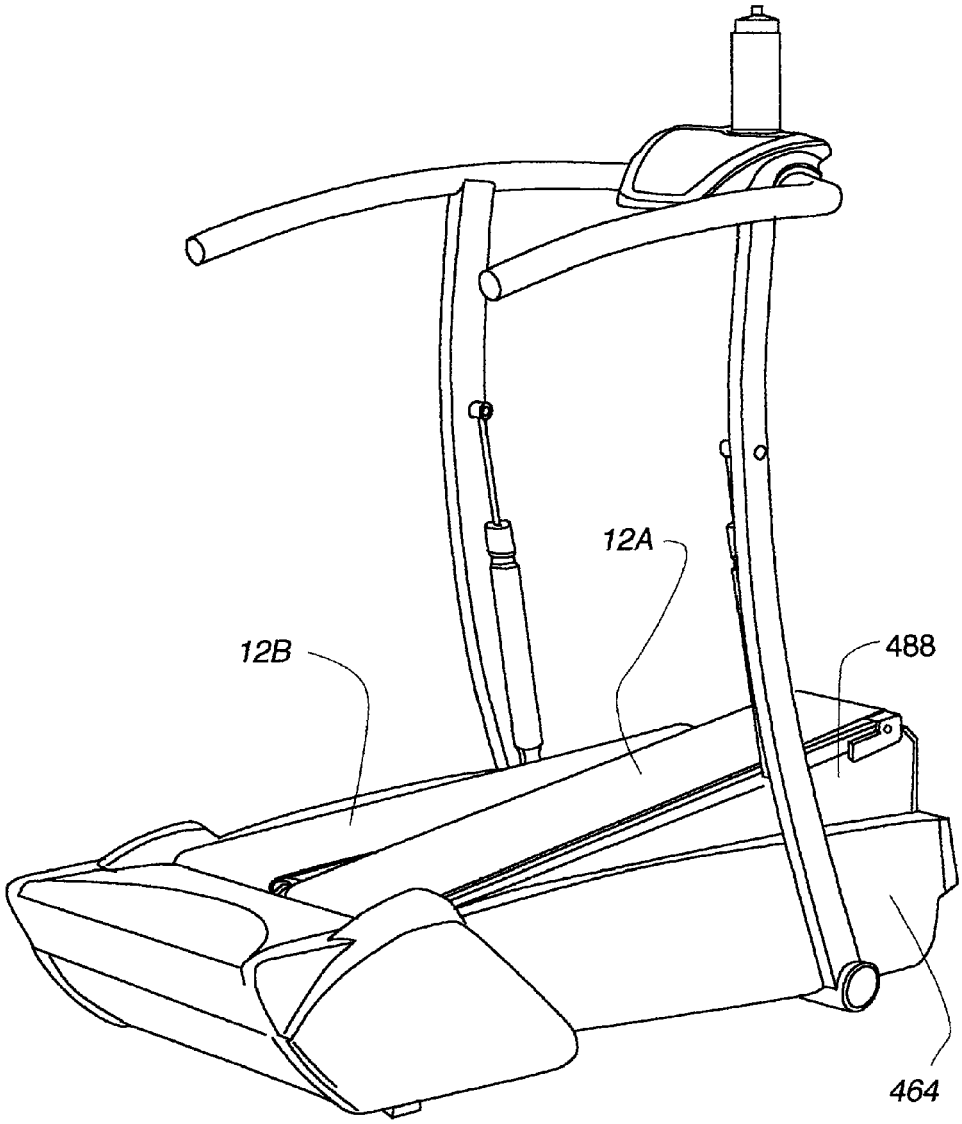
Figure 63L:
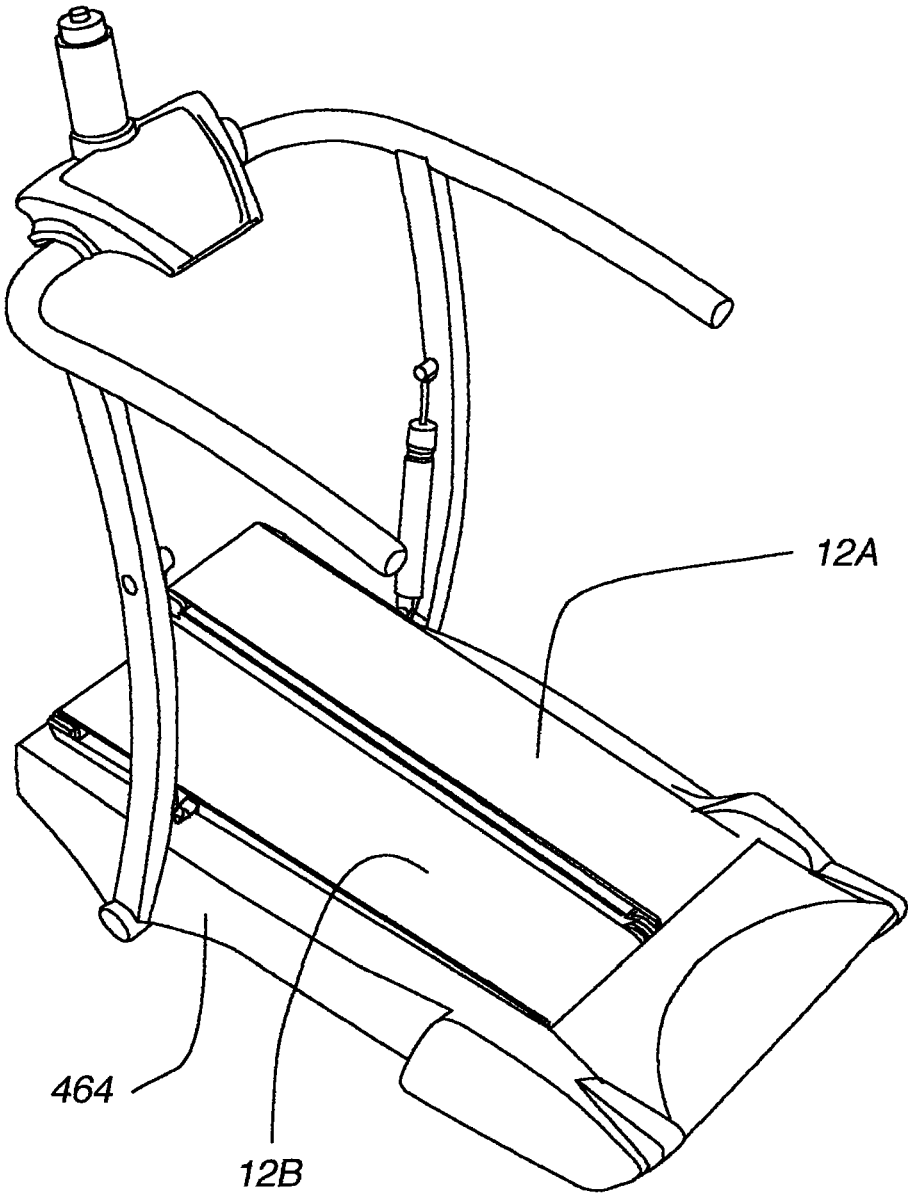
Figure 63M:
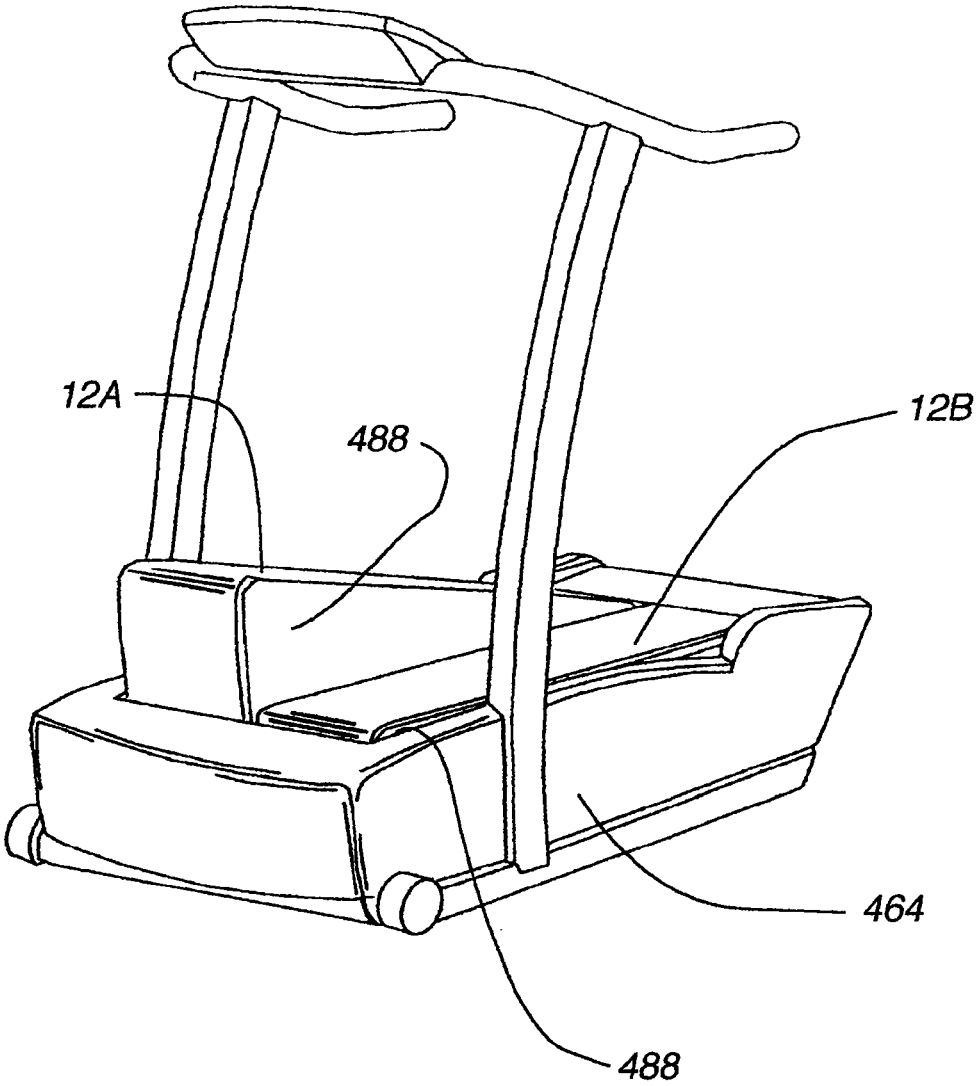
Figure 63N:
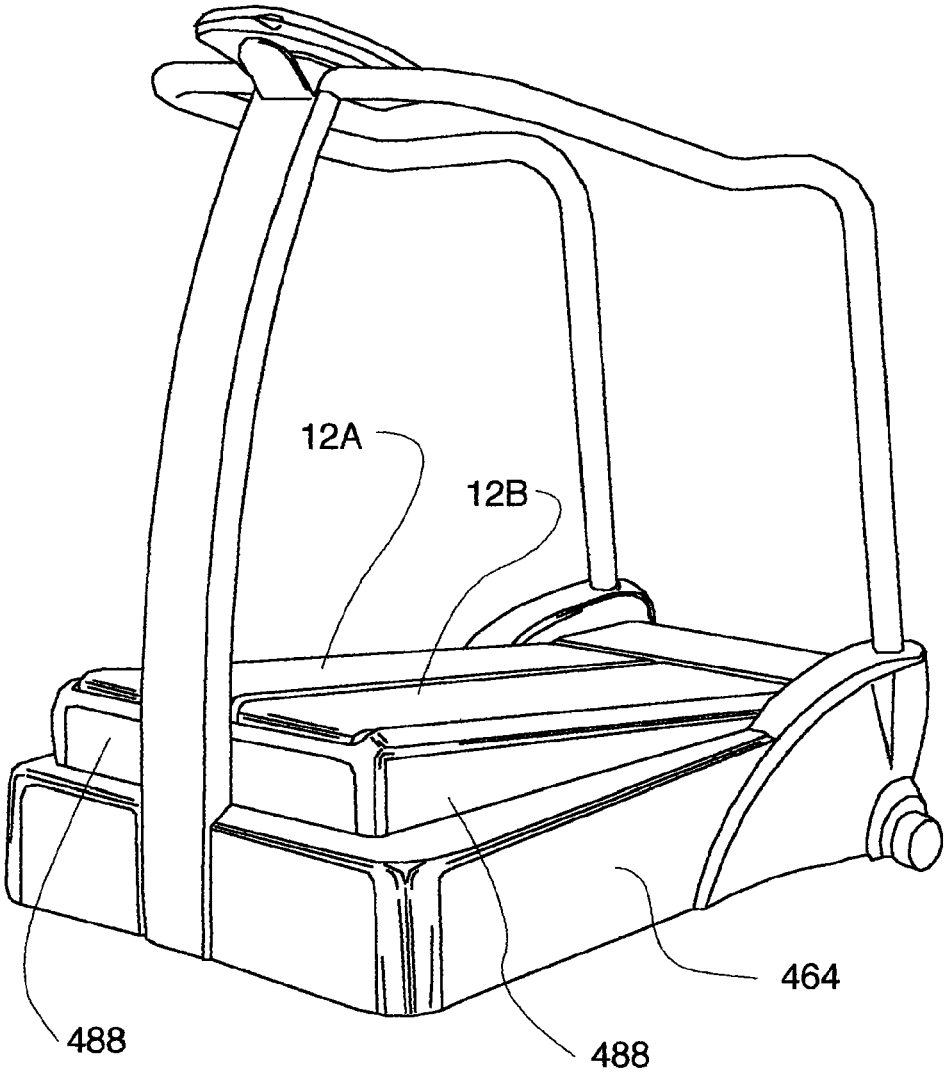
Figure 63O:
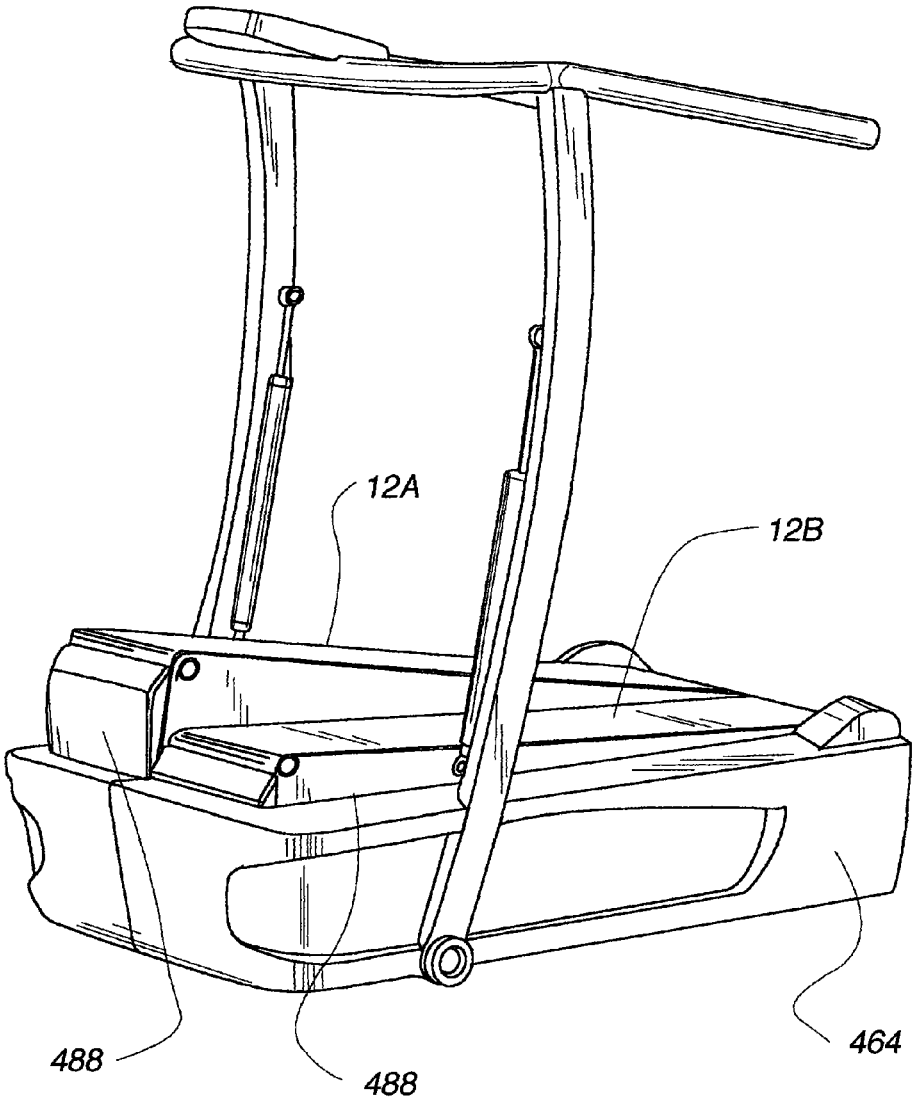
Figure 63P:
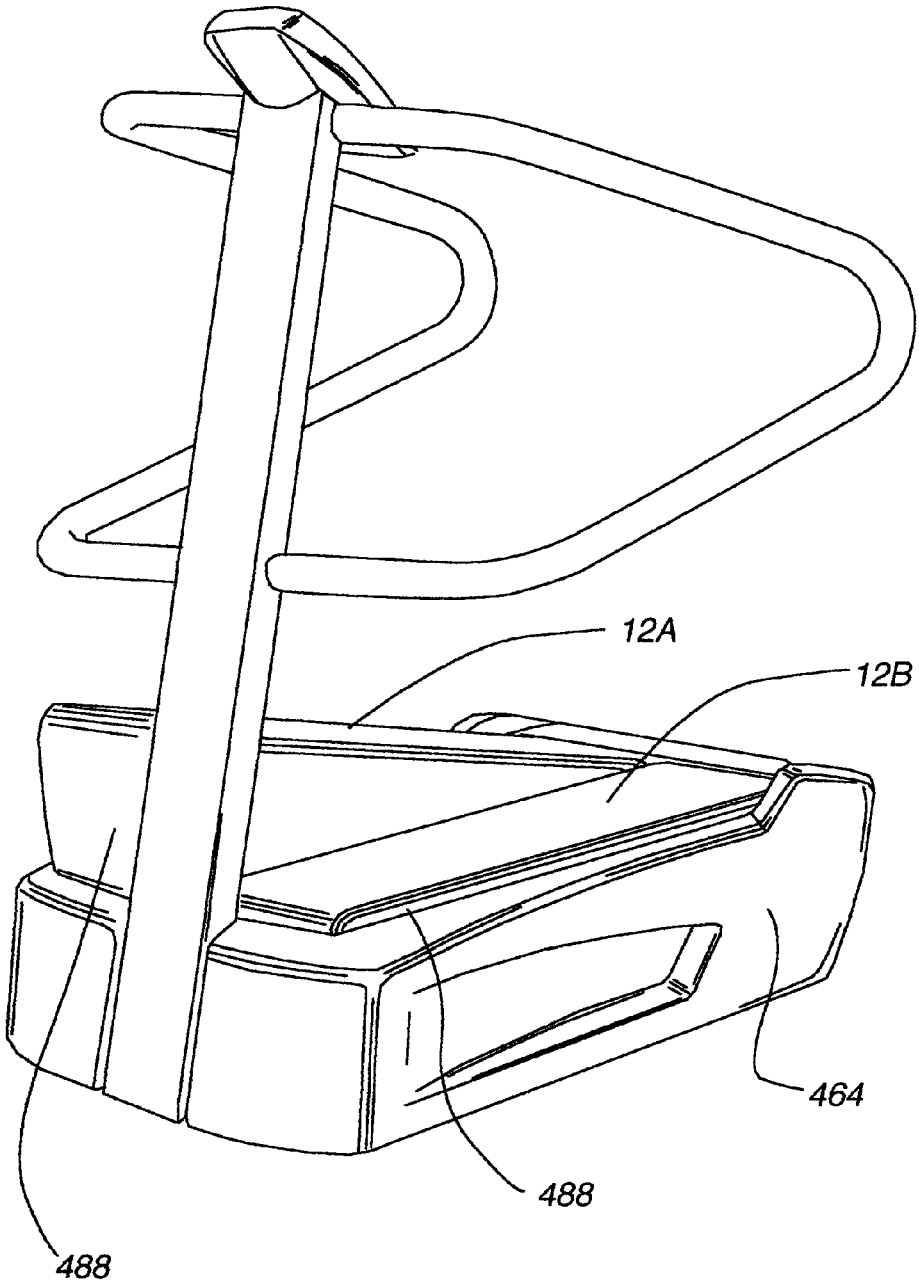
Figure 63Q:
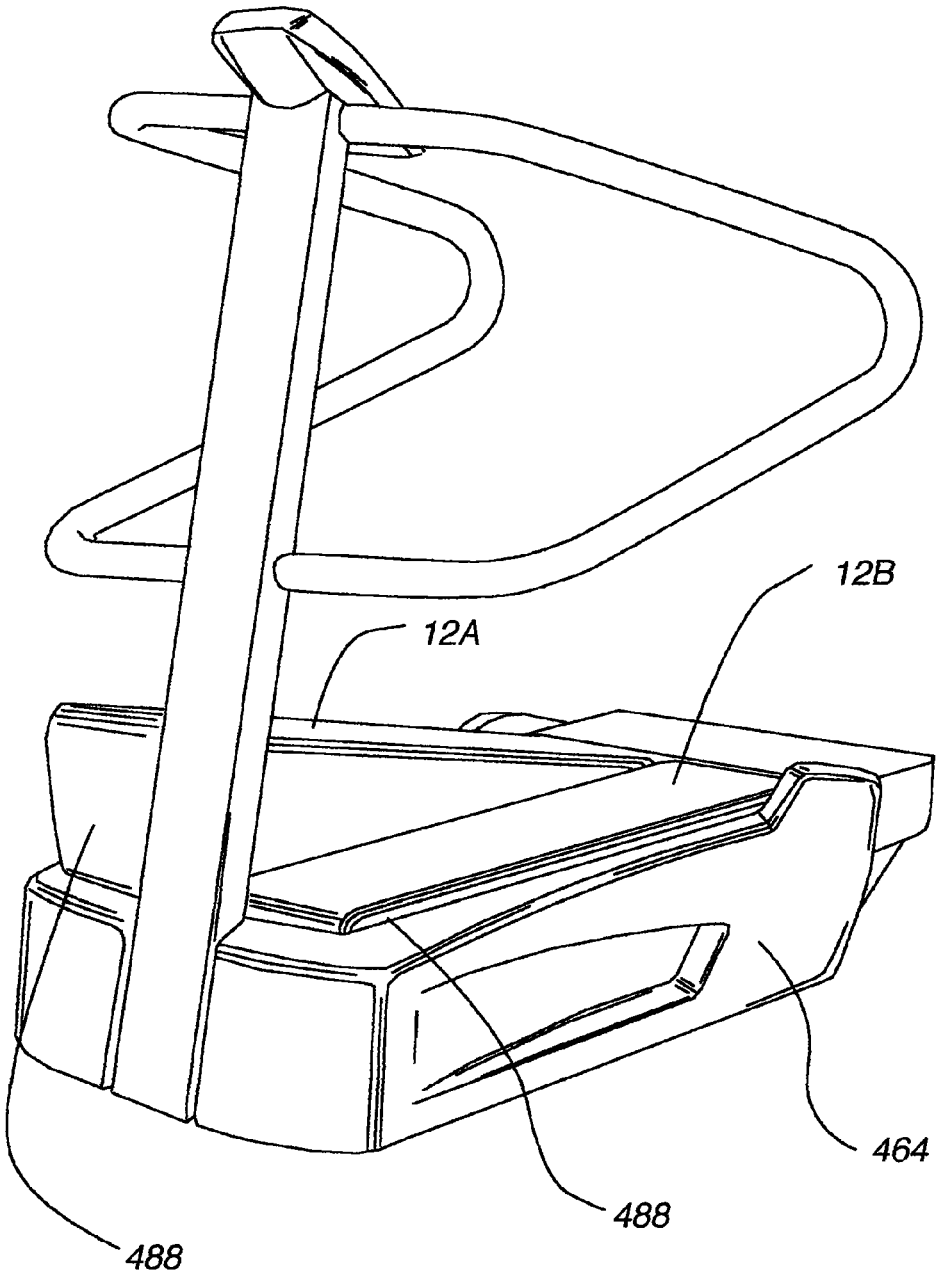
Figure 63R:
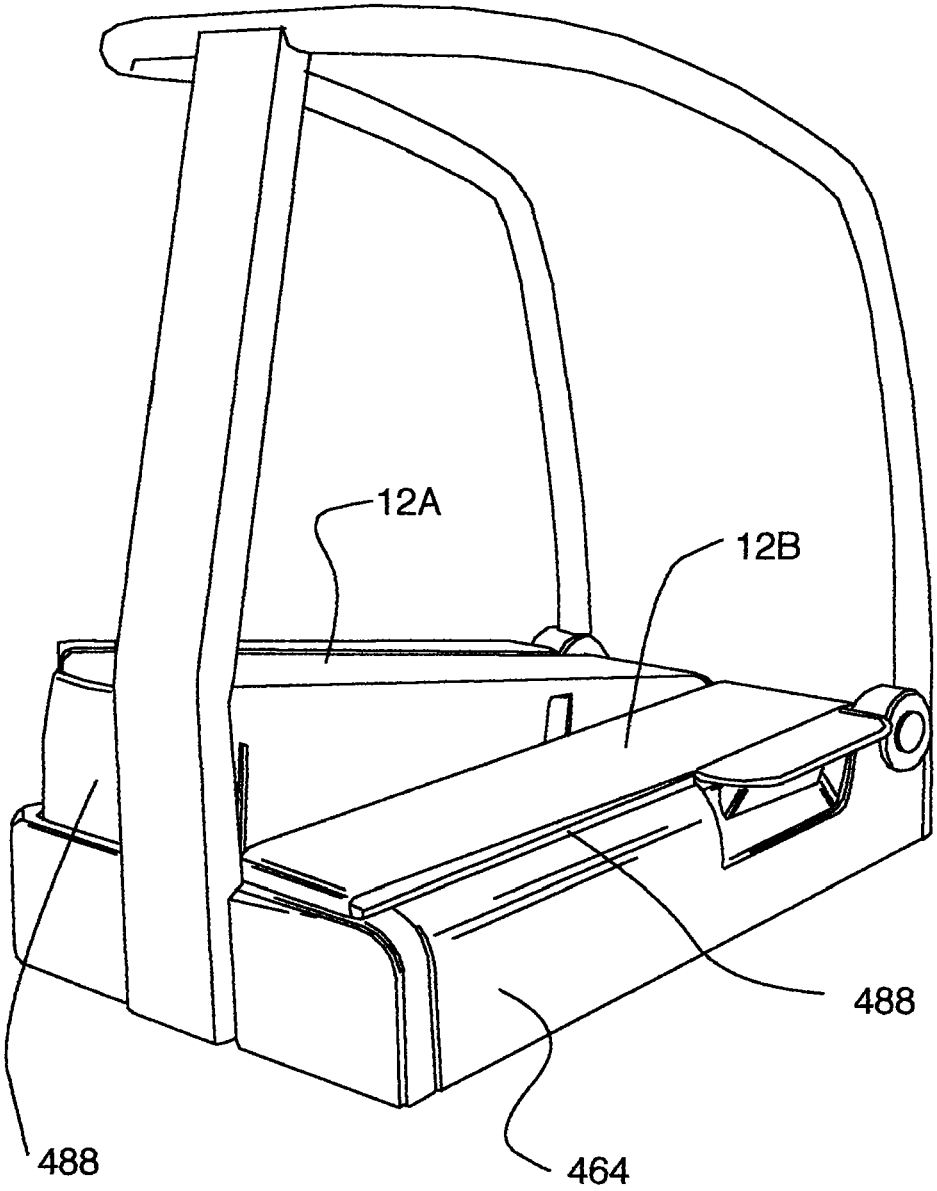
Figure 63S:
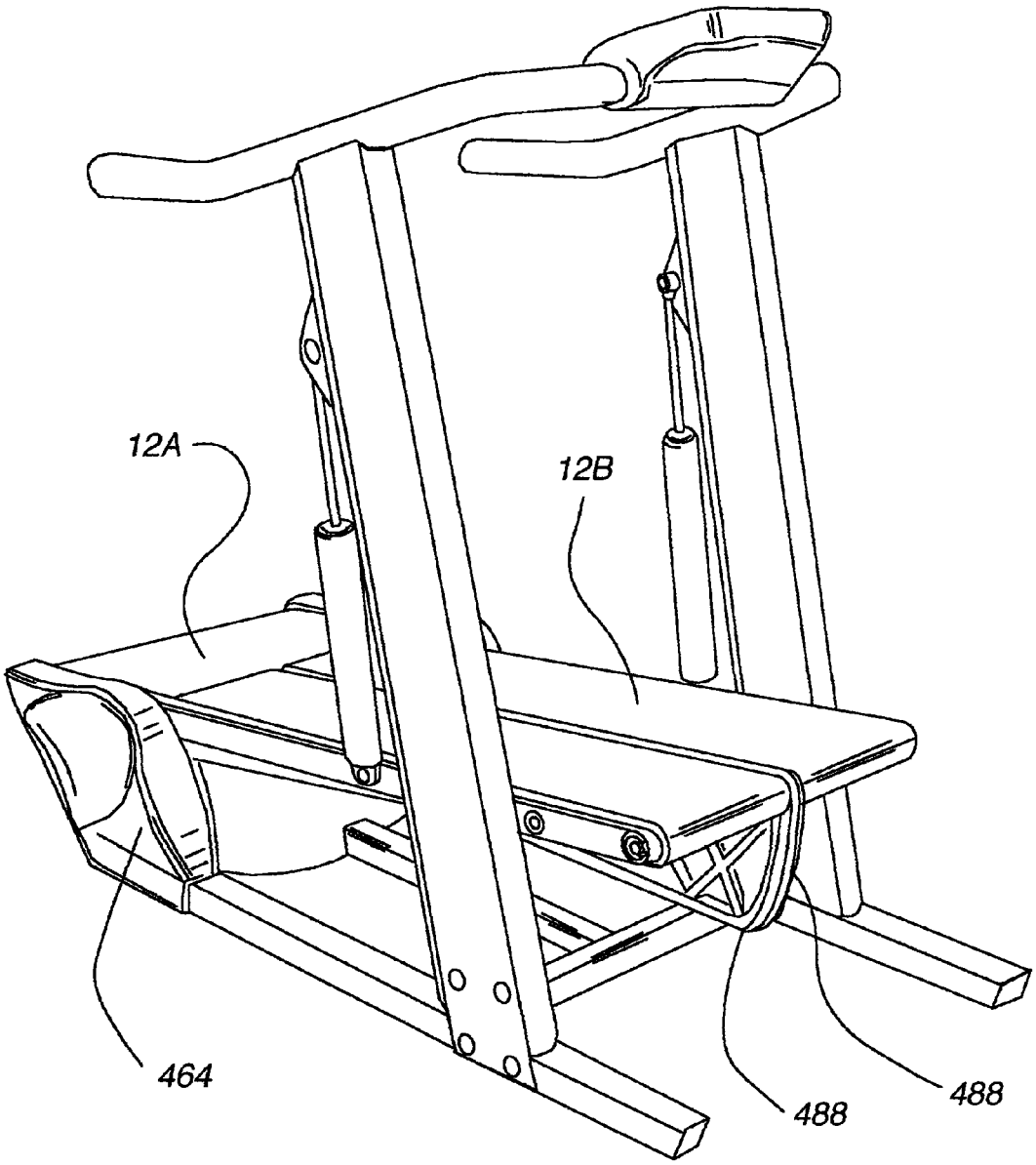
Figure 63T:
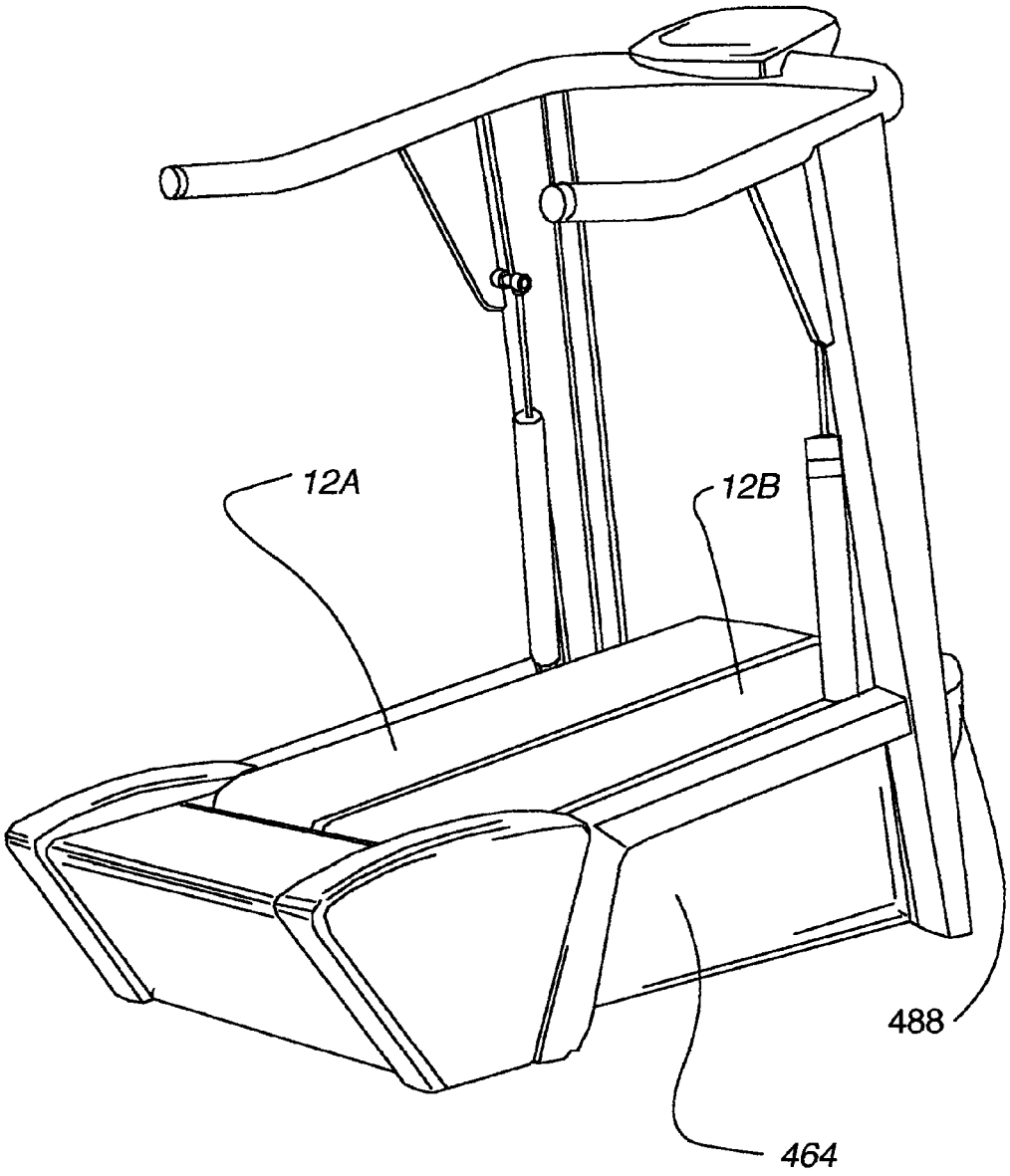
Figure 63U:
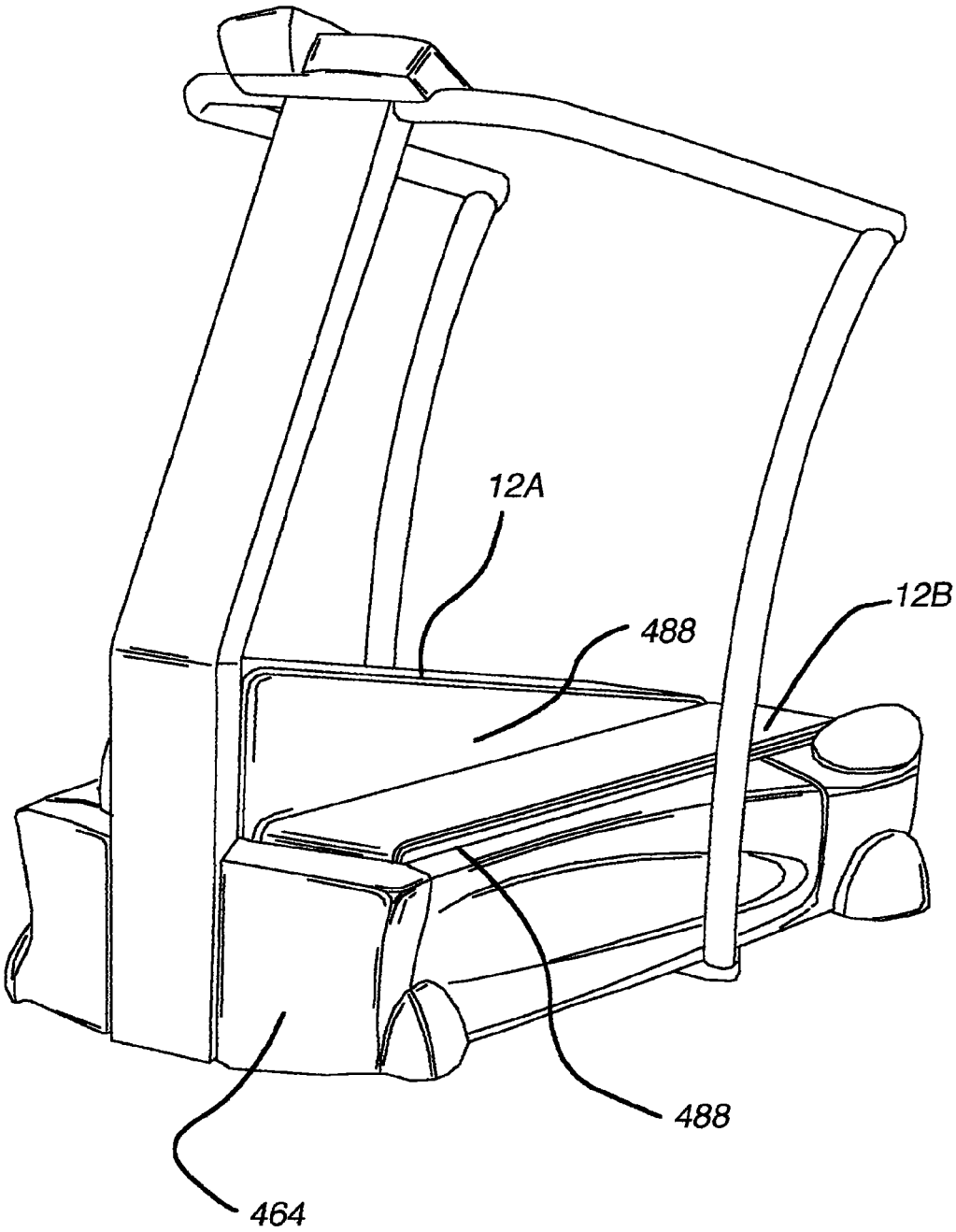
Figure 63V:
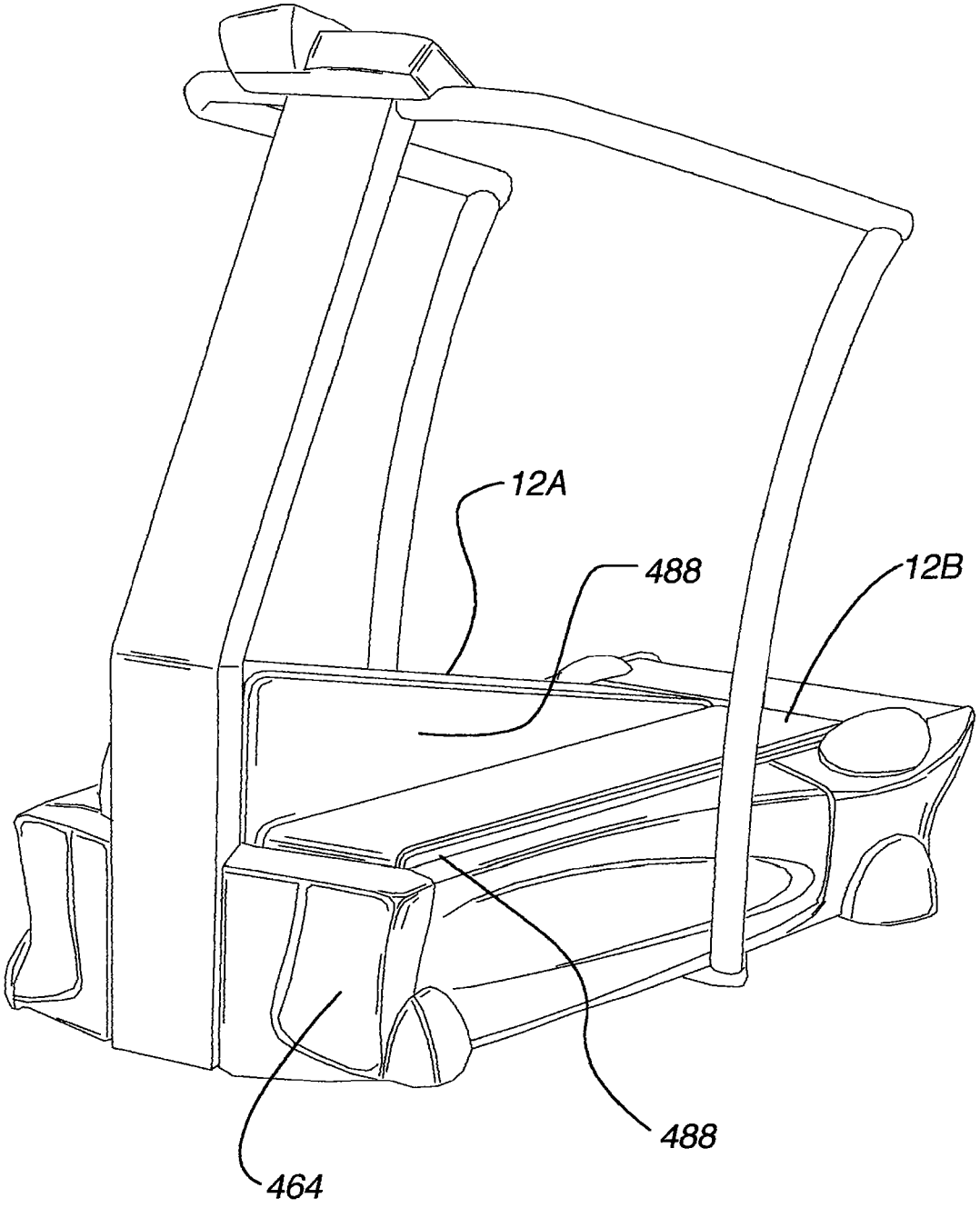
Figure 63W:
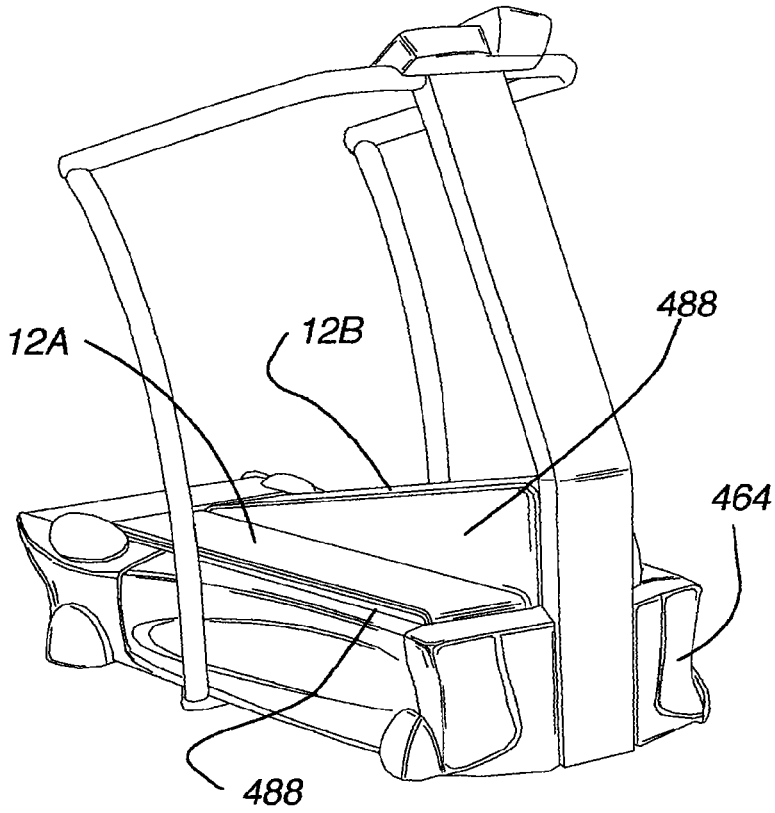
Figure 63X:
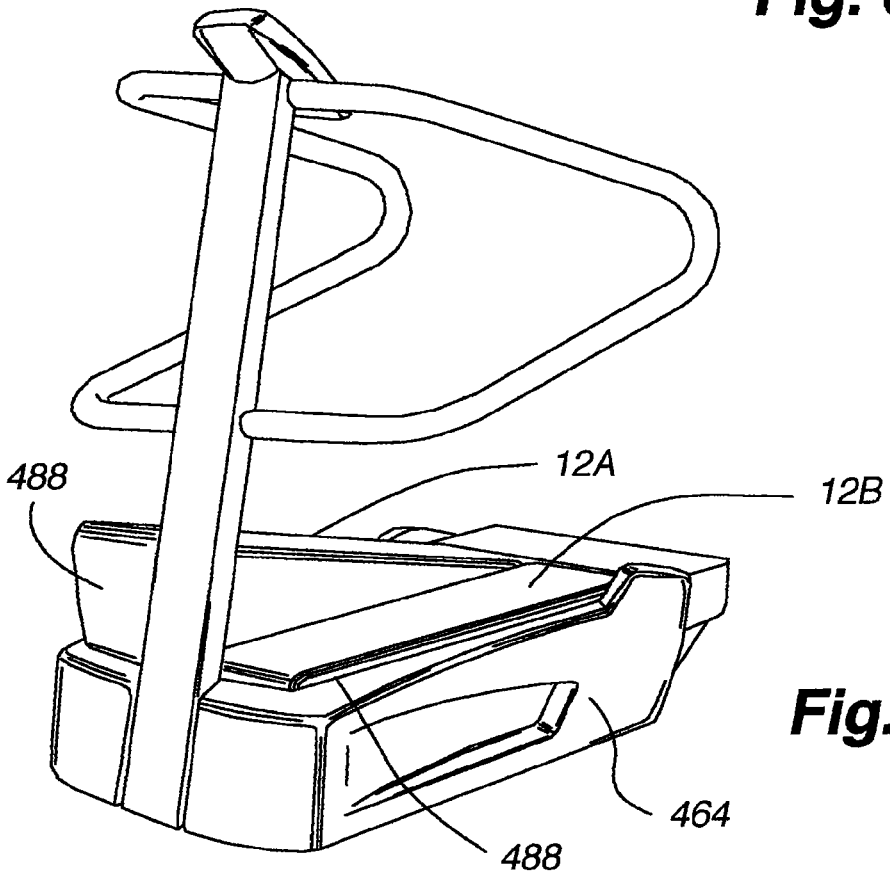

FIGS. 63A-63X: Dual Treadle/Treadmill Exercise Device with Various Shroud Arrangements As shown in FIG. 63A, the exercise apparatus is equipped with a base shroud 464 covering the base frame. The base shroud 464 includes a front portion 466, a right side portion 468, a left side portion 470, a rear portion 472, and a top portion 474. The top portion 474 of the base shroud 464 is defined by a front top surface 476, a left top surface 478, a right top surface 480, and a rear top surface 482. Treadle apertures 484 located in the top portion 474 are separated by a top surface center strip 486 connected with the front top surface 476 and the rear top surface 482. As shown in FIG. 63A, the right upright 42 and left upright 40 are connected to the base frame in conjunction with the right side portion 468 and the left side portion 470 of the base shroud.

The base shroud 464 can be made from molded plastic, fiberglass, aluminum, or any other suitable material, and can be rigid, flexible or any combination. The base shroud can also be manufactured in separate pieces to be assembled using screws, snaps, fasteners, and the like. Considerations as to how the exercise apparatus is to be assembled or disassembled and shipped may be taken into account in determining the manner in which the base shroud may be manufactured. In some embodiments, the base shroud can be manufactured as an integral piece.

As depicted in FIG. 63A, the right treadle assembly 12A, shown in the upward position, and the left treadle assembly 12B, shown in the downward position, are each equipped with a treadle shroud assembly 488 that moves with the treadle assemblies 12 when the exercise device is in use. The treadle shroud assemblies 488 can be made from plastic, fiber glass, aluminum, or any other suitable material, and can be secured to the treadle assemblies using various techniques such as screws, snaps, fasteners, and the like. The treadle shroud assemblies can also be secured to the treadle assemblies using adhesives or hook and loop fasteners. The treadle shroud assembly 488 includes an outside side shield 490, an inside side shield 492, and a front side shield 494. The outside side shield 490 and the inside side shield 492 are connected to the treadle assemblies 12 adjacent the treadle side tubes and spanning the length of the treadle assemblies. The front side shield 494 is connected with the outside side shield 490 and the inside side shield 492 and spans the length of the front roller on the treadle assembly. An inside shield edge 496 is defined by the intersection of the inside side shield 492 and the front side shield 494, and an outside shield edge 498 is defined by the intersection of the outside side shield 490 and the front side shield 494. The inside side shield 492 can be generally triangular in shape and defined by a top shield edge 500, a bottom side shield edge (HIDDEN), and the inside edge 496. The outside side shield edge 498 can also be generally triangular in shape and defined by the top side shield edge 500, the bottom side shield edge (HIDDEN), and the outside edge 498.

As shown in FIG. 63A, the treadle shroud assembly 488 is sized such that when the right treadle assembly 12A is located in the upward position, the area between the right treadle assembly 12A and top portion 474 of the base shroud 464 is covered by the front side shield 494 and the outside side shield 490. In this position, the area between the right treadle assembly 12A and the left treadle assembly 12B is covered by the inside side shield 492 of the right treadle 12A. Opposite of what is shown in FIG. 63A, when the left treadle assembly 12B is located in the upward position, the area between the left treadle assembly 12B and top portion 474 of the base shroud 464 is covered by the front side shield 494 and the outside side shield 490. In this position, the area between the left treadle assembly 12B and the right treadle assembly 12A is covered by the inside side shield 492 of the left treadle 12B.

As the right 12A or left treadle assembly 12B pivots toward the downward position, the treadle shroud assembly 488 passes through the treadle aperture 484 located in the top portion 474 of the base shroud 464. In order to close the gap between the base shroud 464 and the treadle shroud assemblies 12, the inside side shields 492 are positioned close to and adjacent the center strip 486 in the top portion 474 of the base shroud 464, as shown in FIG. 63A. Similarly, the outside side shields 490 are positioned close to and adjacent the left top surface 478 and the right top surface 480. The front side shields 494 are also positioned close to and adjacent the front top surface 476. Because the treadle assemblies 12 pivot up and down in an arcuate path, the inside shield edge 496, the outside shield edge 498, and the front side shield 494 can be arcuately shaped to keep the front side shield 494 close to the front top surface 476 of the base shroud 464 as the treadle assemblies 12 pivot up and down.

The present invention utilizing treadle shroud assemblies 488 similar to that depicted in FIG. 63A can also be used with various different embodiments of the base shroud. For example, FIG. 63B depicts the exercise apparatus utilizing an alternative base shroud design 464 that has only one treadle aperture 484. The treadle assemblies 12 are shown in pivot positions at a point between the upward and downward positions to better illustrate the various components of the treadle shroud assemblies. As shown in FIG. 63B, the treadle assemblies 12 are not separated by a center strip in the top portion, so the treadle assemblies are located on the exercise apparatus such that the inside side shields 492 are adjacent to each other.

In another scenario of the present invention, the treadle assemblies 12 are configured on the exercise apparatus such that the front side shield can be eliminated, as shown in FIGS. 63C and 63D. The right and left treadle assemblies 12 are both depicted in the flush, mid point position, and the front portion 466 of the base shroud 464 is configured so that no gap exists between either treadle assembly and the front top surface 476 of the base shroud 464. As previously described with reference to FIG. 63A, when one treadle assembly is in the upward position and the other treadle assembly is in the downward position, the area between the bottom of one treadle assembly and the top of the other treadle assembly is covered by the inside side shield 496 of the treadle in the upper position. The outside side shields 490 shown in FIGS. 63C and 63D are also equipped with a plurality of shield tracks 502 that slidingly engage shield tracks (HIDDEN) on the inside of the left 470 and right portions 468 of the base shroud 464. Because the treadle assemblies 12 pivot up and down in an arcuate path, the shield tracks 502 can also be arcuate. The shield tracks 502 can add to the sturdiness of the exercise apparatus as a user exerts forces while running or walking on the treadle assemblies.

FIGS. 63E-63X show treadle shroud assemblies 488 in various other views and incorporated in alternative embodiments of the present invention.

Figure 64A:
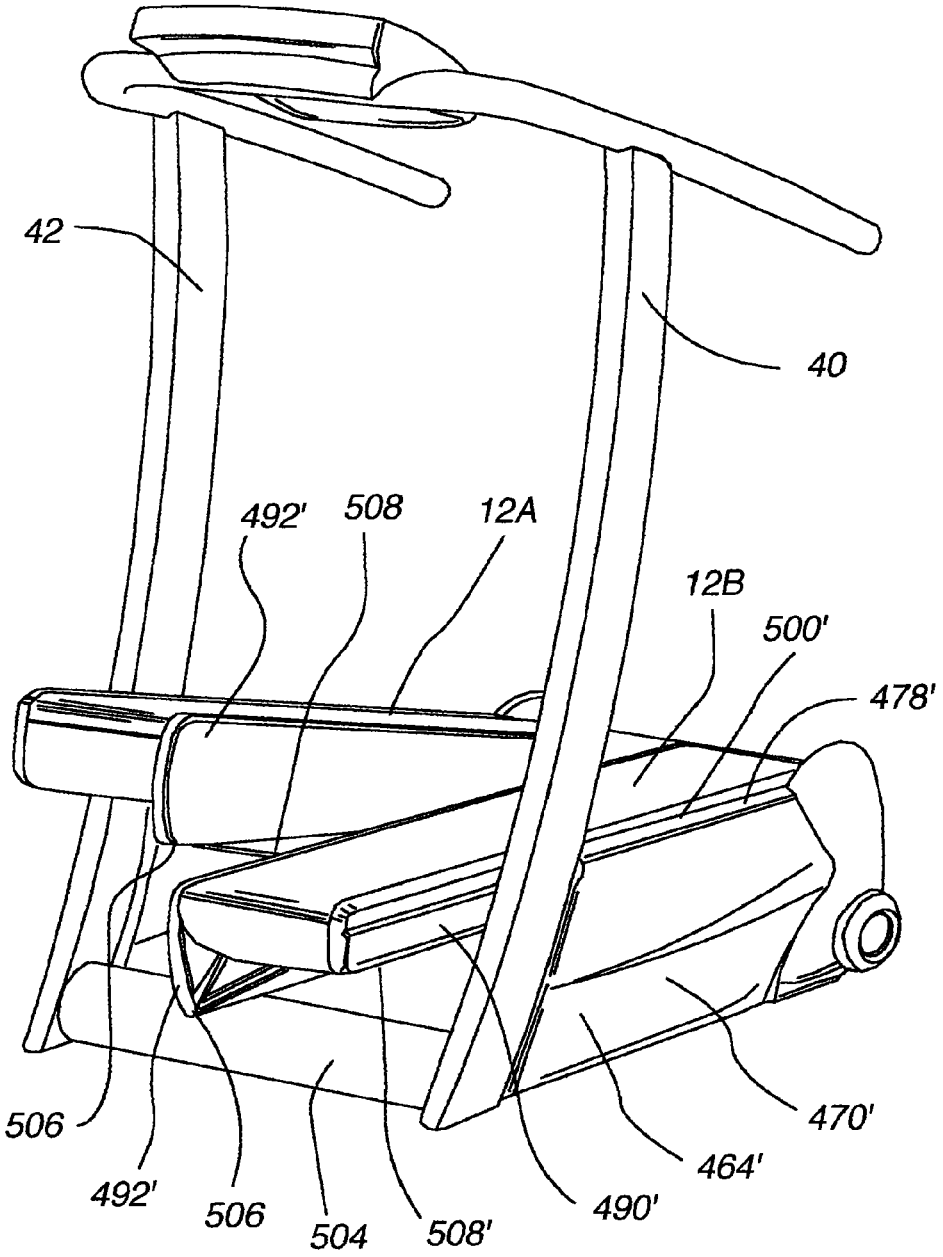
FIG. 64A is a front left-side perspective view of the exercise apparatus depicting treadle shroud assemblies with a flexible shield.
Figure 64B:
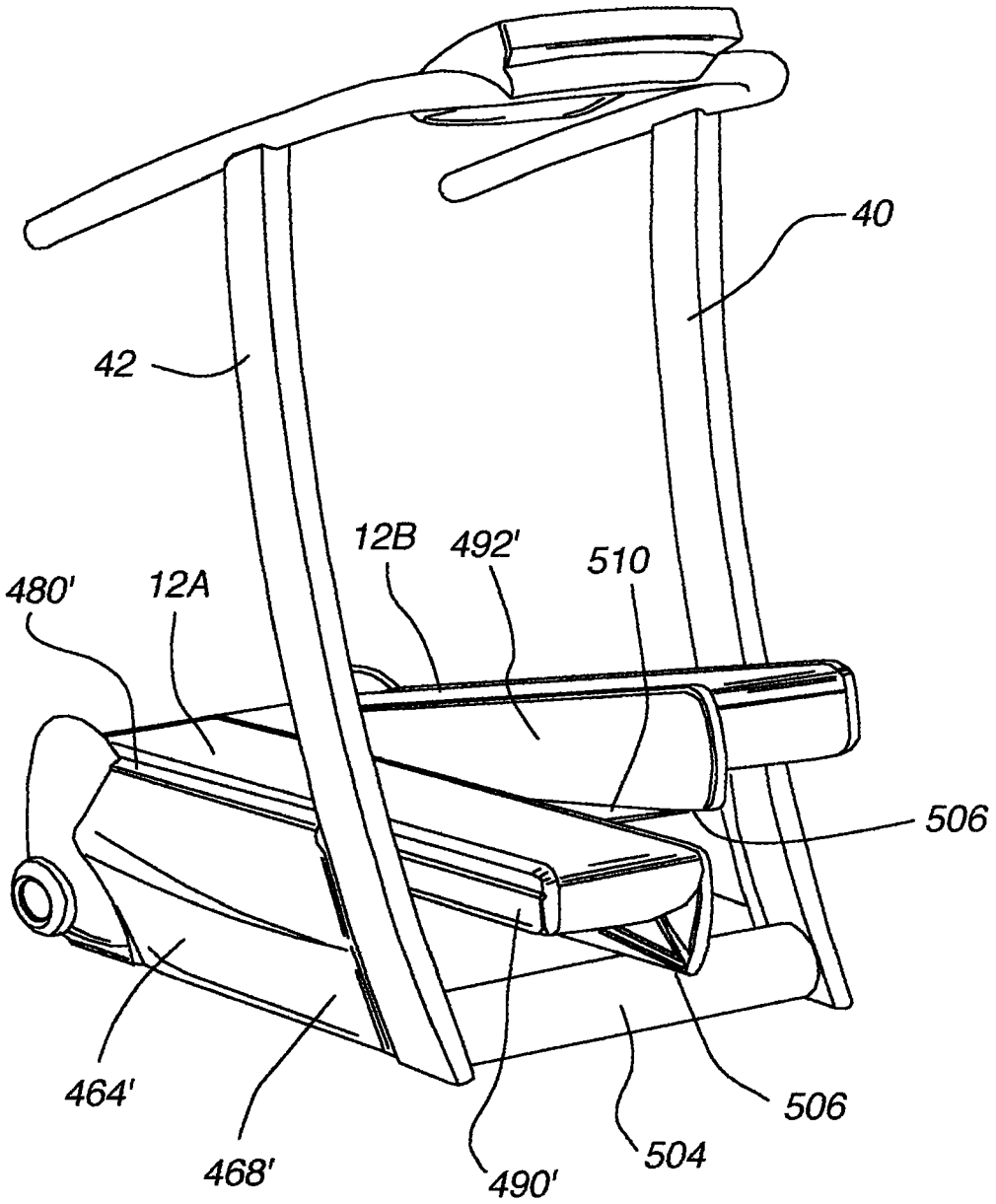
FIG. 64B is a front right-side perspective view of the exercise apparatus depicting treadle shroud assemblies with the flexible shield.
Figure 64C:
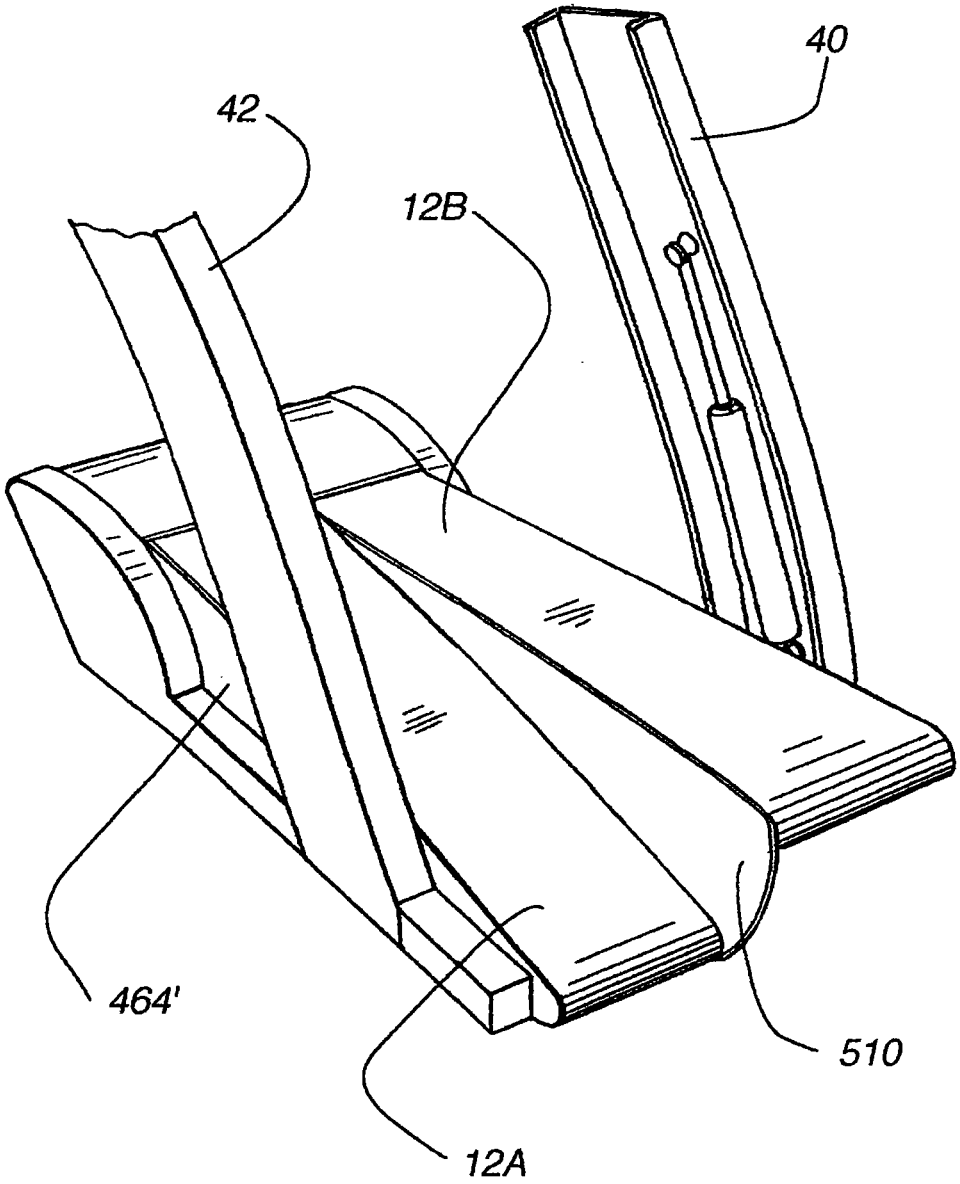
FIG. 64C is a cut-away view depicting treadle shroud assemblies with the flexible shield.

FIGS. 64A-64B: Dual Treadle with Flexible Shield

FIGS. 64A and 64B depict an alternative embodiment of the treadle shroud assembly 488. Unlike the base shroud 464 depicted in FIG. 63A, the base shroud 464' shown in FIGS. 64A and 64B does not have right side and left portions forward of the right 42 and left uprights 40. Instead of having the front portion, the base shroud shown in FIGS. 64A and 64B includes a bottom middle portion 504 connected with the left 40 and right uprights 42. Because the base shroud 464' has no front portion and no front top surface, there is no exposed area between the treadle assemblies 12 and the front top surface of the base shroud 464" when the treadle assemblies pivot up and down. Therefore, there is no need to have front side shields included as part of the treadle shroud assemblies.

As shown in FIGS. 64A and 64B, the outside side shields 490' of the treadle shroud assemblies 488' are generally rectangular in shape. The outside side shields 490' are tall enough such that there is no gap between the bottom shield edge 506 of the outside side shield 490' and the left top surface 478' of the base shroud 464' when the treadle 12 is in the upward position. A flexible shield 510 is connected with the bottom shield edge 508 on each inside shield 492'. As shown in FIG. 64A, the right treadle assembly 12A is in the upward position and the left treadle assembly 12B is in the downward position. The area between the right treadle assembly 12A and the left treadle assembly 12B is covered by the inside side shield 492' and the flexible shield 510. FIG. 64B shows the opposite positioning of the treadle assemblies in FIG. 64A. In FIG. 64B, the left treadle assembly is located in the upward position and the right treadle assembly 12A is located in the downward position. Again, the area between the left treadle assembly 12B and the right treadle assembly 12A is covered by the inside side shield 492' and the flexible shield 510. As shown in FIG. 64A, the shields or shrouds do not have to cover the entire open gap or space.

It should be understood that the treadle shroud assemblies 488' shown in FIGS. 64A and 64B can work with other base shroud configurations. In another example, if the base shroud includes the front portion and the front top surface as described with reference to FIG. 63A, the treadle shroud assemblies as described in FIGS. 64A and 64B can include front shields. In another scenario where the base shroud includes the center strip and two treadle apertures as previously described with reference to FIG. 63A, the flexible shields could be connected with the center strip and the treadle assemblies. Flexible shields could also connect with the treadle assemblies and the right and left top surfaces of the base shroud.

FIG. 65

Figure 65:
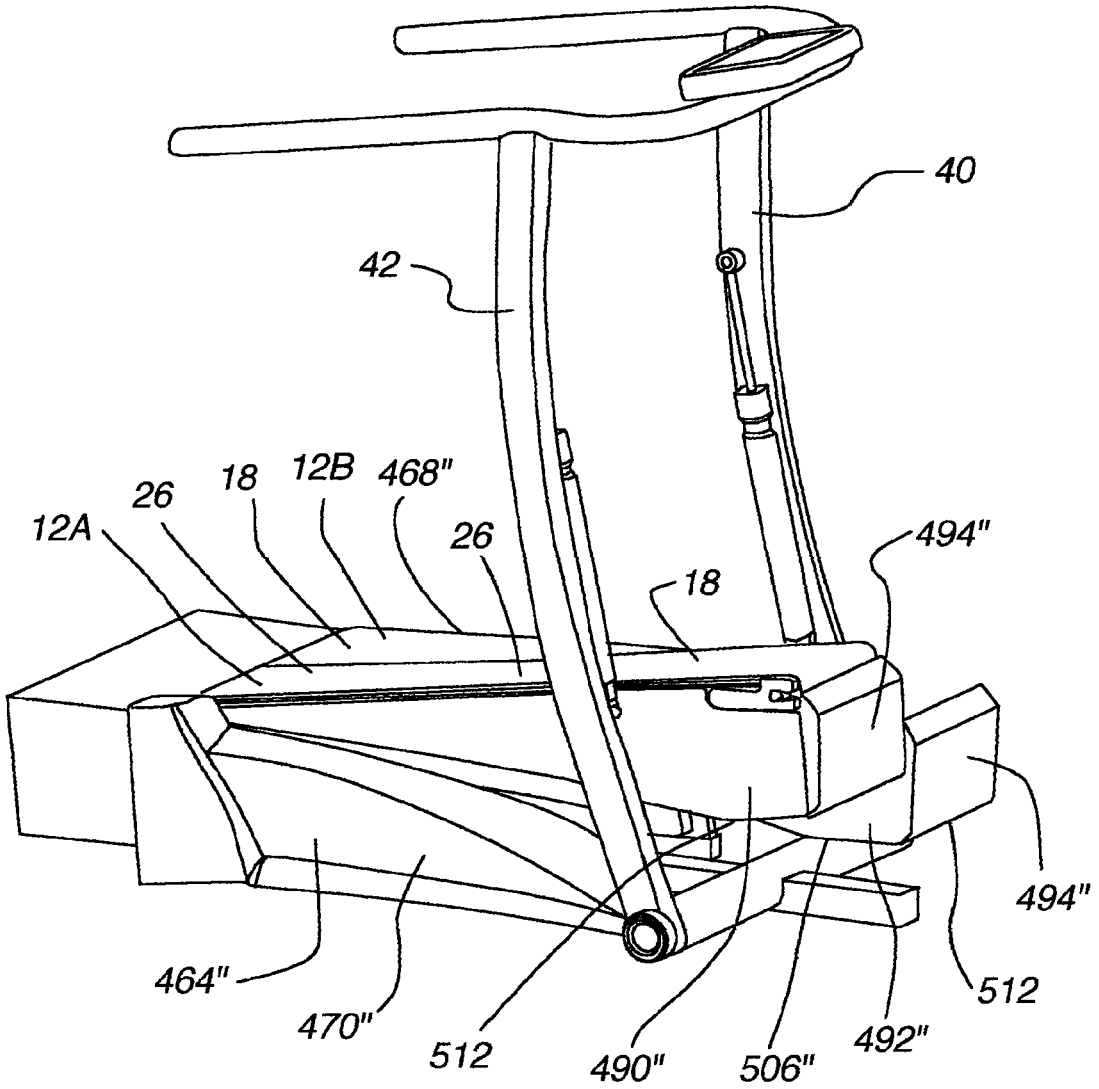
FIG. 65 is a front right-side perspective view of the exercise apparatus with the base shroud having no front portion and depicting treadle shroud assemblies.

An alternative embodiment of the present invention is depicted in FIG. 66. The left side 470" and right side portions 468" of the base shroud 464" do not extend forward of the right 42 and left uprights 40. Therefore, unlike the treadle assemblies depicted in FIG. 63A, the treadle assemblies 12 are not enclosed in the front the portion of the base shroud. As shown in FIG. 65, the treadle assemblies 12 are located on the exercise apparatus such that the inside side shields 492" are adjacent to each other. The inside side shields 492" are also sized so that there is no gap between the bottom shield edge 506" of one treadle assembly and the treadle deck 26 of the other treadle assembly when one treadle assembly is in the upward position and the other treadle assembly is in the downward position. The outside side shield 490" (having a generally rectangular shape), the front side shield 494", and a bottom side shield 512 partially enclose the belt 18 on the treadle assembly 12 as it passes under the treadle deck 26. The front side shield 494" can also be removable to allow access to the treadle belt 18. The inside shield 492" can also have a generally triangular shape.

Figure 66A:
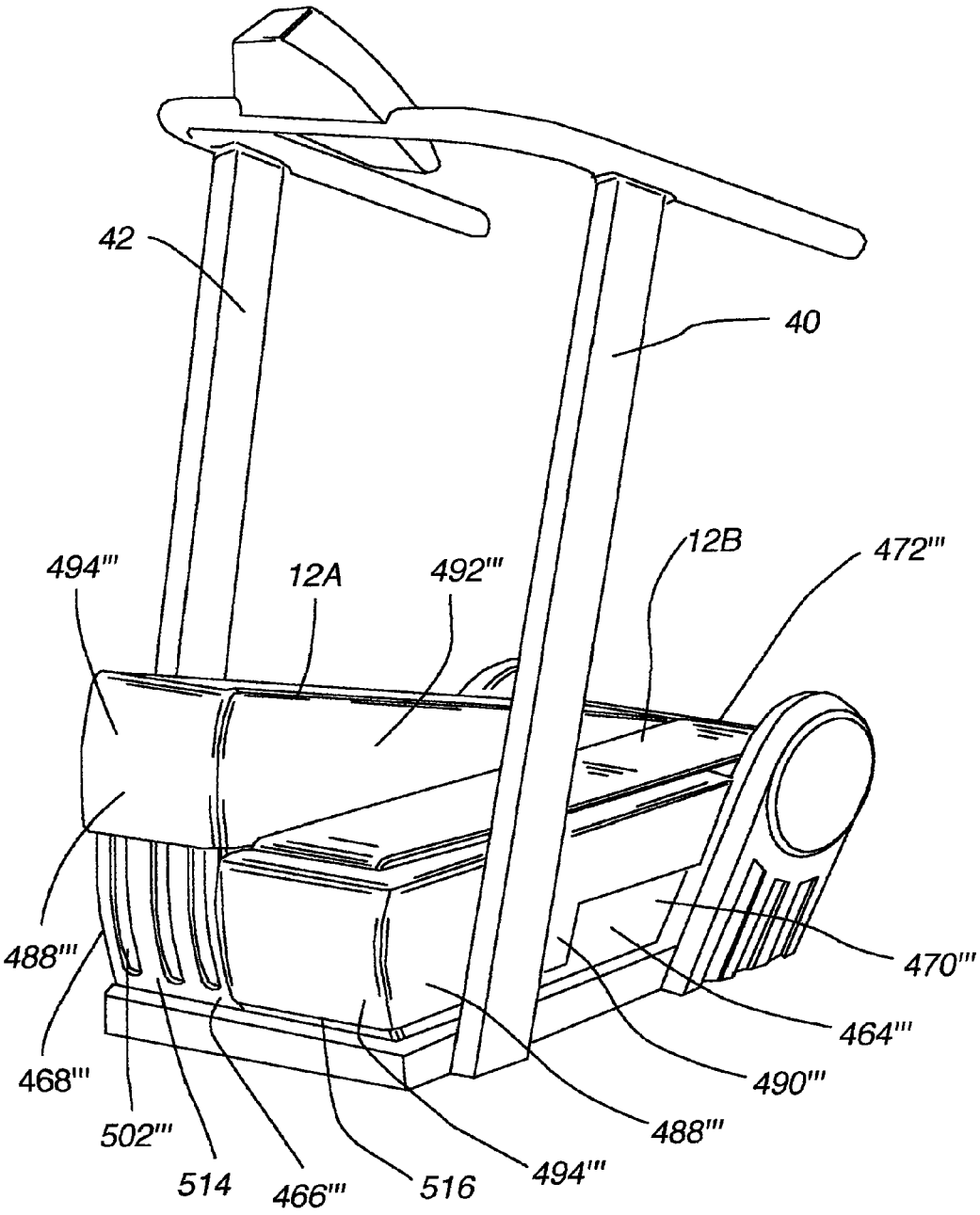
FIG. 66A is a front left-side perspective view of the exercise apparatus depicting treadle shroud assemblies partially enclosing the base shroud.
Figure 66B:
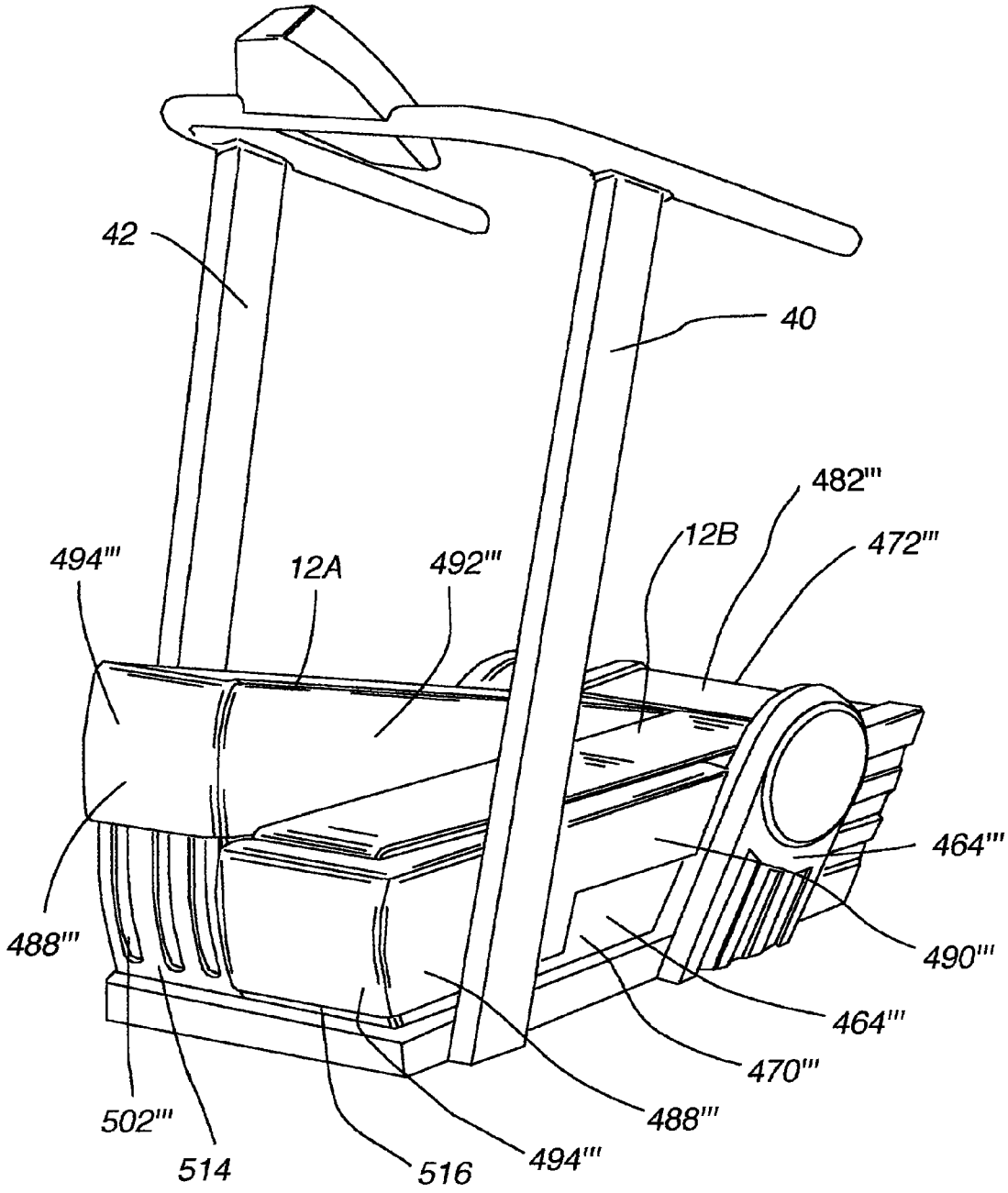
FIG. 66B is a front left-side perspective view of the exercise apparatus depicting treadle shroud assemblies partially enclosing an alternative embodiment of the base shroud.
Figure 66C:
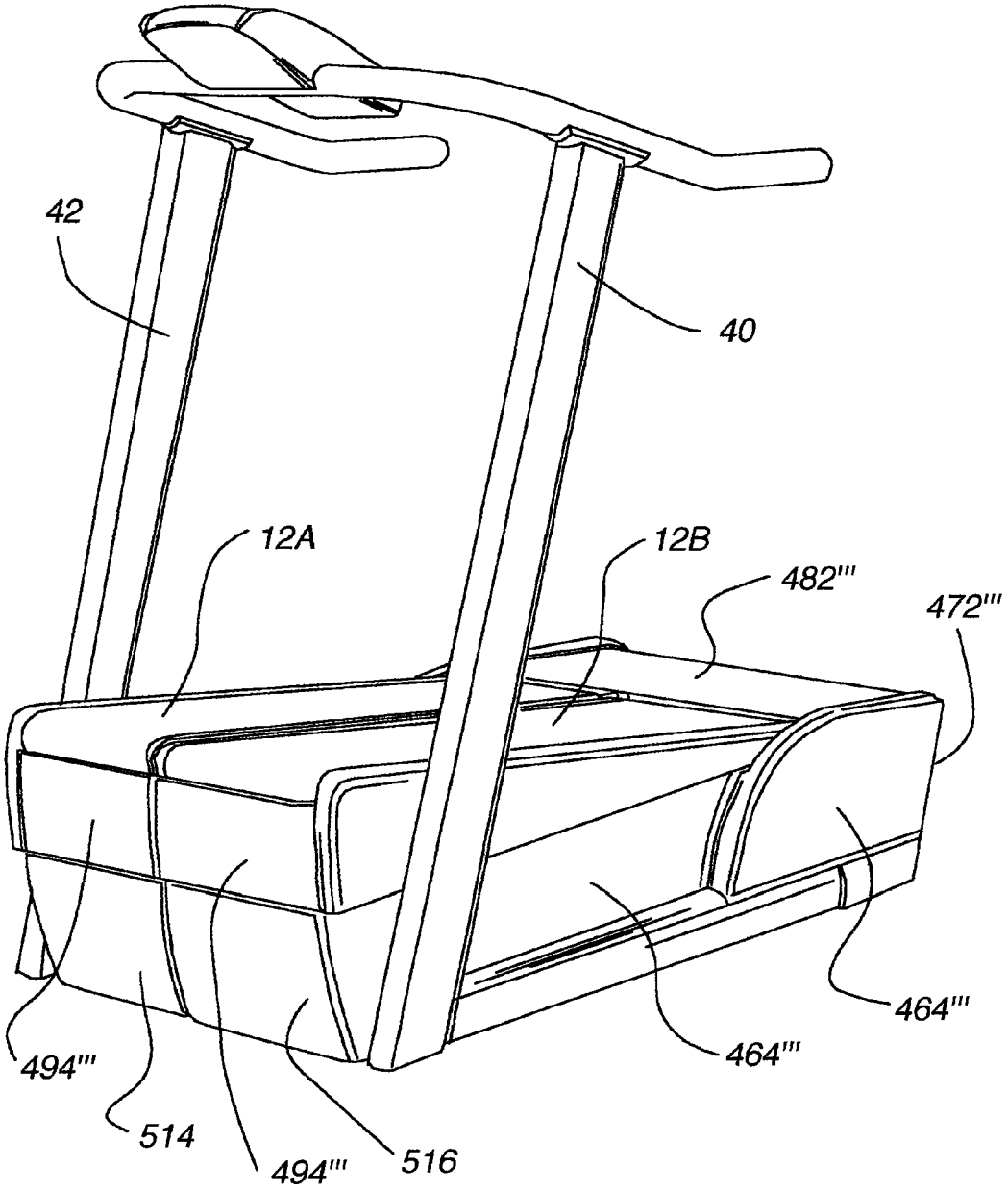
FIG. 66C is a front left-side perspective view of the exercise apparatus depicting treadle shroud assemblies partially enclosing an alternative embodiment of the base shroud.

FIGS. 66A-66C: Alternative Shrouding Arrangements

In FIG. 66A, an alternative embodiment of the base shroud 464" is shown having the front portion 466" split into two sections, a right front portion 514 and a left front portion 516.

As shown in FIG. 66A, the left front portion 516 and the left portion 470" are partially enclosed by the treadle shroud assembly 488" when the left treadle assembly 12B is in the downward position. Similarly, the right front portion 514 and the right portion 468" are partially enclosed by the right treadle shroud assembly 488" when the right treadle assembly 12A is in the downward position. As shown in FIG. 66A, when the right treadle assembly 12A is located in the upward position, most of the right front portion 514 and the right portion 468" are exposed. However, there is no gap between the treadle shroud assembly 488" and the base shroud 464" in this position. Similarly, when the left treadle assembly 12B is located in the upward position, most of the left front portion 516 and the left portion 470" are exposed.

As shown in FIG. 66A, the right front portion 514 and the left front portion 516 can also be configured with shield tracks 502". The shield tracks 502" slidingly engage opposing shield tracks (not shown) on the inside of the front side shield 514, which help reduce any side to side movement of the treadle assemblies 12 when the exercise apparatus is in use. The treadle shroud assembly configuration shown in FIG. 66A can also be used with alternative configurations of the base shroud 464". For example, FIG. 66B depicts an embodiment similar to that shown in FIG. 66A, except the base shroud 464" in FIG. 66 includes the rear top surface 482". In another scenario depicted in FIG. 66C, an alternative embodiment similar to that shown in FIG. 66B does not include shield tracks 502".

Figure 67A:
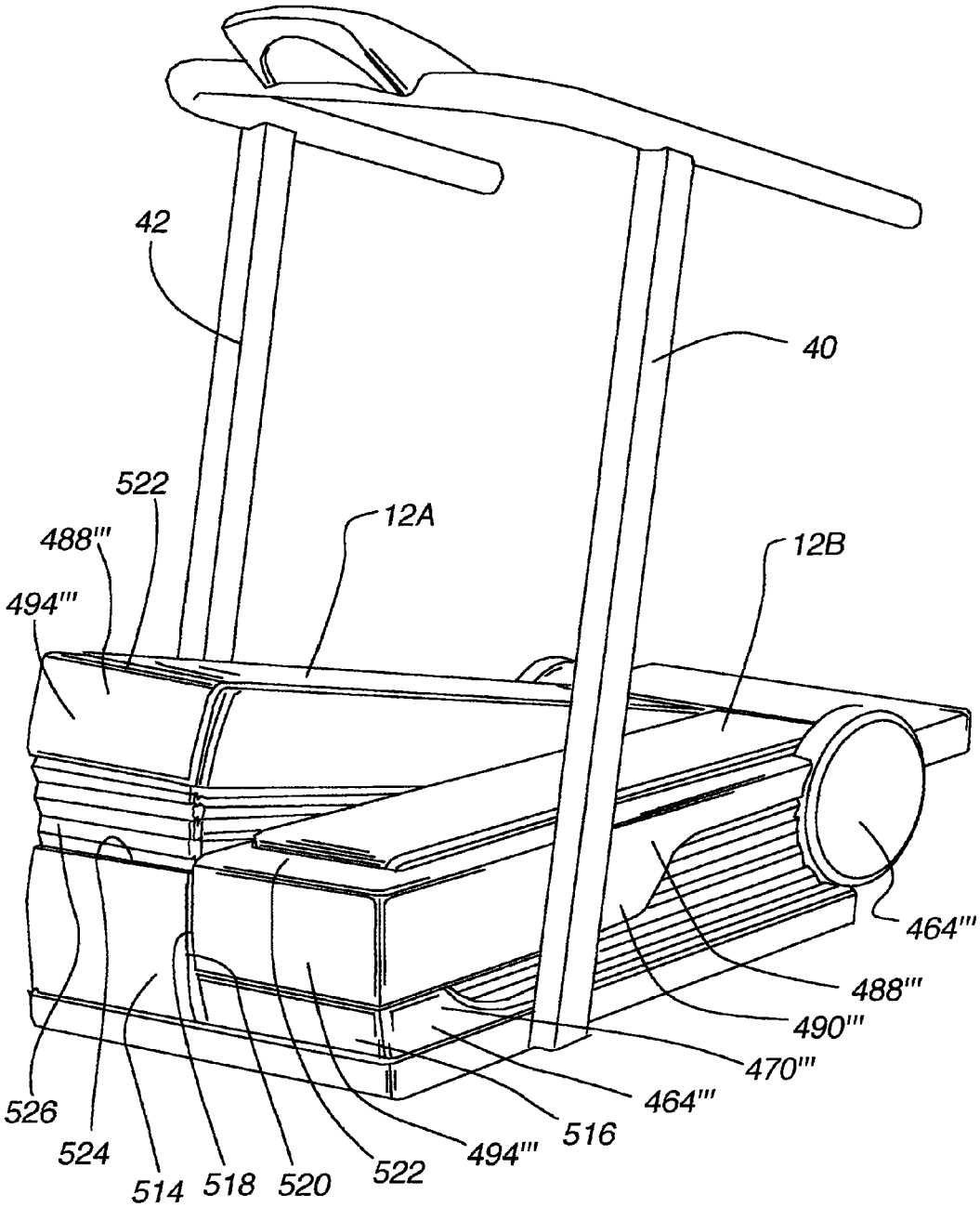
FIG. 67A is a front left-side perspective view of the exercise apparatus depicting treadle shroud assemblies with accordion-pleated shields.
Figure 67B:
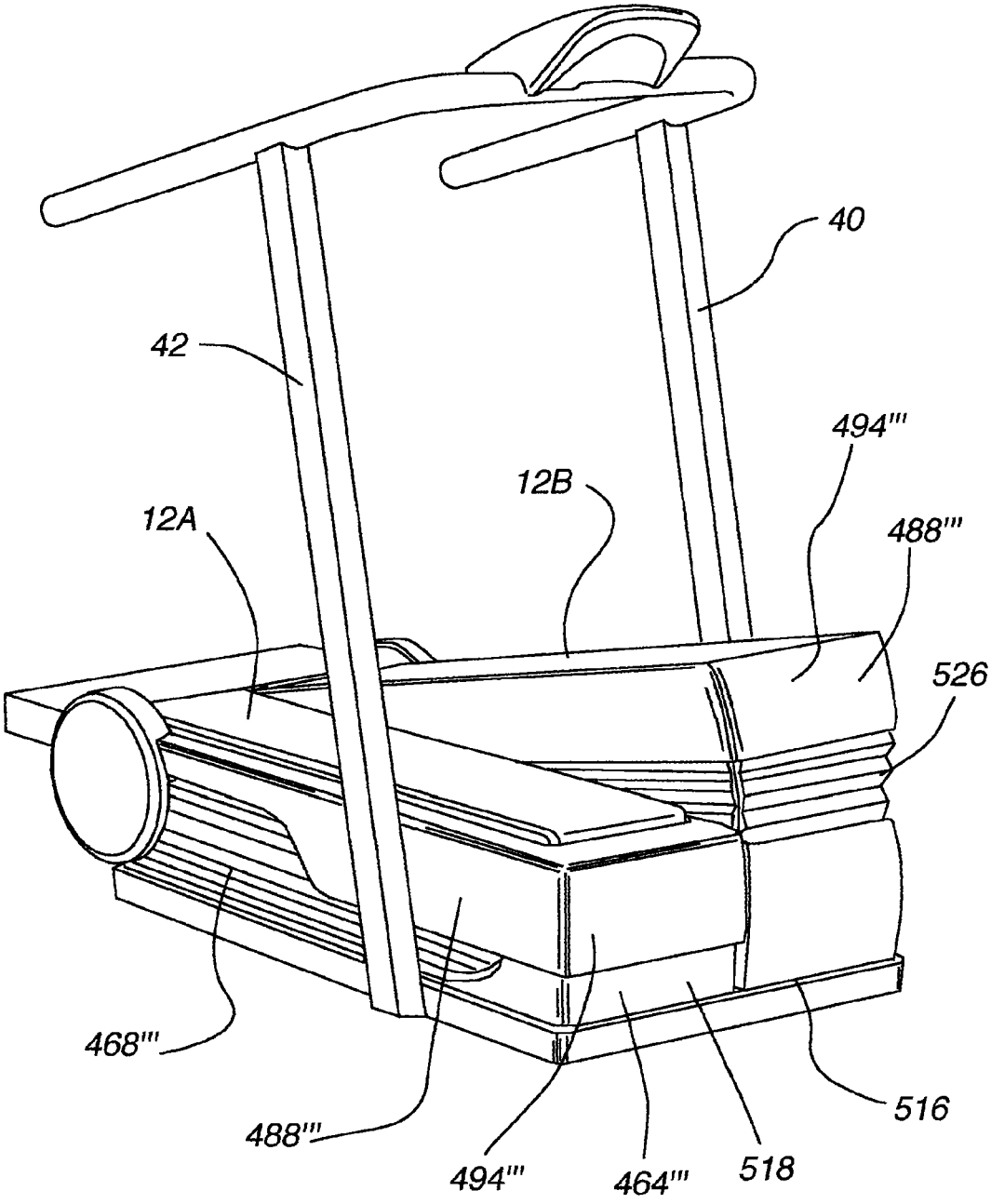
FIG. 67B is a front right-side perspective view of the exercise apparatus depicting treadle shroud assemblies with accordion-pleated shields.
Figure 67C:
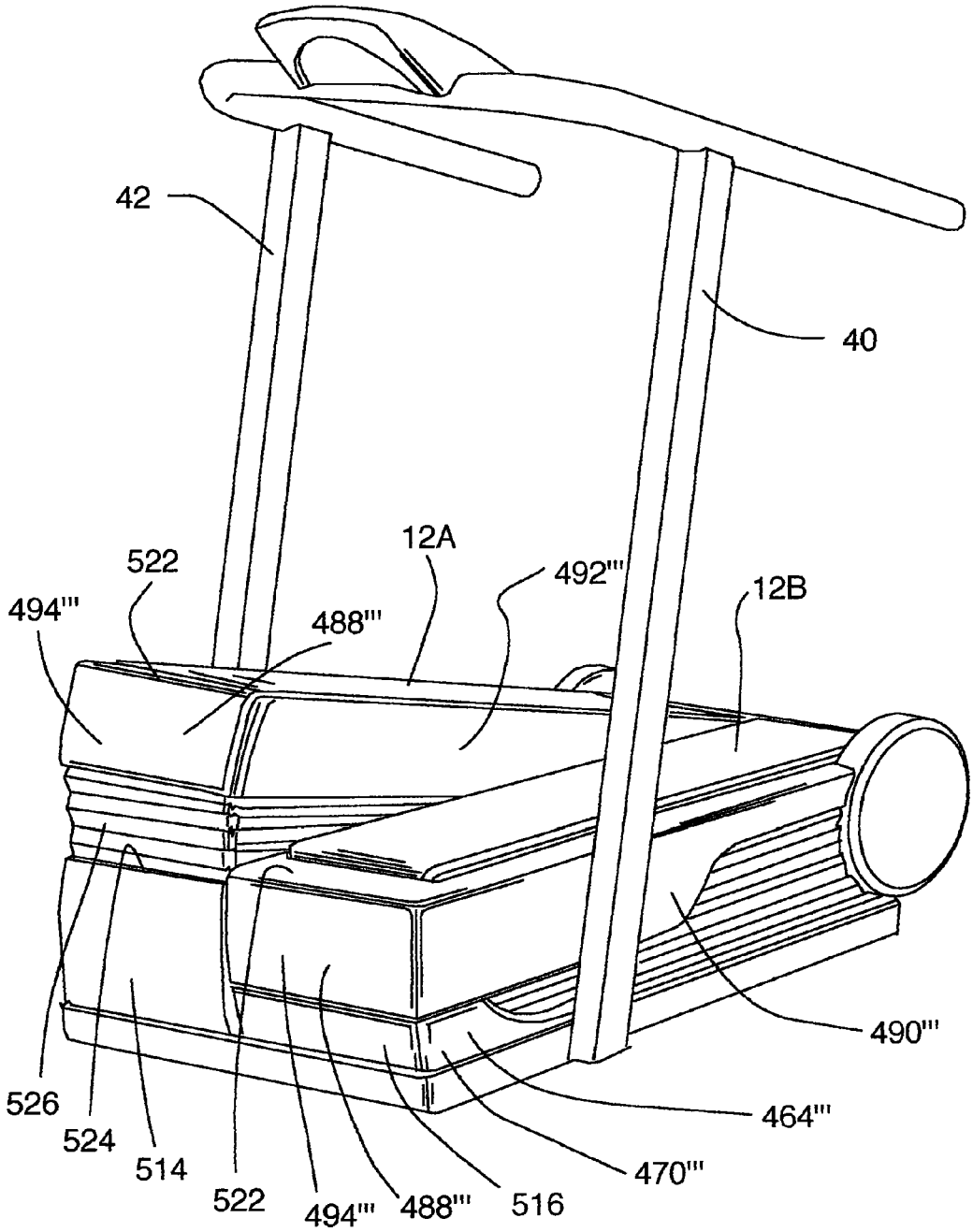
FIG. 67C is a front left-side perspective view of the exercise apparatus depicting treadle shroud assemblies with accordion-pleated shields incorporated on an alternative embodiment of the present invention.

FIGS. 67A-67C: Alternative Shroud Arrangements

A further representation of the present invention is depicted in FIGS. 67A and 67B. The base shroud 464" shown in FIGS. 67A and 67B further includes a right center portion 518 and a left center portion 520 connected with the right front portion 514 and the left front portion 516, respectively. The right 518 and left center portions 520 can also be substantially mirror images of the right 418" and left portions 470". As shown in FIGS. 67A and 67B, accordion-pleated shields 526 are connected with the treadle shroud assemblies 488" and the base shroud 464". More particularly, a first accordion-pleated shield 526A is connected with the base shroud 464" at a base shroud top edge 524 located on top of the right side portion 468", the right front portion 574, and the right center portion 518. The first accordion-pleated shield 526A is also connected with the treadle shroud assembly 588" underneath a top side shield 522 connected with the right treadle assembly 12A. Similarly, a second accordion-pleated shield 526B is connected with the base shroud 464" at the base shroud top edge 524 located on top of the left side portion 470", the left front portion 516, and the left center portion 520. The second accordion-pleated shield 526B is also connected with the treadle shroud assembly 488" underneath the top side shield 522 connected with the left treadle assembly 12B.

The left treadle assembly 12B is depicted in the downward position and the right treadle assembly 12A is depicted in the upward position in FIG. 67A. The treadle shroud assembly 488" connected with the left treadle assembly 12B at least partially encloses the left portion 470", the left front portion 516, and the left center portion 520 of the base shroud 464". Likewise, the treadle shroud assembly 488" connected with the right treadle assembly 12A at least partially encloses the right portion 468, the right front portion 514, and the right center portion 518 of the base shroud 464". As shown in FIG. 67A, when the right treadle assembly 12A is in the upward position, the accordion-pleated shield 526 encloses the space between the treadle shroud assembly 488" and the base shroud 464". As the right treadle assembly moves to the downward position, the accordion-pleated shield 526 folds and collapses on the pleats to become enclosed under the treadle shroud assembly 488". As the left treadle assembly 12B moves to the upward position, the accordion-pleated shield 526 unfolds on the pleats and until it is exposed. As shown in FIG. 67B, the right treadle assembly 12A is depicted in the downward position and the left treadle assembly 12B is depicted in the upward position. As shown in FIGS. 67A and 67B, when the treadle assemblies 12 are in the upward positions, the inside 492" and outside side shields 490" maintain partial coverage of the base shroud 464". Therefore, in certain embodiments, the accordion-pleated shield need not be utilized on the entire length of the treadle shroud assemblies. FIG. 67C shows the shroud assemblies 488" with accordion-pleated shields 526 utilized with an alternative embodiment of the base shroud 464".

FIGS. 68A-69B: Accordion or Folding Shroud Arrangement

Figure 68A:
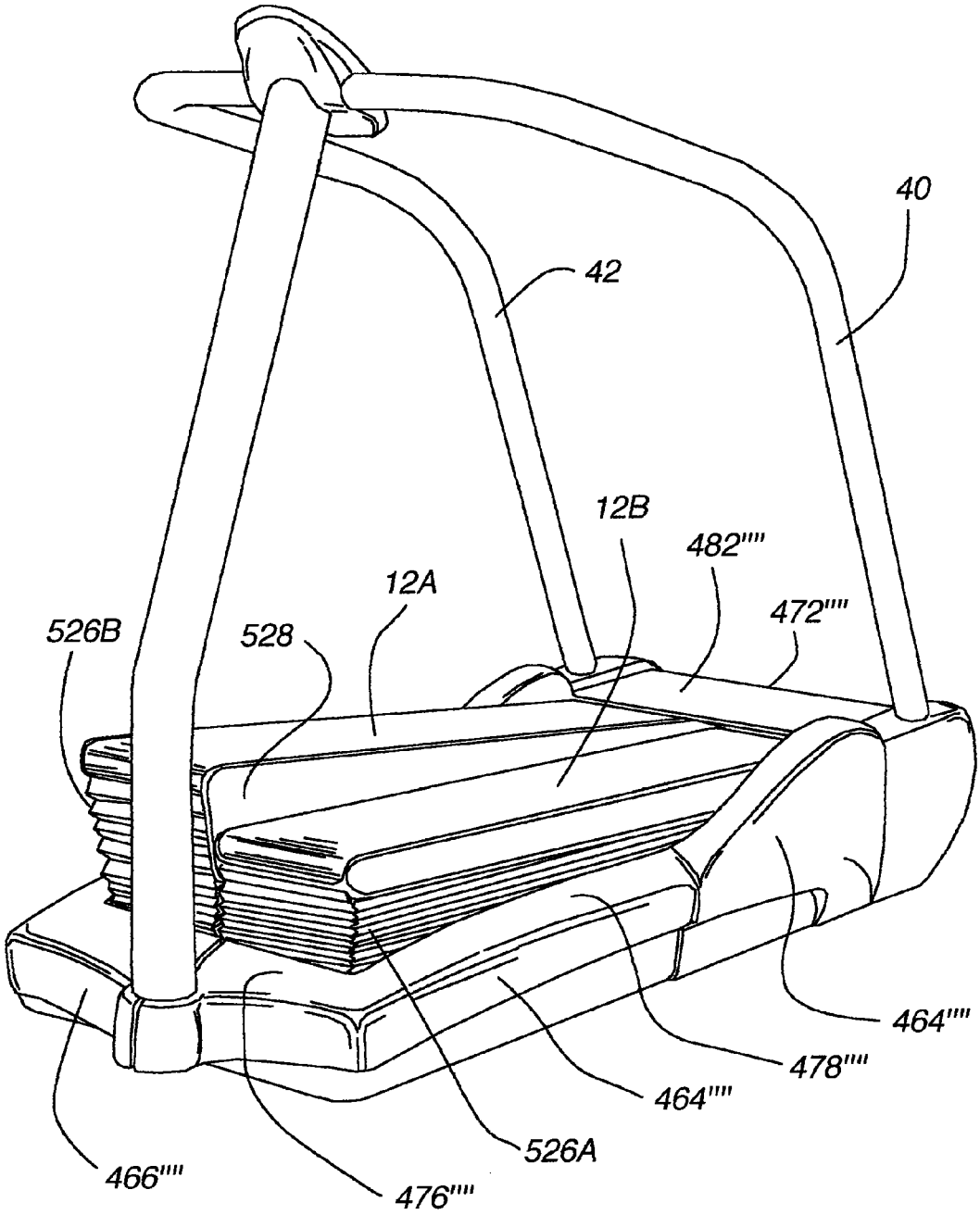
FIG. 68A is a front left-side perspective view of the exercise apparatus depicting accordion-pleated treadle shrouds.
Figure 68B:
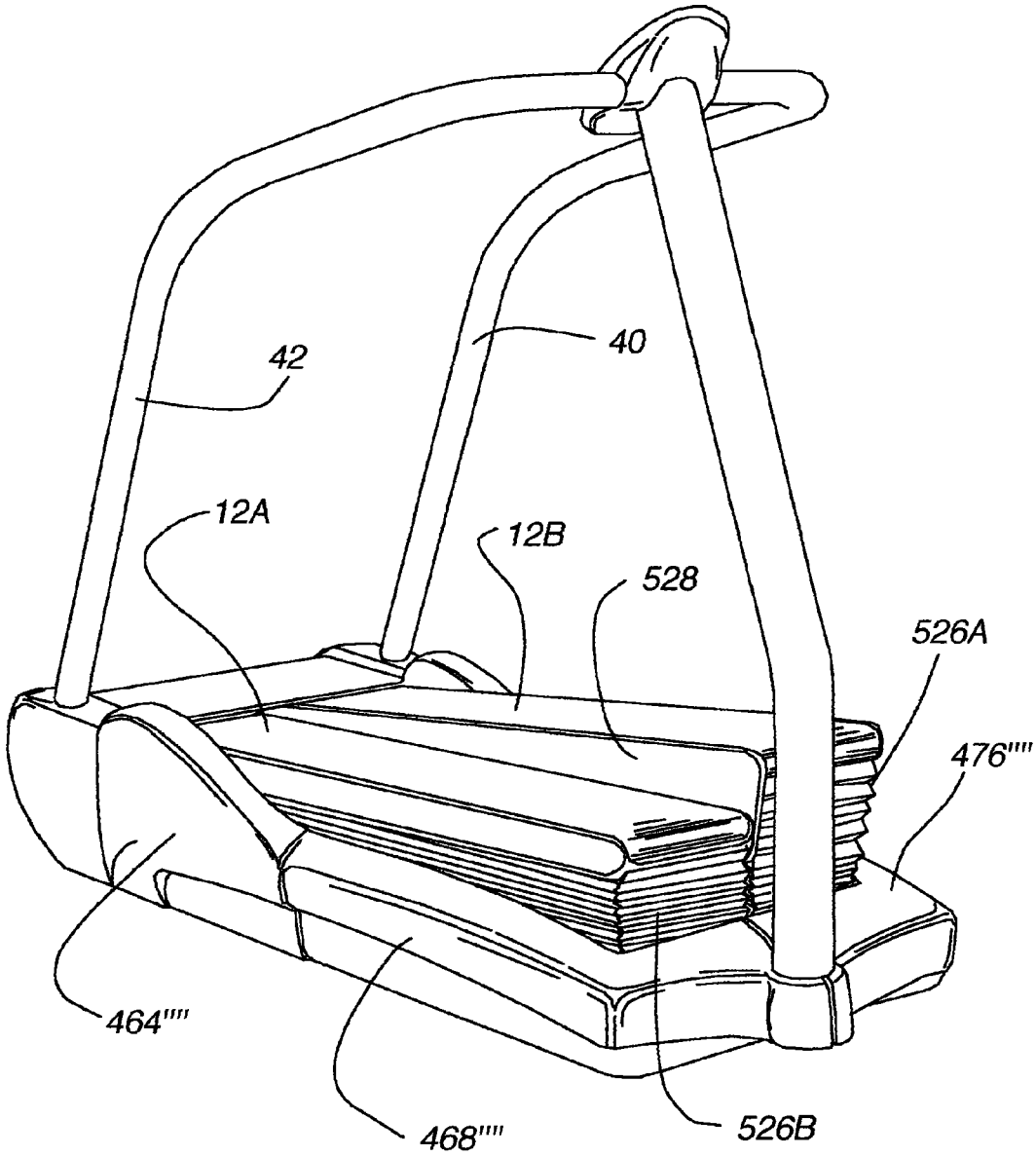
FIG. 68B is a front right-side perspective view of the exercise apparatus depicting accordion-pleated treadle shrouds.

FIGS. 68A and 68B show another scenario of the present invention where the area between the treadle assemblies 12 and base shroud 464" are covered with accordion-pleated shrouds 526. More particularly, a first accordion-pleated shroud 526A is connected with the left top surface 478" and the front top surface 476" of the base shroud 464". The first accordion-pleated shroud 526A is also connected underneath the left treadle assembly 12B. Similarly, a second accordion-pleated shroud 526B is connected with the right top surface 480" and the front top surface 476" of the base shroud 464". The second accordion-pleated shroud 526B is also connected underneath the right treadle assembly 12A. The right and left treadle assemblies 12 are separated by a center shield 528. The center shield 528 can be connected with the base shroud 464" near the rear top surface 480".

Figure 68C:
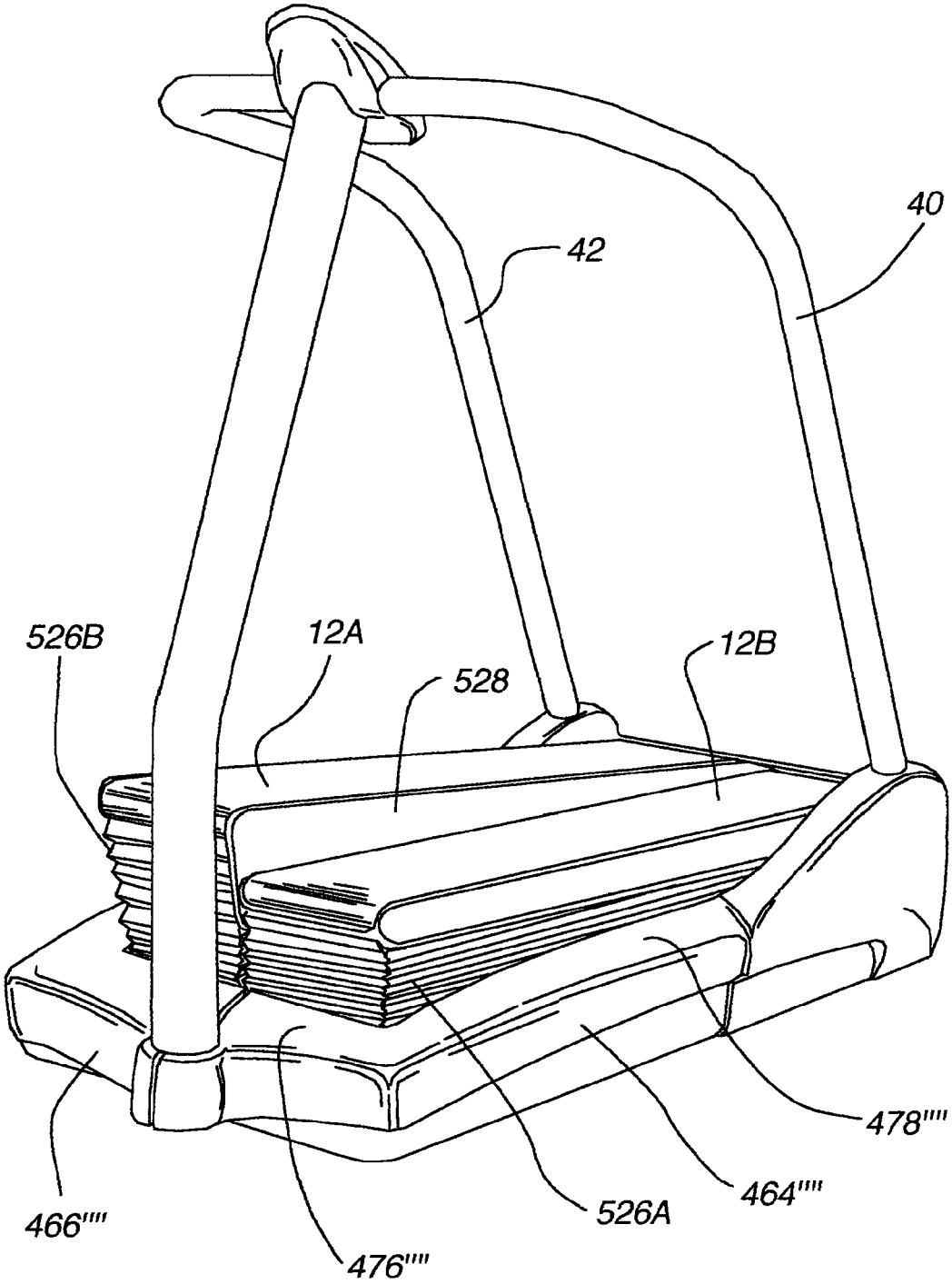
FIG. 68C is a front left-side perspective view of an alternative embodiment of the exercise apparatus depicting accordion-pleated treadle shrouds.
Figure 69A:
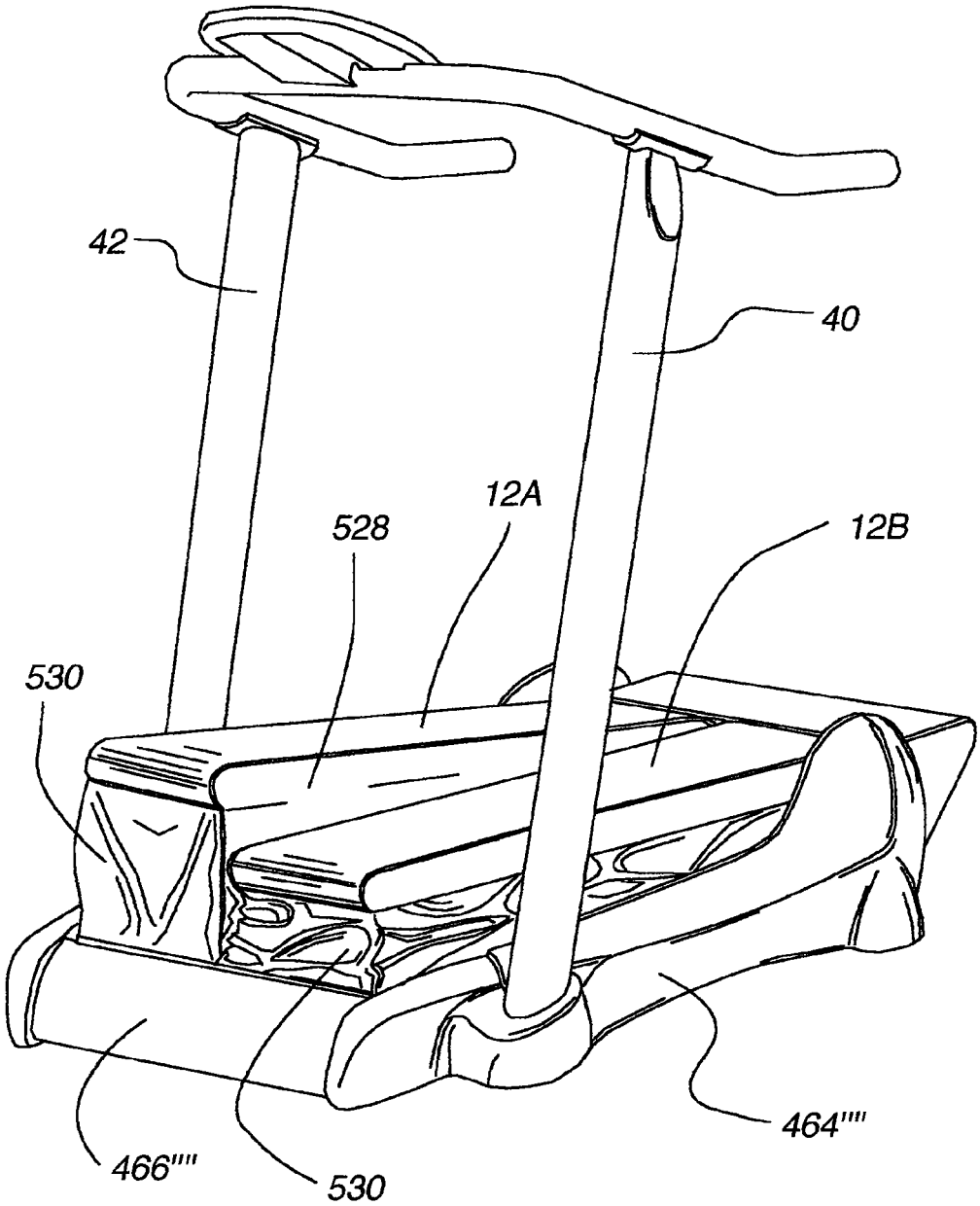
FIG. 69A is a front left-side perspective view of the exercise apparatus depicting multi-fold treadle shrouds.
Figure 69B:
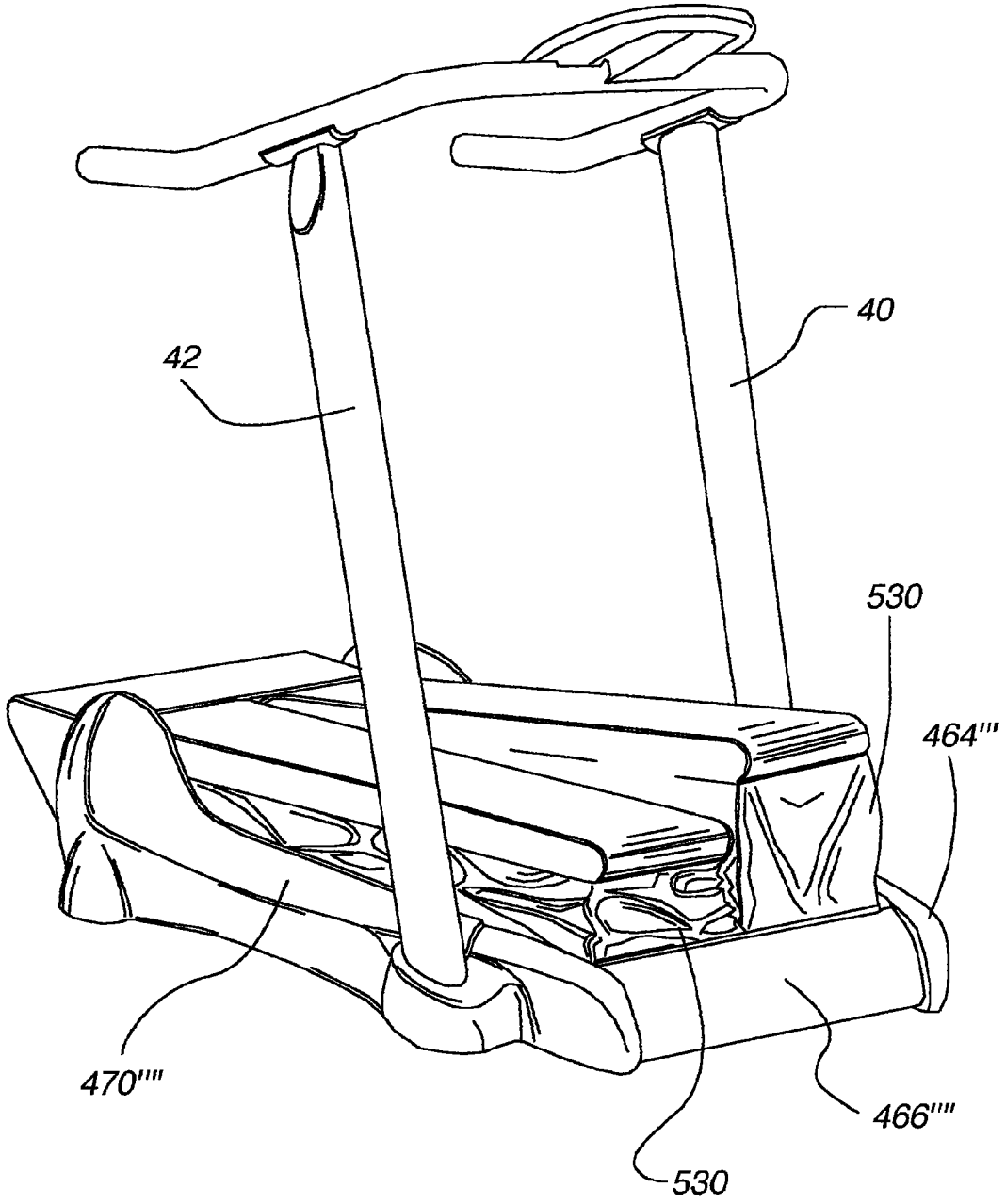
FIG. 69B is a front right-side perspective view of the exercise apparatus depicting multi-fold treadle shrouds.

As shown in FIG. 68A, the right treadle assembly 12A is in the upward position and the left treadle assembly 12B is in the downward position. The center shield 528 covers the area between the bottom of the right treadle assembly 12A and the top of the left treadle assembly 12B. As the right treadle assembly 12A moves to the downward position, the accordion-pleated shroud 526B folds and collapses on the pleats under the treadle shroud assembly 12A. As the left treadle assembly 12B moves to the upward position, the accordion-pleated shroud 526A unfolds on the pleats and until it is extended. As shown in FIG. 68B, the right treadle assembly 12A is depicted in the downward position and the left treadle assembly 12B is depicted in the upward position. FIG. 68C shows the accordion-pleated shroud assemblies 526 utilized with an alternative embodiment of the base shroud 464". The use of the accordion-pleated shrouds is not limited to that which is depicted herein. For example, other embodiments of the present invention could utilize accordion-pleated material on the front and outsides of the treadle assemblies while utilizing hard inside shields, or in any other combination of hard shields and accordion-pleated material thereof.

Other types of material can be used besides the accordion-pleated material on the embodiment depicted in FIG. 68A. For example, as shown FIGS. 69A and 69B, a multi-fold material is utilized on the treadle shroud. The multi-fold material is configured with various patterned folds in the material. When either treadle assembly 12 is in the downward position, the multi-fold treadle shroud 530 collapses on patterned or unpatterned folds or pleats in the material, similar to the accordion-pleated material. When either treadle assembly 12 is in the upward position, the multi-fold treadle shroud 530 unfolds on the patterned folds or pleats and until it is extended. It should be understood that the present invention as described above is not limited to the use of accordion-pleated and multi-fold materials. For instance, embodiments of the present invention could utilize stretchable fabric such as rubber, elastic, Lycra®, and the like.

Figure 70A:
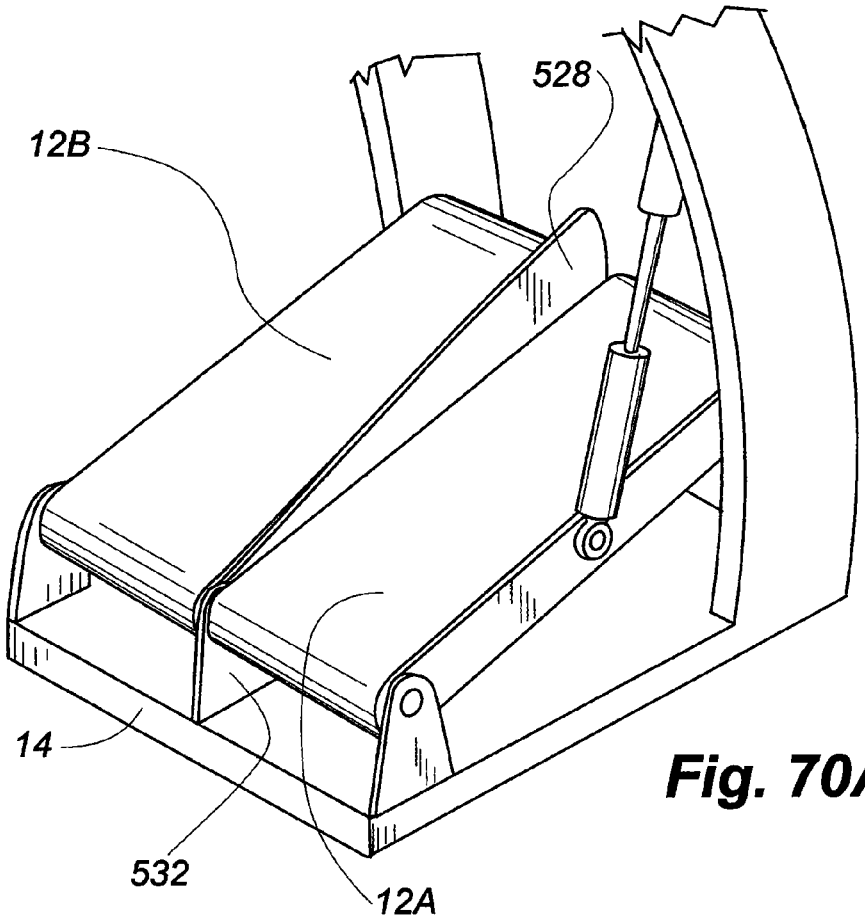
FIG. 70A is a rear right-side cut-away perspective view of the exercise apparatus depicting a center shield supported by a spring.
Figure 70B:
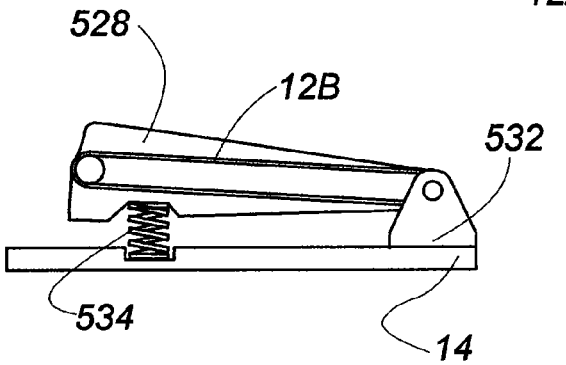
FIG. 70B is a left-side cut-away view of the exercise apparatus of FIG. 70A.
Figure 70C:
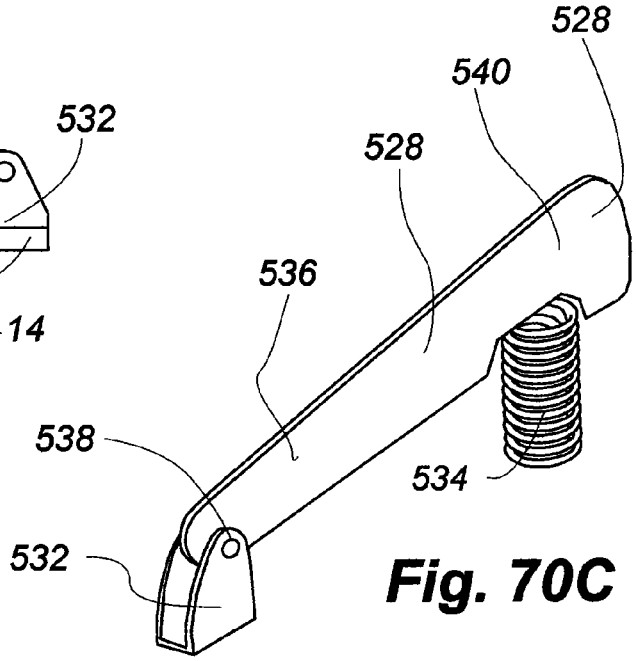
FIG. 70C is a rear right-side cut-away perspective view of the center shield of FIG. 70A.

FIGS. 70A-70C: Shielding Arrangements

FIGS. 70A to 70C depict how various embodiments of the present invention utilizing the center shield 528 can secure it to the frame 14. As shown in FIGS. 70A and 70B, the center shield 528 is supported on the frame 14 by a center drive bracket 532 and a spring 534. As shown in FIG. 70C, a rear portion 536 of the center shield 528 is pivotally supported by a pivot axle 538 on the center drive bracket 532. A front portion 540 of the center shield 528 is supported by the spring 534. Therefore, when force is exerted on the top of the center shield 528 (i.e. when stepped on during use), center shield will pivot down toward the frame 14 as the spring 534 is compressed. The spring 534 restores it to the upright position. This configuration lets the center shield 528 move out of the way when stepped on to avoid interfering with the user's stride. In this embodiment, the top of the center shield 528, when in the upper position, can be flush with the top of either treadle 12 in the upper position, or can be slightly below flush, or can be above-flush as shown.

Alternative embodiments of the present invention could utilize a center shroud assembly instead of the center shield between the treadle assemblies. The center shroud assembly could include a left center wall, a right center wall, a top center surface, and a front center surface. The front center surface extending upward from the top portion of the base shroud. The left center wall and right center wall being generally triangular in shape and separated by the width of the top center surface. The top center surface extending from the front center surface toward the rear portion of the base shroud until it intersects with the top portion.

Figure 71:
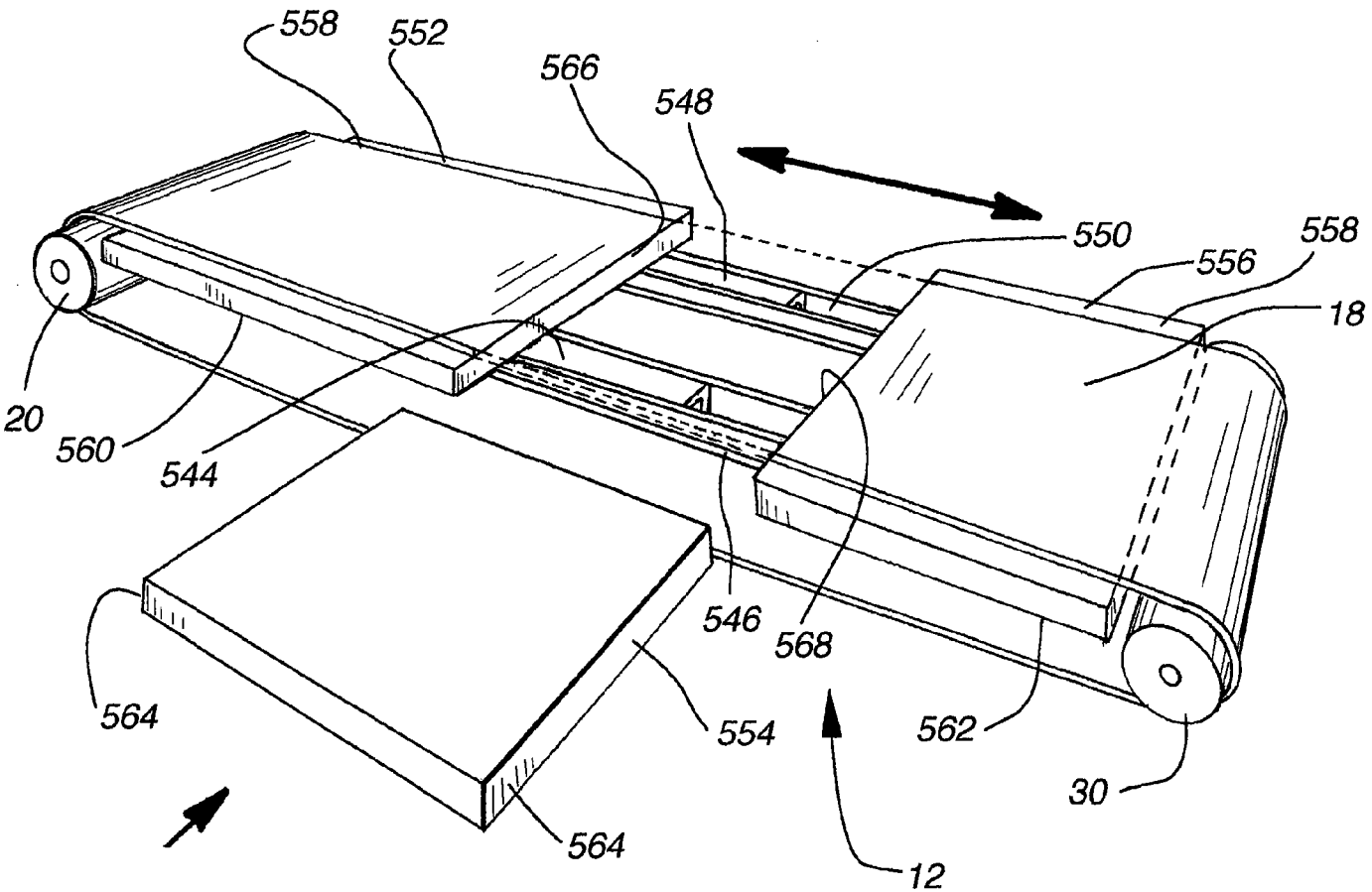
FIG. 71 is a rear left-side perspective view of a treadle assembly depicting an adjustable length treadmill deck.

As the exercise apparatus is used over time, it may be necessary to replace the treadle belt 18 after it wears out. On other occasions, the user may desire to change the length of the treadle assembly depending on how he or she wants to use the exercise apparatus (i.e. for walking or running). An adjustable length treadle assembly 12 is depicted in FIG. 71 that makes it easier for a user to replace a worn treadle belt and to adjust the length of the treadle assembly. Moreover, by reducing the length of the treadle assembly, the overall length of the device may be reduced for shipping. With a reduced device, a smaller box may be used, which is less expensive and easier to handle.

As shown in FIG. 71, the treadle assembly 12 includes a treadle frame 542 having a left forward side tube 544, a left rearward side tube 546, a right forward side tube 548, and a right rearward side tube 550, together making up the frame. The left forward side tube 544 and the right forward side tube 548 are connected with the front roller 28. The left rearward side tube 546 and the right rearward side tube 550 are connected with the rear roller 30. The left forward side tube 544 is slidingly engaged with the left rearward side tube 546, and the right forward side tube 548 is slidingly engaged with the right rearward side tube 550, such as by telescoping engagement or other such structure. The side tubes can also engage each other through mating tracks, grooves, and the like. The sliding engagement of the side tubes allows a user to move the front roller 28 in a rearward direction toward the rear roller 30, or in a forward direction away from the rear roller 30.

The belt deck 26 on the adjustable length treadle assembly 12 can include a forward belt deck 552, a middle belt deck 554, and a rearward belt deck 556, as shown in FIG. 71. It should be understood that more than one middle deck can be used, and the invention should not be construed to be limited to what is depicted herein. When in use, the treadle belt 18 travels over the upper deck surface 558 of the forward belt deck 552, the middle belt deck 554, and the rearward belt deck 556. The left forward side tube 544 and the right forward side tube 548 are connected with the lower deck surface 560 of the forward belt deck 552, and the left rearward side tube 546 and the right rearward side tube 550 are connected with the lower deck surface 562 of the rearward belt deck 556. The treadle side tubes can be connected with the forward and rearward belt decks using screws, snaps, fasteners, glue, and the like.

In FIG. 71, the middle belt deck 554 is shown as removed from between the forward belt deck 552 and the rearward belt deck 556. When the exercise apparatus is in use, the middle belt deck 554 is located between the forward belt deck 552 and the rearward belt deck 556, so that engagement sides 564 of the middle belt deck 554 are in contact with the engagement side 566 of the forward belt deck 552 and the engagement side 568 of the rearward belt deck 556. The engagement sides of the belt decks can include tracks, slots, and/or locking mechanisms to help hold the middle belt deck in position when in use.

If the user desires to replace the treadle belt 18 on the treadle assembly or change the length of the treadle assembly, he or she can remove the middle belt deck 554 by sliding it either right or left from under the treadle belt 18 and out from between the forward treadle deck 552 and the rearward treadle deck 556. The user can then move the front roller 28 rearward toward the rear roller 30 until the treadle belt 18 is loose enough to easily remove. The user can then remove the treadle belt from the rollers and install a replacement treadle belt. If the user is changing the length of the treadle assembly, the replacement treadle belt will be longer or shorter than the removed treadle belt. In some embodiments of the present invention, the belt length can be adjusted without the need to replace the treadle belt. Once the replacement treadle belt is installed on the rollers, the user then moves the front roller 28 forward to remove slack from the replacement treadle belt. The user then slides the properly sized middle belt deck 554 back into position between the forward belt deck 552 and rearward belt deck 556. For instance, if the user is changing the length of the treadle assembly, the user can replace the removed middle belt deck 554 with one that is longer or shorter.

As previously stated, various embodiments of the present invention can utilize varying numbers of treadle decks that can be secured to the treadle frame in various ways. For example, one embodiment of the present invention utilizes only the forward treadle deck and the rearward treadle deck, without the need for the middle treadle deck. In this configuration, the rearward treadle deck can be connected with the treadle frame as previously discussed. However, the forward treadle deck can be removably secured between the rearward deck and a bracket assembly attached to the left forward side tube and the right forward side tube. Removing the forward treadle deck in this configuration can be achieved in a manner similar to that previously discussed with reference to the removal of the middle treadle deck. In other embodiments, the forward treadle deck can be connected with the left forward side tube and the right forward side tube, and the rearward treadle deck is removable.

Alternative embodiments of the present invention could utilize a center shroud assembly instead of the center shield between the treadle assemblies. The center shroud assembly could include a left center wall, a right center wall, a top center surface, and a front center surface. The front center surface extending upward from the top portion of the base shroud. The left center wall and right center wall being generally triangular in shape and separated by the width of the top center surface. The top center surface extending from the front center surface toward the rear portion of the base shroud until it intersects with the top portion.

Figure 72B:
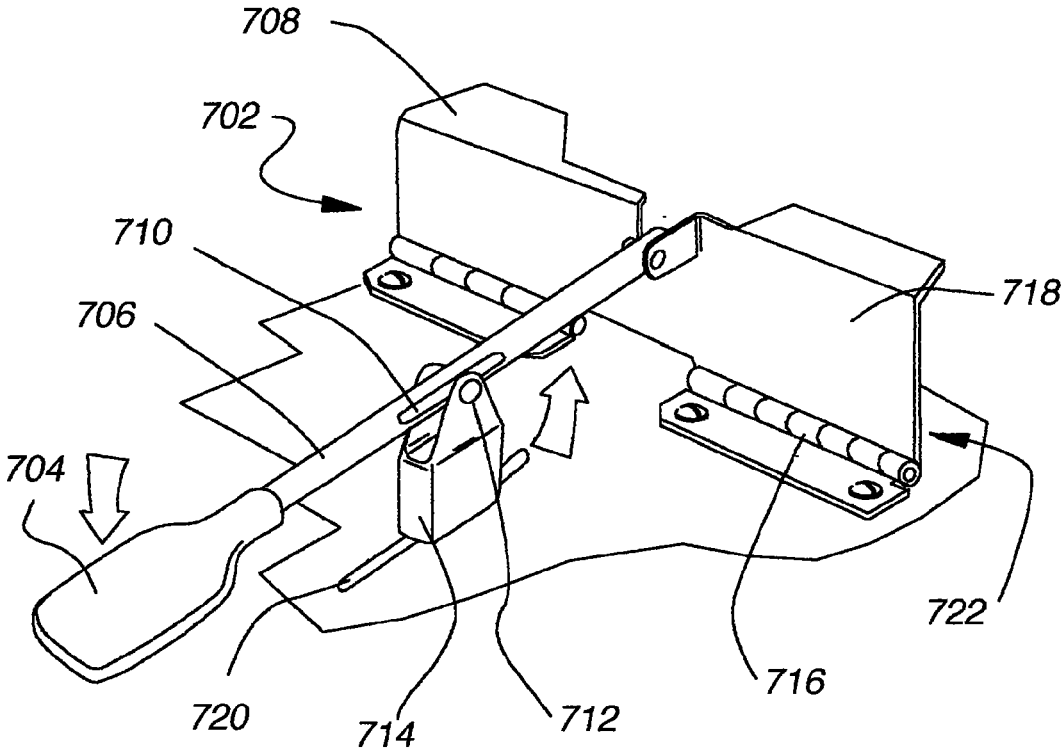
FIG. 72B depicts a second view of the locking mechanism of FIG. 72A.
Figure 72A:
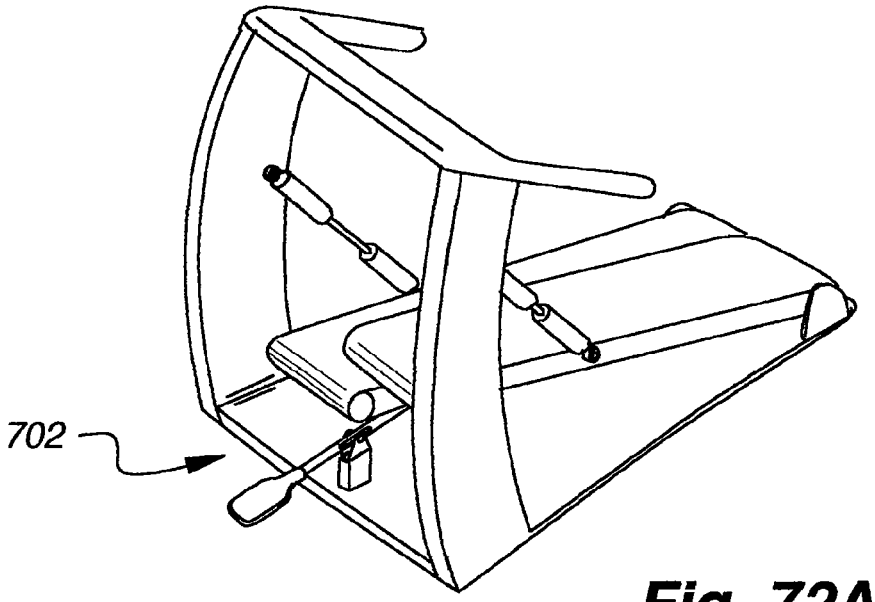
FIG. 72A depicts a first view of a locking mechanism for use with a dual-deck exercise machine.
Figure 74:
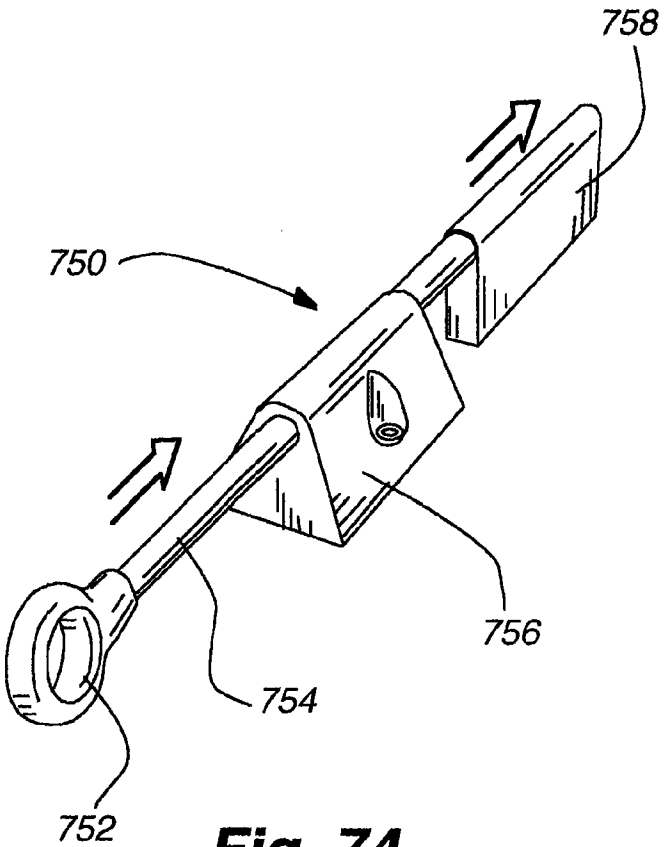
FIG. 74 depicts a third embodiment of a locking mechanism for use with an exercise machine.
Figure 73:
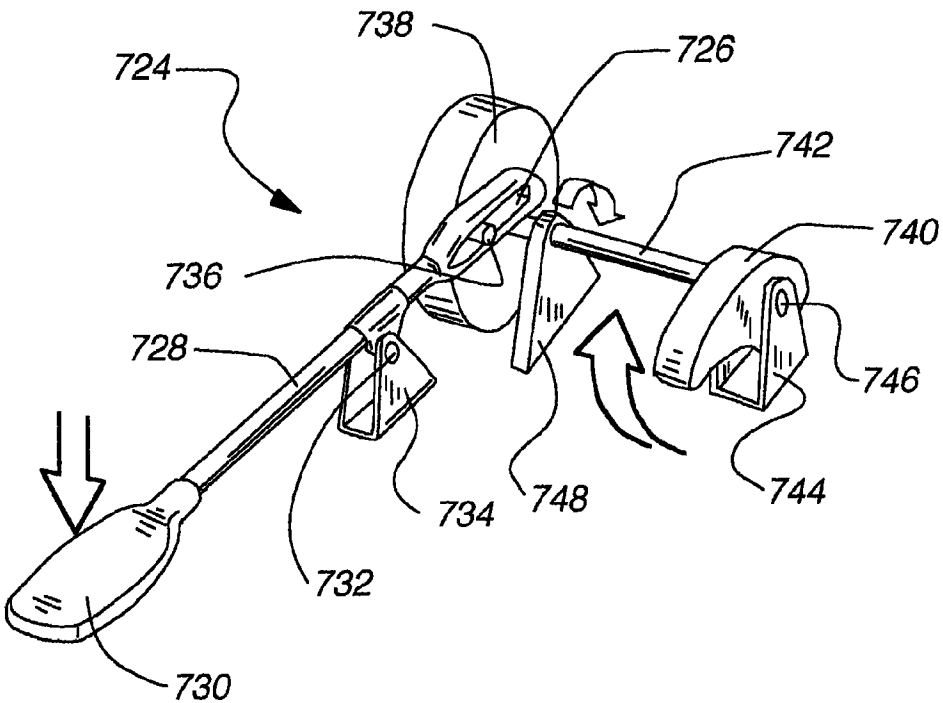
FIG. 73 depicts an alternate embodiment of a locking mechanism for use with an exercise machine.

FIGS. 72-74: Treadle Locking Mechanism

FIGS. 72A-74 display various embodiments of a locking mechanism 702 Generally, the locking mechanism 702 may fix the height of one or both treadles 12, preventing further angular motion. When the locking mechanism 702 is in a fixed position, a portion of the locking mechanism interacts with a portion of the treadle 12, preventing further treadle movement. The exact nature of each interaction is discussed with specific reference to the figures. Alternately, the treadles' bottom surfaces may rest on a portion of the mechanism. This support prevents the treadle or treadles from continuing their up-and-down motion.

FIG. 72A displays a first embodiment of a locking mechanism 702 placed on an exercise device 10, shown in more detail in FIG. 72B.

Turning now to FIG. 72B, an expanded view of the first embodiment 702 of a locking mechanism may be seen. In this embodiment, a user may press down on a pedal 704 to lock out the treadles 12. The pedal 704 is attached to a bar 706, which in turn is attached to a pair of locking tabs 708. A bar slot 710 extends through the bar. A pivot 712 runs through the bar slot 710, and is attached on either side of the bar slot to a pivot support 714. One or more piano hinges 716 anchor the locking tabs 708 to the main frame 14. Similarly, the pivot support 712 is typically affixed to the main frame 14. In the present embodiment, the locking tabs 708 are connected to the piano hinge 716 by a lock upright 718. Generally, the lock upright and locking tabs form a ninety degree angle, although alternate embodiments may vary this angle. Collectively, the locking tabs 708, lock upright 718, and piano hinge 716 are collectively referred to as the "locking tab structure." 722 A pivot slot 720 is depicted in FIG. 72B and typically used in lieu of the bar slot 710, rather than in conjunction therewith. Accordingly, most embodiments 702 include one or the other element, but not both. However, some embodiments may use the bar slot 710 and pivot slot 720 in conjunction with one another.

FIG. 72B shows the locking mechanism 702 in an engaged or locked position. When the locking mechanism is in an unlocked state, the front edge of the locking tabs 708 (i.e., the edge opposite the joinder with the lock upright 718) typically contacts the main frame 14. The pivot 714 is then located at the end of the bar slot 710 nearest the locking tab 708 structure.

As the pedal 704 is depressed, the bar 706 generally slidingly rotates around the pivot 714, with the pivot moving along the bar slot 710. Since the locking tab structure 722 is hingedly affixed to the main frame 14, the lock upright 718 may rotate around the piano hinge 716, bringing the locking tabs 708 into alignment with the treadles 12. Further, as the pedal 704 is depressed, the pivot 712 slides along the bar slot's 710 longitudinal axis towards the pedal. This longitudinal motion permits the lock upright 718 rotation just described. In the present embodiment, the lock upright 718 rotates clockwise about the piano hinge 716.

As the locking tabs 708 move into an upright position, they may engage a groove or channel (not shown) located along the bottom of the treadles 12, either in the bases of the treadles themselves, in the stop blocks 160, or otherwise affixed to the stop brackets 126, 132. The channels may include a snap or spring bracket, or other noise-producing and tab receiving device, at a point near the channel end. When the locking tab 708 engages or pushes the noise-producing device, an audible "click" or other noise is produced. This informs the user that the locking tab 708 is properly seated inside the channel in order to lock out treadle motion. Alternate embodiments may seat the locking tab 708 in a channel or receptacle that makes a noise when receiving the locking tab, but nonetheless securely locking out treadle motion.

The channel (not shown in FIG. 72B) may also include an upright flange or projection oriented perpendicularly to the locking tab 708 travel direction, and projecting far enough across the channel to impact the locking tab as it travels along the channel. Generally, such a projection is sufficiently flexible or deformable to permit the locking tab 708 to continue moving beyond the projection, and is again located near the channel end. The locking tab 708 may include a mating groove located approximately the same distance from the front edge of the locking tab as the projection is from the channel end. When the locking tab 708 impacts the projection and/or the projection seats inside the mating groove, the tactile feedback produced may also inform the user that the locking tab is properly seated within the channel. The tactile feedback mechanism just described may be used in conjunction with a noise-producing device.

The channels previously mentioned may be either parallel to the main frame 14, in which case the front edge of the locking tab 708 enters the channel first, or perpendicular to the main frame, in which case the top surface of the locking tab enters the channel first. Either variety of feedback mechanism (tactile or noise-producing) may be used with either channel configuration.

Although the locking tabs 708 are shown as flat, planar elements in FIG. 72B, alternate embodiments may curve the tabs, either slightly or more significantly. In such a case, the matching channels on the treadle assembly 12 may be curved as well. A curved locking tab 708 directs downward force against the channels, thus providing additional resistance to a rising treadle. In order to mate with a curved locking tab 708, the channel is generally wider at the tab entrance, and has a tapering width along the channel cavity.

In the embodiment 702 shown in FIG. 72B, the lock upright 718 rotates clockwise about the piano hinge 716. In an alternate embodiment, the pivot 712 and bar slot 710 may be configured to permit the lock upright 718 to rotate counterclockwise about the piano hinge 716. In such an embodiment, the pivot positions are reversed along the bar slot 710. That is, while the pedal 704 is in a raised position, the pivot is located at the end of the bar slot 710 nearest the pedal. Conversely, when the pedal 704 is depressed, the pivot 712 slides to the end of the bar slot 710 nearest the locking tab structure 722. Further, the locking tabs 708 may be reversed in orientation to point towards the pedal 704, in order to engage the treadle 12 channel. Reversal of the pivot 712/bar slot 710 and locking tabs 708 may be simultaneously employed in some embodiments, and used separately in others.

In yet another embodiment, the treadle 14 channels may be omitted. In such an embodiment, the treadles 14 simply rest on the locking tabs 708, preventing further angular motion. When such "resting" embodiments are employed, the locking tabs 708 may be T-shaped in order to provide additional support surface for the treadles 12. Further, the locking tabs 708 may point either towards or away from the pedal 704 when in an engaged position, regardless of the direction of rotation of the locking tab structure 722.

In further alternate embodiments, the bar slot 710 may be omitted. If the bar slot is omitted, the pivot support 714 may slide along a pivot slot 720 located in the main frame 14 or other supporting structure. Generally, the pivot support 714 slides in the manner previously mentioned with respect to the pivot 712 itself.

Additionally, the locking mechanism 702 shown in FIG. CH1B may be provided with a ratchet mechanism to enable the lockout procedure described above to take place at varying treadle 12 heights.

Although the above embodiment 702 has been discussed as simultaneously locking out both treadles 12, an alternate embodiment may provide a separate pedal 704 and locking tab 708 arrangement for each treadle. In such an embodiment, pressing on a pedal 704 may swing a single locking tab 708 into a locking position, thus interacting with a single treadle 12. The two locking mechanisms 702 may be synchronized, thus locking both treadles 12 at the same angle, or may be independent, permitting each treadle to be locked at a unique angle.

FIG. 73 shows an alternate locking mechanism 724. Here, the bar slot 726 is located at the end of the bar 728 opposite the pedal 730, rather than along the length of the bar. Rather than sliding the pivot 732 along the bar slot 726, the pivot is fixed in a pivot support 734 and thus occupies a fixed position along the length of the bar 728. Instead, a wheel rod 736 extends from the surface of a lockout wheel 738 into the bar slot 726. Generally, when the pedal 730 is up (corresponding to a non-locked position), the wheel rod 736 is in a portion of the bar slot 726 located closer to the pedal than the opposing bar 729 end. The pivot support 734 is affixed to the main frame.

As the pedal 730 is pushed downward, the bar 728 rotates about the pivot 732. This forces the bar slot 726 upward, which in turn drives the wheel rod 736 along the slot towards the bar 728 end. The lateral motion of the wheel rod 736 along the bar slot 726 rotationally drives the lockout wheel 738 in a clockwise direction.

The lockout wheel 738 is connected to a lockout cam 740 by an axle 742. The lockout cam 740 is attached to a cam support 744, which is in turn affixed to the main frame 14 or otherwise stably supported. The lockout cam 740 is configured to rotate about a cam pivot 746. The lockout wheel 738 may be attached to a wheel support 748, which is also generally attached to the main frame 14. Neither the wheel support 748 nor the cam support 746 prevent rotation of either the lockout wheel 738 or lockout cam 740 to a degree sufficient to lock out treadle 12 motion, as described further below.

As the lockout wheel 738 rotates, it turns the axle 742, which in turn rotates the lockout cam 740 clockwise. The axle 742 may extend through the lockout cam 740 to form the cam pivot 746, may attach to the opposite side of the lockout cam at the cam pivot point, or may attach to the lockout cam at another point along its surface. In any case, the cam support 744 is configured to permit the axle 742 to freely rotate the cam 740 to a degree sufficient to lock out treadle 12 motion without impacting the support structure 14.

As the lockout cam 740 rotates, a cam edge may contact a treadle 12 surface. As the cam fully extends, the cam edge may support the treadle, preventing further angular motion or rotation by the treadle. Alternately, the cam edge may mate with a channel on the treadle 12, in the stop blocks 160, or otherwise affixed to the stop brackets 126, 132. Further, in some embodiments the cam 740 edge may include a flange or projection ("cam flange") extending outwardly from the edge in the direction of rotation. The cam flange may also mate with a channel in the manner described above with respect to FIG. 72B.

In an alternate embodiment, the lockout wheel 738, wheel support 748, and axle 742 may be omitted. In such an embodiment the wheel rod 736 attaches directly to and drives the lockout cam, with similar lockout results.

FIG. 74 shows another locking mechanism embodiment 750. In this embodiment, a user may move a slider handle 752 in a back-and-forth manner. The slider handle 752 is affixed to a slider bar 754, which passes through a slider support 756 and terminates in a slider key 758. As the slider handle 752 is pushed, the slider bar 754 moves through the slider support 756, driving the slider key 758 in the same direction the slider handle is moved. As the slider key 758 extends, it may mate with a channel or groove formed in the treadle 12 bottom (not shown), in the stop blocks 160, or otherwise affixed to the stop brackets 126, 130. This mating locks out one or both treadles 12, preventing further treadle movement. Moving the slider handle 752 in the opposite direction withdraws the key 758, allowing free treadle 12 motion. In some embodiments, one slider 750 per treadle 12 may be employed to permit discrete lockout of treadle motion.

The embodiments 724, 750 described with respect to FIGS. 73 and 74 may lock out one or both treadles 12. Further, these embodiments 724, 750 may incorporate any and all of the features discussed with respect to FIG. 72B, such as noise-producing and/or tactile feedback mechanisms.

The various embodiments 702, 724, 750 discussed herein with respect to FIGS. 72A-74 have been discussed with reference to manual operation thereof, generally by manipulating a pedal 704, 730 or slider 752. Alternate embodiments may actuate any and all of the locking mechanisms disclosed herein by electromechanical or other automated means, such as through a servomotor.

FIGS. 75-78: Dual Reciprocating Treadmill with Arm Exercise

The present exercise apparatus may also include an attachment structure linking the handles to the treadles and/or uprights. For example, FIG. 75 displays the upper body structure 760 of a dual deck treadmill exercise device 780 and a pair of treadles 782. Generally, in the embodiment 780 shown in FIG. 75, the upper body portion 760 of the exercise device includes a left and right upright 784, 786, a left and right handle bar 788, 790, and a left and right interconnect 792, 794. Each handle bar 788, 790 is typically affixed to an upright 784, 786, which in turn attaches to a treadle 782, main frame 14 (not shown), or other portion of the exercise device 780. In alternate embodiments, the upright and handle bar may be of single-piece construction.

Figure 75:
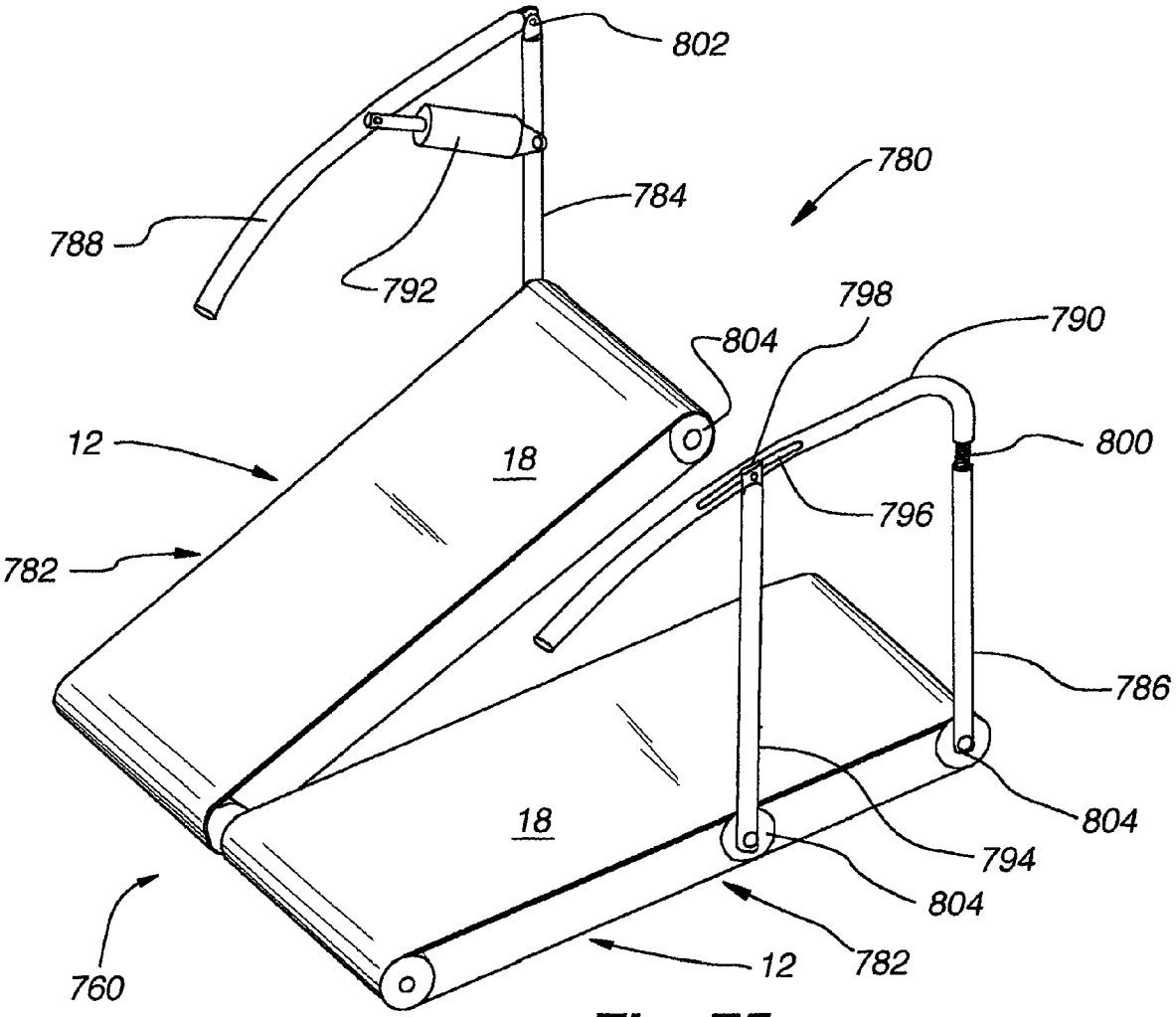
FIG. 75 depicts the upper body structure of a dual deck treadmill exercise device and a pair of treadles, with two different interconnects linking the upper body structure to each of the two treadles.

An interconnect 792, 794 generally operationally attaches the handle bar 788, 790 to the deck 12 or upright 784, 786. Exemplary interconnects suitable for use with the embodiment of FIG. 75 include shocks, torsional springs, elastic members, rigid bars, and so forth. The terms "deck" and "treadmill assembly" 12 are used interchangeably herein. It should be noted that the embodiment 780 shown in FIG. 75 displays two different manners of operationally attaching a handle bar 784, 786 to a deck 12 by means of an interconnect 792, 794, one for each handle bar and deck assembly. Generally, an exercise device 10 will employ the same interconnect structure for both handle bars. Accordingly, the difference between the interconnect structures shown in FIG. 75 is simply a means for displaying two alternate embodiments. FIG. 75 should not be construed as requiring different interconnect mechanisms within a single exercise device, although this may occur in some embodiments. Generally, however, most embodiments employ a single interconnect mechanism.

Returning to FIG. 75 and with respect to the rightmost upper body 760 and treadle assembly 782, the interconnect 794 directly attaches the handle bar 790 to a portion of the assembly 12. The interconnect 794 may, for example, attach to the outer treadle frame. In this embodiment, the interconnect 794 may take the form of a piston cylinder or a solid bar (a solid bar being shown in the figure). When the interconnect 794 is a piston, the bottom portion of the interconnect is generally fixably attached to the treadle assembly. Thus, as the handle bar 790 moves up and down, the piston rod extends from and retracts into the piston body in order to maintain a linkage between the handle bar and the treadle 12. This also provides additional resistance against the motion of the handle bar 790 and/or treadle 782, thus providing a more strenuous workout for a user of the exercise device.

Alternately, the interconnect 794 may be a fixed-length member as shown. In this case, one end of the interconnect 794 is generally mated with a slot or recess 796 on either the treadle assembly 12 or the handle bar 790 in order to permit handle bar motion in the event the treadle is locked in place. The slot 796 into which the interconnect 794 (or a lateral member affixed to the interconnect) fits generally runs longitudinally along either the handle bar 790 or the treadle assembly 782. In this manner, when one of either the handle bar and treadle is fixed in place, the interconnect may move angularly to permit the other element to freely experience its full range of motion.

In yet another embodiment, vertical motion of the handle bar 790 and treadle 12 may be linked by the interconnect 794. In such an embodiment, the slot 796 may be omitted and the interconnect 794 may still comprise a solid member. Here, the interconnect 794 attachments to one or both of the handle bar 790 and treadle 782 may be hinged. Because the interconnect 794 length is fixed and the interconnect does not move laterally of its own accord, up and down motion by either the handle bar 790 or the treadle 782 drives the other in the same manner. For example, when the handle bar 790 is moved up, the treadle 782 is also moved up. Similarly, when the handle bar is moved down, the treadle is pushed down by the downward force exerted through the interconnect and onto the treadle. In this manner, the handle bar 790 motion may be used to drive the vertical motion of a treadle 782 or vice versa.

In a further embodiment, the handle bar 790 may move laterally instead of vertically. In such an embodiment, the interconnect 794 may drive the lateral motion of the treadle belt off the handle bar motion, or vice versa. This embodiment is described in more detail below.

In any of the aforementioned embodiments, the handle bar 790 may be jointed at some point between the interconnect attachment point 798 and the portion of the upright 786 affixed to the treadle 12 or other portion of the exercise device 10. The joint 800 may take, for example, the form of a spring hinge (shown in FIG. 75).

Turning now to the left upper body and treadle deck assembly shown in FIG. 75, it may be seen that the interconnect 792 generally extends between and is attached to the left handle bar 780 and left upright 784. If the interconnect 792 is a piston, as shown, then generally the point of attachment between the upright 784 and handle bar 788 is hinged to permit the piston to extend and contract. The hinge 802 may be located at any point along the length of either the handle bar 788 or upright 784, so long as the hinge is located between the two piston ends. Alternately, when the interconnect 792 takes the form of a fixed-length member, the connection between the handle bar 788 and upright 784 is generally fixed.

In either of the embodiments shown in FIG. 75, the motion of the handle bars 788, 790 may be used to drive the treadle belts 18. Either the interconnect 792, 794 or the upright 784, 786 may be attached to a roller 804 beneath the treadle belt 18. When the handle bar and upright are of single-piece construction, the handle bar may connect directly to the roller 804. Generally, the connection between the roller and handle bar or upright may be considered another interconnect, insofar as the connection ultimately attaches the deck and handle bar to one another.

As the handle bar 788, 790 moves it in turn moves either the upright 784, 786 or interconnect 792, 794 (depending on which is connected to the roller 804) back and forth through an angle. The interconnect 792, 794 or upright 784, 786 may be attached to the roller 804 either by a one-way bearing or a ratchet and pawl assembly. In either case, as the driving element is moved backward (that is, toward the treadle 12 rear), it rotates the roller 804 and thus the overlying belt 18. As the driving element moves forward with the motion of the handle bar 788, 790, the bearing free wheels or the pawl slips along the ratchet (i.e., the element operably connecting interconnect and roller disengages). This disengages the driving element from the roller 804, thus ensuring that the treadle belt 18 is not moved against the natural direction of motion of a user's foot.

Figure 76:
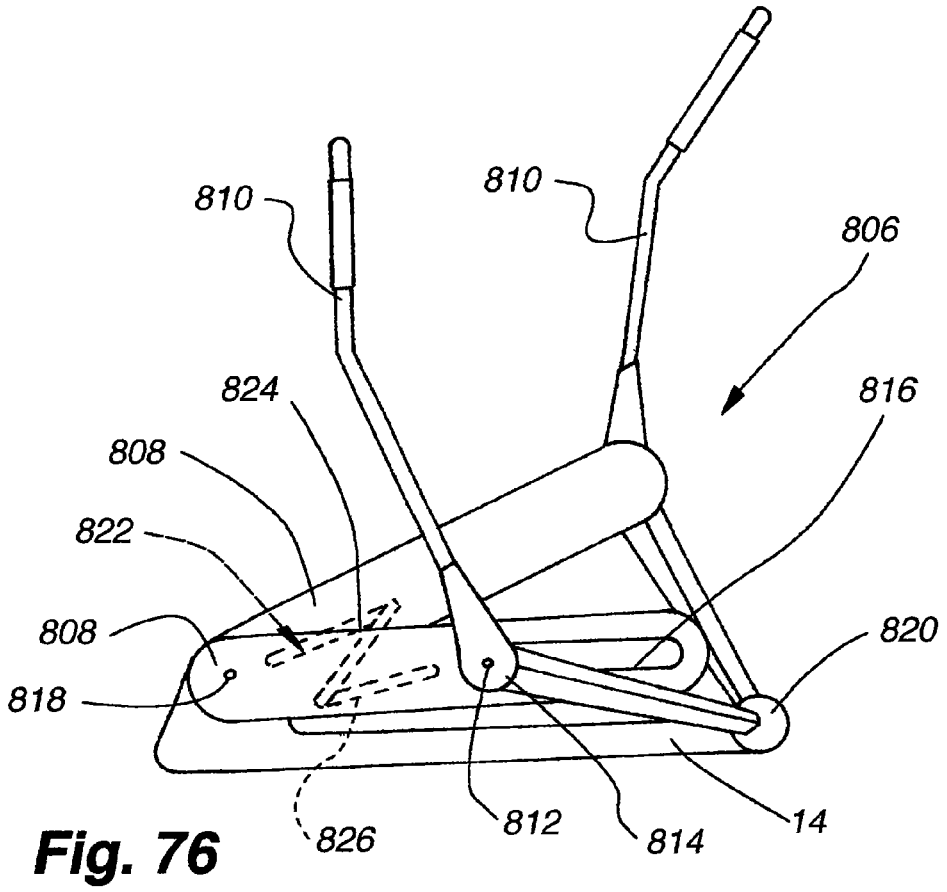
FIG. 76 depicts an embodiment of an exercise device incorporating dual deck treadles driven by a reciprocating pivoting motion of a pair of handle bars.

FIG. 76 displays another embodiment 800 of an exercise device incorporating dual deck treadles 808. In this embodiment, the vertical motion of the treadles may be driven by the reciprocating pivoting motion of the handle bars 810. The handle bars 810, at one end, attach pivotally to the frame 14 at a midpoint of the frame's length. A protrusion 812 extends inwardly from each handle bar 810. This protrusion 812 is shown in FIG. 76 in the middle of the handle bar joint 814, although the protrusion may not be externally visible in some embodiments. The protrusion 812 seats inside a slot 816 along the side of the treadle assembly 808. As the handle bar 810 is pushed forward, the protrusion 812 slides along the treadle slot 816, which in turn forces the treadle 808 front up. Similarly, as the handle bar 810 is moved towards the back of the treadle 808, the combination of protrusion 812 and slot 816 drives the treadle front to pivot downwardly. Generally, each treadle 808 is affixed at and rotates about an axle 818 running through the rear of the treadles. Accordingly, the "up" and "down" motions herein described are also rotational or angular in nature about the rear of the treadle 808. Additionally, both handle bars 810 are typically rotationally affixed to a point 820 on the exercise device 806 (or points lying along a parallel line perpendicular to the long axis of the exercise device) as far forward as the front end of the treadle slot 816 or slightly further (as shown in FIG. 76), when the treadle 808 is in a fully down position. The handle bars 810 typically rotate around this point 820, and accordingly may be attached by any means permitting such rotational motion. Although the treadle slot 816 is shown in FIG. 76 as extending along approximately the first half of the treadle 808, it may be positioned at any point along the treadle. The longer the treadle slot 816, the greater the angular motion of the treadle 808. Similarly, the closer to the treadle rear the slot is located, the higher the angle achieved by the treadle around the axle.

In some embodiments, the treadles 808 may be attached to one another with an interlink 822 (shown in phantom in FIG. 76). Generally, the interlink 822 is a mechanical linkage capable of transferring motive power from one treadle 808 to another. The rocker interconnect assembly may be substituted for the interlink, in some embodiments, either the interlink 808 or the aforementioned common axle 808 is used, but many embodiments may employ both. As one treadle 808 moves in a given direction (up or down), the interlink 822 drives the second treadle in the opposite direction. The interlink 822 may, for example, take the form of a pivotable Z- or C-shaped member (a Z-shaped interlink is shown in FIG. 76) with the left and right members 824, 826 each attached to a slot, chamber recess, or hinged element of an opposing treadle 808. Generally, the left and right members 824, 826 are attached to the inside sidewall or bottom frame of the treadle in such a manner as to avoid interfering with the motion of the treadle or associated belt 18. To continue the example, as one treadle 808 is pushed down, the left member 824 may slide along the recess defined in the left treadle 808 or rotate about the hinged element of the interlink, moving in a generally downward direction with the treadle. This motion pivots the interlink 822 about its pivot point, which in turn pushes the right member 826 in a generally upward direction along the right treadle's recess, thus exerting an upward force on the second treadle and causing it to rise.

In the event that the handle bars 810 and/or uprights (if used and discrete from the handle bars) are attached to the treadles 808 with a protrusion 812 and slot 816 mechanism, as shown in FIG. 76, the interlink 822 may also drive the handle members 810 back and forth. Even without an interlink 822, the handles may be driven by treadle 808 motion where, for example, the rising and falling of each treadle is controlled either by a servomotor or resistive element, such as a torsional spring or piston (not shown).

The exercise device may use resistive elements to enhance a workout. For example, FIG. 77 displays an embodiment of an exercise device 828 incorporating resistive elements 830 in a handle bar structure 832. Generally, the exercise device 828 includes two treadles 834 and two handle bars. As with previous embodiments, the front of the treadles 834 are capable of an up and down reciprocating motion, while the back of each treadle generally neither rises nor falls. The treadle backs are affixed to a main frame 14 or other portion of the exercise device 828 in such a manner as to allow the treadles 834 to rotate around rear ends of the treadle as the front of the treadles raise and lower.

Figure 77:
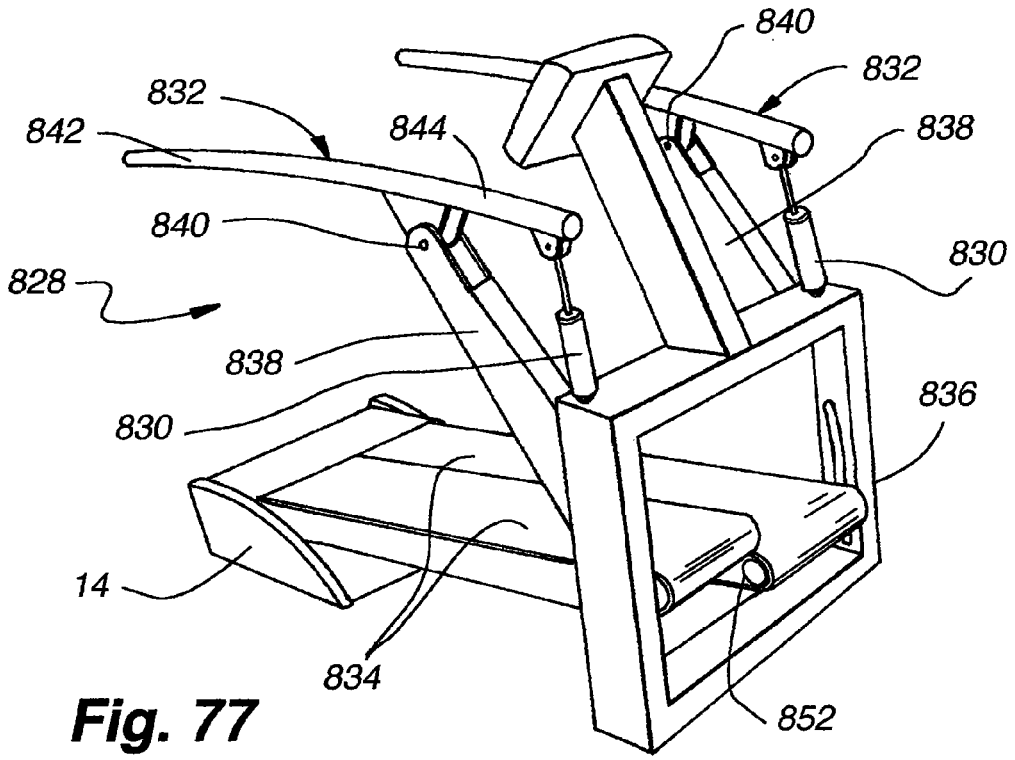
FIG. 77 depicts a first embodiment of an exercise device incorporating resistive elements in a handle bar structure.

Each handle bar 832 typically is anchored to a front body structure 836 by an upright 838, or may alternately be attached directly to the front body structure. The handle bar 832 is pivotally or slidably coupled to the upright 838. In the present embodiment, the connection takes the form of a hinge or pivot 840. Each handle bar is also affixed to a piston or other resistive element 830, which in turn is attached to the front body structure 836. Although a piston 830 is shown in FIG. 77, a spring member may be substituted. The portion of the handle bar 832 behind the pivot point is referred to as the "handle rear" 842, while the portion in front of the pivot point is the "handle front" 844.

Generally, the piston 830 resists the motion of the handle bar 832, exerting force on the front 844 of the handle bar in the same direction as that placed on the handle rear 842. Since the handle front and rear pivot about the hinge 840, the piston 830 increases the difficulty of moving the handle 832. This, in turn, may provide a user of the exercise device 828 with an enhanced upper body workout experience. In alternate embodiments, the front body structure 836 may be omitted and the pistons 830 may attach to other portions of the workout device.

Figure 78:
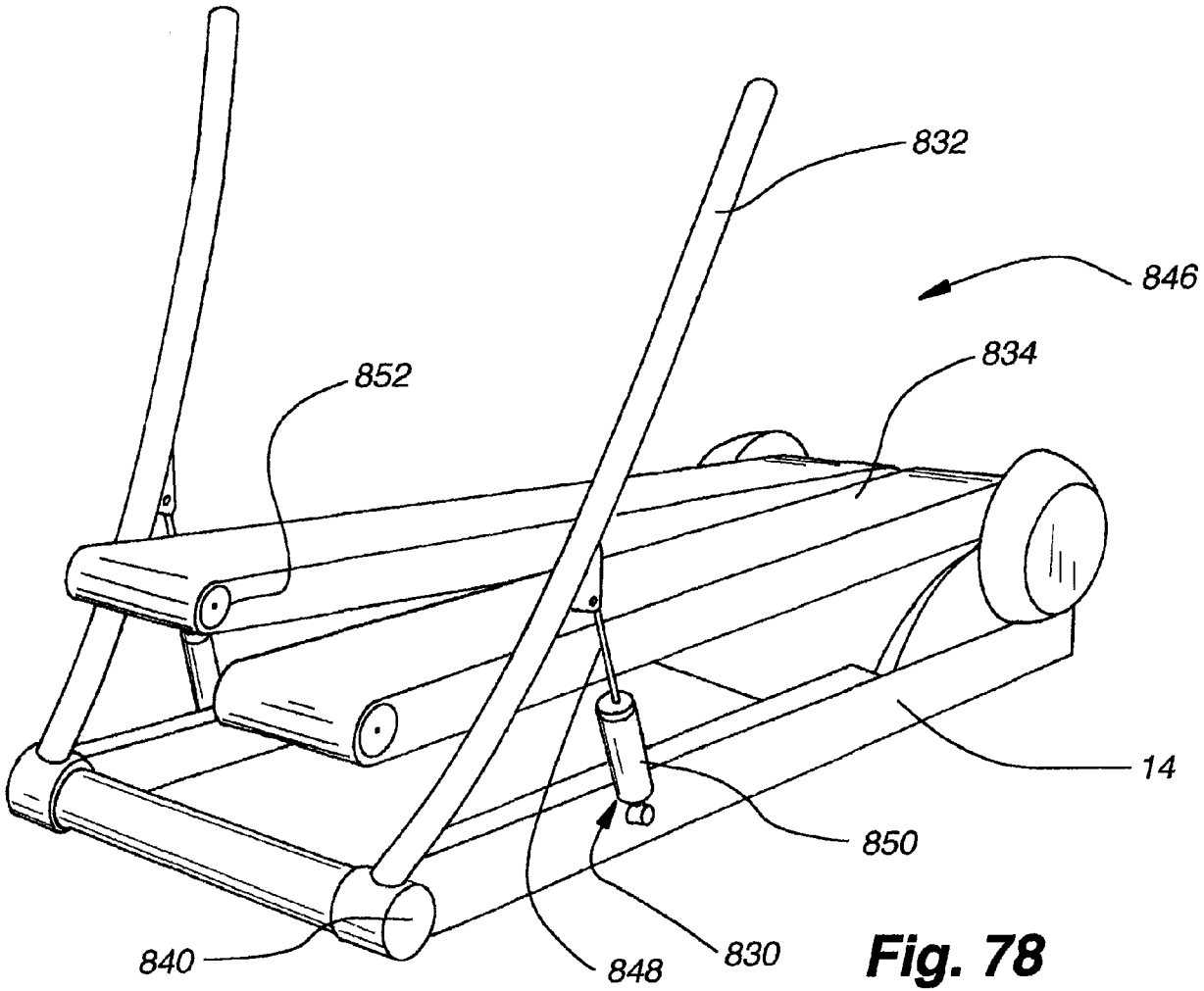
FIG. 78 depicts a second embodiment of an exercise device incorporating resistive elements attached to a handle bar structure.

Additionally, and with reference to both FIGS. 77 and 78, the piston rod 848 may extend through the piston body 850 and into the front body structure or frame 14, ultimately affixing to a portion of the treadle assembly 834, such as a front roller 852. In such an embodiment, the piston 830 may pull or push the treadle 834 in the same direction of motion as the handle front 844 (or handle 832 in FIG. 78). The weight of the treadle 834 (and any user standing on it) may provide additional resistance to the handle bar 832 motion, further increasing the force necessary to move the handle bar. In this embodiment, the interior side walls of the front body structure 836 or frame 14 each include a slot (not shown). The slot may be curved or straight. The piston rod 843 attaches to the treadle 834 through the slot; the slot further allows the treadle to move in an up-and-down manner while remaining attached to the rod.

In some embodiments 846, the piston 830 may be placed between the handle bar 832 and front body structure 836, with the aforementioned upright 838 omitted. In such embodiments, the hinge 840 is the connection point between handle bar 832 and body structure 14. This is shown to better effect in FIG. 78.

This embodiment 846 affixes each handle bar 832 to the treadle structure 834 (or main frame 14) by a hinged joint 840. A resistive element 830, such as a piston dampener, is typically attached at one end to the handle bar 832 at some point along the length of the handle bar above the hinged joint 840, and is attached at the other end to a portion of the main frame 14. Generally, the hinged joint 840 acts as a fulcrum about which a handle bar 832 may revolve. The piston 830 attaches to the handle bar 832 at some point between the hinged joint 840 and handle bar end. The main frame 14 or treadle assembly 834 serves as an anchoring structure for the piston, securing the piston 830 and distributing the resistive force generated by the piston across a sufficiently large stationary mass to prevent unwanted motion of the exercise machine 846. As with the embodiment shown in FIG. 77, the piston generally resists motion of the handle bar. Here, however, the resisted motion is primarily lateral and angular, rather than the primarily vertical motion produced by the embodiment shown in FIG. 77.

FIGS. 79*a*-81: Rear Pivot Height Adjustment

FIGS. 79-79 display various views of one embodiment of an adjustment mechanism 854 configurable to adjust a rear pivot height of a treadle 12. Generally, the embodiment 854 may be used with any of the treadles described herein. The following discussion of the adjustment mechanism 854 makes reference to, and assumes that, a single adjustment mechanism is employed to adjust the height of each treadle 12. It should be noted that one adjustment mechanism 854 may be configured to adjust the height of multiple treadles 12 in alternate embodiments.

Turning now to FIG. 79, a side view of a pair of treadles 12 operably connected to the present embodiment of an adjustment mechanism 854 may be seen. A portion of the mechanism affixes to a treadle base, the main frame 14, or another stable portion of the exercise device (a "support element"). In this context, "stable" refers to a portion or element of the exercise device 10 that does not move with the movement of one or both treadles. Typically, the embodiment 854 includes opposing side brackets 856, each of which are affixed to the support element. A slot 858 is formed in each side bracket, and extends generally vertically from the support element. In alternate embodiments, the slot 858 may extend at an angle from the support element, may be arcuate, may run parallel to the support element (to vary lateral treadle 12 placement), and so forth.

An adjustor pin 862 is at least partially held within one slot 858, operably connects to at least one height adjustment element 860, runs through a rear roller 864, aperture, or space within the treadle (shown in FIG. 79C), and terminates in a second slot. In an alternate embodiment, the adjustor pin 862 may terminate in a series of recesses designed to accept the pin end, or may terminate at a second height adjustment element 860. In yet another embodiment, the height adjustment element 860 may be located on the side of the treadle 12 opposite the support bracket 856, and the pin 862 may terminate at the height adjustment element. The height adjustment element 860 may be configured to allow for either continuous or discrete adjustment.

The general operation of the embodiment 854 is now described with reference generally to FIG. 79A. The height adjustment element 860 may be manipulated to raise or lower the adjustor pin 862. As the position of the adjustor pin is modified, the rear of the treadle 12 is raised or lowered accordingly. In the present embodiment 854, such raising and lowering affects only the height of the treadle 12 rear. The height of the treadle front, as well as the overall treadle throw, remain unchanged. Typically, the top and bottom of the slot 858 define the maximum and minimum heights to which the pin 862 may be raised or lowered. (For reference, "throw" is defined the vertical distance traveled by the treadle front between the lowest and highest points of the treadle's vertical motion.)

FIG. 79B displays an isometric view of the present adjustment mechanism 854, as viewed from the interior of the support bracket 856 (the treadle 12 side). Here, the height adjustment element 860 takes the form of a threaded lead screw, while the operable connection between the adjustor pin 862 and height adjustment element is a threaded adjustor 866 or sleeve. The threaded adjustor 866 is prevented from rotating by the pin 862. Accordingly, as the lead screw is turned 860, the threaded adjustor is drawn up or down the body of the screw, depending on the direction in which the screw is turned and the threads run. As the adjustor sleeve 866 moves, the pin 862 and treadle assembly 12 also move.

FIG. 79C displays a back view of a treadle 12 attached to the present embodiment of a height adjustment mechanism 854. As can be seen, the adjustment mechanism 854 shown in FIG. 79B extends along both sides of the treadle 12. Alternate embodiments may employ a single threaded adjustor 866 and screw 860 located only on one side of the treadle, rather than the double arrangement shown.

As also shown in FIG. 79C, the motor may be encased in a motor case 868. The motor case 868 may also be affixed to one of the treadle assembly 12, threaded adjustor 860, or adjustor pin 862 in order to permit the motor case to raise and lower along with the treadle. In this manner, proper tension is maintained in a drive belt (not shown in FIG. 79C) running between the motor and a treadle roller 864, thus permitting mechanized operation of the treadle 12 without unduly loosening or tightening the drive belt. Were the drive belt affixed to a support element and unable to move up and down, lowering the treadle 12 might unduly slacken the belt, thus preventing the motor from properly driving the treadle. Similarly, where the treadle 12 is raised in such a scenario, the length of the drive belt may prevent the treadle from rising past a certain height.

Figure 79D:
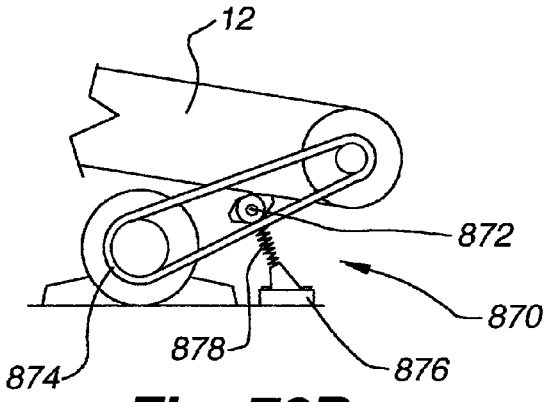
FIG. 79D depicts an apparatus for tensioning a drive belt attached to both a height-adjustable treadle, such as that depicted in FIGS. 79A-79C, and non-height-adjustable motor.

FIG. 79D displays an apparatus 870 for tensioning a drive belt 874 attached to both a height-adjustable treadle, such as that depicted in FIGS. 79A-79C, and non-height-adjustable motor. A tensioner 870 may engage the belt 874. In the present example, the tensioner may consist of a base 876 mounted on a support element, a spring or elastic body 878, and a roller 872 engaging the belt. The spring 878 is configured to pull the roller 872 downward with sufficient force to maintain the proper drive belt 874 tension. As the treadle 12 is raised, the spring 878 is stretched, which exerts additional downward force on the belt 874 through the roller 872. Similarly, as the treadle is 12 lowered the spring contracts, exerting less downward force on the belt through the roller. The spring 878 is typically calibrated to ensure the proper tension is maintained in the drive belt 874 regardless of the treadle height, presuming the treadle height stays within the adjustment range of the height adjustment element 869.

In another embodiment (not shown), the tensioner 870 may be replaced by a tension bar. The bar may be attached at one end to the adjustor pin 862 and the motor case 868 at the other. As the pin is raised and lowered, the tension bar may move the motor case back and forth along an arcuate or slanted slot in the support element 856. Because the tension bar is of fixed length, the distance between the motor and treadle roller varies only minimally. This ensures that the drive belt 274 tension is maintained within a proper range.

In yet another embodiment, the tension bar may be omitted, permitting a user to slide the motor case 868 along the arcuate slot as necessary to maintain drive belt tension. In such an embodiment, the motor case 868 may be fixed in place with a clamp, screw, or other similar device to ensure the motor does not slide when activated.

Alternate embodiments of the present invention 10 may employ different height adjustment mechanism 854. For example, the lead screw 860 may be replaced by a series of brackets attached to, or angled slots or recesses formed in, the support bracket 856. The adjustor pin 862 may be seated in a bracket, slot, or recess to change the treadle height. In yet another embodiment, the height adjustment element 860 may take the form of a jack capable of raising the pin. In a further embodiment, the adjustor pin 862 may be a biased "pop pin" capable of being pulled away from the surface of the height adjustment element, and automatically returning to an engaging position with the adjustment element when the pin is released.

As mentioned elsewhere in this document, the treadles 12 may be locked at an angle to simulate a single treadmill operating either levelly, at an incline, or at a decline ("locked mode"). The treadles may also freely reciprocate ("unlocked mode"). FIG. 80A displays the treadles operating in an unlocked mode, with the treadle rear in a lowest position afforded by the above-referenced adjustment mechanism 854. Colloquially, the lowest position of the adjustment mechanism 854 is referred to as "high position" because it affords the greatest incline angle between the treadle rear and the treadle front, when the treadle front is at its maximum operating height (i.e., the greatest range of angular motion by the treadle about the rear treadle axle). FIG. 80B displays the treadles 16 locked in high position.

Just as the treadles 12 may occupy a high position, so may they occupy a low position. Generally, the low position of the treadles 12 corresponds to the maximum height to which the rear of the treadles may be raised by the adjustment mechanism 854. This creates a minimum incline angle between the treadle rear and front when the treadle front is at its maximum operating height. Depending on the treadle 12 throw, this may correspond to a decline angle for the treadles, even when the treadle front is at maximum extension. FIG. 81 displays one treadle 12 occupying each of the high and low positions discussed above with respect to FIGS. 80A and 80B. One treadle 12 is shown in each position. The rearmost treadle is in the high position, while the frontmost treadle occupies the low position. As shown in FIG. 81, the treadles' 12 heights may be independently adjusted in some embodiments to permit each treadle to occupy a different position.

As previously mentioned, the treadle rear heights may be independently adjusted where each treadle 12 is provided with a discrete adjustment mechanism 854. In such a case, the treadles may actually be set for different incline or decline angles, permitting a user to tailor the angle of operation of the treadles as desired.

FIGS. 82-83F: Treadle Throw Adjustment Mechanism

FIG. 82 displays an embodiment of a treadle throw adjustment mechanism 880. The embodiment may alter the starting and stopping points of the throw of one or both treadles 12 (i.e., the angles defining the lowest and highest points of the treadle's vertical motion, as measured from the main frame or exercise device base). "Throw" refers generally to the vertical distance traveled by a treadle 12. Additionally, the embodiment may also change the angle through which the treadle travels during its vertical motion.

The physical structure of the throw adjustment 880 will now be described with respect to FIGS. 82-83B. A pivot support 882 may be attached to the main frame 14 or another stable portion of the exercise device 10 (a "support element"). In this context, "stable" refers to a portion or element of the exercise device that does not necessarily move with the movement of one or both treadles. A throw bar 884 is rotatably attached to the pivot support 882 about a pivot point 886. The throw bar 884 extends in both directions beyond the pivot point 886, and runs perpendicular to the longitudinal axis of the treadles 12. Although only one direction of extension is shown in FIG. 88, both directions of extension are more clearly shown in FIG. 83A. The throw bar 884 may oscillate through a fixed angle of motion about the pivot point 886. The throw adjustment 880 is operationally attached to the treadle 12 by means of the angle adjustment structure, as described in more detail below.

A throw adjust bracket ("throw adjust") 888 surrounds a portion of the throw bar. Connected to the throw adjust is an throw handle 890, also referred to as a throw pull. A series of throw recesses 892 are defined at fixed intervals along the longitudinal axis of the throw bar 884. An throw pin 894 (the end of which is shown in FIG. 82) passes through at least a portion of an throw recess as well as an egress in the throw adjust, and is fixedly attached at one end to the throw handle. FIG. 83B displays an isometric view of the throw adjust 888 and throw pull 890.

The throw handle 890 may be pulled outwardly, away from the throw bar 884 and adjust 888, in order to unseat the throw pin 894 from the throw recess 892. When the throw pin is unseated, the throw adjust may be moved along the longitudinal axis of the throw bar. Because the throw pull 890 is affixed to the throw adjust 888, the pull and pin 894 may also move with the throw adjust. In an alternate embodiment, the throw pull 890 may be removably attached to the throw adjust 888, thus permitting the pull and throw pin 894 to be completely removed from and inserted into the embodiment. When the throw adjust 888 is positioned with its egress over an throw recess 892, the throw pin 894 may be inserted into the recess, thus securing the throw adjust structure to the throw bar 884. In an alternate embodiment, the throw pull 890 and throw pin 894 may be spring biased towards the center of the throw bar 884. Accordingly, the throw pin may be automatically forced into a properly aligned throw recess. Such biasing may also assist in keeping the throw pin 894 in place during operation of the mechanism. Colloquially, this structure is referred to as a "pop pin."

Reference is now made to FIG. 83C to describe the various adjustments possible with the present throw adjustment mechanism 880. Generally, the farther away from the pivot point 886 the throw adjust 888 is seated, the greater the vertical distance (translated to angle) traveled by the treadle 12 during operation. This is shown in FIG. 83C, represented by the angle bars occupying positions "B." The corresponding stroke angle $\alpha$B, representing the angle between the treadle's minimum and maximum heights, is also shown.

By moving the throw adjust 888 closer to the pivot point 886 and seating the throw pin, the vertical distance ("throw") through which the treadle 12 travels may be minimized. Accordingly, moving the throw adjust 888 and angle bars from positions "B" to positions "A" decreases angle $\alpha$, as shown on FIG. 83C, from angle $\alpha$B to angle $\alpha$A. This corresponds to moving the throw adjusts 888 and associated angle bars 896 from position "B" to position "A" on FIG. 83D.

The treadle 12 will still experience some throw, regardless of in which of the throw recesses 892 the throw pin 894 sits, unless an embodiment of the mechanism permits the throw pin to be seated exactly at the pivot point 886. Because the treadle 12 has a fixed length, the closer the throw adjust 888 sits to the pivot point, the greater the angle of the treadle incline, both at the maximum and minimum throw points, presuming the distance between the throw bar 884 and treadle base remains constant. Similarly, the closer the throw adjust 888 sits to the pivot point, the smaller the angle of operation (stroke angle $\alpha$ on FIG. 83C) experienced by the treadle 12, again presuming the distance between the throw bar 884 and treadle base remains constant. The "angle of operation" refers to the angle traveled by the treadle 12 base as the treadle front travels from its minimum to maximum operational height.

Returning to FIG. 82, in addition to adjusting the throw, the embodiment 880 may also adjust the angle of the treadle 12 at both its minimum and maximum vertical extension (the "starting angle" and "stopping angle," respectively). An angle bar 896 is hingedly attached to the throw adjust 888. The hinge attachment ensure that the angle bar 896 remains vertical as the throw bar 884 oscillates. Like the throw bar 884, the angle bar 896 includes a series of angle recesses 898 linearly defined along its longitudinal axis. An angle pin 899 may be seated in an angle recess. The angle pin 899 is fixedly attached to an angle pull 897, and may be unseated from the angle recess 898 by moving the angle pull away from the angle bar 896. Generally, the angle pull 897 is operationally attached to an angle adjust 895. The angle adjust 895 includes an angle egress (not shown) through which the angle pin 899 at least partially passes. When the angle pin is removed from an angle recess, the angle adjust may slide along the angle bar. Placing the angle pin 899 in an angle recess fixes the angle adjust 895 in place.

As with the throw pull 898, the angle pull 897 and angle pin 899 may be fully detachable from the angle adjust 895, or the angle pull may only be moved a fixed distance away from the angle adjust. Further, the angle pull 897 and pin 899 may be spring biased toward the angle bar 896/angle recesses as described above with respect to the throw pin 894, taking the form of the aforementioned pop pin.

The angle adjust 895 is attached to the treadle assembly 12 (generally to the treadle base) by a treadle attachment (not shown) located at the top end of the angle adjust. The treadle attachment may mate with a receiving cavity or slot running perpendicular to the treadle's 12 longitudinal axis, or in the same direction as the throw bar 884. This structure is referred to herein as a "treadle underslot." As the throw adjust 888 is moved along the throw bar 884, the treadle attachment moves along the treadle underslot in order to keep the angle bar 896 in a relatively vertical orientation. Alternately, the treadle attachment may take the form of a U-joint mated with the fixed rear of the treadle 12. The U-joint may maintain the upright orientation of the angle bar 896. Similarly, the attachment between the throw adjust 888 and angle bar 896 may also be a U-joint.

Again with reference to FIG. 83C, as the angle adjust 895 is moved along the angle bar 896, the distance between the throw bar 884 and treadle 12 base varies. As this distance changes, the starting and stopping angles also change, although the stroke angle may not vary. Generally, as the angle adjust 895 approaches the throw bar 884, the starting and stopping angles become more acute (decrease), while the starting and stopping angles become more obtuse (increase) as the angle adjust moves away from the throw bar. Effectively, the starting and stopping angles are each offset from a base plane by angle β, as shown on FIG. 83C. When the angle adjust 895 is in position "C" along the angle bar 896 (see FIG. 83F), the offset angle is equal to angle βC. If the angle adjust 895 is moved to position "D," the offset angle increases to angle βD.

FIGS. 84A, 84B and 86: Modular Configurations

The exercise device 10 may employ a variety of modular configurations, which may facilitate shipping, packing, storage, and so forth. FIGS. 84A and 84B display one embodiment of a modular treadle and frame configuration 1200. Generally, the embodiment includes at least one treadle assembly 1202, main frame assembly 1204, connector 1206, and optionally, a cover 1208 (cover shown to best effect in FIG. 84B). Broadly, the treadle assembly 1202 may be mounted within the main frame assembly 1204 and attached thereto by the connector 1206. The connector 1206 may be designed to be removable in order to allow the disassembly of the embodiment 1200, in which case the treadle assembly 1202 is removably mounted to the main frame assembly 1204, or the connector may permanently affix the treadle assembly to the main frame assembly. In either event, the general construction of the embodiment 1200 from its constituent parts is essentially the same.

With reference to FIG. 84A, the treadle assembly 1202 includes a continuous treadle belt 1208, one roller 1210 located at each end of and inside the treadle belt, and a belt gear 1212 affixed to an axle 1214 extending through the roller at the treadle rear end. The axle 1214 may also be an integral part of the roller 1210 rather than simply extending therethrough. In the present embodiment 1202, the free end of the axle 1214 is threaded to receive an axle connector 1216 taking the form of a lug nut or screw cap. In alternate embodiments, the axle connector 1216 may snap- or pressure-fit onto the axle 1214 instead of being screwed thereon, or an adhesive bond between the two may be created.

The axle 1214 is sized to fit within a slot 1218 formed on a slotted receptor 1206. The diameter of the axle shaft may be less than the slot 1218 width, or a groove having such a diameter may be formed at a specific point along the axle length. The groove (not shown) may aid in properly aligning the axle 1214 with the slotted receptor 1206, in addition to assisting in securing the axle to the receptor.

When the axle 1214 is properly aligned with and resting within the slot 1218, the belt gear 1212 rests on a drive gear 1220 of the main frame assembly 1204. The drive gear 1220 is operationally connected to, and is rotated by, a motor 1222. The motor, in turn, is secured to a base 1226 of the main frame assembly, typically at one of the frame rear corners. In the present embodiment, the motor 1222 is affixed to the base 1226 by several screws, bolts, or other connectors 1224, although other embodiments may adhere the motor to the base or strap it thereto. The main frame assembly 1204 may include a rotating extendable stabilizer element 1228, such as a shock having dampening capabilities (shown in dashed lines on FIG. 84A), hingedly attached along one side of the main frame assembly 1204 and capable of being affixed to a portion of the treadle assembly 1202. Alternately, a slidable, fixed-length stabilizer element may extend perpendicular to the base 1226, and be affixed to both a first stabilizer slot within the side of the main frame assembly and a second stabilizer slot within the side of the treadle assembly. Such additional stabilizer elements are optional, and are not required in the present embodiment 1200.

Although a single treadle assembly 1202 is shown being mounted to the main frame 1284 in FIG. CH15A, two treadle assemblies may be mounted side by side within a single frame. Generally, the treadle assemblies 1202 are both mounted with the belt gears 1212 facing inwardly. In one embodiment, a slotted receptor 1206 may be affixed to the sidewall of the mainframe 1204 at each corner of the frame rear, so that each receptor may receive an axle 1214 of a treadle assembly 1202. In another embodiment, a treadle assembly 1202 may lack an axle 1214 extending beyond the roller body 1210, and the slotted receptor 1206 may be omitted. In this latter embodiment, the axles 1214 of both treadle assemblies 1202 may extend slightly beyond the surface of the belt gear 1212 and be adapted to mate with one another to allow both assemblies to be driven by a single motor 1222. The axles, for example, may be joined by a connector.

FIG. 84B displays the drive gear 1220 and motor assembly 1222 of the embodiment shown in FIG. 84A, with two treadle assemblies 1202 mounted thereto. The drive gear 1220 extends sufficiently beyond the end of the drive motor 1222 to engage both belt gears 1212. As the motor 1222 operates, it turns the drive gear 1220, which in turn rotates the belt gears 1212. One or more optional drive belts (not shown) may be looped around the drive gear 1220 and one or both belt gears 1212 at sufficient tension to assist in turning the belt gears. The drive belt may also aid in stabilizing the treadle assemblies 1202, as well as securing the treadles to the main frame 1204. A cover 1208, attached to the treadle assemblies' frames 1230, may extend over and shield the belt gears 1212.

FIG. 85 displays an alternate embodiment 1230 of the drive gear 1220 and motor assembly 1222 discussed with respect to FIG. 84B. In this embodiment, the drive motor 1234 is secured to the frame base 1226 near the middle of the rear frame sidewall, instead of in one of the rear corners. Further, the motor 1234 is not affixed to a drive gear, but instead to two drive wheels 1232. Each drive wheel 1232 is slightly larger in diameter than the motor 1234, which ensures that the wheel surface extends above the top of the motor.

A pair of modified treadle assemblies 1236 lack the belt gear 1212 discussed with respect to FIGS. 84 and 85. Instead, the treadle belt 1238 rests directly on the drive wheel 1232, with the treadle roller 1240 being located above the drive wheel. When the motor 1234 is activated, the drive wheel 1232 turns and frictionally spins the treadle belt 1238. The drive wheel may be rotated either clockwise or counter-clockwise, depending on the motion desired for the treadles, and still drive the treadle belt. Since the treadle assemblies 1236 lack belt gears 1212, the cover 1208 shown in FIG. 84B is unnecessary.

Still with respect to FIG. 85, the diameter of each drive wheel 1232 is typically aligned directly with the diameter of the roller 1240, in such a fashion that a line connecting the centers of the drive wheel and roller would extend generally perpendicularly from the main frame base 1204. This permits the treadles 1236 to pivot up and down at the opposite treadle end without breaking contact between the treadle belt 1238 and drive wheel 1232, or imparting undesired lateral motion to the treadle from the rotation of the drive wheel.

Axles 1242 of the treadle assemblies 1236 may still rest in a slot 1218, and may still be connected to a slotted receptor 1206. Further, the axles 1242 of each treadle assembly 1236 may extend inwardly towards the middle of the main frame assembly 1204 and slightly beyond the exterior surface of each roller 1240. The axles may be mated together in a manner previously described, or may be mated through a gooseneck extension (not shown, although a connector 1244 is depicted in FIG. 85) affixed to a portion of the frame assembly 1204 and curving up and over the motor. The gooseneck extension, or other connection 1244 between the axles 1242, not only stabilizes the treadle assemblies 1236 within the frame 1204, but also assists in regulating the motion of the treadles with respect to one another.

FIG. 85: Dual Deck Exercise with Handle Motion Tied to Treadle Motion

In some embodiments of the exercise device, the handles may actuate the treadles in lieu of, or in conjunction with, a drive motor. FIG. 85 displays an exemplary embodiment 1246 of a dual-deck exercise device with the aforementioned handle 1248 actuation. In this embodiment 1246, a treadle belt 1250 motion may be powered or synchronized to a handle bar motion. Generally, each handle bar 1248 is affixed to a portion of an exercise device body 1252, such as a center console or main frame, by a rotational joint 1254. The rotational joint 1254 allows the handle bar 1248 to move freely in an arcuate manner about the joint, through a fixed angle of rotation. Alternate embodiments may permit a user to configure the angle of rotation of the handle bars 1248, varying either the total angle of rotation or the starting and stopping points of the angle.

Each handle bar 1248 is typically affixed to a rotational drive element 1256. The rotational drive element may make up the rotational joint 1254, or the drive element may be operably connected to the handle bar 1248 by the rotational joint. The rotational drive element 1256 may, for example, take the form of a freewheel bearing or ratchet and pawl arrangement. As the handle 1248 is moved in one direction, the rotational drive element 1256 engages and turns with the motion of the handle. As the handle moves in the opposite direction, the rotational drive element disengages, ceasing any movement powered by or linked to the handle motion. The drive element 1256 may still be subject to residual motion from its own inertia, or the inertia of a different element of the device.

The rotational drive element 1256 is also operably coupled to a treadle roller 1258. As the rotational drive element 1256 moves, it turns the treadle roller 1258 in the same direction of motion. A belt 1260 extends across the exterior roller surface. As the roller 1258 turns, it drives the belt 1260, imparting lateral motion to the top belt surface. Accordingly, motive force may be transferred from a handle bar 1248, through the rotational joint 1254, to a rotational drive element 1256, to a roller 1258, and finally to a treadle belt 1260. In the present embodiment 1246, the direction of powered motion of the treadle belt 1260 corresponds to the direction of motion of the handle bar 1248 in which the rotational drive element 1256 is engaged. That is, if the rotational drive element is configured to engage when the handle bar moves back and disengage when the handle bar moves forward, then the treadle belt moves backward when the handle bar moves backward. Continuing the example, when the handle bar 1248 is moved forward, the rotational drive element 1256 disengages and no motive power is provided to the treadle belt 1260.

As shown in FIG. 85, the present embodiment 1246 of the exercise device includes two treadles 1250 and two handle bars 1248, and accordingly two rotational drive elements. Each rotational drive element 1258 is operably connected to one handle bar 1248 in the present embodiment, and ultimately drives only one treadle belt 1260. Alternate embodiments may employ a single drive element for both belts.

Further, the motion of a first handle bar 1248 generally opposes that of a second handle bar in the embodiment of FIG. 85. That is, while the first handle bar 1248 moves back, the second handle bar typically moves forward. This simulates the arm-swinging motion making up part of a person's standard stride. Although the handle bars may move in opposite directions at any given moment, the treadle belts generally move or rotate in the same direction. Thus, both the first and second rotational drive elements may impart motive force to the treadles from the same handle motion (i.e., forward or backward), which ensures that only one treadle is motively powered by a handle at any given moment. Alternately, while the first rotational drive element moves the treadle in the same direction as the handle bar, the second rotational drive element may move the treadle in the direction opposite the handle bar.

FIG. 85 shows the handle bars attaching to a front portion of the exercise device, with the front roller of each treadle fixed in place and the rear roller of each treadle rising and falling. In an alternate embodiment, the handle bars may be bent or canted in such a manner as to attach to a rear portion of the device. In such an embodiment, the rear roller of each treadle generally remains fixed, while the front treadle vertically moves.

In yet another embodiment, the drive element may turn a solid axle extending through both treadle belts, rather than a single roller devoted to each treadle belt.

In yet another embodiment, the rotational drive element may be replaced by a vertical drive element. The vertical drive element may convert the arcuate lateral motion of a handle bar to arcuate vertical motion for the treadle, thus driving the up-and-down motion of one treadle, instead of driving the treadle belt motion.

In yet another embodiment, the drive element may turn a solid axle extending through both treadle belts, rather than a single roller devoted to each treadle belt. In yet another embodiment, the rotational drive element may be replaced by a vertical drive element. The vertical drive element may convert the arcuate lateral motion of a handle bar to arcuate vertical motion for the treadle, thus driving the up-and-down motion of one treadle, instead of driving the treadle belt motion.

FIGS. 87-90: Interfaces Between Treadles

For a discussion of the low friction interface between the treadles 12, reference is now made to FIG. 87, which is an isometric view of the treadle and base frame portion 300 of the exercise machine 10 in accordance with an embodiment of the present invention. As indicated in FIG. 87, a low friction surface is provided on the top surface 902 or portion of the interior edge or interface of each treadle 12. This is done so that during use of the exercise machine in any mode, if a portion of the user's foot steps downwardly on the low friction interface 902 between the treadles 12, the user's foot can track the movement of the belts 18 by moving rearwardly on the low friction interface 902.

As shown in FIG. 87, the interior edge 904 or interface of the left treadle 12A is adjacent to the interior edge 906 or interface of the right treadle 12B. Thus, in one embodiment, both interior edges 904, 906 have low friction surfaces 902 and, as a result, are low friction interfaces 902. In another embodiment, only one of the interior edges 904, 906 is a low friction surface 902. In one embodiment, each low friction surface 902 extends generally the entire length of the treadle 12. In another embodiment, each low friction surface only extends over a portion of the entire length of the treadle 12.

For purposes of this discussion, "low friction surface" is defined as being any type of surface where a foot or shoe of a person using the exercise machine may easily, slidably or rollably displace along the surface with minimal frictional adhesion between the surface and the foot or shoe. For example, as shown in FIG. 88, which is an enlarged isometric view of the low friction interface 902 illustrated in FIG. 87, in one embodiment, a "low friction surface" includes a slick, slidable surface. In one embodiment, the slidable surface is formed of TEFLON™, nylon, or another polymer having a low coefficient of friction. In one embodiment, the slidable surface is a material having a low coefficient of friction that is further lowered by the application of a lubricant (e.g., a light oil, wax, silicone, etc.).

In another embodiment, as shown FIG. 89, which is an enlarged isometric view of the low friction interface illustrated in FIG. 87, a "low friction surface" 902 includes a set of rollers 908. In one embodiment, the rollers 908 are cylindrically shaped with longitudinal axes perpendicular to the travel direction of the treadle belt 18. In another embodiment, the rollers 908 are spherically shaped.

In one embodiment, the "low friction surface" 902 includes a combination of rollers and slick, slidable surfaces. In one embodiment, one low friction interface may have rollers and the other low friction interface may have a slick, slidable surface.

By using a "low friction surface" 902 at the interfaces of the treadles 12, the user's foot or shoe is more easily able to move with the belts 18 during treadmill operation. This reduces the chances that the user will stumble and/or fall.

Besides providing the low friction surface 902 at the interior edges 904, 906 or interfaces of the right and left treadles 12, the low friction surface may additionally be provided in other locations. For instance, in one embodiment, the exterior edges and surfaces of the treadles 12 are provided with a low friction surface. Also, in one embodiment, as shown in FIG. 90, which is an isometric view of the treadle and base frame portion 300 of the exercise machine, the machine may be equipped with a third or middle treadle 910. As illustrated in FIG. 90, the third or middle treadle 910 is located between the left and right treadles 12. The left and right treadles 12 are equipped with a displaceable belt 18 or tread and the third or middle treadle 910 is provided with a "low friction surface" as defined above. Thus, in one embodiment, the low friction surface of the middle treadle 910 includes a set of rollers. In another embodiment, the low friction surface of the treadle includes a slick, slidable surface, which may or may not be lubricated. Alternatively, in one embodiment, the middle treadle's low friction surface is a displaceable treadle belt similarly configured to the displaceable treadle belts described elsewhere in this specification.

As indicated in FIG. 90, if a portion of a user's foot 912 accidentally steps on the middle stationary treadle 910 during use, the user's foot 912 can move along with the belt 18 of the adjacent treadle 12. Thus, the middle treadle 910 with its low friction surface reduces the potential for tripping or falling.

In one embodiment, as shown in FIG. 90, a biasing mechanism 428, such as a coil spring 428 or set of coil springs, upwardly biases each treadle 12 and, as a user steps on a particular treadle, the treadle 12 moves downward. In one embodiment, a coil spring 428 engages a flange 430 protruding outwardly from the frame 52 of the treadle 12 in order to support the treadle and couple the treadle with the base frame 14 of the exercise machine. In other embodiments, the treadles 12, including the middle treadle 910, are biased in the upward position by other biasing mechanisms or means as described elsewhere in this specification. In one embodiment, a biasing mechanism 428 (e.g., a spring structure, etc.) attached to the middle treadle 910 causes the middle treadle 910 to remain in the upward position unless stepped on by the user. Once released, the biasing element 428 causes the middle treadle 910 to return to the upward position.

In one embodiment, the middle treadle 910 can pivot to be flush with the highest portion of an upwardly moving treadle 12. For example, the middle treadle 910 tracks the highest treadle 12, which at this point in the example is the right treadle 12B, downwardly to a midway position where the left and right treadles 12 are generally even in height. At that point, unless the middle treadle 910 is being stepped on, the middle treadle 910 tracks the left treadle 12B upward to its peak height. As the left treadle 12A begins its descent, the middle treadle 910 tracks the left treadle 12A to the midway position, where the middle treadle 910 again begins to track the right treadle 12B upward, unless the middle treadle 910 is being stepped on. Thus, if a user steps partially on the highest treadle 12 and partially on the middle treadle 910, the middle treadle 910 is at the proper height.

FIG. 91: Dual Treadle with Rollers Providing a Striding Surface

For a discussion of an embodiment of the exercise machine having an alternative tread surface, reference is now made to FIG. 91, which is an isometric view of the treadle and base frame portions 300 of the exercise machine 10. As shown in FIG. 91, each tread surface 914 (i.e., the displaceable upper surface of a treadle 12 intended to be treaded on by a user's feet or shoes) includes a plurality of adjacent, coplanar rollers 916. Thus, in this embodiment, the plurality of rollers 916 has been substituted for the displaceable belt 18 utilized as the tread surface 914 in some of the other embodiments described in this specification.

As shown in FIG. 91, the left and right treadles 12A, 12B are pivotally attached to the base frame 14 through two or more link members 918 that may be welded or integral to the base frame 14 and extend upwardly therefrom. In one embodiment, a pivot shaft 330 or member extends through a treadle frame 52, thereby permitting the treadle frame 52 to pivot about the shaft 330. In one embodiment, the treadles 12 share the same pivot shaft 330. In another embodiment, each treadle 12 pivots about its own pivot shaft 330 and, the pivot shafts 330 are axially aligned along the same axis. Thus, in one embodiment, regardless of whether the each treadle 12 has its own pivot shaft 330 or whether the treadles 12 share a pivot shaft 330, the treadles 12 are pivotably displaceable about a single rotational axis.

As indicated in FIG. 91, in one embodiment, a plurality of rollers 916 are positioned within the treadle frame 52 in a co-planar or substantially co-planner (such as with a concave or convex plane) arrangement. In one embodiment, the rollers 916 are supported in the treadle frame 52 by a plurality of rods about which the rollers can rotate during operation. In one embodiment, the rollers 916 may be freewheeling. In another embodiment, the rollers 916 are interconnected through the use of a drive belt, chain, or gearing mechanism, such that the rotation of the rollers can be controlled to provide a selectable amount of resistance to rotation. For instance, a drive mechanism or motor 88 may be provided about the rear portion of the treadle 12. The drive mechanism may have a control, such as an electrical control, located on the center console or handlebar of the exercise machine so that the user can easily regulate the amount of resistance or the rotational speed of the rollers 916. The treadles 12 can be used with springs or dampeners if desired to condition the motion of the treadles 12.

FIGS. 92-105: Treadle Frames with Pivot Location Between Ends of Treadle

For a discussion of the various manners of coupling the treadle frames 52 to the base frame 14, reference is now made in turn to FIG. 92. FIG. 92 is an isometric view of the treadle and base frame portion 300 of the exercise machine 10. As shown in FIG. 92, in one embodiment the base frame 14 is coupled with the treadle frame 52 at a point or location between the longitudinal ends of each treadle 12. Specifically, a frame member 918 extends upwardly from the base frame 14 and the treadle frame 52 is pivotally attached to the frame member 918 at a point between the longitudinal ends of the treadle 12. As indicated in FIG. 92, treadles 12 can be pivoted at locations other than the rear end of a treadle or other than at a treadle's rear roller 30.

As illustrated in FIG. 92, in one embodiment, an elongated pivot rod 330 extends from a first frame member 918 to a second frame member 918 through both the left and right treadle frames 52 so as to pivotally support the left and right treadles 12A, 12B at a pivot point located between the ends of the treadle. In other words, the left and right treadles 12A, 12B share the same pivot rod 330 and are rotationally displaceable about the same rotational axis.

In another embodiment, each treadle 12 has its own pivot rod 330 about which the treadle is rotationally displaceable. Each pivot rod 330 is supported by frame members 918. The pivot rods 330 are axially aligned and, as a result, the left and right treadles 12A, 12B pivot about the same rotational axis.

The frame members 918 are sized so as to provide a vertical offset between the treadles 12 and the base frame 14. This allows the treadles 12 to be pivoted to various desired positions or orientations during use.

FIGS. 93-94

For a discussion of another manner of coupling the treadle frames 52 to the base frame 14, reference is now made to FIGS. 93 and 94, which are, respectively, an isometric view and a right side elevation of the treadle and base frame portion 300 of the exercise machine. As shown in FIGS. 93 and 04, in one embodiment, triangular frame members 52 are provided to pivotally couple the treadles 12 to the base frame 14 of the exercise machine. In one embodiment, each treadle 12 is coupled to the base frame 14 by a single triangular frame member 52. In another embodiment, each treadle 12 is coupled to the base frame 52 by a pair or set of triangular frame members 56.

As indicated in FIGS. 93 and 94, the pivot points 330 between the base frames 14 and the triangular members 52 are between the ends of the top surface of the treadles 12, but offset away from the top surface of the treadles. Thus, the ends of the top surface of the treadles 12 and the pivot point 330 form the three points of a triangle when viewed from the side as shown in FIG. 94.

As shown in FIGS. 93 and 94, in one embodiment, a single pivot rod 330 extends through the triangular frame member 52 or members coupled to the right treadle 128, the triangular frame member 52 or members coupled to the left treadle 12A, and the base frame 14 so as to pivotally support the left and right treadles 12A, 12B. In other words, the left and right treadles 12A, 12B share the same pivot rod 330 and are rotationally displaceable about the same rotational axis.

In another embodiment, the triangular frame member 52 or members of each treadle 12 has its own pivot rod 330 about which the treadle is rotationally, displaceably coupled to the base frame 14. However, the pivot rods 330 are axially aligned and, as a result, the left and right treadles 12A, 12B pivot about the same rotational axis.

As shown in FIG. 93, for each treadle 12, the triangular frame member 52 is coupled to the axle of the rear roller 30 and if to the axle of the front roller 28, its axle. Alternatively, the triangular frame member 52 can be coupled with a portion of the treadle frame, thereby pivotally connecting the treadle 12 to the base frame 14. As indicated in FIGS. 93 and 94, each treadle 12 pivots off of the pivot point 330, which is offset below the level of the front and rear rollers 28, 30 at a location between the rollers 28, 30.

As indicated in FIG. 93, the displaceable tread surface 18 (i.e., tread belt) can be driven by the rear roller 30 or front roller 28 of a treadle. However, as illustrated in FIG. 94, in one embodiment, the pivot point 330 between the triangular frame members 52 and the base frame 14 may include an offset roller 31 such as an idler roller or a drive roller about which the belt 18 is wound for controlling the speed and direction of belt movement. As shown in FIG. 94, in one embodiment, the three rollers 28, 30, 31 of each treadle 12 are held in location by the respective treadle frame and/or the respective triangular frame member 52. Consequently, the three rollers 28, 30, 31 define a triangle about which the belt 18 passes. Depending on the embodiment, the belt 18 can be driven by the rear, front, or offset roller 30, 28, 31.

FIGS. 95-96

For a discussion of another manner of coupling the treadle frames 52 to the base frame 14, reference is now made to FIGS. 95 and 96. FIG. 95 is an isometric view of the treadle and base frame portion 300 of the exercise machine, and FIG. 96 is a left side view of the treadle 12 illustrated in FIG. 95. As indicated in FIGS. 95 and 96, in one embodiment, the treadles 12 are coupled to the base frame 14 through a pair of pivot points 920, 922 so as to produce an articulated motion of the treadle 12 during use.

As shown in FIGS. 95 and 96, a flange 918 extends upwardly from the base frame 14 and provides a first pivot point 920 to which one end of a pivot link 924 is connected. The other end of the pivot link 924 is coupled with a roller 30 of a treadle 12 and defines a second pivot point 922. Alternatively, in one embodiment, the pivot link 924 may be coupled with a portion of the treadle frame 52 forward of the rear of the treadle 12 to define the second pivot point 922 and for supporting or connecting the treadle 12 with the base frame 14.

As illustrated in FIG. 95, a spring 428 is attached between the treadle frame 52 and the base frame 14 of the exercise machine. The spring 428 upwardly biases the treadle 12 in an upright position. As shown in FIG. 96, when a treadle 12 is in the fully upright position, the bottom edges of the treadle frame 52 and the top edges of the corresponding pivot 924 links form an acute angle$^{\alpha}$. As the treadle 12 is pushed downward, the angle$^{\alpha}$ becomes more acute.

As can be understood from FIGS. 95 and 96, in operation, as a user's foot pushes downwardly on a treadle 12, the treadle 12 moves downwardly as it pivots counterclockwise around the second pivot point 922. At the same time, the treadle 12 also moves rearwardly as the link 924 and the treadle 12 pivot clockwise around the first pivot point 920. Thus, as indicated in FIG. JP10, these movements combine to create an articulated motion including a downwardly pivoting motion and a rearwardly pivoting motion, when the user's foot pushes downwardly on a treadle 12. Conversely, when the user's foot moves upwardly off of the treadle 12, the spring force moves the treadle 12 upwardly and forwardly due to the dual pivot points 920, 922. Therefore, as can be understood from FIG. 96, when a downward force is applied to a treadle 12, the treadle 12 moves generally downward and reward, and when the downward force is removed, the treadle 12 returns to its initial position by moving generally upward and forward.

FIGS. 97-99B: Treadle with Two Treadle Frame Arrangements

For a discussion of another manner of coupling the treadle frames 52 to the base frame 14, reference is now made to FIGS. 97-99B. FIG. 97 is an isometric view of the treadle and base frame portion 300 of the exercise machine, the treadles 12 having a trapezoidal configuration when viewed from the side. FIG. 98A is a right side view of the right treadle 12B illustrated in FIG. 97 and indicates the trapezoidal configuration of the treadle 12. FIG. 98B is a right side view of an alternative embodiment of the embodiment of the invention illustrated in FIG. 97 and indicates the triangular configuration of the treadle 12. FIG. 99A is a right side view of the treadle 12 illustrated in FIG. 97 and indicates the trapezoidal treadle 12 displacing about a pivot point 330. FIG. 99B is the same view of the treadle illustrated in FIG. 98A and indicates the triangular treadle 12 displacing about a pivot point 330.

As indicated in FIGS. 97-99B, in one embodiment, each treadle 12 has more than two rollers about which the continuous tread belt 18 (i.e., tread surface) changes direction. For example, in one embodiment, as illustrated in FIGS. 97, 98A and 99A, each treadle 12 has an upper treadle frame 52A and a lower treadle frame 52B. Each treadle frame 52A, 52B has a front roller 28 and a rear roller 30 about which the continuous tread belt 18 changes its direction of travel. Thus, as illustrated in FIGS. 98A and 99A, in one embodiment, the treadle frames 52A, 52B and rollers 28, 30 of each treadle 12 are oriented, when viewed from the side, such that each of the four rollers 28, 30 forms a single corner of a trapezoid.

While FIGS. 97, 98A, and 99A depict a treadles 12 with four roller equipped corners, those skilled in the art will recognize that treadles 12 with greater or lesser numbers of roller equipped corners may be developed without departing from the spirit of embodiment depicted in FIG. 97. For example, as shown in FIGS. 98B and 99B, in one embodiment, the treadles are equipped with a treadle framework 52 and three rollers 28, 30, 31 about which the continuous tread belt 18 changes direction. Thus, as indicated in FIGS. 12B and 13B, in one embodiment, the treadles 12 have a triangular configuration when viewed from the side, the triangle having three roller equipped corners.

As shown in FIGS. 97-98B, a frame 52 supports each of the rollers 28, 30, 31, and the frames and rollers are maintained in rigid position relative to each other, thereby allowing each treadle 12 to move as a complete, generally rigid unit. As indicated in FIGS. 97-98B, the top frame 52A supports the deck 26 just under the tread belt 18. With respect to the four roller embodiment as illustrated in FIGS. 97 and 98A, a bottom frame 52B connects the bottom two rollers 28, 30, and a top frame 52A connects the top two rollers 28, 30. With respect to the three roller embodiments, the top two rollers 28, 30 may be maintained in position relative to the single bottom roller 31 through a variety of framing methods, one of which is illustrated in FIG. 98B.

As illustrated in FIGS. 97, 99A and 99B, in one embodiment, a bottom roller 30, 31 is mounted between a pair of brackets 918 on the base frame 14 so as to allow the treadle 12 (i.e., treadle frames 52 or framework and rollers 28, 30, 31 held in generally rigid position relative to each other) to pivot as a single unitary structure. In other embodiments, the pivot point 330 between the treadle 12 and the base frame 14 is located along the treadle frames 52 or framework away from the rollers (e.g., see pivot arrangement in FIG. 92).

As indicated in FIG. 99A, when the pivot connection 330 between the treadle 12 and the base frame 14 is the rotational axis of the bottom left roller 30, the lateral end of the treadle opposite the pivot connection 330 pivots up and down around the pivot point 330 during use. Similarly, when the pivot connection 330 between the treadle 12 and the base frame 14 is the rotational axis of the bottom right roller 28, the lateral end of the treadle opposite the pivot connection 330 pivots up and down around the pivot point 330 during use. Similar pivot action between the treadle 12 and the base frame 14 can be envisioned when the pivot connection is the rotational axis of the top left or top right rollers 28, 30.

As indicated in FIG. 99B, when the pivot connection 330 between the treadle 12 and the base frame 14 is the rotational axis of the bottom roller 31, the top end of the treadle 12 opposite the pivot connection 330 pivots up and down around the pivot point 330 during use. Similarly, when the pivot connection 330 between the treadle 12 and the base frame 14 is the rotational axis of the top right roller 28, the left lateral end of the treadle pivots up and down around the pivot point 330 during use.

As shown in FIG. 98A, with respect to the four roller embodiment of the invention, to maintain the rollers 28, 30 in a generally rigid relationship to each other, the upper treadle frame 52A can be supported on the bottom treadle frame by a rigid structural member or a stiff dampener and/or spring structure 928. With respect to the three roller embodiment, a rigid structural member 930 or a stiff dampener and/or spring structure may also be employed to maintain the rollers 28, 30, 31 in a generally rigid relationship to each other.

FIGS. 100-101B

In alternative versions of the four roller and three roller embodiments depicted in FIGS. 97-99B, the position of the rollers 28, 30, 31 may be allowed to shift relative to each other, thereby eliminating the need for a pivot connection 330 between the base frame 14 and the treadles 12. This concept is illustrated in FIGS. 100 and 101A, which are, respectively, an isometric view of the treadle and base frame portion 300 of the exercise machine and a right side view of the treadle illustrated in FIG. 100.

As shown in FIGS. 100 and 101A, the treadles 12 have an upper treadle frame 52A and a lower tread frame 52B. The upper tread frame 52A supports a front roller 28, a rear roller 30 and a deck 26 that supports the tread belt 18 (i.e., tread surface). The lower treadle frame 52B supports a front roller 28 and rear roller 30. As indicated in FIGS. 100 and 101A, a continuous tread belt 18 is routed about the treadle 12 and changes direction at each roller 28, 30.

As shown in FIGS. 100 and 101A, in one embodiment, the treadle 12 has a trapezoidal configuration when viewed from the side, and the lower rear roller 30 and the front rear roller 28 are fixed relative to the base frame 14. In one embodiment, this is achieved by fixedly attaching the axes of the rollers 28, 30 to the base frame 14. In another embodiment, this is achieved by fixedly attaching the lower treadle frame 52B to the base frame 14.

As shown in FIG. 101A the trapezoidal treadle 12 is capable of collapsing such that the upper treadle frame 52A, with its front and rear rollers 28, 30, displaces downwards and rearwards while the lower treadle frame 52B, with is front and rear rollers 28, 30, remains positionally fixed relative to the base frame 14. As illustrated in FIG. 101A, when the upper treadle frame 52A collapses downward and rearward, the upper treadle frame 52A remains generally parallel to the lower treadle frame 52B. A spring or dampener (similar to the one illustrated in FIG. 98A), or a set thereof, can be used to maintain the upper treadle frame 52A in the upper most position relative to the lower treadle frame 52B (e.g., as shown FIG. 101A).

As indicated in FIG. 101A, during use, the upper treadle frame 52A moves downwardly and rearwardly relative to the lower frame 52B when the user exerts downward force on the upper treadle frame. In an alternative embodiment, the upper treadle frame 52A moves downwardly and forwardly, depending upon the orientation of the exercise machine or the user thereon.

As indicated in FIG. 101A, when the user stops applying downward force to the upper treadle frame 52A, the treadle frame 52A returns to the upper most position by moving upward and forward. This return to the upper most position is brought about by the spring(s) and/or dampener(s) biasing the upper treadle frame 52A upwardly.

As shown in FIGS. 101A, B, in one embodiment, the drive roller may be the lower rear roller 30, while in other embodiments, the drive roller may any of the other rollers. As with many of the various embodiments disclosed herein, the left and right treadles 12 may be interconnected through a rocker arm, attached dampeners, interconnected springs, or other means so that when one of the treadles 12 is moved downwardly by the user's foot, the other treadle 12 is mechanically moved upwardly an equal or proportionate distance, and vice versa.

FIG. 102: Treadle Frame with Pivot Link Members

For a discussion of another manner of coupling the treadle frames 52 to the base frame 14, reference is now made to FIG. 102, which is an isometric view of the treadle and base frame portion 300 of the exercise machine. As indicated in FIG. 102, in one embodiment, the treadles 12 are coupled to the base frame 14 via pivot link members 924.

As illustrated in FIG. 102, flanges 918 extend upwardly from the base frame 14. A first end of each pivot link member 924 is pivotally secured to the flanges 918 via a support rod 932 to form a first pivot point 920. The rod 932 serves as the axis about which the pivot link 924 may rotate relative to the flange 918. The other end of each pivot link 924 is coupled with a rear roller 30 of a treadle 12 and defines a second pivot point 922. Alternatively, each pivot link 924 may be coupled with a portion of the treadle frame 52 forward of the rear of the treadle 12 to define the second pivot point 922 and for supporting or connecting the treadle 12 with the base frame 14. Alternatively, separate rods 932 may be used for each treadle, and/or the rod(s) may be supported by two, three or four flanges 918.

As shown in FIG. 102, in one embodiment, a torsion spring 934 is wound about the first pivot point 920 with a first end of the spring secured to a portion of the flange 918 and a second end of the spring secured to a portion of the link member 924. This arrangement tends to move the link member 924 upwards or counterclockwise relative to the flange about the first pivot point.

As indicated in FIG. 102, when a treadle 12 is in the fully upward position, the upward edges of the treadle frame 52 and the upward edges of the associated pivot link members 924 form an obtuse angle X. As the treadle 12 is pressed downward, the angle X becomes more obtuse.

In one embodiment, the front end of each treadle 12 is supported by springs or dampeners as described elsewhere in this specification. As the user's foot contacts the treadle 12 and depresses the treadle, the treadle pivots about the second pivot point clockwise and the link pivots 924 about the first pivot point 920 clockwise. In another embodiment, the treadles 12 are interconnected through a rocker arm as described elsewhere in this specification, and as one treadle is depressed, the opposing treadle 12 moves upward and rearward.

FIGS. 103-104: Treadle Frame with Four Bar Linkage

For a discussion of another manner of coupling the treadle frames 52 to the base frame 14, reference is now made to FIGS. 103 and 104, which are, respectively, an isometric view and a left side elevation of the treadle and base frame portion 300 of the exercise machine. As shown in FIGS. 103 and 104, in one embodiment, each treadle 12 is coupled to the base frame 14 of the exercise machine via a four bar linkage 936.

As illustrated in FIGS. 103 and 104, in one embodiment, each four bar linkage 936 includes an upper and lower horizontal linkage member 938, 940 and a front and rear vertical linkage member 942, 944. The linkage members are pivotally attached.

As shown in FIGS. 103 and 104, in one embodiment, a spring 428 is connected between the upper and lower horizontal members 938, 940. The spring 428 biases the upper and lower members 938, 940 away from one another and keeps the four bar linkage assembly 936 generally in the shape of a parallelogram, when the spring 428 is uncompressed.

As indicated in FIGS. 103 and 104, the lower right joint of the four-bar linkage is attached to the base frame 14 at a first pivot point 920, and the rear of the treadle 12 is attached to the upper left joint of the four-bar linkage at a second pivot point 922. In one example, each treadle 12 is coupled with the base frame 14 through a first set of four bar linkages 936 and a second set of four bar linkages 936. In one embodiment, the second pivot point 922 coincides with the rotational axis of the rear treadle roller 30. In another embodiment, the second pivot point 922 intersects the treadle frame 52 at a point that is forward of the rear treadle roller 30.

As can be understood from FIG. 104, when the user's foot contacts a treadle 12 and moves it downwardly, the spring 428 compresses and the upper horizontal member 938 moves closer to the lower horizontal member 940 (i.e., the parallelogram begins to collapse) and the front and rear vertical members pivot forwardly about their lower pivotable connections. From the left-side perspective as shown in FIG. 104, as the treadle 12 is depressed, the four bar linkage 936 pivots counterclockwise about the first pivot point 920, and the treadle 12 pivots counterclockwise about the second pivot point 922. Thus, as the treadle 12 is depressed, the four bar linkage 936 transitions to a collapsed configuration and the treadle transitions from an inclined orientation to a less inclined orientation.

As the user's foot is removed from the treadle surface, the compressed spring expands and separates the upper and lower horizontal members 938, 940 while shifting the upper horizontal member 938, as well as the treadle 12, rearwardly. Thus, as the user's foot is removed from the treadle 12, the four bar linkage 936 transitions back to its expanded configuration and the treadle 12 transitions from a generally horizontal orientation to a more inclined orientation. In one embodiment, the treadles 12 are mechanically interconnected so that the left and right treadles move in opposing directions during use.

FIG. 105: Swing Arm Supported Treadle with Cable Interconnect

The treadles 12 of the exercise machine of the present invention may be interconnected together so the treadles 12 displace relative to each other in an alternating manner. This may be accomplished via a variety of interconnection arrangements. One of these interconnection arrangements is illustrated in FIG. 105, which is an isometric view of the treadle and base frame portion 300 of the exercise machine.

As shown in FIG. 105, each treadle 12 is supported by two swing arms 942. A cabling system is used to interconnect the left and right treadles 12 and to effect their movement opposite to one another during use of the exercise device.

As illustrated in FIG. 105, a generally U-shaped frame structure 14 is provided having a rectangular base portion and rectangular side supports extending upwardly from the base portion. Each treadle 12 is pivotally attached to a rectangular side support through a pair of swing arms 942. In one embodiment, each swing arms is attached to a portion of the treadle frame 52. In another embodiment, each swing arm 942 is attached to a treadle 12 at a roller 28, 30.

As can be understood from FIG. 105, because of the swing arms 942, each treadle 12 moves generally arcuately downwardly when depressed. Also, the slope of the treadle surface depends on the relative lengths of the attached swing arms 942. In one embodiment, the length of some or all of the swing arms 942 may be adjusted to allow the slope of the treadles 12 to be modified by the user.

In one embodiment, each treadle 12 has, as one of the rollers 28, 30, a drive roller that moves the tread belt 18 around the rollers of the treadle 12. In one embodiment, the drive roller is a roller with an integral motor within the roller. In another embodiment, the drive motor is secured to the treadle frame 52 to displace with the treadle frame. The drive motor then powers the drive roller via a drive belt or gear arrangement. In yet another embodiment, the drive roller is powered by a motor mounted on the U-shaped frame structure 14. Power is transferred from the frame-mounted motor to the drive roller via a drive belt routed around sheaves on a tension link.

As shown in FIG. 105, at a first end of the frame structure, an upwardly extending center support member 944 is attached to the first swing arm 942' of each treadle 12 through an elastic cable 946. The elastic cable 946 has an elasticity that permits the treadles 12 to swing forwardly and rearwardly relative to the frame structure 14. In one embodiment, the elastic cables 946 are selected to return the treadles 12 to a desired orientation relative to one another when no forces are being applied to the treadles.

At a second end of the frame structure, which is opposite the first end of the frame structure, the second swing arm 942" of the right treadle is attached to one end of a cable 948'. The cable extends from the second swing arm 942" of the right treadle, around a first pulley 950 that is attached via a flange to the frame structure 14, and up over the top of a second pulley 952A that is mounted on an axle 954 supported by flanges secured to the side supports of the frame structure 14.

In a similar fashion, the second swing arm 942" of the left treadle is attached to one end of another cable 948". The cable 948" extends from the second swing arm 942" of the left treadle 12, around a first pulley 950 that is attached via a flange to the frame structure 14, and under the bottom of a second pulley 952B that is also mounted on the axle 954.

As can be understood from FIG. 105, because both treadles 12 are connected via cables 948', 948" to pulleys 952A, 952B mounted on the axle 954, and because each cable 948', 948" is wound about its respective second pulley 952A, 952B in a manner opposite from the corresponding cable 948', 948", the axle 954 translates motion from the right treadle to the opposing left treadle in a reversed manner. For instance, in operation, as the user's foot drives the right treadle 12, the right treadle moves rearwardly and downwardly and the right treadle's cable 948' is pulled downwardly. This imparts a clockwise motion (as viewed from the right side of the frame 14) on the pulley 952A attached to the axle 954. The axle 954 rotates in a clockwise manner, which pulls the left treadle's cable 948" upwardly, thereby moving the left treadle 12 upward and forward.

Conversely, when the user's left foot depresses the left treadle, the left treadle moves downwardly and rearwardly, which pulls down on the left treadle's cable 948" and imparts a counterclockwise rotation of the axle 954. This pulls the right treadle's cable 948' upwardly thereby moving the right treadle 12 forward and upward.

As indicated in FIG. 105, in one embodiment, a brake mechanism 956 may be attached to either end of the axle 954 and may be electronically or mechanically controlled. The brake mechanism 956 may provide selective levels of resistance to axle rotation, thereby providing a selective resistive force to the movement of the treadles 12.

FIG. 106: Dual Treadle Exercise Machine with Sliding Treadles and Cable System Interconnect For a discussion of another manner of interconnecting the treadles together so the treadles displace relative to each other in an alternating manner, reference is now made to FIG. JP20, which is an isometric view of the exercise machine 10. As indicated in FIG. JP20, in one embodiment, the exercise machine 10 has a pulley and cable system that provides for opposing motion of the left and right treadles 12 relative to one another.

As shown in FIG. 106, in one embodiment, the exercise machine 10 includes a lower frame portion 14' that is generally U-shaped, a U-shaped upper frame portion 14" with downwardly extending arms 960 connected to the lower frame portion 14', and left and right rectangular posts 958', 958" extending between a pair of rectangular post-receiving openings in the lower frame portion 14' and the upper frame portion 14". A center post 40 extends upwardly from the upper frame portion 14" and a console and handlebars 44 may be attached at the free end of the center post 40.

As illustrated in FIG. 106, in one embodiment, each treadle 12 is connected to its respective rectangular post 958', 958" through a sleeve 962', 962" and U-shaped coupling member 964', 964" slidably engaged about the respective post 958', 958". In one embodiment, the U-shaped coupling member 964', 964" is pivotally attached to a portion of the treadle frame 52 at a pivot point 330 so that the treadles 12 can pivot about the pivot point 330 as the treadles 12 move upwardly and downwardly as guided by the rectangular posts 958', 958". In one embodiment, each pivot point 330 coincides with the pivotal axis of a treadle roller. In another embodiment, each pivot point 330 is attached to a point on the treadle frame other than at an axis of a treadle roller. In one embodiment, the interconnection between the coupling member 964', 964" and the treadle 12 can be rigid and non-pivotal.

As illustrated in FIG. 106, a cable 948 is attached to a first attachment point 966" on the right sleeve 962" and to a second attachment point 966' on the left sleeve 962'. The cable 948 is wound about a set of four pulleys 968 pivotally secured to the upper and lower frame portions 14', 14" of the exercise machine 10.

As can be understood from FIG. 106, in operation, as the user's right foot pushes downwardly on the right treadle 12, the right treadle moves downwardly and is guided along the right rectangular post 958" by the right sleeve 962". At the same time, in one embodiment, the right treadle can pivot about its pivot point 330 (i.e., the pivot point between the right U-shaped coupling member 964" or bracket and the right treadle 12).

As the right sleeve 962" moves downwardly, the cable 948 is pulled downwardly along the right rectangular post 958". This, in turn, causes the cable 948 to be pulled upwardly along the left rectangular post 958', which pulls the left sleeve 962' upward, thereby imparting an upward force on the left treadle 12.

Conversely, as can be understood from FIG. 106, as the user's left foot pushes downwardly on the left treadle 12, the left treadle moves downwardly and is guided along the left rectangular post 958' by the left sleeve 962'. At the same time, in one embodiment, the left treadle 12 can pivot about its pivot point 330 (i.e., the pivot point between the left U-shaped coupling member 964' or bracket and the left treadle 12).

As the left sleeve 962' moves downwardly, the cable 948 is pulled downwardly along the left rectangular post 958'. This, in turn, causes the cable 948 to be pulled upwardly along the right rectangular post 958", which pulls the right sleeve 962" upward, thereby imparting an upward force on the right treadle 12.

As previously stated, in one embodiment, the treadles 12 are pivotally attached to the U-shaped coupling member 964', 964" or bracket so that the treadles 12 can pivot with respect to the bracket 964', 964" as the bracket travels vertically up and down the uprights 958', 958". Consequently, in one embodiment, a spring or return force is included in the pivot structure between the bracket and the treadle. The spring biases the treadle into the upmost position, but does allow the treadle to pivot downwardly under load.

For example, in use, as the left foot strikes the left treadle 12 near the pivot point 330, the free end of the left treadle deflects (pivots) downwardly from its uppermost position. Since the left foot strikes the treadle at a point relatively close to the pivot connection 330 with the bracket 964', the treadle pivots downwardly based on the moment force applied by the user and resisted by the return, or spring, force.

As the user's left foot moves rearwardly, its distance from the pivot connection 330 increases, and the moment force thus increases, causing the treadle 12 to pivot more downwardly. As the user's left foot begins to move behind the user's body there is generally a weight shift to the right foot, and the load on the left foot starts to decrease. Thus, although the left foot continues to move away from the pivot point 330, thereby increasing the distance at which the load is supplied, the moment force decreases and, as a result, the downwardly deflection of the treadle 12 either decreases, stops, or reverses as the left foot moves behind the user.

Once the left foot lifts off the treadle 12, the spring return force causes the treadle 12 to pivot to its upmost position, ready for the next footfall by the left foot. The same process as described above occurs for the right foot and the right treadle 12. The left foot, in the cycle between impact and lift-off, first moves downwardly and rearwardly, with the heel lowering faster than the toe until the foot passes under the person's body. At some point thereafter, the toe and heal begin to lower at the same rate. Eventually, the heel begins rising faster than the toe until lift-off from the treadle 12.

In one embodiment, the rear roller 30 of each treadle 12 can operate as the drive roller to drive the tread belt around the rollers of the treadle 12. In another embodiment, the front roller 28 of each treadle operates as the drive roller. In one embodiment, each drive roller has an integral motor within the drive roller for powering the drive roller. In another embodiment, each drive roller is powered by a motor mounted on the respective treadle frame.

In one embodiment, the drive roller may drive the tread belts 18 of the treadles 12 in forward or rearward directions. This allows a user to exercise on the machine 10 facing forwardly, or facing rearwardly.

FIG. 107: Treadle Rocker Arm Assembly

For a discussion of another manner of interconnecting the treadles 12 together so the treadles 12 displace relative to each other in an alternating manner, reference is now made to FIG. 107, which is an isometric view of the treadle and base frame portion 300 of the exercise machine. As indicated in FIG. 107, in one embodiment, the exercise machine has a rocker arm system 970 that provides for opposing motion of the left and right treadles 12 relative to one another.

As shown in FIG. 107, in one embodiment, the left and right treadles 12 are interconnected to one another through a rocker arm assembly 970 and pivoting swing arm elements 942', 942". As illustrated in FIG. 107, the frame 14 includes a pair of U-shaped side frame members 972 connected together at the front end by a front frame member 974 and connected together at the rear end by a rear frame member 976.

As indicated in FIG. 107, in one embodiment, each treadle 12 is pivotally connected to a front and rear swing arm 942 and the swing arms are pivotally attached to the respective side frame member 972. A rocker arm 978 is attached to the front frame member 974 through a rocker pivot 980. Left and right tie rods 982', 982" are connected at one end to a bottom end portion of the respective left and right swing arms 982', 982". The opposing ends of the tie rods 982', 982" are coupled with the rocker arm 978 through ball joints 984, in one embodiment of the invention.

As shown in FIG. 107, in one embodiment, a spring 428 is connected between the rear swing arms 942' and the rear legs of the side frame members 972. In one embodiment, the spring 428 is positioned along the swing arm 942' so that after the treadle 12 has moved forwardly, the force developed about a portion of the spring 428 returns the swing arm 942' to a generally vertical orientation, which thereby returns the treadle 12 to a generally central position.

In one embodiment, each treadle 12 has, as one of its rollers 28, 30, a drive roller that moves the tread belt 18 around the rollers of the treadle. In one embodiment, the drive roller is a roller with an integral motor within the roller. In another embodiment, the drive motor is secured to the treadle frame to displace with the treadle frame 52. The drive motor then powers the drive roller via a drive belt or gear arrangement. In yet another embodiment, the drive roller is powered by a motor mounted on the U-shaped frame structure 972. Power is transferred from the frame-mounted motor to the drive roller via a drive belt routed around sheaves on a tension link.

In one embodiment, the drive motor or motors may cause the treadle belts 18 to move rearwardly or forwardly as desired by the user. This allows the user to utilize the exercise machine facing forward or facing rearward.

In one embodiment, as the user's right foot presses against the right treadle 12, the right treadle responds by pivoting rearwardly. This causes the right front swing arm 942' to pivot rearwardly, the right tie rod 982" to move rearwardly, the rocker arm 978 to pivot in a clockwise direction (as viewed from above the rocker arm) about the rocker pivot 980, and the left tie rod 982' to move forwardly. Because the left tie rod 982' moves forwardly, the left front swing arm 942" moves in a forward direction, which moves the left treadle 12 in a forward direction.

Conversely, as the user's left foot presses against the left treadle 12, the left treadle responds by pivoting rearwardly. This causes the left front swing arm 942" to pivot rearwardly, the left tie rod 982" to move rearwardly, the rocker arm 978 to pivot in a counterclockwise direction (as viewed from above the rocker arm) about the rocker pivot 980, and the right tie rod 982" to move forwardly. Because the right tie rod 982" moves forwardly, the right front swing arm 942" moves in a forward direction, which moves the right treadle 12 in a forward direction.

FIGS. 108-110: Treadle Adjustment

For a discussion of a manner of attaching the treadles 12 to the base frame 14 so the slope or position of the treadles 12 may be adjusted with respect to the base frame 14, reference is now made to FIG. 108, which is an isometric view of the treadle and base frame portion 300 of the exercise machine. As indicated in FIG. 108, in one embodiment, the exercise machine has a slotted flange structure 918 for adjusting the position of a treadle 12 with respect to the base frame 14.

As shown in FIG. 108, in one embodiment, each treadle 12 is pivotally mounted on a pivot rod 330, such as the pivot rods disclosed elsewhere in this specification. The pivot rod 330 has a first end that resides in a slot 984 in a left flange 918 and a second end that resides in a slot 984 in a right flange 918. The flanges 918 are secured to the base frame 14 of the exercise machine.

In one embodiment, the pivot rod 330 coaxially aligns with the rotational axis of the rear roller 30 of each treadle 12 as the pivot rod 330 extends from the slot 984 in the left flange 918 to the slot 984 in the right flange 918. In another embodiment, the pivot rod 330 coaxially aligns with the rotational axis of the front roller 28 of each treadle. In other embodiments, the pivot rod 330 extends through another portion of each treadle 12, for example the axis of another roller or through the treadle frame 52 at a position between the front roller 28 and the rear roller 30.

As indicated in FIG. 108, the pivot rod 330 may displace along the slots 984 in the flanges 918. A nut 986 attached to at least one of the ends of the pivot rod 330 secures the pivot rod within the slots of the flanges. The nut 986 can be rotated by the user to position the pivot rod 330 and fix the treadles 12 in position along the slots 984.

As shown in FIG. 108, in one embodiment, each slot 984 is generally arcuate. In other embodiments, other slot shapes can be used, such as straight or angled slots or slots having notches or detents.

As illustrated in FIG. 108, in one embodiment, a link member 924 is pivotally attached between the flange structure 918 and the pivot rod 330. The link member 924 helps to guide the pivot rod 330 as it displaces along the slot 984 in the flange 918.

By displacing the pivot rod 330 along the slots 984, the slope of the treadles 12, relative to the base frame 14, may be adjusted. For example, as the pivot rod 330 is displaced to the extreme forward position along the slots 984 and the slots 984 are arcuate as illustrated in FIG. 108, the front ends (i.e., the free ends) of the treadles 12 will become closer to the base frame 14 (i.e., the slope of the treadles will decrease). Conversely, as the pivot rod 330 is displaced to the extreme rearward position along the slots 984 and the slots 984 are arcuate, the front ends of the treadles 12 will become further away from the base frame 14 (i.e., the slope of the treadles will increase). Once the desired treadle slope is attained, the nut 986 may be tightened to secure the pivot rod 330 and the treadle 12 in place.

For a discussion of a manner of adjusting the stroke depth and slope of a treadle 12, reference is now made to FIGS. 109 and 110. FIG. 109 is an isometric view of the treadle and base frame portion 300 of the exercise machine, and FIG. 110 is a side elevation of a slotted flange structure 988 depicted in FIG. 109. As illustrated in FIGS. 109 and 110, an arcuate flange structure 988 is used for adjusting the slope of a treadle 12 with respect to the base frame 14 and limiting the angular displacement of the treadles 12 about the pivot point 330.

As indicated in FIG. 109, in one embodiment, the rear end of the treadles 12 are pivotally attached to the frame 14 by an upwardly extending flange 918, which is connected by a pivot rod 330 or support member extending through the interior of the rear rollers 30, coaxially with the pivot axes of the rollers. Alternatively, in one embodiment, the pivot rod may extend through a portion of the treadle frames 52 such that the treadles pivot 330 about a pivot point ahead of the rear rollers 30.

As shown in FIGS. 109 and 110, in one embodiment, an arcuately shaped guide flange 988 extends upwardly from the base frame 14 and includes an arcuate slot 984. A pair of positioning elements 990 displaceably resides within each arcuate slot. The positioning elements are for selectively controlling the positioning and movement of a treadle 12.

As illustrated in FIG. 109, each positioning element 990 includes a stopper 992 attached to a knob 994. The stopper 992 is adapted to come in contact with a portion of the outside edge of the treadle frame 52, thereby preventing the treadle from displacing past the stopper. The opposing end of the positioning element 990 includes a knob 994 that allows the user to tighten the positioning element 990 and fix the location of the positioning element 990 within the slot 984 of a guide flange 988. It should be noted that the stoppers 992 in FIG. 109 have been exaggerated with respect to size in order to clearly depict the features of the stoppers. In actual practice the stoppers 992 abut against the edge of the treadle frame 52 and do not overlap or contact the tread belt 18.

The slot 984 guides the positioning elements 990, and the positioning elements 990 may be located in various positions along the slot 984 of the guide flange 988 to limit the angular displacement of the treadles 12 about the pivot point 330. For example, by placing the positioning elements 990 in close proximity to each other along the slot 984, the treadle 12 will have a smaller degree of angular displacement about the pivot point 330 as compared to when the positioning elements 990 are placed further apart. Also, by placing the positioning elements 990 higher along the slot 984, the treadle 12 has a higher average slope over its range of angular displacement as compared to placing the positioning elements 990 lower along the slot 984. Furthermore, if desired, the positioning elements 990 can be put close enough together to hold the treadles 12 in one place. Thus, as can be understood from FIG. 109, the positioning elements 990 may be used to control the stroke of the treadle 12, as well as the treadle's general angle or slope.

FIG. 111: Exercise Machine with Cam for Controlling Rocker Arm

For a discussion of another manner of adjusting the stroke depth of a treadle 12, reference is now made to FIG. 111. FIG. 111 is an isometric view of a portion of an exercise machine including a pair of cam surfaces 996 for controlling the movement of a rocker arm 112.

As shown in FIG. 111, in one embodiment, a control mechanism 998 is provided for limiting or controlling the extent to which the treadles 12 can move upwardly or downwardly during use. In this embodiment, treadle movement is regulated by controlling the degree to which a rocker arm can pivot.

As illustrated in FIG. 111, in one embodiment, the control mechanism 998 includes a pair of cam elements 1000 attached about a cross support rod 1002 or member that is rotatably attached to the base frame 14. The cam elements 1000 can be adjusted through the rotation of a knob 1004 attached to the cross support rod 1002.

As indicated in FIG. 111, in one embodiment, the rocker arm 112 includes first and second diamond shaped plates 112A, 112B connected together through a cylindrical joining member 112C. The cylindrical joining member 112C is pivotally coupled to a pivot point 120 on the cross support member 114 of the base frame 14. A rocker rod 134, 136 is pivotally attached to each end of the rocker arm 112, and a treadle 12 is attached to the top of each rocker rod 134, 136. As explained elsewhere in this specification, the rocker rods 134, 136 push up or pull down on the treadles 12 during operation (i.e., as the left rocker rod pushes down on the rocker arm due to the user's foot pushing downwardly on the left treadle, the rocker arm pivots and the right rocker arm pushes upwardly on the right treadle, thereby moving the right treadle upward).

As can be understood from FIG. 111, in one embodiment, the treadle movement can be regulated by the degree to which the rocker arm 112 can pivot about the rocker pivot 120. As shown in FIG. 111, in one embodiment, the degree of rocker arm pivot can be regulated by rotating the knob.

As indicated in FIG. 111, in one embodiment, the radius R of each cam element 1000 varies about the circumference of the cam element 1000. The portion of the cam element 1000 that comes in contact with the edges of the rocker arm 112 will affect the degree to which the rocker arm 112 can pivot upwardly or downwardly. If the knob 1004 is rotated such that the portion of the cam element 1000 having a small radius contacts the rocker arm 112, then the rocker arm 112 is freer to pivot upwardly and downwardly. In contrast, if the knob 1004 is rotated such that the portion of the cam element 1000 having a large radius contacts the rocker arm 112, then the rocker arm 112 is less free to pivot upwardly and downwardly. In one embodiment, a portion of each cam element 1000 has a radius R sufficiently large to prevent the rocker arm 112 from pivoting upwardly or downwardly at all (i.e., a lockout position).

FIGS. 112-114: Treadle with Non-Continuous Belt

For a discussion of an embodiment of the exercise machine employing a non-continuous tread belt 18, reference is now made to FIGS. 112-114. FIG. 112 is a side elevation of the front and rear rollers 28, 30 and the tread belt 18 of an exercise machine employing a non-continuous tread belt 18. FIG. 113 is an exploded isometric view of the tread belt 18 and rollers 28, 30 illustrated in FIG. 112, according to one embodiment. FIG. 114 is an exploded isometric view of the tread belt 18 and rollers 28, 30 illustrated in FIG. 114, according to another embodiment.

As shown in FIGS. 112-114, in one embodiment, a non-continuous tread belt 18 (i.e., tread surface) is dispaceably located above a deck 26 and is attached at a first end to a first roller 28 and at a second end to a second roller 30. Each roller 28, 30 is provided with a spring 1006. The force of the springs 1006 maintains the non-continuous tread belt 18 in a centered position (e.g., in one embodiment, the centered position is where the longitudinal length of the tread belt 18 generally coincides with the longitudinal center of the distance between the first and second rollers 28, 30). As a user's foot moves a tread belt 18 from its normal resting position, either rearwardly or forwardly, the rollers 28, 30 rotate in response to the tread belt movement caused by the movement of the user's foot. When the user's foot is removed from the tread belt 18, both springs 1006 return the tread belt to its centered position.

For instance, when the user's foot initially strikes the front part of the non-continuous tread belt 18, the force of the user's stride moves the belt 18 rearwardly in opposition to the bias imparted by the springs 1006 on the belt 18. This winds the springs 1006, thereby increasing the energy stored in the springs 1006. When the user's foot is removed from the tread belt 18, the springs 1006 unwind rapidly and, in one embodiment, return the belt 18 to a centered position so that the belt 18 is poised to receive another foot motion from the user.

As indicated in FIGS. 112-114, in one embodiment, the front roller 28 securely receives a front edge of the non-continuous belt 18 in a slot 1007, and the rear roller 30 securely receives a rear edge of the non-continuous belt 18 in a slot 1009. The belt 18 is wound about the front and rear rollers 28, 30 so as to permit a sufficient amount of rearward motion of the belt 18 during use (i.e., sufficient to accommodate the strides of various users).

As illustrated in FIG. 113, in one embodiment, the front roller 28 and the rear roller 30 are pivotally attached to the base frame 14 through a roller securing member 1008 and pin 1010. In one embodiment, the front roller 28 and the rear roller 30 are each provided with a spring 1006 biased to move the belt forwardly. Alternatively, in one embodiment, a single roller, such as the front roller, is provided with a spring biased to move the belt forwardly during use.

As shown in FIG. 113, in one embodiment, the roller securing member 1008 has an elongated rectangular bottom portion 1012 adapted to be secured to the base frame 14 and has a pair of end caps 1014 extending upward from the rectangular bottom 1012. Each end cap 1014 is provided with a pin 1010. Each roller 28, 30 resides between a pair of end caps 1014, and the end of each roller 28, 30 pivotally receives the pin 1010 of the adjacent end cap 1014. This permits the roller 28, 30 to pivot or rotate about the pins 1010 within the roller-securing member 1008.

As illustrated in FIG. 113, in one embodiment, the spring 1006 is a coil spring having a base end 1016 that can be securely attached within the roller-securing member 1008. As the user's foot contacts the belt 18 and moves the belt 18 rearwardly, the front roller 28 rotates in a direction opposing the spring force and the front spring 1006 winds up, and when the user's foot is removed from the belt/treadle surface 18, the spring 1006 quickly unwinds and rotates the roller 28 in a forward motion to return the belt 18 to its original position. The treadle 12 is now poised for receiving another foot motion. One or more treadles 12 of an exercise device can be configured using the non-continuous belts 18 to form treadmill surfaces.

As shown in FIG. 114, in one embodiment, the front roller 28 and the rear roller 30 are pivotally attached to the base frame 14 through a rectangular support plane 1018 having upwardly extending flanges 1020 that provide pivot and support points for the rollers 28, 30. In one example, a supporting pin 1010 may extend through the rollers 28, 30 or may be integral within the interior of the rollers.

In one embodiment, the front roller 28 and the rear roller 30 may each be provided with a spring 1006 biased to move the belt 18 forwardly. An end cap 1014 secures each roller 28, 30 with its spring 1006 along the pivot axis of the roller between the flanges 1020. Alternatively, in another embodiment, a single roller 23, such as the front roller, may be provided with a spring 1006 biased to move the belt 18 forwardly during use.

As previously explained, the front roller 28 has a slot 1007 for securely receiving a front edge of a non-continuous belt 18, and the rear roller 30 has a slot 1009 for securely receiving a rear edge of the non-continuous belt 18. In one embodiment, as shown in FIG. 114, a greater amount of belt material is wound about the front roller 28 than the rear roller 30. This permits a sufficient amount of rearward motion of the belt 18 during use (i.e., sufficient to accommodate the strides of various users).

As the user's foot contacts the belt 18 and moves the belt 18 rearwardly, the front and rear rollers 28, 30 rotate in a direction opposing the spring force, such that when the user's foot is removed from the tread belt 18 (i.e., tread surface), the spring 1006 or springs rotate the roller 28 or rollers 28, 30 in a forward motion to return the belt 18 to its original position. One or more treadles 12 of an exercise device can be equipped to utilize the non-continuous tread belts 18 to form the tread surfaces 18 of the exercise machine.

FIG. 115: Tubular Frame Treadle with Front Mounting Shocks

FIG. 115 shows a tubular frame exercise device. Each side of the frame 14 is generally U-shaped with an upstanding portion 42. Between the upstanding portion a support bar is suspended. The shocks 76 are supported between a bracket at the front of the treadles and the support bar.

Although preferred embodiments of this invention have been described above with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention. Joinder references (e.g., attached, coupled, connected, and the like) are to be construed broadly and may include intermediate members between a connection of elements and relative movement between elements. As such, such joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

It is claimed:

1. An exercise apparatus comprising:

a frame;

a first pivotable treadle assembly including left and right side members and a first moving surface;

a first foot platform extending outwardly from either the left side member or the right side member of the first treadle assembly; and a second pivotable treadle assembly including left and right side members and a second moving surface;

whereby a user can stride on the first and second moving surfaces or step onto the first foot platform.

2. The exercise apparatus of claim 1, further comprising an interconnection assembly operably coupled between the first treadle assembly and the second treadle assembly.

3. The exercise apparatus of claim 1, further comprising at least one resistance element operably coupled to the frame and at least one of the first treadle assembly and the second treadle assembly.

4. The exercise apparatus of claim 3, wherein the at least one resistance element is configured to resist and dampen movements of the first and second treadle assemblies.

5. The exercise apparatus of claim 3, wherein the at least one resistance element comprises:

a first shock operably coupled to the first treadle assembly and the frame; and a second shock operably coupled to the second treadle assembly and the frame.

6. The exercise apparatus of claim 5, wherein:

the first shock is operably coupled to an outer frame member of the first treadle assembly and a first upright of the frame extending above the treadle assemblies; and the second shock is operably coupled to an outer frame member of the second treadle assembly and a second upright of the frame extending above the treadle assemblies.

7. The exercise apparatus of claim 6, wherein:

the first shock is coupled to a rear surface of the first upright; and the second shock is coupled to a rear surface of the second upright.

8. The exercise apparatus of claim 6, wherein:

the first shock is aligned with the first upright; and the second shock is aligned with the second upright.

9. The exercise apparatus of claim 6, wherein:

the first upright includes a rearwardly extending first handle member;

the first shock is aligned with the first handle member in a vertical direction of the apparatus;

the second upright includes a readwardly extending second handle member; and the second shock is aligned with the second handle member in the vertical direction of the apparatus.

10. The exercise apparatus of claim 5, wherein:

the first shock is positioned below the first treadle assembly; and the second shock is positioned below the second treadle assembly.

11. The exercise apparatus of claim 1, wherein the first foot platform defines a substantially flat mounting surface configured to be engaged by at least one foot of a user.

12. The exercise apparatus of claim 11, wherein the mounting surface of the first foot platform is located at approximately the same level as an upper surface of the first treadle assembly.

13. The exercise apparatus of claim 1, wherein as the first treadle assembly pivots, the first foot platform moves relative to the frame.

14. The exercise apparatus of claim 1, wherein pivotal movement of the first treadle assembly causes movement of the first foot platform.

15. The exercise apparatus of claim 1, wherein the second treadle assembly further comprises a second foot platform extending outwardly from either the left side member or the right side member of the second treadle assembly.

16. The exercise apparatus of claim 15, wherein the second foot platform defines a substantially flat mounting surface configured to be engaged by at least one foot of a user.

17. The exercise apparatus of claim 16, wherein the mounting surface of the second foot platform is located at approximately the same level as an upper surface of the second treadle assembly.

18. An exercise apparatus comprising:

a frame;

a first pivotable treadle assembly including left and right side members and a first moving surface;

a first foot platform cantilevered from either the left side member or the right side member of the first treadle assembly; and a second pivotable treadle assembly including left and right side members and a second moving surface;

whereby a user can stride on the first and second moving surfaces or step onto the first foot platform.

19. The exercise apparatus of claim 18, wherein the second treadle assembly further comprises a second foot platform cantilevered from either the left side member or the right side member of the second treadle assembly.

* * * * *